US010413141B2

(12) United States Patent
Conrad et al.

(10) Patent No.: US 10,413,141 B2
(45) Date of Patent: Sep. 17, 2019

(54) SURFACE CLEANING APPARATUS

(71) Applicant: Omachron Intellectual Property Inc., Hampton (CA)

(72) Inventors: Wayne Ernest Conrad, Hampton (CA); Nina Conrad, Hampton (CA); Dave Peterson, Bowmanville (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 115 days.

(21) Appl. No.: 15/250,155

(22) Filed: Aug. 29, 2016

(65) Prior Publication Data

US 2018/0055301 A1 Mar. 1, 2018

(51) Int. Cl.
*A47L 5/32* (2006.01)
*A47L 5/30* (2006.01)
(Continued)

(52) U.S. Cl.
CPC ..... *A47L 5/32* (2013.01); *A47L 5/225* (2013.01); *A47L 5/30* (2013.01); *A47L 5/36* (2013.01);
(Continued)

(58) Field of Classification Search
CPC . A47L 5/32; A47L 5/30; A47L 7/0019; A47L 9/0036; A47L 9/009; A47L 9/0411;
(Continued)

(56) References Cited

U.S. PATENT DOCUMENTS 1,759,947 A 5/1930 Lee
2,071,975 A 2/1937 Holm-Hansen et al.
(Continued)

FOREIGN PATENT DOCUMENTS

CA 1218962 A1 3/1987
CA 2658402 A1 9/2010
(Continued)

OTHER PUBLICATIONS

English machine translation of KR 10-2001-0024752, as published on Mar. 26, 2001.
(Continued)

*Primary Examiner* — Dung Van Nguyen
(74) *Attorney, Agent, or Firm* — Philip C. Mendes da Costa; Bereskin & Parr LLP/S.E.N.C.R.L., s.r.l.

(57) ABSTRACT

An upright surface cleaning apparatus may have a surface cleaning head with a central longitudinal axis extending between its front and rear ends. An upright section may be mounted to the surface cleaning head and may be moveable between a generally upright position and a rearwardly inclined in use position. The upright section may include an air treatment member assembly and a suction motor. The air treatment member assembly may include an air treatment member and a dirt collection region that is positioned laterally from the air treatment member. The suction motor may be positioned below at least one of the air treatment member and the dirt collection region. The first and second laterally opposed sides and one of the front side and the rear side of the air treatment member assembly may be generally rectangular in top plan view when the upright section is in the upright position.

20 Claims, 90 Drawing Sheets

(51) Int. Cl.

| | |
|---|---|
| ***A47L 7/00*** | (2006.01) |
| ***A47L 9/32*** | (2006.01) |
| ***A47L 9/04*** | (2006.01) |
| ***A47L 9/00*** | (2006.01) |
| ***A47L 9/14*** | (2006.01) |
| ***A47L 9/22*** | (2006.01) |
| ***A47L 9/24*** | (2006.01) |
| ***A47L 9/16*** | (2006.01) |
| ***A47L 5/22*** | (2006.01) |
| ***A47L 5/36*** | (2006.01) |
| ***A47L 9/10*** | (2006.01) |
| ***A47L 9/12*** | (2006.01) |

(52) U.S. Cl.

CPC ..... *A47L 9/009* (2013.01); *A47L 9/0036* (2013.01); *A47L 9/0045* (2013.01); *A47L 9/106* (2013.01); *A47L 9/122* (2013.01); *A47L 9/165* (2013.01); *A47L 9/1608* (2013.01); *A47L 9/1625* (2013.01); *A47L 9/1666* (2013.01); *A47L 9/1683* (2013.01); *A47L 9/22* (2013.01); *A47L 9/24* (2013.01); *A47L 9/242* (2013.01); *A47L 9/325* (2013.01)

(58) Field of Classification Search

CPC .... A47L 9/0477; A47L 9/1608; A47L 9/1625; A47L 9/1641; A47L 9/1683; A47L 9/22; A47L 9/24; A47L 9/325

See application file for complete search history.

(56) References Cited

U.S. PATENT DOCUMENTS 2,542,634 A 2/1951 Davis et al.
2,898,621 A * 8/1959 Vance ..... A47L 5/32 15/324
2,913,111 A 11/1959 Rogers
2,942,691 A 6/1960 Dillon
3,085,221 A 4/1963 Kelly
3,130,157 A 4/1964 Kelsall et al.
3,200,568 A 8/1965 McNeil
3,320,727 A 5/1967 Farley et al.
3,356,334 A 12/1967 Scaramucci
3,451,495 A 6/1969 Bayless et al.
3,530,649 A 9/1970 Porsch et al.
3,582,616 A 6/1971 Wrob et al.
3,639,939 A * 2/1972 Crener ..... A47L 11/20 15/320
3,822,533 A 7/1974 Oranje
3,898,068 A 8/1975 McNeil
3,988,132 A 10/1976 Oranje
3,988,133 A 10/1976 Schady
4,187,088 A 2/1980 Hodgson
4,236,903 A 12/1980 Malmsten
4,373,228 A 2/1983 Dyson
4,393,536 A 7/1983 Tapp
4,517,705 A * 5/1985 Hug ..... A47L 9/00 15/351
4,635,315 A 1/1987 Kozak
4,660,246 A 4/1987 Duncan et al.
4,724,574 A * 2/1988 Bowerman ..... A47L 5/30 15/351
4,809,393 A 3/1989 Goodrich et al.
4,826,515 A 5/1989 Dyson
4,831,685 A 5/1989 Bosyj et al.
5,078,761 A 1/1992 Dyson
5,107,567 A 4/1992 Ferrari et al.
5,129,125 A 7/1992 Gamou et al.
5,230,722 A 7/1993 Yonkers
5,254,019 A 10/1993 Noschese
5,309,600 A 5/1994 Weaver et al.
5,309,601 A 5/1994 Hampton et al.
5,331,714 A 7/1994 Essex et al.
5,331,715 A 7/1994 Johnson et al.
5,524,321 A 6/1996 Weaver et al.
5,766,283 A * 6/1998 Bumb ..... A47L 9/1427 15/347
5,815,883 A 10/1998 Stein et al.
5,858,038 A 1/1999 Dyson et al.
5,927,758 A 7/1999 Carolsson
5,961,676 A * 10/1999 King ..... A47L 9/00 15/347
5,996,175 A 12/1999 Fusco
6,032,321 A 3/2000 Shirey et al.
6,058,559 A 5/2000 Yoshimi et al.
6,070,291 A 6/2000 Bair et al.
6,079,080 A 6/2000 Rutter et al.
6,080,022 A 6/2000 Shaberman et al.
6,122,796 A * 9/2000 Downham ..... A47L 5/00 15/328
6,155,620 A 12/2000 Armstrong
6,173,474 B1 1/2001 Conrad
6,192,550 B1 2/2001 Hamada et al.
6,209,925 B1 4/2001 Edin
6,210,469 B1 4/2001 Tokar
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,301,740 B1 10/2001 Quiroz
6,310,740 B1 10/2001 Dunbar et al.
6,345,408 B1 2/2002 Nagai et al.
6,382,058 B1 5/2002 Owoc
6,406,505 B1 6/2002 Oh et al.
6,440,197 B1 8/2002 Conrad et al.
6,463,622 B2 10/2002 Wright et al.
6,510,583 B2 1/2003 Griffin et al.
6,531,066 B1 3/2003 Saunders et al.
6,553,612 B1 4/2003 Dyson et al.
6,553,613 B2 4/2003 Onishi et al.
6,560,818 B1 5/2003 Hasko
6,561,549 B1 5/2003 Moris et al.
6,565,069 B2 5/2003 Morris
6,581,239 B1 6/2003 Dyson et al.
6,581,974 B1 6/2003 Ragner et al.
6,599,338 B2 7/2003 Oh et al.
6,623,539 B2 9/2003 Lee et al.
6,695,352 B2 2/2004 Park et al.
6,722,806 B2 4/2004 Kunkler et al.
6,736,873 B2 5/2004 Conrad et al.
6,746,500 B1 6/2004 Park et al.
6,768,073 B1 7/2004 Tondra et al.
6,779,229 B2 8/2004 Lee et al.
6,782,583 B2 8/2004 Oh
6,782,585 B1 8/2004 Conrad et al.
6,832,408 B2 12/2004 Roney et al.
6,833,015 B2 12/2004 Oh et al.
6,848,146 B2 2/2005 Wright et al.
6,860,799 B2 3/2005 Loveless
6,874,197 B1 4/2005 Conrad et al.
6,902,596 B2 6/2005 Conrad et al.
6,904,640 B2 6/2005 Jin et al.
6,929,516 B2 8/2005 Brochu et al.
6,941,615 B2 9/2005 Shanor et al.
6,976,885 B2 12/2005 Lord
7,039,985 B2 5/2006 Hisrich et al.
7,055,204 B2 6/2006 Ajluni
7,073,226 B1 7/2006 Lenkiewicz et al.
D532,944 S 11/2006 Choi
7,131,165 B2 11/2006 Wright et al.
7,146,681 B2 12/2006 Wright et al.
D535,070 S 1/2007 Shin
7,159,271 B2 1/2007 Sepke et al.
7,162,796 B2 1/2007 Wark et al.
7,219,390 B2 5/2007 Johnson et al.
7,222,393 B2 5/2007 Kaffenberger et al.
7,160,346 B2 9/2007 Park
7,281,298 B2 10/2007 Joung et al.
7,350,263 B2 4/2008 Yoshimi et al.
7,356,874 B2 4/2008 Skinner Macleod et al.
7,377,008 B2 5/2008 Park et al.
7,380,308 B2 6/2008 Oh et al.

(56) References Cited

U.S. PATENT DOCUMENTS 7,381,234 B2 6/2008 Oh
7,383,609 B2 6/2008 Ji
7,386,916 B2 6/2008 Bone
D581,609 S 11/2008 Conrad et al.
7,448,363 B1 11/2008 Rasmussen et al.
7,485,164 B2 2/2009 Jeong et al.
7,496,984 B2 3/2009 Pang
7,507,269 B2 3/2009 Murphy et al.
7,547,338 B2 6/2009 Kim et al.
7,584,522 B1 9/2009 Weeter et al.
7,604,675 B2 10/2009 Makarov et al.
7,645,311 B2 1/2010 Oh et al.
7,681,279 B2 3/2010 Kelly
7,686,858 B2 3/2010 Oh
7,779,505 B2 8/2010 Krebs et al.
7,832,050 B2 11/2010 Pullins et al.
7,887,612 B2 2/2011 Conrad
7,922,794 B2 4/2011 Morphey
7,941,895 B2 5/2011 Conrad
7,979,953 B2 7/2011 Yoo
8,020,251 B2 9/2011 Luebbering et al.
8,032,983 B2 10/2011 Griffith et al.
8,048,180 B2 11/2011 Oh et al.
8,062,398 B2 11/2011 Luo et al.
8,100,999 B2 1/2012 Ashbee et al.
8,117,713 B2 2/2012 Kasper et al.
8,127,398 B2 3/2012 Conrad
8,166,607 B2 5/2012 Conrad
8,370,993 B2 2/2013 Conrad
8,640,304 B2 2/2014 Conrad
8,813,297 B2 8/2014 Rosenzweig et al.
9,027,200 B2 5/2015 Chong et al.
9,173,533 B1 11/2015 Theising
9,232,877 B2 1/2016 Conrad
9,254,069 B2 2/2016 Kim et al.
9,326,652 B2 * 5/2016 Conrad ..... A47L 9/009
9,480,378 B2 11/2016 Paliobeis
2001/0042283 A1 11/2001 Oh et al.
2002/0011052 A1 1/2002 Oh et al.
2002/0011053 A1 1/2002 Oh
2002/0062531 A1 5/2002 Oh
2002/0078519 A1 6/2002 Boothby
2002/0101075 A1 8/2002 Park et al.
2002/0134059 A1 9/2002 Oh
2002/0162188 A1 11/2002 Harmen
2002/0178535 A1 12/2002 Oh et al.
2002/0178698 A1 12/2002 Oh et al.
2002/0178699 A1 12/2002 Oh
2003/0028994 A1 2/2003 Kitamura et al.
2003/0046910 A1 3/2003 Lee et al.
2003/0066273 A1 4/2003 Choi et al.
2003/0158238 A1 8/2003 Hale
2003/0159411 A1 8/2003 Hansen et al.
2003/0163891 A1 9/2003 Nagai et al.
2003/0167595 A1 9/2003 Jin et al.
2004/0007278 A1 1/2004 Williams
2004/0010885 A1 1/2004 Hitzelberger et al.
2004/0025285 A1 2/2004 McCormick et al.
2004/0112022 A1 6/2004 Vuijk
2004/0134022 A1 7/2004 Murphy et al.
2004/0216266 A1 11/2004 Conrad
2004/0237482 A1 12/2004 Lim et al.
2004/0244131 A1 12/2004 Cassar
2004/0250376 A1 12/2004 Hori et al.
2004/0255426 A1 12/2004 Davis et al.
2004/0261212 A1 12/2004 Park et al.
2004/0261213 A1 12/2004 Park et al.
2005/0081326 A1 4/2005 Jeon
2005/0115017 A1 6/2005 Kim
2005/0115018 A1 6/2005 Jeon
2005/0125944 A1 6/2005 Ji
2005/0125945 A1 6/2005 Park et al.
2005/0198769 A1 9/2005 Lee et al.
2005/0252179 A1 11/2005 Oh et al.
2006/0026789 A1 2/2006 Fischer et al.
2006/0037172 A1 2/2006 Choi
2006/0042206 A1 3/2006 Arnold et al.
2006/0123590 A1 6/2006 Fester et al.
2006/0137304 A1 6/2006 Jeong et al.
2006/0137305 A1 6/2006 Jung
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0156509 A1 7/2006 Luebbering et al.
2006/0156510 A1 7/2006 Park et al.
2006/0156699 A1 7/2006 Kim
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0230726 A1 10/2006 Oh et al.
2006/0236663 A1 10/2006 Oh
2006/0248678 A1 11/2006 Park
2006/0278081 A1 12/2006 Han et al.
2007/0011998 A1 1/2007 Yoo et al.
2007/0012002 A1 1/2007 Oh et al.
2007/0012003 A1 1/2007 Oh et al.
2007/0039120 A1 2/2007 Choi
2007/0067944 A1 3/2007 Kitamura et al.
2007/0077810 A1 4/2007 Gogel et al.
2007/0079473 A1 4/2007 Min et al.
2007/0079584 A1 4/2007 Kim et al.
2007/0079585 A1 4/2007 Oh et al.
2007/0079587 A1 4/2007 Kim
2007/0084161 A1 4/2007 Yoo
2007/0095028 A1 5/2007 Kim et al.
2007/0095029 A1 5/2007 Min et al.
2007/0174994 A1 8/2007 Allard et al.
2007/0271724 A1 11/2007 Hakan et al.
2007/0289085 A1 12/2007 Yoo
2007/0289089 A1 12/2007 Yacobi
2007/0289264 A1 12/2007 Oh
2008/0047091 A1 2/2008 Nguyen
2008/0083085 A1 4/2008 Genn
2008/0134460 A1 6/2008 Conrad
2008/0134462 A1 6/2008 Jansen et al.
2008/0155774 A1 7/2008 Pang
2008/0172992 A1 7/2008 Conrad
2008/0172995 A1 7/2008 Conrad
2008/0178416 A1 7/2008 Conrad
2008/0196194 A1 8/2008 Conrad
2008/0196196 A1 8/2008 Conrad
2008/0216282 A1 9/2008 Conrad
2008/0256744 A1 10/2008 Rowntreer et al.
2009/0000054 A1 1/2009 Hampton et al.
2009/0044371 A1 2/2009 Yoo et al.
2009/0056054 A1 3/2009 Hanschur et al.
2009/0144929 A1 6/2009 Yoo
2009/0020529 A1 8/2009 Oh
2009/0205160 A1 8/2009 Conrad
2009/0205161 A1 8/2009 Conrad
2009/0300873 A1 12/2009 Grey
2010/0005611 A1 1/2010 Hong et al.
2010/0071153 A1 3/2010 Genn
2010/0095476 A1 4/2010 Kim et al.
2010/0132150 A1 6/2010 Egler et al.
2010/0139030 A1 6/2010 Yoo
2010/0162515 A1 7/2010 Stephens
2010/0175217 A1 7/2010 Conrad
2010/0229315 A1 9/2010 Rosenzweig
2010/0229336 A1 9/2010 Conrad
2010/0229338 A1 9/2010 Conrad
2010/0242222 A1 9/2010 Conrad
2011/0023262 A1 2/2011 Conrad
2011/0088195 A1 4/2011 Dyson et al.
2011/0314629 A1 12/2011 Conrad
2012/0000030 A1 1/2012 Conrad
2012/0159734 A1 6/2012 Fujiwara

(56) References Cited

U.S. PATENT DOCUMENTS

| | | | |
|---|---|---|---|
| 2013/0091660 | A1 | 4/2013 | Smith |
| 2013/0091661 | A1 | 4/2013 | Smith |
| 2013/0091812 | A1 | 4/2013 | Smith |
| 2013/0091813 | A1 | 4/2013 | Smith |
| 2014/0237756 | A1 | 8/2014 | Conrad |
| 2014/0237768 | A1 | 8/2014 | Conrad |
| 2016/0367094 | A1 | 12/2016 | Conrad |

FOREIGN PATENT DOCUMENTS

| | | | |
|---|---|---|---|
| CA | 2674056 | A1 | 9/2010 |
| CA | 2674761 | A1 | 9/2010 |
| CA | 2678220 | A1 | 9/2010 |
| CA | 2574291 | C2 | 8/2013 |
| CN | 2524655 | Y | 12/2002 |
| CN | 2534954 | Y | 2/2003 |
| CN | 1434688 | A | 8/2003 |
| CN | 2592103 | Y | 12/2003 |
| CN | 1765283 | A | 5/2006 |
| CN | 1806741 | A | 7/2006 |
| CN | 101061932 | A | 10/2007 |
| CN | 201101488 | Y | 8/2008 |
| CN | 101288572 | A | 10/2008 |
| CN | 101357051 | A | 2/2009 |
| CN | 202699035 | U | 1/2013 |
| CN | 103040412 | A | 4/2013 |
| CN | 103040413 | A | 4/2013 |
| DE | 3734355 | C2 | 6/1989 |
| DE | 69110424 | T2 | 2/1996 |
| DE | 69309275 | T3 | 6/2002 |
| DE | 10110581 | C2 | 11/2003 |
| DE | 69907201 | T2 | 2/2004 |
| DE | 10360002 | A1 | 12/2004 |
| DE | 60105004 | T2 | 8/2005 |
| DE | 60201666 | T2 | 6/2006 |
| DE | 69834473 | T2 | 11/2006 |
| DE | 60211663 | T2 | 5/2007 |
| DE | 102004028678 | B4 | 9/2007 |
| DE | 102007011457 | A1 | 10/2007 |
| DE | 102004055192 | B4 | 11/2007 |
| DE | 102004028677 | B4 | 1/2008 |
| DE | 102005008278 | B4 | 3/2008 |
| DE | 112006003479 | T5 | 12/2008 |
| DE | 112007001314 | T5 | 4/2009 |
| DE | 602006000726 | T2 | 4/2009 |
| DE | 112010001135 | T5 | 8/2012 |
| DE | 112011104642 | T5 | 10/2013 |
| DE | 112012000251 | T5 | 10/2013 |
| DE | 102012110765 | A1 | 5/2014 |
| EP | 0489468 | A1 | 6/1992 |
| EP | 1771104 | B1 | 9/2008 |
| EP | 966912 | B1 | 3/2010 |
| EP | 2049000 | B1 | 6/2011 |
| EP | 1629758 | B1 | 10/2013 |
| FR | 2812531 | B1 | 11/2004 |
| GB | 2163703 | B | 1/1988 |
| GB | 2365324 | B | 7/2002 |
| GB | 2465781 | A | 6/2010 |
| GB | 2465781 | B | 10/2012 |
| JP | 2000140533 | A | 5/2000 |
| JP | 2005040246 | A | 2/2005 |
| JP | 2005087508 | A | 4/2005 |
| JP | 2009261501 | A | 11/2009 |
| KR | 10-2001-0024752 | A | 3/2001 |
| KR | 10-2001-0045598 | A | 6/2001 |
| KR | 10-2002-0067489 | A | 8/2002 |
| KR | 10-2004-0050174 | A | 6/2004 |
| KR | 10-2005-0091829 | A | 9/2005 |
| KR | 10-2005-0091830 | A | 9/2005 |
| KR | 10-2005-0091833 | A | 9/2005 |
| KR | 10-2005-0091834 | A | 9/2005 |
| KR | 10-2005-0091835 | A | 9/2005 |
| KR | 10-2005-0091836 | A | 9/2005 |
| KR | 10-2005-0091837 | A | 9/2005 |
| KR | 10-2005-0091838 | A | 9/2005 |
| KR | 10-2005-0103343 | A | 10/2005 |
| KR | 10-2005-0108623 | A | 11/2005 |
| KR | 10-2006-0008365 | A | 1/2006 |
| KR | 1020060031321 | A | 4/2006 |
| KR | 10-2006-0081229 | A | 7/2006 |
| KR | 10-2006-0112420 | A | 11/2006 |
| KR | 10-2006-0125952 | A | 12/2006 |
| KR | 10-2006-0125954 | A | 12/2006 |
| KR | 10-2010-0084127 | A | 7/2010 |
| WO | 9619294 | A1 | 6/1996 |
| WO | 0065978 | A1 | 11/2000 |
| WO | 0078546 | A1 | 12/2000 |
| WO | 2005089618 | A2 | 9/2005 |
| WO | 2006026414 | A2 | 3/2006 |
| WO | 2007084699 | A2 | 7/2007 |
| WO | 2007104138 | A1 | 9/2007 |
| WO | 2008017802 | A1 | 2/2008 |
| WO | 2008070966 | A1 | 6/2008 |
| WO | 2008070980 | A1 | 6/2008 |
| WO | 2008135708 | A1 | 11/2008 |
| WO | 2009026709 | A1 | 3/2009 |
| WO | 2010102396 | A1 | 9/2010 |
| WO | 2011054106 | A1 | 5/2011 |
| WO | 2013127237 | A1 | 9/2013 |
| WO | 2014131108 | A1 | 9/2014 |
| WO | 2015188112 | A1 | 12/2015 |

OTHER PUBLICATIONS

English machine translation of KR 10-2001-0045598, as published on Jun. 5, 2001.

English machine translation of KR 10-2002-0067489, as published on Aug. 22, 2002.

English machine translation of KR 10-2004-0050174, as published on Jun. 16, 2004.

English machine translation of KR 10-2001-0024752, as published on Sep. 15, 2005.

English machine tranaslation of KR 10-2005-0091830, as published on Sep. 15, 2005.

English machine translation of KR 10-2005-0091833, as published on Sep. 15, 2005.

English machine translation of KR 10-2005-0091834, as published on Sep. 15, 2005.

English machine translation of KR 10-2005-0091835, as published on Sep. 15, 2005.

English machine translation of KR 10-2005-0091836, as published on Sep. 15, 2005.

English machine translation of KR 10-2005-0091837, as published on Sep. 15, 2005.

English machine translation of KR 10-2005-0091838, as published on Sep. 15, 2005.

English machine translation of KR 10-2005-0103343, as published on Oct. 31, 2005.

English machine translation of KR 10-2005-0108623, as published on Nov. 17, 2005.

English machine translation of KR 10-2006-0008365, as published on Jan. 26, 2006.

English machine translation of KR 10-2006-0081229, as published on Jul. 12, 2006.

English machine translation of KR 10-2006-0112420, as published on Nov. 1, 2006.

English machine translation of KR 10-2006-0125952, as published on Dec. 7, 2006.

English machine translation of KR 10-2006-0125954, as published on Dec. 7, 2006.

English machine translation of KR 10-2010-0084127, as published on Jul. 23, 2010.

International Search Report and Written Opinion, received in connection to International Patent Application No. PCT/CA2017/051008, dated Nov. 21, 2017.

TotalPatent: English machine translation of the Abstract from WO2013127237, published on Sep. 6, 2013.

TotalPatent, English machine translation of the Abstract from KR1020060031321, published on Apr. 12, 2006.

(56) References Cited

OTHER PUBLICATIONS

English machine translation of DE602006000726, as published on Apr. 16, 2009.
English machine translation of DE112012000251, as published on Oct. 17, 2013.
English machine translation of DE112011104642, as published on Oct. 2, 20113.
English machine translation of DE112010001135, as published on Aug. 2, 2012.
English machine translation of DE102012110765, as published on May 15, 2014.
English Machine translation of DE102007011457, as published on Oct. 25, 2007.
English Machine translation of DE102005008278, as published on Mar. 27, 2008.
English Machine translation of DE102004055192, as published on Nov. 15, 2007.
English Machine translation of DE102004028677, as published on Jan. 10, 2008.
English Machine translation of JP2009261501, as published on Nov. 12, 2009.
English Machine translation of DE112007001314, as published on Apr. 23, 2009.
English Machine translation of DE112006003479, as published on Dec. 18, 2008.
English Machine translation of JP2005040246, as published on Feb. 17, 2005.
English Machine translation of CN103040413, as published on Apr. 17, 2013.
English Machine translation of CN103040412, as published on Apr. 17, 2013.
English Machine translation of CN101288572, as published on Oct. 22, 2008.
English Machine translation of CN101061932, as published on Oct. 31, 2007.
English Machine translation of DE69907201, as published on Feb. 5, 2004.
English Machine translation of DE69834473, as published on Nov. 30, 2006.
English Machine translation of DE69309275, as published on Jun. 27, 2002.
English Machine translation of DE69110424, as published on Feb. 1, 1996.
English Machine translation of DE60211663, as published on May 10, 2007.
English Machine translation of DE60201666, as published on Jun. 1, 2006.
English Machine translation of DE60105004, as published on Aug. 18, 2005.
English Machine translation of DE10360002, as published on Dec. 16, 2004.
English Machine translation of DE10110581, as published on Nov. 13, 2003.
English Machine translation of CN1434688, as published on Aug. 6, 2003.
English machine translation of DE102004028678, as published on Sep. 6, 2007.
International Search Report and Written Opinion received on the co-pending International Application No. PCT/CA2012/000185, dated Jun. 28, 2012.
International Search Report and Written Opinion received on International Application No. PCT/CA2010/000366, dated Sep. 13, 2011.

* cited by examiner

SURFACE CLEANING APPARATUS

FIELD

The subject matter of the teachings described herein relates generally to surface cleaning apparatuses. In one embodiment, the apparatus is an upright surface cleaning apparatus and is optionally operable in a floor cleaning mode and an above floor cleaning mode.

BACKGROUND OF THE INVENTION

The following is not an admission that anything discussed below is part of the prior art or part of the common general knowledge of a person skilled in the art.

Various types of surface cleaning apparatus are known including upright vacuum cleaners and extractors. Typically, an upright vacuum cleaner includes an upper section, including an air treatment member such as one or more cyclones and/or filters, drivingly mounted to a surface cleaning head. An up flow conduit is typically provided between the surface cleaning head and the upper section. In some such vacuum cleaners, a spine, casing or backbone extends between the surface cleaning head and the upper section for supporting the air treatment member. The suction motor may be provided in the upper section.

U.S. Pat. No. 7,188,388 (Best) discloses a multi-use vacuum cleaner with a detachable cyclonic vacuum module. The vacuum cleaner may be used as an upright vacuum cleaner when the detachable vacuum module is mounted to the base or the detachable vacuum module may be detached and used by itself. The detachable vacuum module includes a vacuum motor, a motor driven fan, a cyclonic dirt separator and a hose.

US patent publication No. US 2015/0096143 (Conrad) discloses an upright vacuum cleaner with a removable hand vacuum cleaner. The upright vacuum cleaner may be used in different cleaning modes including use as an upright vacuum cleaner when the hand vacuum cleaner is mounted to the handle.

BRIEF SUMMARY OF THE INVENTION

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

A surface cleaning apparatus, such as an upright surface vacuum cleaner, may be used to clean floors and other surfaces. When in use, it sometimes desirable to clean beneath furniture and other objects that are resting on the floor, such as beds, couches, tables and the like. Often, the space beneath the furniture (i.e. the distance between the floor and the lower surface of furniture) can be relatively narrow, and may be about 6-8 inches in some instances. Configuring a vacuum cleaner to help clean underneath such furniture, preferably using its primary surface cleaning head, may help users clean hard to access areas.

Optionally, a vacuum cleaner can be configured so that its surface cleaning head can fit underneath furniture, and can have a height that is less than the height beneath the furniture. Using such a configuration may allow the vacuum cleaner to extend under furniture up to the depth (front to back) of the surface cleaning head. However, the upper section will limit the extent to which the surface cleaning head can extend under furniture. For example, in Best, the surface cleaning head is not operable when the detachable cyclonic vacuum module has been removed from the upright section. Therefore, when the vacuum cleaner is used to clean under furniture, the extent to which the cleaning head may pass under furniture is limited by the height of the surface cleaning head (from the floor to the upper end of the surface cleaning head) and the depth (front to back) of the upright section.

In Conrad, in one mode, the hand vacuum cleaner may be removed from the handle but may remain in air flow communication with the surface cleaning head via a flexible hose. In this mode, the depth of the upright section (front to back) is reduced since the hand vacuum cleaner has been removed. Therefore, the extent to which the depth of the upright section inhibits cleaning under furniture is reduced. However, this design requires a user to remove and carry the hand vacuum cleaner In accordance with this disclosure, an upright surface cleaning apparatus, such as an upright vacuum cleaner, is configured so that the surface cleaning head and at least a portion, and optionally all, of the upright section of the vacuum cleaner is sized to fit beneath furniture having a lower surface positioned close to the floor, such as a bed or a couch. Preferably, the portion of the upright section that can fit underneath the furniture includes a cleaning unit provided on the upper section, which itself may include an air treatment member assembly and suction motor. Configuring the cleaning unit to fit beneath furniture while mounted to the upright section, and making it moveable into a suitable orientation/alignment so as to be moved beneath the furniture, allows part if not all of the upright section to be positioned beneath furniture such that the surface cleaning head may clean the entire floor that underlies furniture. Accordingly, a user may be able to extend a sufficient portion of the upright section of the vacuum cleaner beneath a couch such that the entire area under the couch can be cleaned without requiring the couch to be moved, or the use of secondary cleaning tools like wands and/or crevice tools.

When the upright section is rotated rearwardly into an orientation suitable for low profile cleaning (i.e. beneath furniture), the upright section with the air treatment member may extend substantially horizontally from the surface cleaning head (i.e., the upright section may have been rotated rearwardly about 90°). Therefore, if the upright section has a small depth in the forward/backward direction, then the upright section will have a relatively short height in the upward direction when oriented for low profile cleaning. In accordance with one aspect of this disclosure, the depth in the forward/backward direction is generally reduced and the width of the upright section in the left/right, lateral direction may be adjusted so as to be greater than the depth so as to provide a vacuum cleaner which has good dirt separation efficiency and suitable dirt storage capacity for use to clean a house. Optionally, the cleaning unit may have a generally rectangular, slab like configuration, such that it has a generally rectangular shape in a top plan view.

To help reduce the depth of the upright section, components of the upright section of the surface cleaning apparatus may be at least partially, and optionally entirely, overlapped with each other. For example, portions of the air flow path may be positioned behind and/or beside portions of the air treatment member assembly. The suction motor may be positioned below, and may underlie at least portions of the air treatment member assembly (including for example, a cyclone chamber and/or a dirt collection chamber). Configuring the components vertically in this manner may help reduce the front/back depth of the cleaning unit. Positioning the suction motor below the air treatment member assembly may help lower the centre of gravity of the upright section, which may help maneuverability. Optionally, the air inlet of the suction motor may be substantially aligned with the air outlet of the air treatment member (such as a cyclone chamber), which may help reduce the overall size of the cleaning unit and/or the length and complexity of the air flow path therethrough.

Alternately, or in addition, to help reduce the depth of the upright section/cleaning unit of the surface cleaning apparatus, the amount of material/housings that are provided in front of or behind the operating components (such as the air treatment member assembly and/or the suction motor) may be reduced. For example the cleaning unit (which may comprise one or more air treatment members and the suction motor) may not be provided with a surrounding support structure. Instead, the cleaning unit may itself be rotatably mounted to the surface cleaning head and may have the drive handle attached thereto.

Alternately, or in addition, the upright section may be configured such that the air treatment member assembly forms the front and/or rear face of the cleaning unit, and may extend almost the entire depth of the cleaning unit (and optionally the entire depth), such that the overall depth of the cleaning unit may be the depth of the air treatment member assembly. This may help provide an air treatment member assembly that has an acceptable size and dirt collection volume, while keeping the overall depth in an acceptable range. Similarly, the components may be sized such that the depth of the air treatment member assembly is not substantially greater than the depth (i.e. diameter if vertically oriented) of the suction motor, and vice versa. For example, the depth of the air treatment member assembly may be the same as the diameter of the suction motor ±2 inches. This may allow both components to be an acceptable size, while helping to keep the overall depth of the cleaning unit in an acceptable range.

If the dirt collection region in the apparatus is external the air treatment member, e.g. a dirt collection chamber that is external a cyclone chamber, some and preferably all of the dirt collection region may be positioned laterally beside the cyclone chamber. Accordingly, the dirt collection region may not be positioned forward of the forward most part of the air treatment member and/or rearward of the rearward most part of the air treatment member, thereby reducing the depth of the cleaning unit. The dirt collection region can be located on only one side lateral of the air treatment member, or alternatively dirt collection regions (either discrete regions or portions of a common region) may be positioned on both lateral sides of the cyclone chamber. The volume of the portions of the dirt collection region that are laterally beside the cyclone chamber may be more than 50%, 60%, 70%, 80% or 90% of the total volume of the dirt collection region. Optionally, the dirt outlet on the cyclone chamber may be on a lateral side of the cyclone chamber, and be in communication with the laterally positioned dirt collection chamber.

Optionally, portions of the air flow path, including portions of the above floor cleaning assembly may be configured in a non-circular shape, and oriented so that their depth in the forward/rearward direction is less than their length or width. This may help reduce the overall depth of the apparatus while maintaining, and may help nest portions of the air flow path with other portions of the apparatus.

Optionally, the apparatus may include additional filters in the air flow path between a dirty air inlet and a clean air outlet, including one or more pre-motor filter(s) and post-motor filter(s). The suction motor may be laterally centered in the cleaning unit, and a post-motor filter and clean air outlet may be provide on at least one, and optionally both of the lateral sides of the suction motor. If on both sides, the cleaning unit may include two clean air outlets, each preceded by a respective post-motor filter. Providing the post-motor filters and clean air outlets on the lateral sides of the suction motor, as opposed to forward or rearward of the suction motor, may help reduce the depth of the cleaning unit and upright section. Optionally, providing a post-motor filter below the suction motor as an alternative to the laterally positioned filters, or in addition thereto, may also help provide a desired amount of filtration while helping to control the overall depth.

Preferably, to help move the upright section of the vacuum cleaner beneath an object, at least a portion of the upright section, such as the cleaning unit, may be moveable so as to be oriented into a low profile, generally horizontal position—such that the cleaning unit is substantially parallel to the floor being cleaned. That is, the vacuum cleaner may be configurable in a storage position (where the upright section is generally upright), an upright mode floor cleaning position (where the upright section is inclined rearwardly from the surface cleaning head) and a low profile floor cleaning mode (in which at least the cleaning unit portion of the upright section is parallel or at least substantially parallel to the surface being cleaned). This may help the cleaning unit to be moved beneath the object.

To move the cleaning unit into the low profile cleaning position, the drive handle may be bendable or otherwise reconfigurable. This may allow a user to continue holding the same grip portion in the different modes, and may help reduce the need to lower the grip portion down to the floor by requiring a user to bend over. Instead, the grip portion may remain at a more comfortable position, while allowing the cleaning unit to be oriented horizontally. For example, the handle may include a pivot joint or other suitable mechanism, whereby an upper handle portion may be pivotal relative to the cleaning unit. The pivot joint can preferably be lockable, to help a user secure the handle in one or more of its possible positions.

To help facilitate above floor cleaning, the surface cleaning apparatus may include an above floor cleaning assembly, which may optionally include a flexible hose and a generally rigid cleaning wand. The wand and hose may form part of the air flow path in the floor cleaning modes as well (and be detached for above floor cleaning), or alternatively may not form part of the air flow path in the floor cleaning mode.

In accordance with a first aspect of this disclosure, a surface cleaning apparatus is provided wherein in top plan view, the first and second laterally opposed sides and one of the front side and the rear side of the air treatment member assembly is generally rectangular in top plan view. An advantage of this design is that positioning components of the cleaning unit is this configuration reduces the depth of the cleaning unit. For example, instead of positioning a dirt collection chamber around a cyclone chamber, the dirt collection chamber or chambers may be positioned laterally beside the cyclone chamber and the dirt collections chamber(s) may be square or rectangular in top plan view when the upright section is in the upright position.

In accordance with this aspect, there is provided an upright surface cleaning apparatus having a surface cleaning head with a front end, a rear end, a central longitudinal axis extending between the front and rear ends, first and second laterally opposed sides, a dirty air inlet and a surface cleaning head air outlet. An upright section may be mounted to the surface cleaning head and may be moveable between a generally upright position and a rearwardly inclined in use position. The upright section may include an air treatment member assembly and a suction motor. The air treatment member assembly may have a longitudinally extending air treatment member assembly axis, first and second laterally opposed sides, a front side and a rear side. The air treatment member assembly may include an air treatment member and a dirt collection region that is positioned laterally from the air treatment member (i.e., lateral being a direction to the right or left side of the surface cleaning apparatus from the perspective of a user standing behind the surface cleaning apparatus and facing forwardly towards the front of the surface cleaning head.). The suction motor may be positioned below at least one of the air treatment member and the dirt collection region. The first and second laterally opposed sides and at least one of the front side and the rear side of the air treatment member assembly may be generally rectangular in top plan view when the upright section is in the upright position.

The other of the one of the front side and the rear side of the air treatment member assembly may have a portion that extends outwardly in a direction of the central longitudinal axis of the surface cleaning head when the upright section is oriented to extend generally upwardly from the surface cleaning head. The portion may also extend along a length of the air treatment member assembly in a direction of the longitudinally extending air treatment member assembly axis.

The suction motor may underlie at least one of the air treatment member and the dirt collection region. The inlet of the suction motor may be aligned with an air outlet of the air treatment member.

The air treatment member may have a dirt outlet provided on a lateral side of the air treatment member.

A depth of the air treatment member assembly in a direction of the central longitudinal axis may be about equal to a diameter of the suction motor, and/or may be the same as the diameter of the suction motor ±2 inches.

A maximum depth of the upright section in a direction of the central longitudinal axis may be 6 inches or less, and may be 4 inches or less.

A depth of the air treatment member in a direction of the central longitudinal axis may be about equal to a diameter of the suction motor.

The depth of the air treatment member assembly may be the same as the diameter of the suction motor ±2 inches.

A maximum depth of the upright section in a direction of the central longitudinal axis may be 6 inches or less, and may be 4 inches or less.

In accordance with this aspect of the teachings described herein, an upright surface cleaning apparatus may include a surface cleaning head having a front end, a rear end, a central longitudinal axis extending between the front and rear ends, first and second laterally opposed sides, a dirty air inlet and a surface cleaning head air outlet. An upright section may be mounted to the surface cleaning head and may be moveable between a generally upright position and a rearwardly inclined in use position. The upright section may include a cyclone bin assembly and a suction motor. The cyclone bin assembly may have a longitudinally extending cyclone bin assembly axis, first and second laterally opposed sides, a front side and a rear side, the air treatment member assembly comprising a cyclone and a dirt collection chamber external to and positioned laterally from the cyclone. The suction motor may be positioned below at least one of the cyclone and the dirt collection chamber. The first and second laterally opposed sides and one of the front side and the rear side of the cyclone bin assembly may be generally rectangular in top plan view when the upright section is in the upright position.

The other of the one of the front side and the rear side of the cyclone bin assembly may have a portion that extends outwardly in a direction of the central longitudinal axis of the surface cleaning head when the upright section is oriented to extend generally upwardly from the surface cleaning head. The portion may also extend along a length of the cyclone bin assembly in a direction of the longitudinally extending cyclone bin assembly axis. The portion may be rounded in transverse section.

An inlet of the suction motor may be aligned with an air outlet of the cyclone.

The cyclone may have a laterally directed dirt outlet.

A diameter of the cyclone may be about equal to a diameter of the suction motor.

A maximum depth of the upright section in a direction of the central longitudinal axis may be 6 inches or less, and may be 4 inches or less.

In accordance with this aspect of the teachings described herein, an upright surface cleaning apparatus may include a surface cleaning head having a front end, a rear end, a central longitudinal axis extending between the front and rear ends, first and second laterally opposed sides, a dirty air inlet and a surface cleaning head air outlet. An upright section may be mounted to the surface cleaning head and may be moveable between a generally upright position and a rearwardly inclined in use position. The upright section may include an air treatment member assembly and a suction motor positioned below the air treatment member assembly. The air treatment member assembly may have a longitudinally extending air treatment member assembly axis, first and second laterally opposed sides, a front side and a rear side. The air treatment member assembly may be generally rectangular in top plan view when the upright section is in the upright position other than at least one of the front and rear sides having an outward protrusion that extends in the direction of the longitudinally extending air treatment member assembly axis.

A maximum depth of the upright section in a direction of the central longitudinal may be is 6 inches or less, and may be 4 inches or less.

In accordance with another aspect of this disclosure, a surface cleaning apparatus has an upper section wherein components are vertically aligned. For example, a push handle of the upper section may be positioned such that the drive axis extends through the air treatment member assembly and the suction motor housing and a rotatable mount of the upper section underlies the upright section when the upright section is in the generally upright position. An advantage of this design is the depth of the upper section may be reduced while providing a maneuverable surface cleaning head.

In accordance with this aspect, there is provided an upright surface cleaning apparatus that may include a surface cleaning head having a front end, a rear end, rear wheels, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may have a cleaning unit and a push handle. The cleaning unit may include an air treatment member assembly having an air treatment member and a suction motor housing having a suction motor therein. The push handle may include a longitudinally extending member having a longitudinally extending drive axis and a hand grip portion provided at an upper end of the longitudinally extending member wherein the drive axis extends through the air treatment member assembly and the suction motor housing. A rotatable mount may rotatably mount the upright section with respect to the surface cleaning head about an upright section axis wherein the rotatable mount underlies the upright section when the upright section is in the generally upright position.

Axis of rotation of the rear wheels may underlie the air treatment member assembly when the upright section is in the generally upright position.

The suction motor may underlie the air treatment member assembly when the upright section is in the generally upright position.

The drive axis may be located a distance from the front end of the surface cleaning head that is generally the same as a distance the rotatable mount is located from the front end.

The air treatment member assembly may also include a dirt collection region exterior to and laterally spaced with respect to the air treatment member and an up flow duct that is positioned behind the dirt collection region.

The air treatment member may have a depth in a direction of the central longitudinal axis that is greater than a depth of the dirt collection region in a direction of the central longitudinal axis. A rear side of the up flow duct may be located proximate a rear side of the air treatment member.

The air treatment member may have a depth in a direction of the central longitudinal axis that is generally equal to a depth of the dirt collection region in a direction of the central longitudinal axis and a depth of the up flow duct in a direction of the central longitudinal axis.

The push handle may be rotatable relative to the cleaning unit about a laterally extending axis wherein the laterally extending axis is positioned above the air treatment member when the upright section is in the generally upright position.

In accordance with this aspect, an upright surface cleaning apparatus may include a surface cleaning head having a front end, a rear end, rear wheels, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may have a cleaning unit and a push handle. The cleaning unit may include an air treatment member assembly having an air treatment member, a dirt collection region exterior to and laterally spaced with respect to the air treatment member and a suction motor housing having a suction motor therein. The suction may be is beneath the air treatment member assembly when the upright section is in the generally upright position. An up flow duct may be positioned behind the dirt collection region. The push handle may include a longitudinally extending member having a longitudinally extending drive axis and a hand grip portion provided at an upper end of the longitudinally extending member. A rotatable mount may rotatably mount the upright section with respect to the surface cleaning head about an upright section axis. The rotatable mount may underlie the upright section when the upright section is in the generally upright position.

The air treatment member may have a depth in a direction of the central longitudinal axis that is greater than a depth of the dirt collection region in a direction of the central longitudinal axis and a rear side of the up flow duct is located proximate a rear side of the air treatment member.

The air treatment member may have a depth in a direction of the central longitudinal axis that is generally equal to a depth of the dirt collection region in a direction of the central longitudinal axis and a depth of the up flow duct in a direction of the central longitudinal axis.

An axis of rotation of the rear wheels may underlie the air treatment member assembly when the upright section is in the generally upright position.

In accordance with this aspect, an upright surface cleaning apparatus may include a surface cleaning head having a front end, a rear end, rear wheels, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include a front face having a forward most portion provided in a front plane that is transverse to a forward direction of travel of the surface cleaning head, a rear face having a rearward most portion provided in a rear plane that is transverse to the forward direction. An air treatment member assembly may include an air treatment member, a dirt collection region exterior to the air treatment member and a suction motor therein. The suction motor may underlie the air treatment member assembly when the cleaning unit is in the generally upright position. A push handle may have a longitudinally extending member with a longitudinally extending drive axis and a hand grip portion provided at an upper end of the longitudinally extending member. A rotatable mount may rotatably mount the upright section with respect to the surface cleaning head about an upright section axis. The air treatment member, the dirt collection region an axis of rotation of the rear wheels and the rotatable mount may be located between the front and rear planes.

The rotatable mount may underlie the air treatment member assembly when the cleaning unit is in the generally upright position.

The axis of rotation of the rear wheels may underlie the air treatment member assembly when the cleaning unit is in the generally upright position.

The suction motor may underlie the air treatment member assembly when the cleaning unit is in the generally upright position.

The drive axis may be located a distance from the front end of the surface cleaning head that is generally the same as a distance the rotatable mount is located from the front end.

The dirt collection region may be laterally spaced with respect to the air treatment member and an up flow duct is positioned behind the dirt collection region.

The air treatment member may have a depth in a direction of the central longitudinal axis that is greater than a depth of the dirt collection region in a direction of the central longitudinal axis and a rear side of the up flow duct is located proximate a rear side of the air treatment member.

The air treatment member may have a depth in a direction of the central longitudinal axis that is generally equal to a depth of the dirt collection region in a direction of the central longitudinal axis and a depth of the up flow duct in a direction of the central longitudinal axis.

A maximum depth of the cleaning unit in a direction of the central longitudinal axis may be 6 inches or less and may be 4 inches or less.

In accordance with another aspect of this disclosure, a surface cleaning apparatus is provided with a surface cleaning head wherein the rear wheels of the surface cleaning head have a diameter that is greater than a depth of the portion of the dirt collection region that is exterior to the air treatment member. An advantage of this design is the depth of the upper section may be reduced while providing a maneuverable surface cleaning head.

In accordance with this aspect, there is provided an upright surface cleaning apparatus that may have a surface cleaning head having a front end, a rear end, rear wheels having a diameter, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include an air treatment member assembly including an air treatment member and a dirt collection region. At least a portion of the dirt collection region may be exterior to and laterally spaced with respect to the air treatment member. A housing may include a suction motor therein. The diameter of the rear wheels may be greater than a depth of the portion of the dirt collection region in a direction of the central longitudinal axis.

The housing may have a motor housing portion which houses the suction motor and a lateral portion laterally spaced from the motor housing portion. The lateral portion may have a depth in a direction of the central longitudinal axis that is less than a depth of the central portion.

The housing may have a central portion which houses the suction motor and a lateral portion laterally spaced from the central portion wherein the lateral portion has a depth in a direction of the central longitudinal axis that is less than a depth of the central portion. The lateral portion may house a post motor filter.

The dirt collection region may be located above the lateral portion when the upright section is in the generally upright position.

The motor housing portion may underlie the air treatment member.

The air treatment member may include a cyclone chamber and the dirt collection region comprises a dirt collection chamber.

The suction motor may be generally laterally aligned with an air outlet of the cyclone chamber.

The upright section may include an up flow duct positioned behind the lateral portion. The lateral portion may house a post motor filter.

The up flow duct may be located proximate a rear side of the motor housing portion.

The motor housing portion may have a depth in a direction of the central longitudinal axis that is generally equal to a depth of the lateral portion in a direction of the central longitudinal axis and a depth of the up flow duct in a direction of the central longitudinal axis.

An axis of rotation of the rear wheels may be located rearward of the lateral portion and may underlie the upright section when the upright section is in the generally upright position.

The upright section may include a cleaning unit that contains the air treatment member assembly and suction motor and a drive handle extending from an upper end of the cleaning unit. A maximum depth of the cleaning unit in a direction of the central longitudinal axis may 6 inches or less, and may be 4 inches or less.

The upright section further may include an up flow duct that has a length in a lateral direction that is transverse to the central longitudinal axis that is greater than a depth of the up flow duct in a direction of the central longitudinal axis.

The length of the up flow duct may be more than twice the depth of the up flow duct. The up flow duct may be rectangular or ovaloid.

In accordance with another aspect of this disclosure, an upper section of a surface cleaning apparatus utilizes non-rounded air flow ducts. For example, one or more air flow conduits may be a parallelogram in cross section transverse to the air flow direction through the conduit (e.g., square or rectangular), elliptical or the like. The longer dimension of the conduit preferably extends transverse to a central longitudinal axis of the surface cleaning head to thereby increase the lateral dimension of the cleaning unit while reducing the depth of the cleaning unit.

In accordance with this aspect, there is provided an upright surface cleaning apparatus that may include a surface cleaning head having a front end, a rear end, rear wheels having a diameter, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include an air treatment member assembly having an air treatment member, a suction motor and an air flow duct. The upright section may have a motor receiving portion housing the suction motor and a lateral portion laterally spaced from the motor receiving portion. The air flow duct may be positioned laterally from the motor receiving portion. The air flow duct may have a length in a lateral direction that is transverse to the central longitudinal axis that is greater than a depth of the air flow duct in a direction of the central longitudinal axis.

The length of the up flow duct may be more than twice the depth of the up flow duct. The up flow duct may be rectangular or ovaloid in cross-section, and may include an up flow duct.

The motor receiving portion that may have a depth in a direction of the central longitudinal axis that is greater than a depth in a direction of the central longitudinal axis of the lateral portion and the air flow duct is provided in front or behind the lateral portion. The lateral portion may house a post motor filter.

A depth in a direction of the central longitudinal axis of the motor receiving portion may be approximately the same as a depth of the lateral portion in a direction of the central longitudinal axis and a depth of the air flow duct in a direction of the central longitudinal axis.

The surface cleaning head may include an up flow duct, and the upright surface cleaning apparatus may include a rotatable mount rotatably mounting the upright section with respect to the surface cleaning head about an upright section axis. The up flow duct may have a circular cross-sectional area. The air flow duct may be downstream from the up flow duct.

The air treatment member may have an air inlet having a shape that is similar to a shape of the air flow duct.

The air inlet of the air treatment member may have a height in a direction of a longitudinal axis of the upright section that is ±15% of a depth of the up flow duct in a direction of the central longitudinal axis and the air inlet of the air treatment member has a width in a direction transverse to the longitudinal axis of the upright section that is ±15% of a width of the up flow duct in a lateral direction.

The air treatment member assembly may have a dirt collection region external to and laterally spaced from the air treatment member. The dirt collection region may be located above the lateral portion when the upright section is in the generally upright position.

The motor receiving portion may underlie the air treatment member.

The air treatment member may include a cyclone and the dirt collection region may include a dirt collection chamber.

The suction motor may be generally aligned with an air outlet of the cyclone.

A flexible conduit may include a downstream end that has a transition member that is removably receivable in the air flow duct. The transition member may have, in cross-section, a length and a width and the length may be greater than the width.

The cross-sectional length of the transition member may be more than twice the cross-sectional depth of the transition member. The transition member may be rectangular or ovaloid in cross-section.

In accordance with this aspect, an upright surface cleaning apparatus may include a surface cleaning head having a front end, a rear end, rear wheels having a diameter, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include an air treatment member assembly and may include an air treatment member, a suction motor and an air flow duct. The air flow duct may have a length in a lateral direction that is transverse to the central longitudinal axis that is greater than a depth of the air flow duct in a direction of the central longitudinal axis. A flexible conduit may have a downstream end that has a transition member that is removably receivable in the air flow duct. The transition member, in cross-section, may have a length and a depth and the length may be greater than the depth.

In accordance with this aspect, an upright surface cleaning apparatus may include a surface cleaning head having a front end, a rear end, rear wheels having a diameter, a central longitudinal axis extending between the front and rear ends, first and second laterally opposed sides, a dirty air inlet and a surface cleaning head air outlet. An upright section moveably mounted to the surface cleaning head between a generally upright position and a rearwardly inclined in use position, the upright section comprising an air treatment member assembly comprising an air treatment member, a suction motor and an air flow duct. A flexible conduit may have a downstream end that has a transition member. The air flow duct may have a non-circular perimeter in cross-section and the transition member may have a perimeter in cross-section that is comparable to perimeter of the air flow duct.

In accordance with another aspect of this disclosure, all or a substantial portion of the dirt collection region is positioned laterally beside the air treatment member. For example, the volume of the portions of the dirt collection region that are laterally beside the cyclone chamber may be more than 50%, 60%, 70%, 80% or 90% of the total volume of the dirt collection region. Accordingly, the depth of the cleaning unit may be reduced by positioning the dirt collection chamber to not be in front and/or behind the air treatment member.

In accordance with this aspect, there is provided an upright surface cleaning apparatus that may include a surface cleaning head having a front end, a rear end, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include a cyclone bin assembly having a cyclone chamber and at least one dirt collection chamber exterior to the cyclone. The dirt collection chamber may have a volume and at least 60% of the volume may be positioned laterally from the cyclone.

The cyclone chamber has a laterally directed dirt outlet. The laterally directed dirt outlet may include a laterally positioned opening in a sidewall of the cyclone chamber.

The cyclone chamber may have first and second lateral sides and the at least one dirt collection chamber may be provided on only the first lateral side of the cyclone chamber.

The cyclone bin assembly may have first and second lateral sides and the cyclone chamber is provided on the first lateral side of the cyclone bin assembly and the at least one dirt collection chamber may be provided on the second lateral side of the cyclone bin assembly.

The cyclone chamber may have first and second lateral sides and a first dirt collection chamber may be provided on the first lateral side of the cyclone and a second dirt collection chamber may be provided on the second lateral side of the cyclone chamber.

The cyclone bin assembly may have first and second lateral sides and the cyclone chamber may be provided centrally between the first and second lateral sides. The dirt collection chamber may be provided on the first lateral side of the cyclone bin assembly and the second dirt collection chamber may be provided on the second lateral side of the cyclone bin assembly.

At least 80% of the volume may be positioned laterally from the cyclone chamber.

The cyclone chamber may have a depth in a direction of the central longitudinal axis that is greater than a depth of at least a portion of the at least one dirt collection chamber in the direction of the central longitudinal axis.

An up flow duct may be positioned behind the portion of the at least one dirt collection chamber.

In accordance with this aspect, an upright surface cleaning apparatus may include a surface cleaning head having a front end, a rear end, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include an air treatment member assembly having an air treatment member and at least one dirt collection region exterior to the air treatment member. The dirt collection region may have a volume and at least 60% of the volume may be positioned laterally from the air treatment member.

The air treatment member may have a laterally directed dirt outlet. The laterally directed dirt outlet may include a laterally positioned opening in a sidewall of the air treatment member.

The air treatment member may have first and second lateral sides and the at least one dirt collection region may be provided on only the first lateral side of the air treatment member.

The air treatment member assembly has first and second lateral sides and the air treatment member is provided on the first lateral side of the air treatment member assembly and the at least one dirt collection region is provided on the second lateral side of the air treatment member assembly.

The air treatment member may have first and second lateral sides and a first dirt collection chamber may be provided on the first lateral side of the air treatment member and a second dirt collection chamber may be provided on the second lateral side of the air treatment member.

The air treatment member assembly may have first and second lateral sides, the air treatment member may be provided centrally between the first and second lateral sides. The dirt collection chamber may be provided on the first lateral side of the air treatment member assembly and the second dirt collection chamber may be provided on the second lateral side of the air treatment member assembly.

At least 80% of the volume may be positioned laterally from the air treatment member.

The air treatment member may have a depth in a direction of the central longitudinal axis that is greater than a depth of at least a portion of the at least one dirt collection region in the direction of the central longitudinal axis.

An up flow duct may be positioned behind the portion of the at least one dirt collection region.

In accordance with this aspect, an upright surface cleaning apparatus may include a surface cleaning head having a front end, a rear end, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include an air treatment member assembly comprising an air treatment member and a dirt collection region exterior to the air treatment member. The air treatment member may have first and second lateral sides and the dirt collection region may be provided on only the first lateral side of the air treatment member.

The air treatment member assembly may have first and second lateral sides and the air treatment member may be provided on the first lateral side of the air treatment member assembly. The dirt collection region may be provided on the second lateral side of the air treatment member assembly.

The air treatment member may include a cyclone.

The air treatment member may have a depth in a direction of the central longitudinal axis that is greater than a depth of at least a portion of the at least one dirt collection region in the direction of the central longitudinal axis.

An up flow duct may be positioned behind the portion of the at least one dirt collection region.

In accordance with another aspect of this disclosure, the push handle of the upright surface cleaning apparatus may be positioned such that a portion of the air treatment member may be positioned laterally thereof. For example, the push handle may be positioned off centre (towards one lateral side of the upper section) thereby enabling the air treatment member to extend further rearwardly and reducing the depth of the cleaning unit.

In accordance with this aspect, there is provided an upright surface cleaning apparatus that may include a surface cleaning head having a front end, a rear end, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include a support structure and an air treatment member assembly that includes an air treatment member. The support structure may be positioned rearward of a front face of the air treatment member assembly when the cleaning unit is in the generally upright position. A push handle may include a longitudinally extending member having a longitudinally extending drive axis and a hand grip portion provided at an upper end of the longitudinally extending member. A lower end of the longitudinally extending member may be mounted to the support structure and a portion of the air treatment member assembly may extend rearward of the longitudinally extending member when the cleaning unit is in the generally upright position.

A portion of the air treatment member may extend rearward of the longitudinally extending member when the cleaning unit is in the generally upright position.

The longitudinally extending member may extend generally vertically when the cleaning unit is in the generally upright position.

The support structure may include an up flow duct and the longitudinally extending member may be mounted to an upper end of the up flow duct.

The air treatment member assembly may include a dirt collection region and the up flow duct may be positioned behind the dirt collection region.

The air treatment member may have a depth in a direction of the central longitudinal axis that is greater than a depth of at least a portion of the dirt collection region in the direction of the central longitudinal axis.

The up flow duct may be positioned behind the portion of the at least one dirt collection region.

The support structure may include first and second laterally spaced struts and a cross member provided on an upper end of the struts.

The struts may be positioned behind the air treatment member assembly.

The air treatment member assembly may include first and second lateral sides. A first dirt collection region external to the air treatment member may be provided on the first lateral side of the air treatment member assembly and a second dirt collection region external to the air treatment member may be provided on the second lateral side of the air treatment member assembly. A strut may be positioned behind each of the dirt collection regions. The first and second dirt collection regions may be contiguous.

The first and second dirt collection regions may be provided on either side of an air treatment member and may be isolated from each other.

The air treatment member may have a depth in a direction of the central longitudinal axis that is greater than a depth of at least a portion of the first and second dirt collection regions in the direction of the central longitudinal axis.

The first strut may be positioned behind the portion of the first dirt collection region and the second strut may be positioned behind the portion of the second dirt collection region.

The drive axis may extend through the air treatment member assembly.

The air treatment member assembly may include a cyclone bin assembly and the air treatment member may include a cyclone.

In accordance with this aspect, an upright surface cleaning apparatus may include a surface cleaning head having a front end, a rear end, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include a support structure and an air treatment member assembly. The support structure may include first and second laterally spaced struts and a cross member provided on an upper end of the struts. The air treatment member assembly may include an air treatment member, first and second lateral sides, a first dirt collection region external to the air treatment member provided on the first lateral side of the air treatment member assembly and a second dirt collection region external to the air treatment member provided on the second lateral side of the air treatment member assembly. A strut may be positioned behind each of the dirt collection regions. A push handle may include a longitudinally extending member having a longitudinally extending drive axis and a hand grip portion provided at an upper end of the longitudinally extending member. A lower end of the longitudinally extending member may be mounted to the support structure.

In accordance with this aspect, an upright surface cleaning apparatus may include a surface cleaning head having a front end, a rear end, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include an up flow duct and an air treatment member assembly comprising an air treatment member. The up flow duct may be positioned rearward of a front face of the air treatment member assembly when the cleaning unit is in the generally upright position. A push handle may include a longitudinally extending member having a longitudinally extending drive axis and a hand grip portion provided at an upper end of the longitudinally extending member wherein a lower end of the longitudinally extending member is mounted to the up flow duct.

The first and second dirt collection regions may be contiguous.

The first and second dirt collection regions may be provided on either side of an air treatment member and may be isolated from each other.

In accordance with another aspect of this disclosure, the post motor filter(s) and/or the clean air outlet(s) may be provided on one or both lateral sides of the upper section. An advantage of this design is that a post motor filter need not be positioned forward and/or rearward of the suction motor. Therefore, the suction motor may essentially extend from the front to the rear of the cleaning unit thereby reducing the depth of the cleaning unit.

In accordance with this aspect, there is provided an upright surface cleaning apparatus that may include a surface cleaning head having a front end, a rear end, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include first and second lateral opposed sides, an air treatment member assembly comprising an air treatment member and a suction motor having first and second lateral sides. Each lateral side of the upright section may have a clean air outlet and a post-motor porous filter media located upstream of the clean air outlet.

The post-motor porous filter media may be provided on each lateral side of the suction motor.

The post-motor porous filter media may be positioned opposed to and facing each of the lateral sides of the suction motor. The suction motor may be positioned below the air treatment member.

The clean air outlets may be provided in a lower portion of the upright section. The post-motor porous filter media may be positioned below the suction motor.

The upper section may have a width in a direction transverse to the central longitudinal axis that is more than twice a depth of the upright section in the direction of the central longitudinal axis. The air treatment member may include a cyclone chamber.

In accordance with this aspect, an upright surface cleaning apparatus may include a surface cleaning head having a front end, a rear end, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include first and second lateral opposed sides, an air treatment member assembly comprising an air treatment member and a suction motor having first and second lateral sides. The first lateral side may have a clean air outlet. A post-motor porous filter media may be located upstream of the clean air outlet. The upper section may have a width in a direction transverse to the central longitudinal axis that is more than twice a depth of the upright section in the direction of the central longitudinal axis.

The post-motor porous filter media may be provided on the first lateral side of the suction motor, wherein the first lateral side of the suction motor faces the first lateral side of the upper section.

The post-motor porous filter media may be positioned opposed to and facing the first lateral side of the suction motor. The suction motor may be positioned below the air treatment member. The clean air outlet may be provided in a lower portion of the upright section. The air treatment member may include a cyclone.

In accordance with this aspect, an upright surface cleaning apparatus may include a surface cleaning head having a front end, a rear end, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include first and second lateral opposed sides, an air treatment member assembly comprising an air treatment member, a suction motor having first and second lateral sides and a clean air outlet. Each lateral side of the upright section may include a post-motor porous filter media located upstream of the clean air outlet. The upper section may have a width in a direction transverse to the central longitudinal axis that is more than twice a depth of the upright section in the direction of the central longitudinal axis.

The post-motor porous filter media may be positioned opposed to and facing each of the lateral sides of the suction motor.

The suction motor may be positioned below the air treatment member.

The clean air outlet may be provided in a lower portion of the upright section.

The post-motor porous filter media may be positioned below the suction motor. The air treatment member may include a cyclone.

In accordance with another aspect of this disclosure, the surface cleaning apparatus may have a telescoping push handle with a pivot joint provided therein. Optionally, one of the telescoping shafts may provide an anti-rotation lock for the pivot joint. An advantage of this design is that a user may position the cleaning unit to extend generally horizontal while still standing in a generally upright position such that the user may maneuver the surface cleaning head under furniture while in a comfortable operating position.

In accordance with this aspect, there is provided an upright surface cleaning apparatus that may include a surface cleaning head having a front end, a rear end, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include an air treatment member assembly comprising an air treatment member and a suction motor. A telescoping push handle may include upper and lower telescoping longitudinally extending members which are reconfigurable between a retracted position and a first extended position. The upper telescoping longitudinally extending member may have a longitudinally extending drive axis and a hand grip portion provided at an upper end of the upper longitudinally extending member. The lower telescoping longitudinally extending member may have a first pivot joint provided at an upper end of the lower telescoping longitudinally extending member. The first pivot joint may be non-rotationally locked when the push handle is in the retracted position and the upper telescoping longitudinally extending member may be pivotal about the first pivot joint when the push handle is in the first extended position.

The upper telescoping longitudinally extending member may have a first abutment member and the first pivot joint may have a first pivot joint abutment member and the abutment members prevent rotation of the upper telescoping longitudinally extending member when the push handle is in the retracted position.

The upper telescoping longitudinally extending member may include a longitudinally extending drive shaft and the first abutment member may include a portion of the outer surface of the drive shaft whereby the portion of the outer surface is exterior to the first pivot joint when the push handle is in the first extended position.

The upper telescoping longitudinally extending member may extend through the first pivot joint when the push handle is in the retracted position.

The upper telescoping longitudinally extending member may be slideably receivable in the lower telescoping longitudinally extending member.

The first pivot joint may be located above the air treatment member.

The first pivot joint may overlie the air treatment member.

The push handle may be mounted to the cleaning unit.

A second pivot joint may be provided on longitudinally extending member and above the first pivot joint. The second pivot joint may be non-rotationally locked when the push handle is in the first extended position and the upper telescoping longitudinally extending member may be pivotal about the second pivot joint when the push handle is in a second extended position.

When the upper longitudinally extending member is in the second extended position, the upper longitudinally extending member may be further extended than when the upper longitudinally extending member is in the first extended position.

The upper telescoping longitudinally extending member may have a second abutment member and the second pivot joint may have a second pivot joint abutment member and the second abutment member and the second pivot joint abutment member prevent rotation of the upper telescoping longitudinally extending member when the push handle is in the retracted position.

The upper telescoping longitudinally extending member may include a longitudinally extending drive shaft and the second abutment member may include a portion of the outer surface of the drive shaft whereby the portion of the outer surface is exterior to the second pivot joint when the push handle is in the second extended position.

The upper telescoping longitudinally extending member may extend through the second pivot joint when the push handle is in the retracted position.

The second pivot joint may be located above the air treatment member.

The second pivot joint may overlie the air treatment member.

The upper telescoping longitudinally extending member may have first and second abutment members. The first pivot joint may have a first pivot joint abutment member and the second pivot joint may have a second pivot joint abutment member. The first abutment member and the first pivot joint abutment member may prevent rotation of the upper telescoping longitudinally extending member when the push handle is in the retracted position. The second abutment member and the second pivot joint abutment member may prevent rotation of the upper telescoping longitudinally extending member when the push handle is in the first extended position.

The upper telescoping longitudinally extending member may include a longitudinally extending drive shaft. The first abutment member may include a first portion of the outer surface of the drive shaft and the second abutment member may include a second portion of the outer surface of the drive shaft. The first portion of the outer surface may be exterior to the first pivot joint when the push handle is in the first extended position and the second portion of the outer surface may exterior to the second pivot joint when the push handle is in the second extended position.

The second portion of the outer surface of the drive shaft may be below the first portion of the outer surface of the drive shaft.

The first and second pivot joints may each overlie the air treatment member.

The push handle may be mounted to the cleaning unit.

In accordance with another aspect of this disclosure, an upright surface cleaning apparatus is provided with a flexible conduit, wherein in a floor cleaning mode the flexible conduit is positioned between a front transverse plane of the cleaning unit and a rear transverse of the cleaning unit. An advantage of this design is that the flexible conduit does not increase the depth of the upper section.

In accordance with this aspect, there is provided an upright surface cleaning apparatus that may include a surface cleaning head having a front end, a rear end, rear wheels, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include an air treatment member assembly having an air treatment member and a suction motor therein. The cleaning unit may have an upper end, a front side and a rear side and first and second opposed lateral sides. A push handle may have a longitudinally extending member having a longitudinally extending drive axis and a hand grip portion. An above floor cleaning assembly may include a flexible conduit having an inlet end and an outlet end. In a floor cleaning mode the above floor cleaning assembly may be positioned between a front transverse plane that extends transverse to the central longitudinal axis and is located at the front side of the cleaning unit and a rear transverse plane that extends transverse to the central longitudinal axis and is located at the rear side of the cleaning unit.

The above floor cleaning assembly may include a rigid conduit that is upstream of the flexible conduit in an above floor cleaning mode. In the floor cleaning mode, the rigid conduit may be located on a first lateral side of the air treatment member, a first portion of the flexible conduit having the outlet end may be located on a second lateral side of the air treatment member. A second portion of the flexible conduit may extend from the second lateral side of the air treatment member over an upper end of the air treatment member to the first lateral side of the air treatment member.

The rigid conduit may have an upstream end that in the floor cleaning mode is received in an up flow duct and in an above floor cleaning mode is removed from the up flow duct.

The air treatment member assembly may include a first dirt collection region that is located on the first lateral side of the air treatment member and the rigid conduit may be located behind the first dirt collection region.

The air treatment member assembly may include a second dirt collection region that is located on the second lateral side of the air treatment member and the first portion of the flexible conduit may be located behind the second dirt collection region.

The air treatment member may have a depth in a direction of the central longitudinal axis that is greater than a depth of the first dirt collection region in a direction of the central longitudinal axis.

The air treatment member may have a depth in a direction of the central longitudinal axis that is greater than a depth of the first dirt collection region and greater than a depth of the second dirt collection region in a direction of the central longitudinal axis. The drive axis may extend through the air treatment member assembly.

The drive axis may extend through the air treatment member assembly and, in the floor cleaning mode, the second portion of the flexible conduit may be positioned in front of the drive axis. In the floor cleaning mode, a rearward extent of a rear side of the above floor cleaning assembly may be at most a rear side of the cleaning unit.

In accordance with this aspect, an upright surface cleaning apparatus may include a surface cleaning head having a front end, a rear end, rear wheels, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include an air treatment member assembly having an air treatment member and a suction motor therein. The air treatment member may have an upper end, a front side and a rear side and first and second opposed lateral sides. A push handle may have a longitudinally extending member having a longitudinally extending drive axis and a hand grip portion. An above floor cleaning assembly may include a flexible conduit having an inlet end and an outlet end. In a floor cleaning mode a front side of the entire above floor cleaning assembly may be positioned forward of a rear side of the air treatment member.

The above floor cleaning assembly may include a rigid conduit that is upstream of the flexible conduit in an above floor cleaning mode. In the floor cleaning mode, the rigid conduit may be located on the first lateral side of the air treatment member, a first portion of the flexible conduit having the outlet end may be located on the second lateral side of the air treatment member and a second portion of the flexible conduit may extend from the second lateral side of the air treatment member over the upper end of the air treatment member to the first lateral side of the air treatment member.

The rigid conduit may have an upstream end that in the floor cleaning mode is received in an up flow duct and in an above floor cleaning mode is removed from the up flow duct.

The air treatment member assembly may include a first dirt collection region that is located on the first lateral side of the air treatment member and the rigid conduit may be located behind the first dirt collection region.

The air treatment member assembly may include a second dirt collection region that is located on the second lateral side of the air treatment member and the first portion of the flexible conduit may be located behind the second dirt collection region.

The air treatment member may have a depth in a direction of the central longitudinal axis that is greater than a depth of the first dirt collection region in a direction of the central longitudinal axis.

The air treatment member may have a depth in a direction of the central longitudinal axis that is greater than a depth of the first dirt collection region and greater than a depth of the second dirt collection region in a direction of the central longitudinal axis.

The drive axis may extend through the air treatment member assembly.

The drive axis may extend through the air treatment member assembly and, in the floor cleaning mode, the second portion of the flexible conduit may be positioned rearward of the drive axis.

In the floor cleaning mode, a rearward extent of a rear side of the above floor cleaning assembly may be at most a rear side of the cleaning unit.

In accordance with another aspect of this disclosure, the cleaning unit is provided with a carry handle that extends transversely. An advantage of this design is that the handle does not increase the depth of the upper section.

In accordance with this aspect, there is provided an upright surface cleaning apparatus that may include a surface cleaning head having a front end, a rear end, a central longitudinal axis extending between the front and rear ends, first and second laterally opposed sides, a dirty air inlet and a surface cleaning head air outlet. An upright section may be moveably mounted to the surface cleaning head between a generally upright position and a rearwardly inclined in use position. The upright section may include a cleaning unit having a carry handle, an air treatment member assembly having an air treatment member, and a suction motor. The air treatment member assembly may have an upper end, a front side and a rear side and first and second opposed lateral sides. The carry handle may extend in a direction transverse to the central longitudinal axis. The carry handle may have a hand grip portion that has a length in the transverse direction that is greater than a depth of the cleaning unit in a direction of the central longitudinal axis.

The carry handle may be provided on the upper end of the air treatment member assembly.

The carry handle may overlie the upper end of the air treatment member assembly and may be positioned between the front and rear sides of the air treatment member assembly.

The air treatment member assembly may be removable from the upright section.

The cleaning unit may include a suction motor housing and the air treatment member assembly is removably mounted to an upper end of the suction motor housing.

A push handle may include a longitudinally extending member having a longitudinally extending drive axis and a hand grip portion provided at an upper end of the longitudinally extending member. A lower end of the longitudinally extending member may be pivotally mounted to the cleaning unit by a pivot joint. The pivot joint may be located above the carry handle when the cleaning unit is in the upright position. The longitudinally extending member may be positioned between the front and rear sides of the air treatment member assembly.

A push handle may include an upper and lower longitudinally extending members, the upper longitudinally extending member having a longitudinally extending drive axis and a hand grip portion provided at an upper end of the upper longitudinally extending member. The lower longitudinally extending member may have a pivot joint provided at an upper end of the lower longitudinally extending member. The pivot joint is located above the carry handle when the upright section is in the upright position. The longitudinally extending member may be positioned between the front and rear sides of the air treatment member assembly.

A length of the carry handle in the transverse direction may be greater than twice the depth of the cleaning unit in the direction of the central longitudinal axis.

In accordance with this aspect, an upright surface cleaning apparatus may include a surface cleaning head having a front end, a rear end, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include a carry handle, an air treatment member assembly comprising an air treatment member, and a suction motor. The air treatment member assembly may have an upper end, a front side and a rear side and first and second opposed lateral sides. A push handle may have a first longitudinally extending member having a longitudinally extending drive axis and a hand grip portion provided at an upper end of the first longitudinally extending member. A lower end of the first longitudinally extending member may be rotatably mounted with respect to the cleaning unit at a location above the carry handle when the upright section is in the upright position wherein the upper end of the first longitudinally extending member is rotatable forwardly.

The first longitudinally extending member may be positioned between the front and rear sides of the air treatment member assembly.

The push handle further may include a second longitudinally extending member. The first and second longitudinally extending members may be telescopically mounted with respect to each other. A rotational joint may be provided on the second longitudinally extending member and the lower end of the first longitudinally extending member may be slidably receivable in the rotational joint. The rotational joint may be in a locked position when the lower end of the first longitudinally extending member is received in the rotational joint.

The carry handle may be provided on the upper end of the air treatment member assembly, and may overlie the upper end of the air treatment member assembly.

The carry handle may be positioned between the front and rear sides of the air treatment member assembly.

The air treatment member assembly may be removable from the cleaning unit.

The cleaning unit may include a suction motor housing and the air treatment member assembly may be removably mounted to an upper end of the suction motor housing.

The carry handle may extend in a direction transverse to the central longitudinal axis. The carry handle may have a hand grip portion that has a length in the transverse direction that is greater than a depth of the cleaning unit in a direction of the central longitudinal axis.

The location at which the lower end of the first longitudinally extending member is rotatably mounted with respect to the cleaning unit may overlie the carry handle when the upright section is in the upright position.

In accordance with another aspect of this disclosure, an upright surface cleaning apparatus is provided with a push handle that is rotatably mounted with respect to the cleaning unit about a rotational joint located above the air treatment member and a flexible conduit is vertically spaced with respect to the rotational joint. An advantage of this design is that the hose and rotational joint do not increase the depth of the upper section.

In accordance with this aspect, there is provided an upright surface cleaning apparatus that may include a surface cleaning head having a front end, a rear end, a central longitudinal axis extending between the front and rear ends, first and second laterally opposed sides, a dirty air inlet and a surface cleaning head air outlet. A cleaning unit may be moveably mounted to the surface cleaning head between a generally upright position and a rearwardly inclined in use position. The cleaning unit may include an air treatment member assembly, having an air treatment member, and a suction motor. The air treatment member may have an upper end, a front side and a rear side and first and second opposed lateral sides. A push handle may include a first longitudinally extending member having a longitudinally extending drive axis and a hand grip portion provided at an upper end of the longitudinally extending member, a lower end of the longitudinally extending member is rotatably mounted with respect to the cleaning unit about a rotational joint located above the air treatment member assembly when the cleaning unit is in the upright position. An above floor cleaning assembly may include a flexible conduit having an inlet end and an outlet end. In a floor cleaning mode a first portion of the flexible conduit having the outlet end may be located on the second lateral side of the air treatment member and a second transverse portion of the flexible conduit may extend from the second lateral side of the air treatment member over the upper end of the air treatment member to the first lateral side of the air treatment member wherein the second transverse portion is vertically spaced from the rotational joint.

In the floor cleaning mode, the second transverse portion may be positioned above the rotational joint, and/or may be positioned rearward of the rotational joint.

The air treatment member assembly may include a dirt collection region that is located on the second lateral side of the air treatment member and in the floor cleaning mode the first portion of the flexible conduit may be located behind the second dirt collection region.

The air treatment member may have a depth in a direction of the central longitudinal axis that is greater than a depth of the dirt collection region in a direction of the central longitudinal axis.

A transverse plane that extends transverse to the central longitudinal axis may extend through the air treatment member and the first portion of the flexible conduit.

The drive axis may extend through the air treatment member assembly.

In the floor cleaning mode, the second transverse portion may be positioned above the rotational joint and/or may be positioned rearward of the rotational joint.

The above floor cleaning assembly may include a rigid conduit and the air treatment member assembly may include a first dirt collection region that is located on the first lateral side of the air treatment member and a second dirt collection region that is located on the second lateral side of the air treatment member. In the floor cleaning mode, the rigid conduit may be located behind the first dirt collection region and the first portion of the flexible conduit may be located behind the second dirt collection region.

The air treatment member may have a depth in a direction of the central longitudinal axis that is greater than a depth of the first dirt collection region and greater than a depth of the second dirt collection region in a direction of the central longitudinal axis.

A transverse plane that may extend transverse to the central longitudinal axis extends through the air treatment member, the first portion of the flexible conduit and the rigid conduit.

The drive axis may extend through the air treatment member assembly.

In the floor cleaning mode, the second transverse portion is positioned above the rotational joint and/or may be positioned rearward of the rotational joint.

The push handle may be mounted to the upright section.

The push handle may include a second longitudinally extending member. The first and second longitudinally extending members may be telescopically mounted with respect to each other. A rotational joint may be provided on the second longitudinally extending member and the lower end of the first longitudinally extending member may be slidably receivable in the rotational joint. The rotational joint may be in a locked position when the lower end of the first longitudinally extending member is received in the rotational joint.

BRIEF DESCRIPTION OF THE DRAWINGS

The drawings included herewith are for illustrating various examples of articles, methods, and apparatuses of the teaching of the present specification and are not intended to limit the scope of what is taught in any way.

In the drawings.

DETAILED DESCRIPTION

Figure 1:
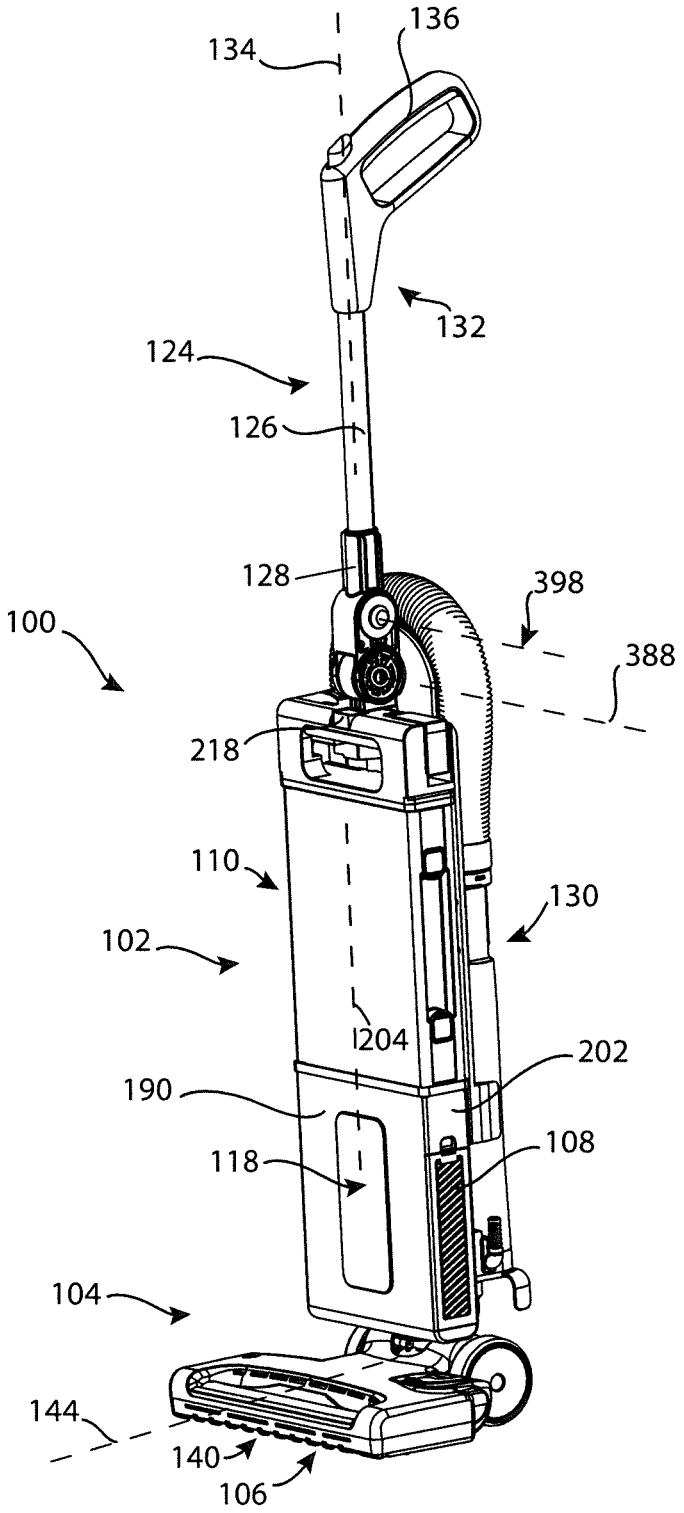
FIG. 1 is a front perspective view of one embodiment of a surface cleaning apparatus.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

General Description of a Vacuum Cleaner

Referring to FIGS. 1 to 13, a first embodiment of a surface cleaning apparatus 100 is shown. The following is a general discussion of this embodiment which provides a basis for understanding several of the features which are discussed herein. As discussed in detail subsequently, each of the features may be used in other embodiments.

In the embodiment illustrated, the surface cleaning apparatus 100 is an upright-style vacuum cleaner. Optionally, the surface cleaning apparatus incorporating some or all of the features described herein could alternatively be configured as another suitable type of surface cleaning apparatus, including, for example, an extractor, a stick vac, a wet-dry vacuum cleaner and the like.

In this embodiment, the surface cleaning apparatus 100 includes an upright section 102 that is movably and drivingly connected to a surface cleaning head 104, such that the upright section 102 is movable between an upright position (FIG. 1), such as for storage and optionally when in an above floor cleaning mode, and one or more inclined positions (FIGS. 12 and 13), such as for when the apparatus 100 is operated in a floor cleaning mode to clean floors or other such surfaces. Optionally, the apparatus 100 may be operable in an inclined, upright-style floor cleaning mode as well as a low profile floor cleaning mode (FIGS. 12 and 13), during which some or all of the upright section 102 may be maneuvered underneath relatively low objects, such as furniture.

The surface cleaning apparatus 100 also includes at least one dirty air inlet 106 (FIG. 1), at least one clean air outlet 108 and an air flow path or passage extending therebetween. The air flow path may include any suitable combination of air flow conduits, chambers and the like, and may include rigid conduits, flexible conduits (such as hoses) and a combination of rigid and flexible conduits. Optionally, the air flow path may be at least partially reconfigurable, such that two or more dirty air inlets can be connected to the air flow path. In such configurations, the two or more dirty air inlets may be connected to the air flow path in parallel and accessible independently of each other (e.g., each may be used in different cleaning modes).

Figure 7:
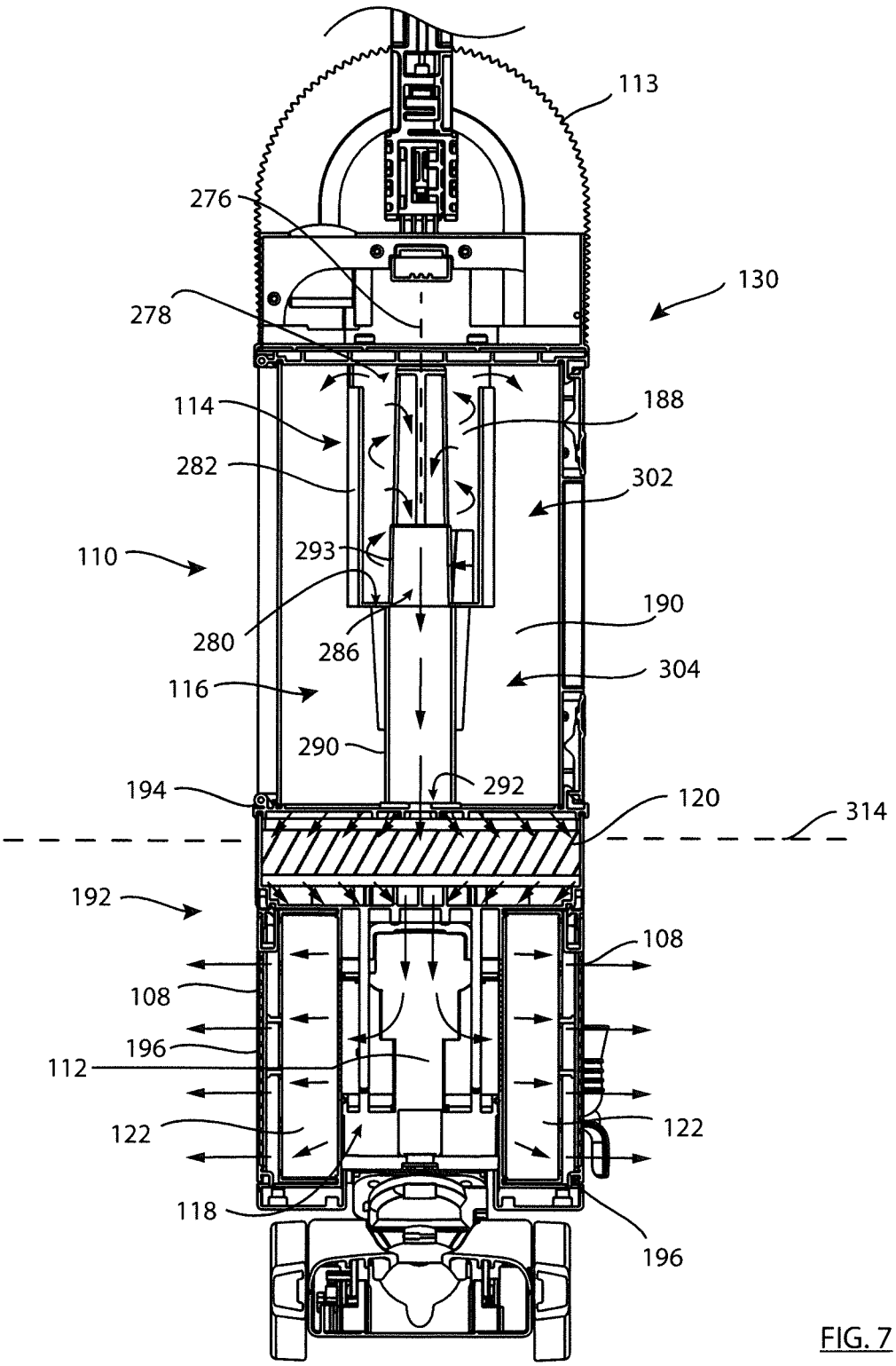
FIG. 7 is a cross-sectional view of a portion of the surface cleaning apparatus of FIG. 1, taken along line 7-7 in FIG. 4.
Figure 10:
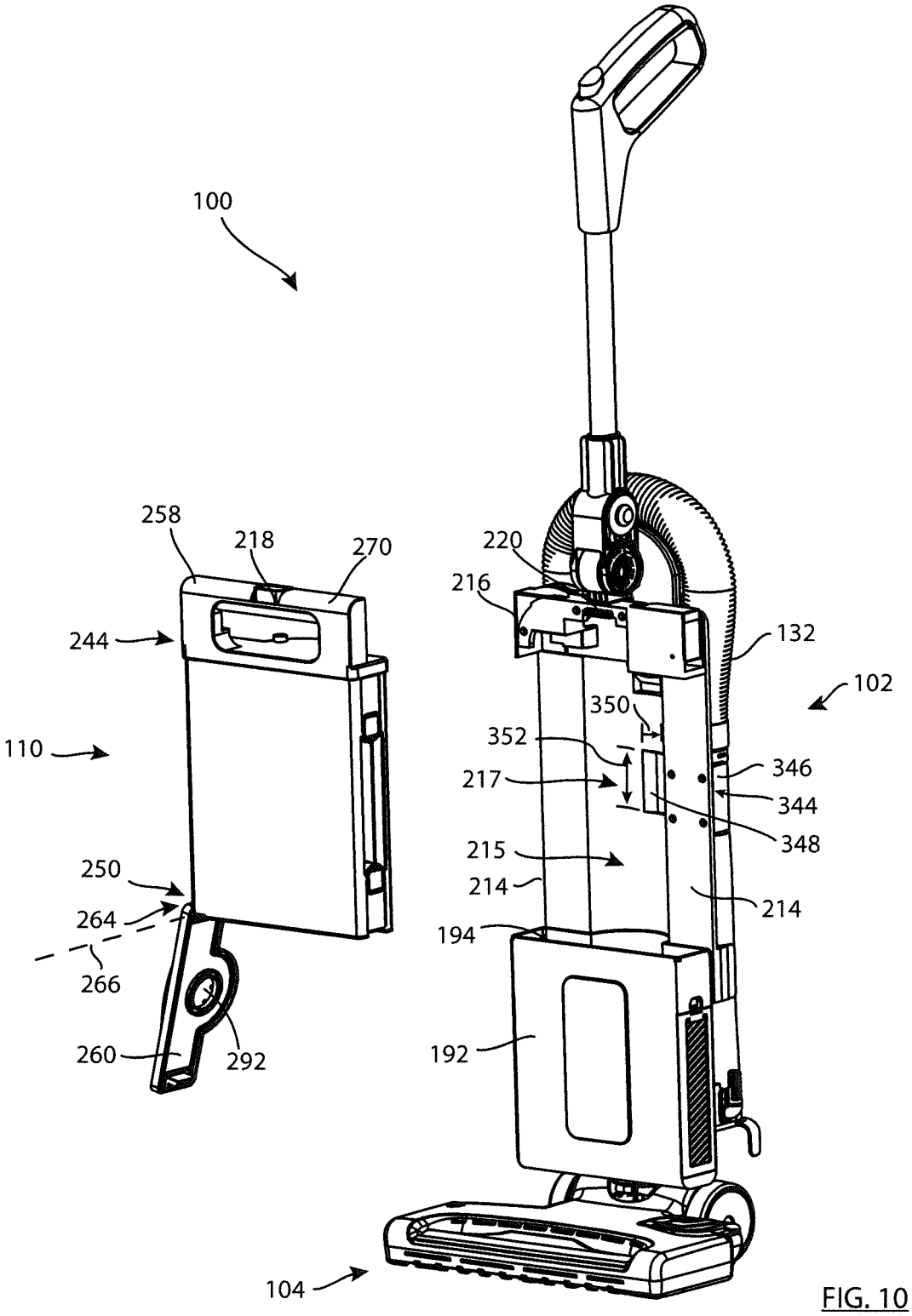
FIG. 10 is a front perspective view of the surface cleaning apparatus of FIG. 1, with the air treatment member assembly removed and a bottom emptying door in the open position.
Figure 11:
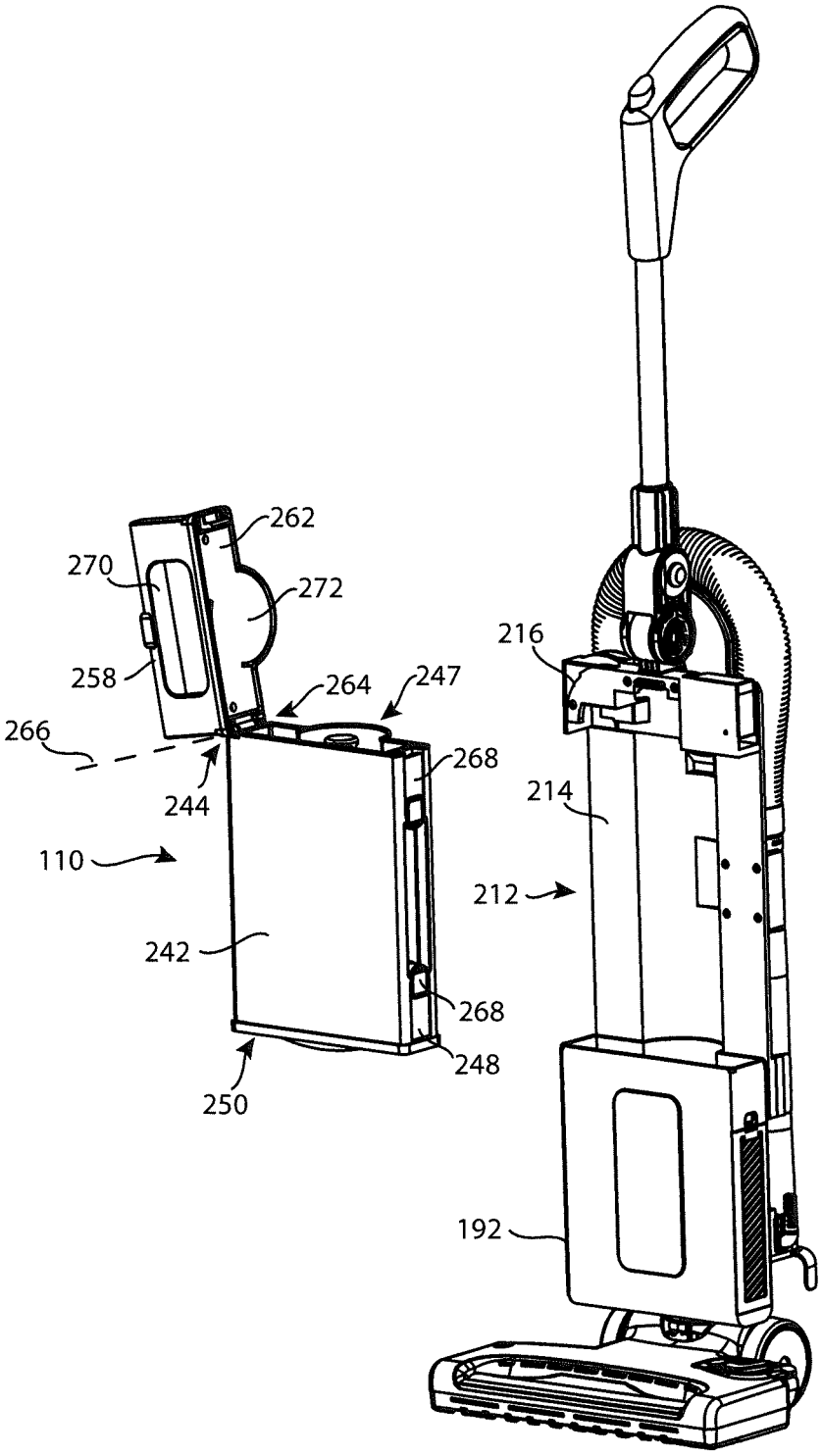
FIG. 11 is a front perspective view of the surface cleaning apparatus of FIG. 1, with the air treatment member assembly removed and the lid of the air treatment member assembly in an open position.

Referring to FIGS. 1 and 7, the upright section 102 has a cleaning unit 130 that includes at least one air treatment member assembly 110, for removing dirt and/or debris from the air flow, and at least one suction motor 112, for generating the vacuum air flow, are positioned in the air flow path, between the at least one dirty air inlet 106 and the at least one clean air outlet 108. The air treatment member assembly 110 may be any suitable apparatus, and preferably includes an air treatment member 114 and a dirt collection region 116, that may be either inside the air treatment member 114 or external the air treatment member 114 as illustrated. Some examples of air treatment members may including, for example, one or more cyclones, filters, and bags, and preferably the at least one air treatment member is provided upstream from the suction motor. The dirt collection region or regions are preferably exterior to and laterally spaced from the air treatment member. Preferably, the air treatment member 114 and/or dirt collection region 116 may be removable from the upright section 102 for emptying and/or maintenance (FIGS. 10 and 11). The suction motor 112 may be housed in a motor housing portion 118, which in the illustrated embodiment is located beneath the air treatment member assembly 110. Optionally, the suction motor 112 may be positioned directly beneath the air treatment member 114, such that the air treatment member 114 (or optionally only portions thereof) overlie at least a portion of the suction motor 112, and preferably the entire suction motor 112 may be positioned directly beneath air treatment member 114. This stacked arrangement may help reduce the overall size of the upright section.

Optionally, one or more pre-motor filters 120 may be provided in the air flow path between the air treatment member 114 and the suction motor 112, and/or one or more post-motor filters 122 may be provided in the air flow path downstream from the suction motor 112 and preferably upstream from the clean air outlet 108. The pre-motor filter 120 and post-motor filter 122 may each be any suitable type of filter, including a physical, porous media type filter such as foam or felt, and optionally may include a HEPA filter.

The apparatus 100 also includes a push handle 124 (FIG. 1) that can be used by a user to drive and maneuver the surface cleaning apparatus 100. The handle 124 may be of any suitable configuration, and in the illustrated embodiment includes an elongate extension member 126 that has a lower end 128 that may be connected to the cleaning unit 130, a support for the cleaning unit or optionally to the air treatment member assembly 110, and an upper end 132 that is spaced apart from the lower end along a handle axis 134, which defines a drive axis of the apparatus 100 when in the upright floor cleaning mode. A hand grip portion 136 that can be grasped by the user may also be provided, and in the illustrated embodiment is located at the upper end 132 of the extension member 126 and forms the upper most portion of the handle 124 (see also FIG. 5). Optionally, the surface cleaning apparatus 100 may be configured so that the upper most portion of the handle 124, i.e. the handgrip portion 136, is at a generally comfortable height 138 (FIG. 5) for an average user, and may be positioned between about 36-48, 40-48 or 42-48 inches above the ground when the apparatus 100 is in the upright position. Optionally, the handle 124 may be adjustable, such that the height 138 can be modified. For example, the extension member 126 may be extendible to help provide a desired combination of comfortable heights 138 in both the low profile mode and the upright mode. For example, providing an extendible extension member 126 may allow the height 138 in the upright position to be in a desired range, and may then allow the extension member 126 to be extended to help increase the height 138 between the floor and hand grip 136 in the low profile mode to a desired range (or contracted). The extension of the extension member 126 may be achieved using any suitable mechanism, including configuring the extension member as a telescoping member. In such configurations, the distance between the hand grip and the pivot joint of the handle may be adjusted (see FIGS. 64-71).

Surface Cleaning Head

The following is a description of a surface cleaning head that may be used by itself in any surface cleaning apparatus or in any combination or sub-combination with any other feature or features described herein. For example, any surface cleaning head described herein may be used with any one or more of the moveable wheels, upright section, air treatment member assemblies, carry handles, cyclone configurations, dirt collection chambers, pre-motor filters, suction motors, post-motor filters, cleaning unit air flow ducts, above floor cleaning assemblies, low profile floor cleaning mode, bendable handle, adjustable handles, hose wraps and other features described herein.

In accordance with this embodiment, the surface cleaning head is configured to have a low profile (e.g., it may have a vertical height of less than 6 inches, and more preferably is less than about 4 inches and may be less than 3 inches). Accordingly, the upper and lower surfaces of the surface cleaning head may be generally planar (horizontal) and the suction motor may be provided in the upright section. Rear wheels may be provided which have a large diameter (e.g., larger than or the same height as the surface cleaning head) to enhance stability of the surface cleaning apparatus when in the upright position.

Referring to FIGS. 1, 2, 4 and 5, in the illustrated embodiment, the surface cleaning head 104 has a front end 140, a rear end 142 spaced apart from the front end along central longitudinal axis 144, and laterally spaced apart sides 146. The surface cleaning head 104 is rollable across the floor or surface to be cleaned in a generally forward/rearward direction that is parallel to the longitudinal axis 144, and may also be steerable, e.g., by a steering coupling that connects the push handle/upper section to the surface cleaning head, such that the surface cleaning apparatus 100 is not limited to only linear, forward/rearward movements.

Figure 5:
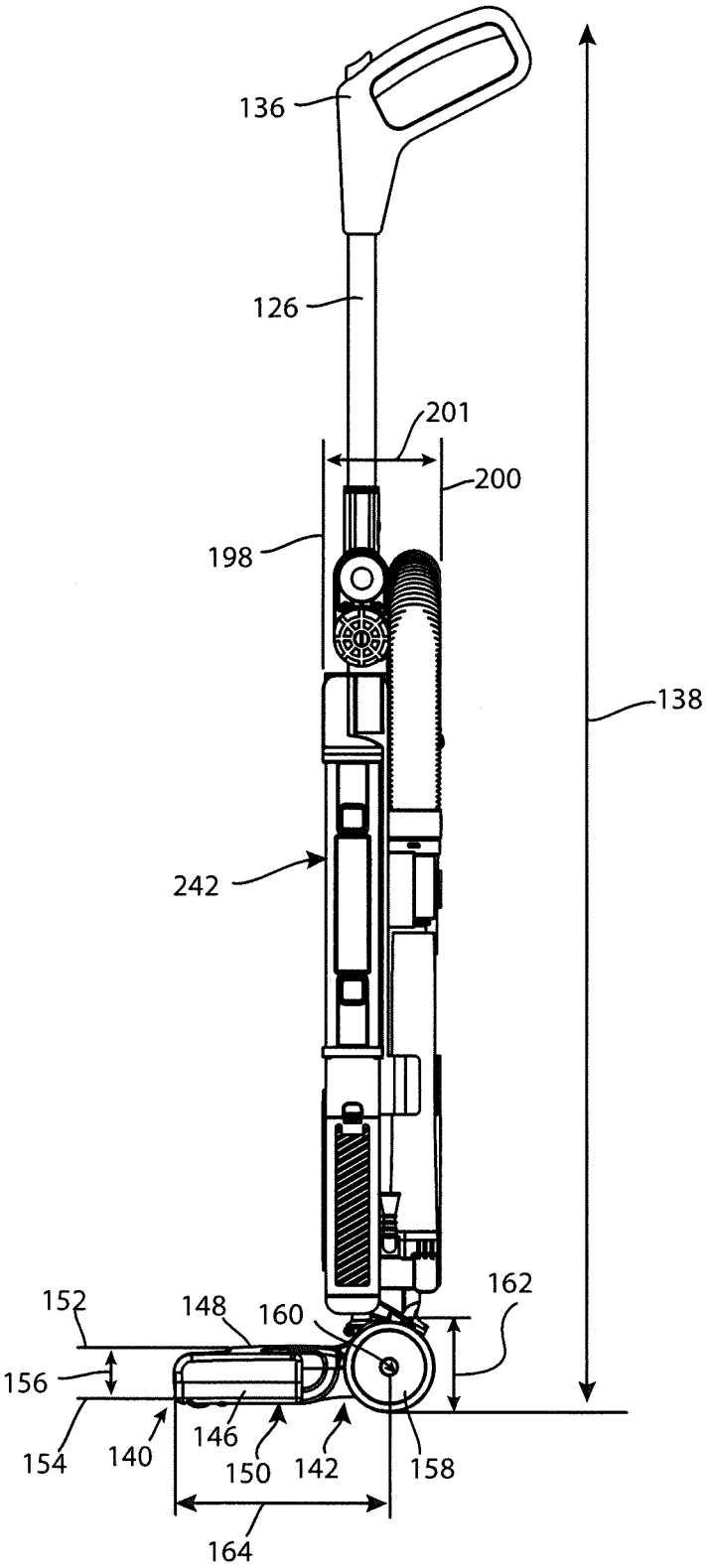
FIG. 5 is a left side view of the surface cleaning apparatus of FIG. 1.
Figure 6:
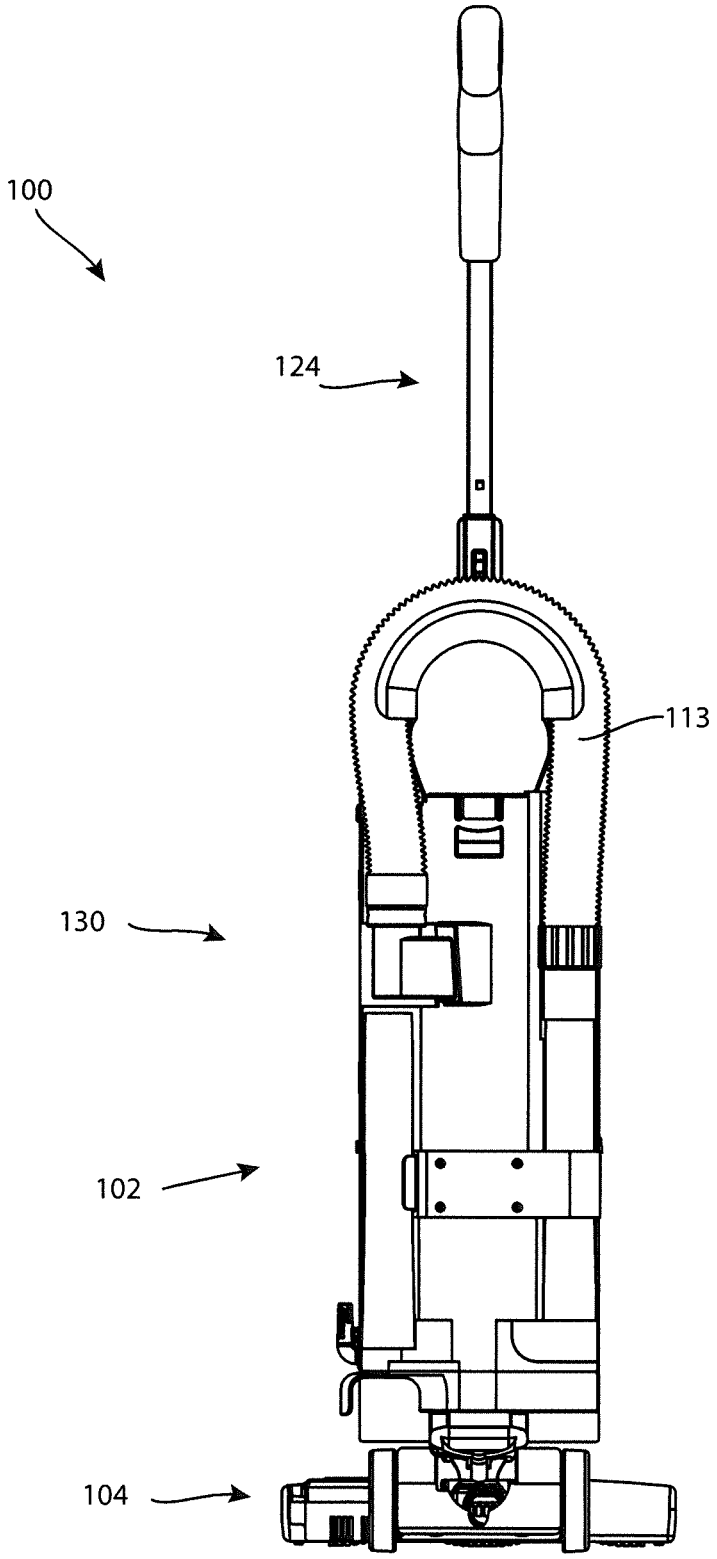
FIG. 6 is a rear elevation view of the surface cleaning apparatus of FIG. 1.

The surface cleaning head 104 also has an upper surface 148 and an opposed lower surface 150 that faces the floor to be cleaned. The upper and lower surfaces 148 and 150 may have any suitable configuration, and in the present embodiment are each optionally configured as substantially flat, planar surfaces. The upper surface 148 lies generally in an upper plane 152, and the lower surface 150 lies generally in a lower plane 154. A vertical distance between the upper and lower planes/surfaces defines a surface cleaning head height 156 (FIG. 5). The height 156 may be any suitable height, and preferably is less than 6 inches, and more preferably is less than about 4 inches and may be less than 3 inches.

Figure 2:
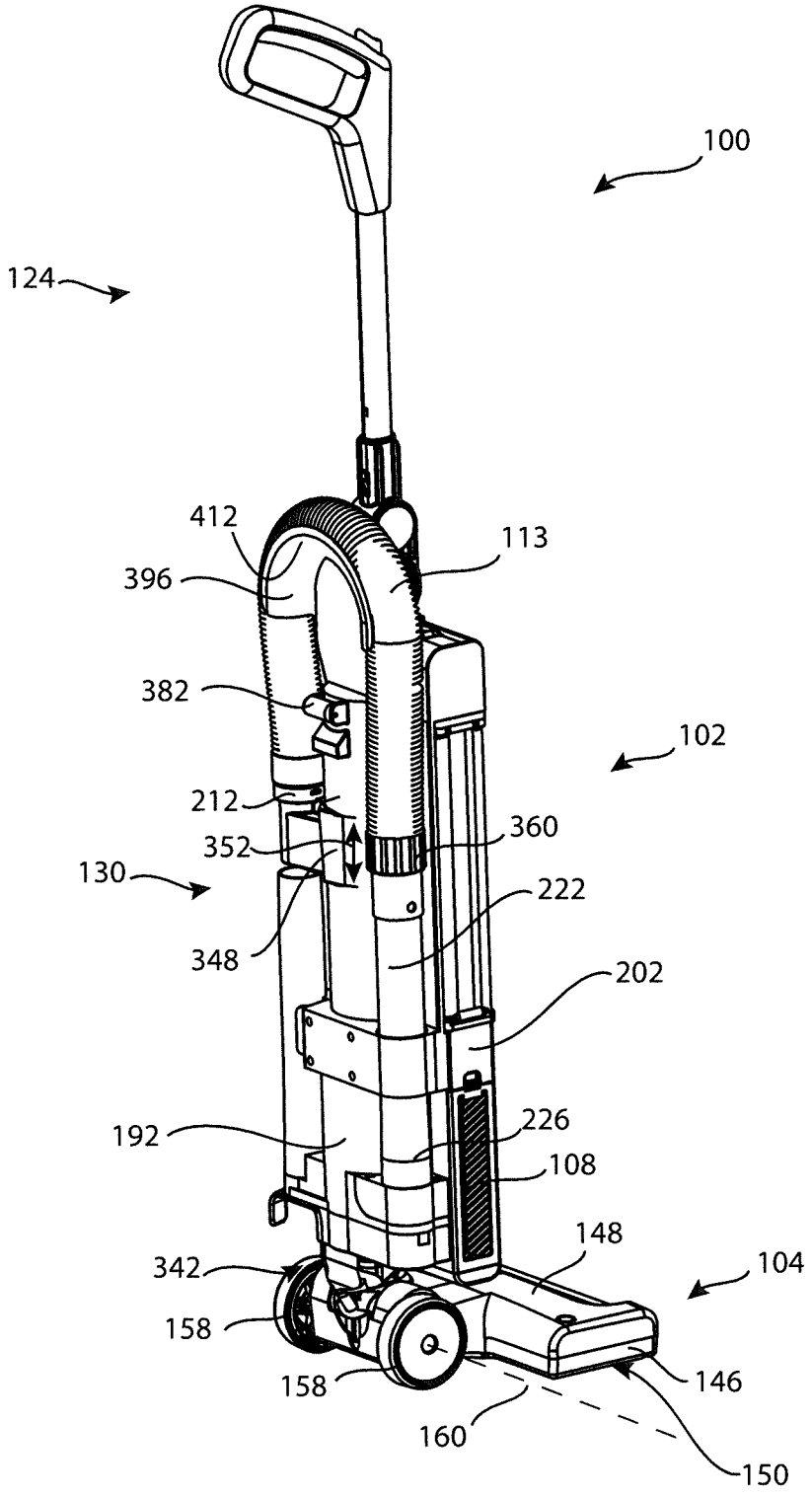
FIG. 2 is a rear perspective view of the surface cleaning apparatus of FIG. 1.

The downward facing dirty air inlet 106 is provided in the lower surface 150, and may be positioned toward the front end 140. Main wheels 158 are provided at the rear end 142 of the surface cleaning head 104, and are rotatable about a laterally oriented rotation axis 160 (FIG. 2). The wheels 158 may have any suitable diameter 162, which may be greater than or about the vertical height 156 of the surface cleaning head 104. The rotation axis 160 of the wheels 158 may be offset from the front end 140 of the surface cleaning head 104 by an offset distance 164 (FIG. 5). This distance may be any suitable distance, and may be selected so that (as illustrated) the wheels 158 extend rearwardly beyond the rear end 142 of the surface cleaning head 104. This may help stabilize the apparatus 100 when in the upright position. This may also help enhance maneuverability of the apparatus 100 when in use. Optionally, as illustrated in these embodiments, the wheels 158 may be positioned such that the rotation axis 160 is positioned below the cleaning unit 130 when the upright section 102 is in the upright, storage position (FIG. 5). In this configuration, the rotation axis 160 underlies the suction motor 112 and portions of the air treatment member assembly 110, including the cyclone chamber 188 and dirt collection chamber 190 (see also FIG. 21). This may help improve the stability of the apparatus 100 when in the storage position.

In addition to the main wheels 158, the surface cleaning head 104 may include one or more additional wheels to help rollingly support the surface cleaning head 104, and the rest of the apparatus 100, above the floor. For example, smaller front wheels may be provided on the lower surface 150, toward the front end 140.

Figure 21:
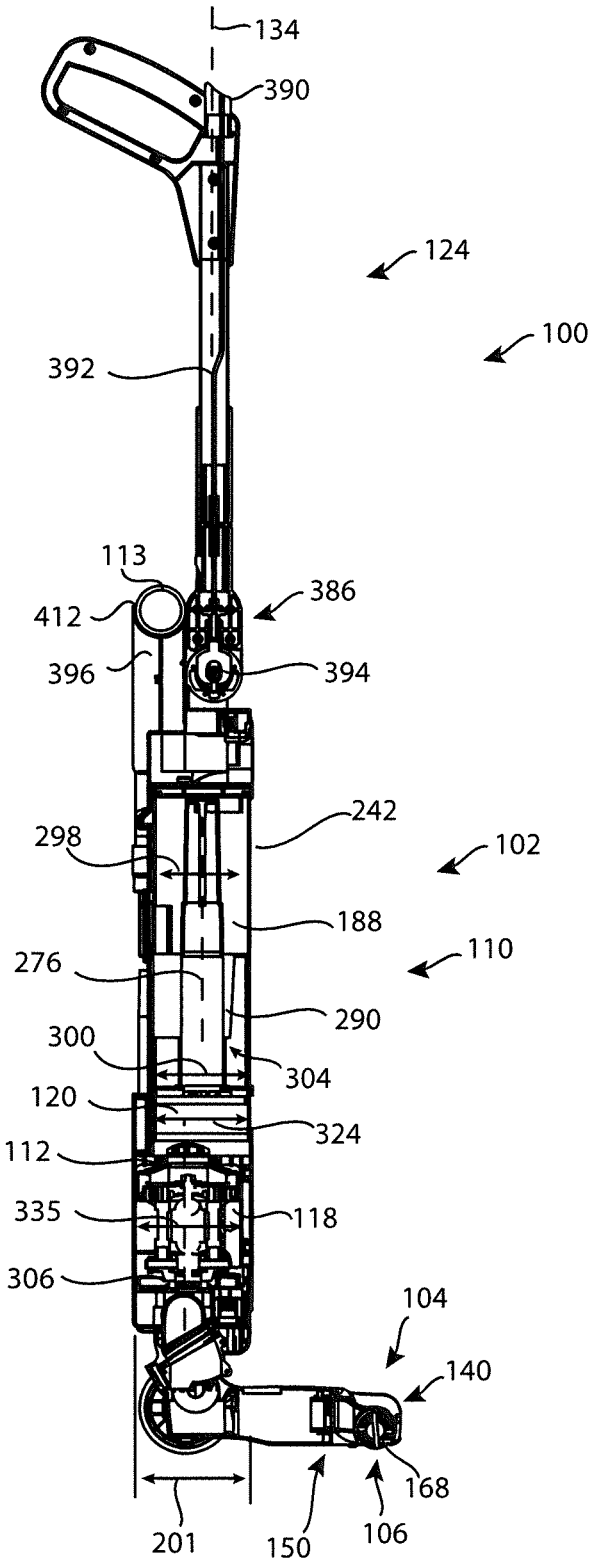
FIG. 21 is a cross-sectional view of the surface cleaning apparatus of FIG. 1, taken along line 21-21 in FIG. 3.

Optionally, the surface cleaning head 104 may include a rotating agitating member, such as a brush 168 and the like, positioned at the dirty air inlet 106 to help dislodge debris from the surface being cleaned (FIG. 21). The agitating member may be any known in the art (e.g., a rotatable brush) and may be driven by an electric motor (optionally positioned within the surface cleaning head 104), an air powered turbine or other suitable mechanism as is known in the art.

The surface cleaning head 104 may be used with a variety of differently configured upright sections 102, including, for example, the embodiments illustrated in FIGS. 42-48 and 49-52. Similarly, a surface cleaning head having a different configuration than the embodiment shown may be used in combination with any of upright sections described herein.

It will be appreciated that, as exemplified, the suction motor may be provided in the upper section. Therefore the height of the surface cleaning head may be reduced as it need not include a suction motor, thereby permitting the height of the surface cleaning head to be reduced and to thereby increase the ability of the surface cleaning head to extend under furniture having a small ground clearance.

Moveable Wheels

The following is a description of moveable wheels that may be used by itself in any surface cleaning apparatus or in any combination or sub-combination with any other feature or features described herein. For example, the movable wheels described herein may be used with any one or more of the surface cleaning head, upright section, air treatment member assemblies, carry handles, cyclone configurations, dirt collection chambers, pre-motor filters, suction motors, post-motor filters, cleaning unit air flow ducts, above floor cleaning assemblies, low profile floor cleaning mode, bendable handle, adjustable handles, hose wraps and other features described herein.

In accordance with this aspect, the surface cleaning head may have rear wheels that are moveable in the rearward forward/direction and/or the lateral direction. The movement may be automatic upon reconfiguring the surface cleaning apparatus between different operating positions.

For example, the rear wheels may be extended when the upright section is placed in a storage position so as to enhance stability. Alternately or in addition, the rear wheels may be moved laterally inwardly in the floor cleaning position so as to enhance maneuverability.

Optionally, the offset distance 164 may be variable and/or adjustable (automatically as the configuration and/or operating mode of apparatus 100 is adjusted, or manually by a user, or a combination of both). In such embodiments, the wheels 158 may be in one location when the upright section 102 is in the upright configuration and a different position when the upright section 102 is in the use configuration. Optionally, the wheels 158 may be moved in the forward/rearward direction (thereby changing the offset distance 164) and/or the lateral spacing between the rear wheels may also be adjusted. This may allow the wheel position, balance and/or handling of the apparatus 100 to be adjusted.

Accordingly, the rear wheels may be biased to a forward position and the upper section may be drivingly connected to the rear wheels so as to move the rear wheels rearward when the upper section is moved to the upright configuration. Alternately, the rear wheels may be biased to a rearward position and the upper section may be drivingly connected to the rear wheels so as to move the rear wheels forward when the upper section is moved to the inclined floor cleaning position.

Figure 58:
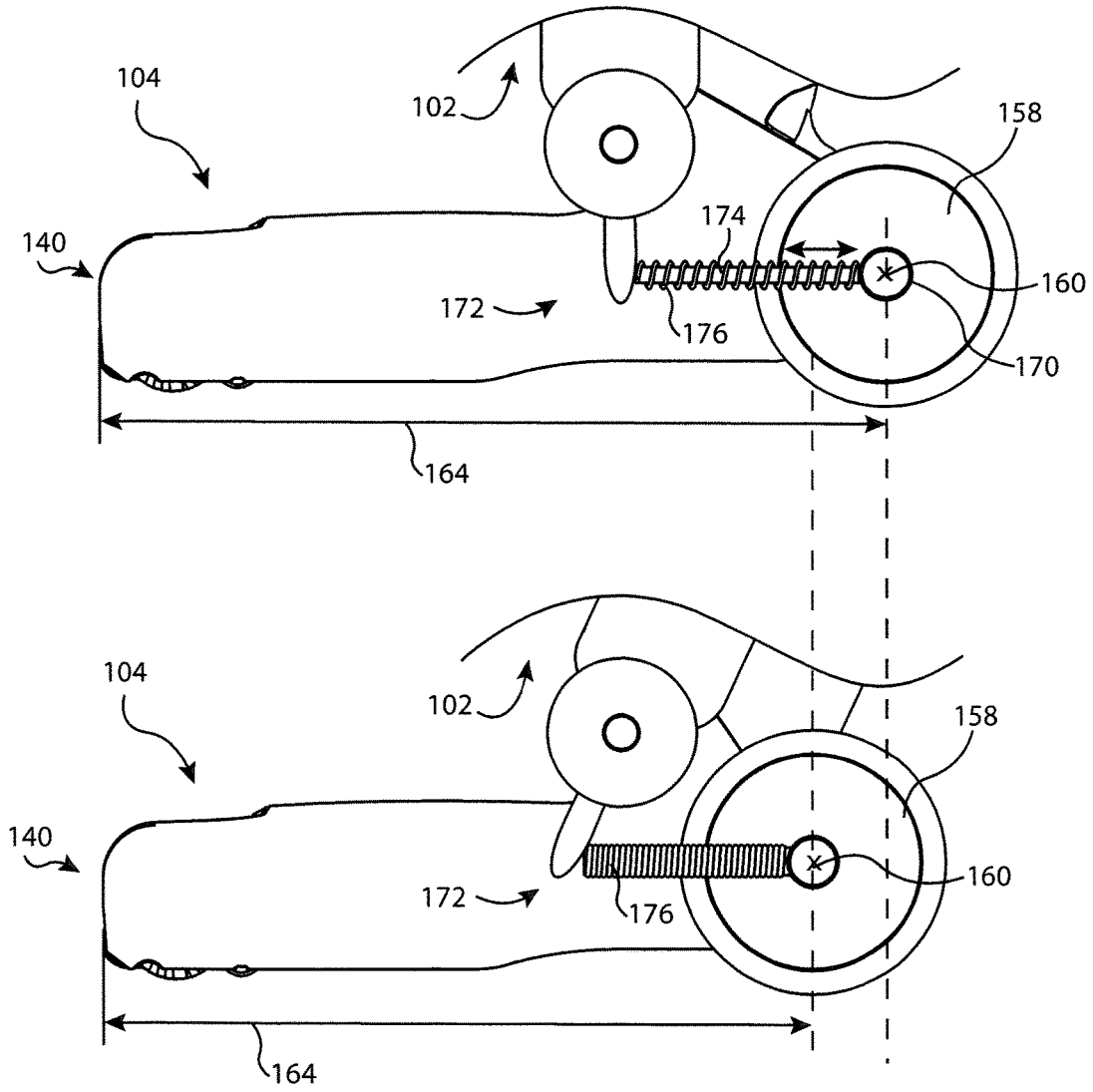
FIG. 58 is a schematic illustration of another embodiment of a surface cleaning head for use with a surface cleaning apparatus.

For example, referring to FIG. 58, one embodiment of a wheel deployment mechanism is schematically illustrated. In this embodiment, the axle 170 supporting the rear wheel 158 is translatable in the forward/rearward direction (for example slidable within a slot). A linkage 172 between the upright section 102 and the axle 170 is provided, such that moving the upright section 102 relative to the surface cleaning head 104 translates the axle 170 in the forward/rearward direction. As illustrated, when the upright section 102 is moved into the upright position, a rod 174 is driven backwards and pushes the axle 170 rearward. This may increase the stability of the apparatus 100 when the upright section 102 is in the upright position. When the upright section 102 pivots to the inclined floor cleaning position, the rod 174 is pulled forwardly and/or may be moved forwardly by a biasing member 176 (e.g., the rod may be biased to the forward position by a spring or the like). This may enable axle 170 to move forwardly. Moving the rear wheels forwardly may increase the maneuverability of the surface cleaning head 104 when a push handle is used to drive the surface cleaning head.

Figure 59:
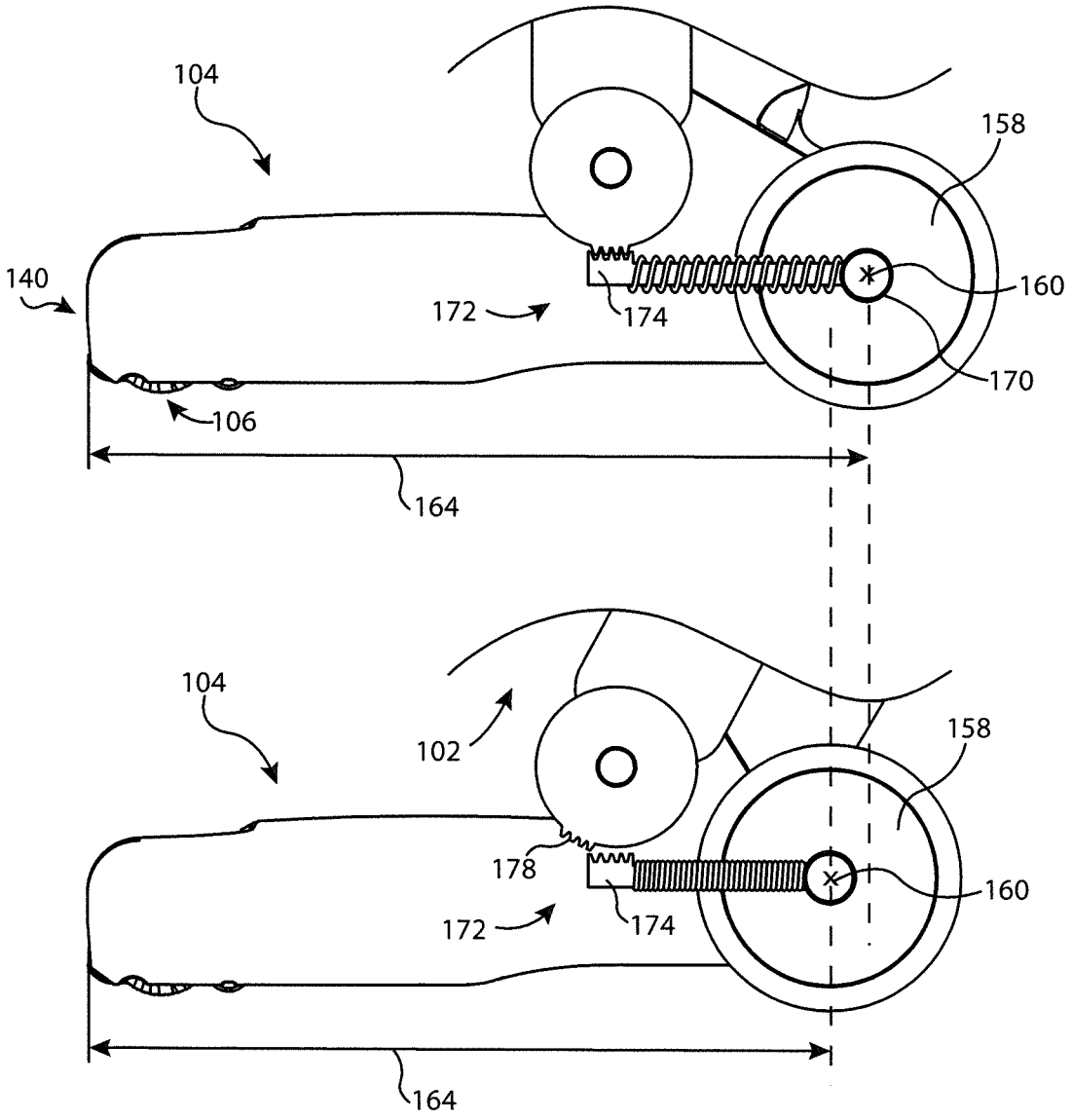
FIG. 59 is a schematic illustration of another embodiment of a surface cleaning head for use with a surface cleaning apparatus.
Figure 60:
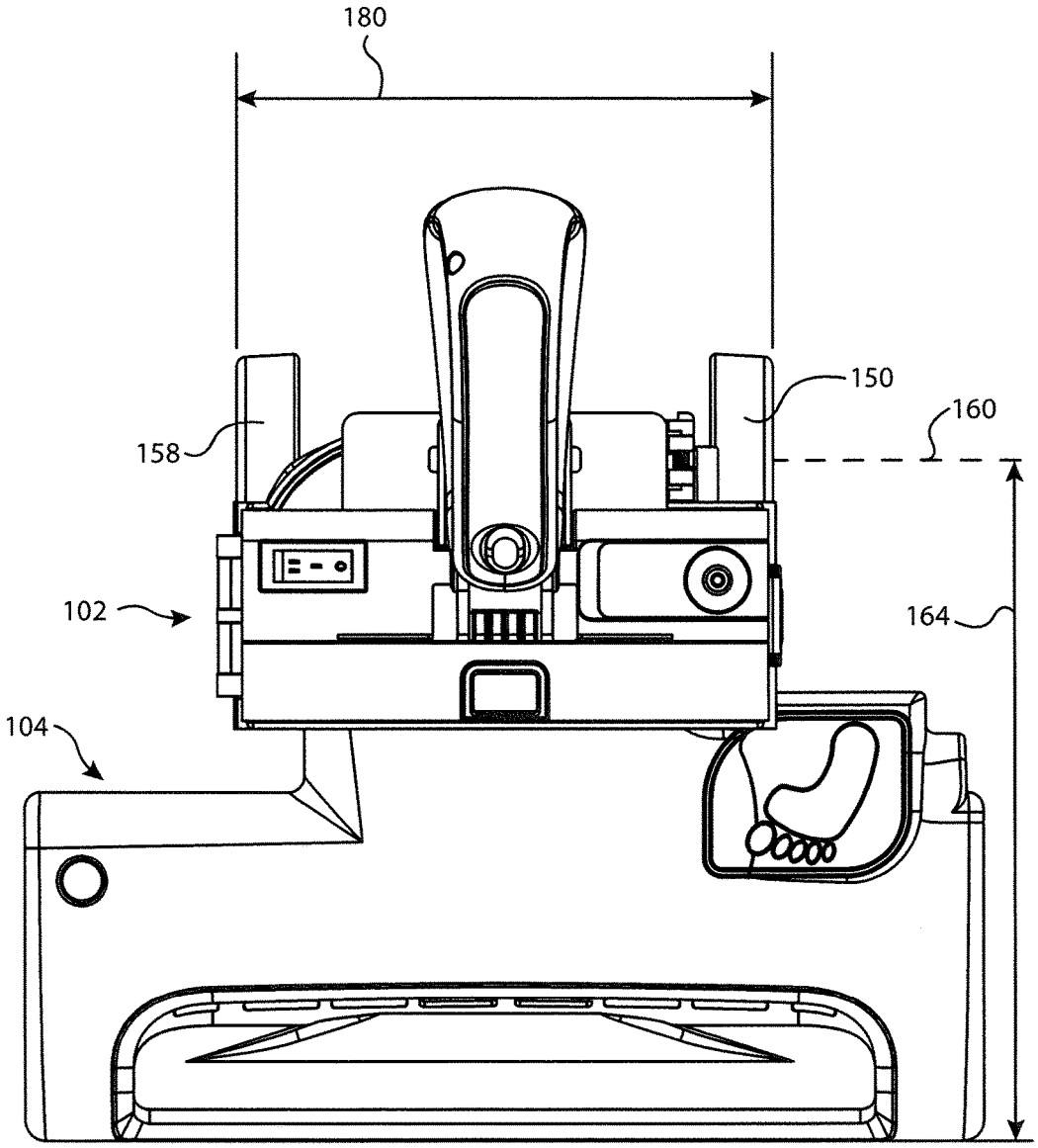
FIG. 60 is a top view of another embodiment of a surface cleaning apparatus with wheels in a first position

An alternative embodiment of a linkage 172 is illustrated in FIG. 59, in which gear teeth 178 on the upright section 102 engage complimentary teeth on a linkage rod 174 and urge it backward when the upright section 102 is in the upright position. When the upright section 102 is inclined, the teeth 178 disengage, and a biasing spring 176 urges the axel 170 forwardly. In an alternate embodiment, it will be appreciated that the teeth 178 may drive rod both forward and rearward without any biasing member being required.

Alternatively, instead of being linked to movement of the upright section 102, the apparatus may be manually adjustable by a user, such that a user can manually select the forward/rearward position of the wheels 158.

Figure 61:
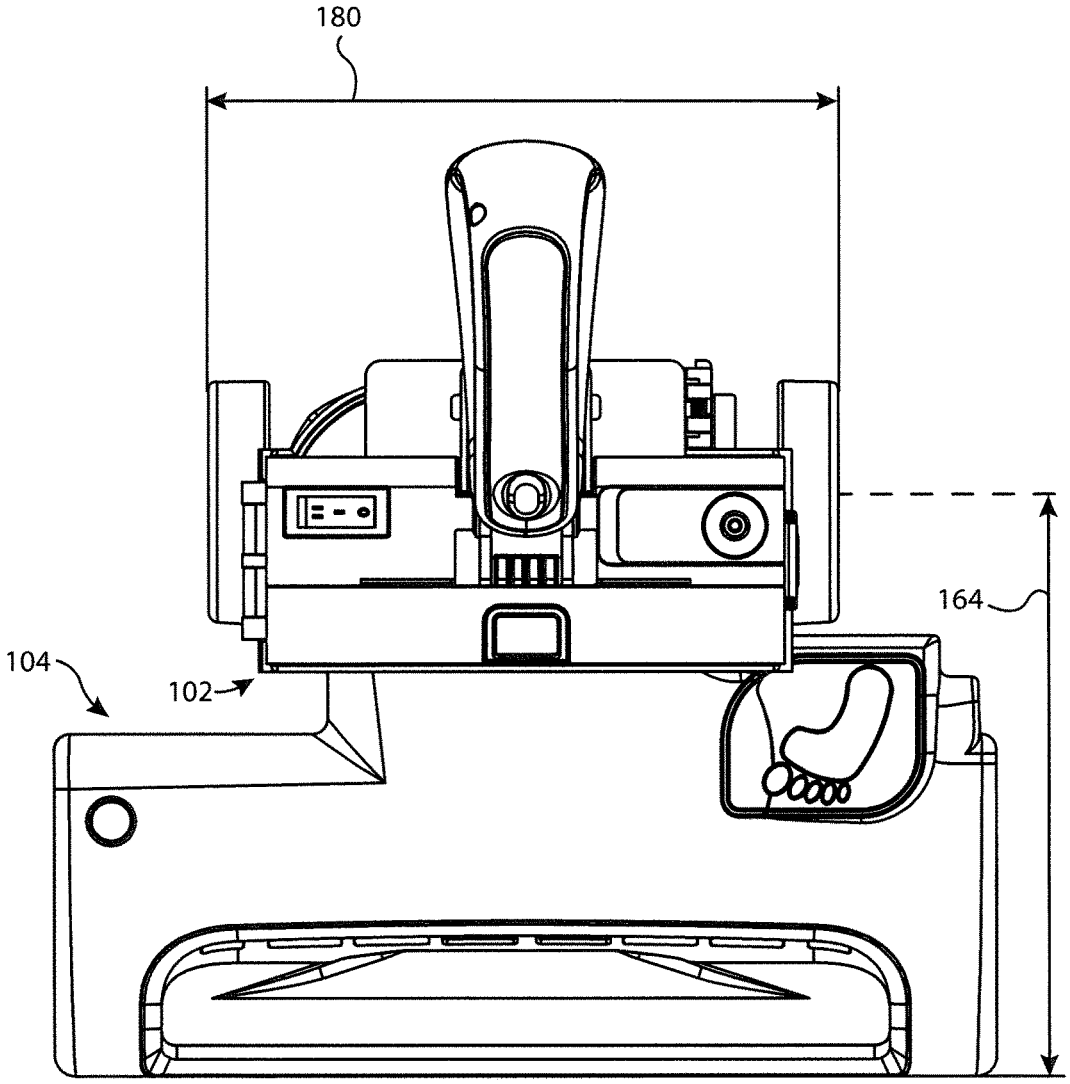
FIG. 61 is the top view of FIG. 60, with the wheels in a second position.
Figure 62:
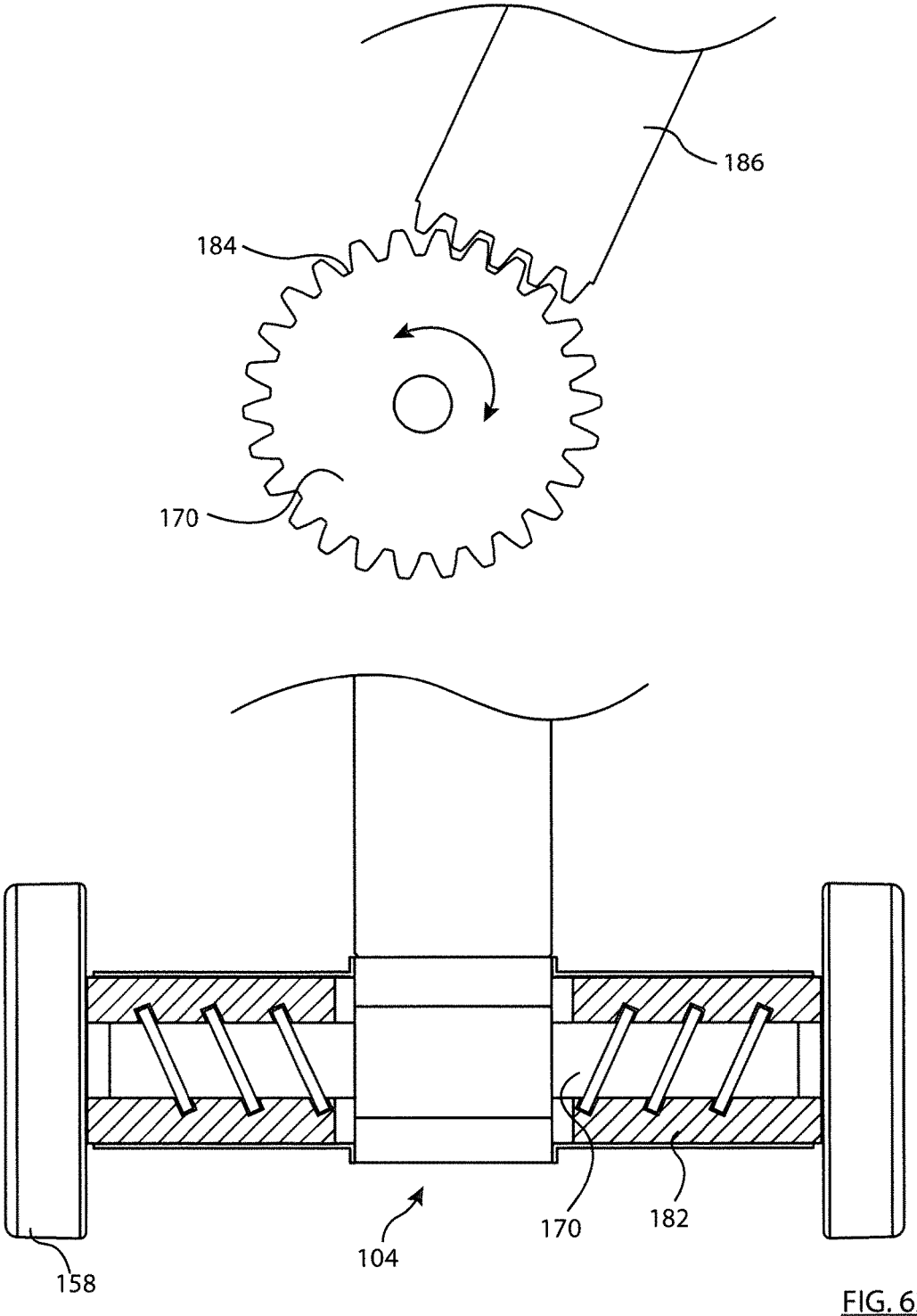
FIG. 62 is a schematic illustration of wheels for use with a surface cleaning apparatus in a first position.
Figure 63:
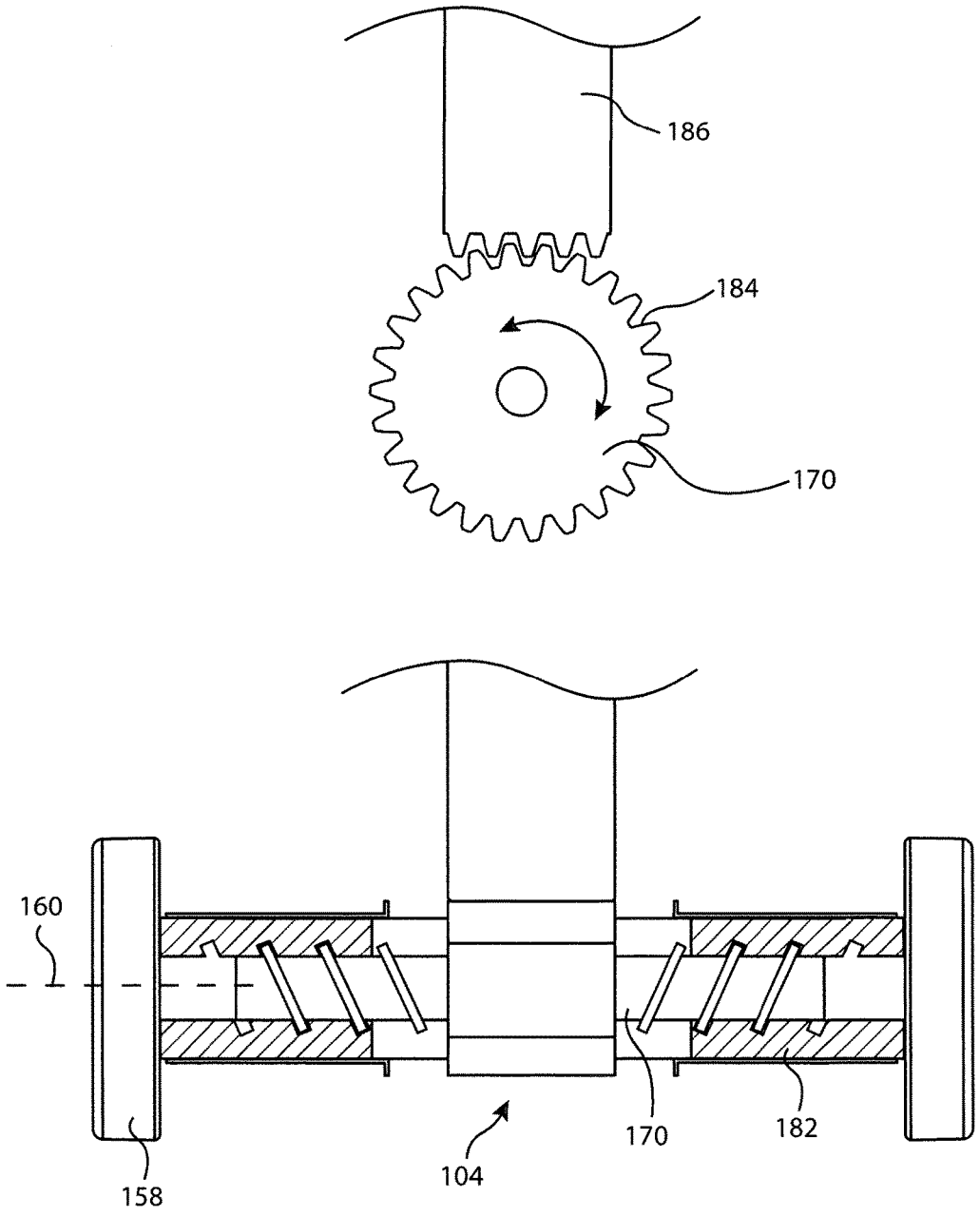
FIG. 63 is a schematic illustration of wheels for use with a surface cleaning apparatus in a first position.

FIGS. 60-63 schematically illustrate an example of an apparatus 100 that can adjust the lateral spacing 180 of the rear wheels 158, from a relative narrow spacing (FIG. 60) to a relatively wider spacing (FIG. 61). This may also optionally be used in combination with the mechanisms for adjusting the forward/rearward position of the wheels. As illustrated in FIGS. 62 and 63, the wheels 158 may be supported on threaded sleeves 182 that can threadingly engage a threaded axel 170. Rotating the sleeves 182 and axles 170 relative to each other causes the sleeves 182 to translate axially along the axis 160, thereby changing the lateral wheel spacing 180. The axle 170 may be rotated using any suitable mechanism, including providing teeth 184 on the axle 170 and using a driving member 186 associated with the upright section 102 for engaging the teeth 184. The driving 186 member may be independently operable, or may be linked to the movement of the upright section 102 relative to the surface cleaning head 104. The wheels 158 may be configured to be moveable only in the lateral direction, only in the forward rearward direction, a combination of both types of movement and/or need not be movable at all.

Upright Section

The following is a description of an upright section that may be used by itself in any surface cleaning apparatus or in any combination or sub-combination with any other feature or features described herein. For example, the upright section described herein may be used with any one or more of the surface cleaning head, moveable wheels, air treatment member assemblies, carry handles, cyclone configurations, dirt collection chambers, pre-motor filters, suction motors, post-motor filters, cleaning unit air flow ducts, above floor cleaning assemblies, low profile floor cleaning mode, bendable handle, adjustable handles, hose wraps and other features described herein.

In accordance with this aspect, the components of the upright section may be arranged to reduce the depth (front to back) of the upright section. It will be appreciated that if the upright section includes a bendable wand such that the surface cleaning apparatus may be reconfigured into the low profile floor cleaning mode of FIG. 12, then the depth of the handle does not affect the extent to which the upright section below the bendable portion of the handle can extend under furniture. In such a case, the components of the upright section may be arranged to reduce the depth (front to back) of the cleaning unit. For example, the dirt collection region may be positioned such that it is not located in front of the air treatment member. Alternately or in addition, the dirt collection region may be positioned such that it is not located behind the air treatment member. For example, as exemplified in FIG. 18, the dirt collection regions are positioned such that the depth of the air treatment member is the diameter of the cyclone chamber. The dirt collection regions are exemplified as having a greater lateral extent then depth such that they have a rear side that is recessed inwardly (forwardly) compared to the rearward extent of the cyclone chamber. Recessing the rearward side of the dirt collection regions inwardly provides, as exemplified, two recesses in which air flow passages, accessory tools or the like may be positioned. If the components positioned in the recesses do not extend rearward of the rearward extent of the cyclone chamber, then the maximum depth of the upright section that houses the cleaning unit may be the depth of cyclone chamber (i.e. the air treatment member). If the components positioned in the recesses do extend rearward of the rearward extent of the cyclone chamber, then the maximum depth of the upright section that houses the cleaning unit will increase but will still be reduced due to the recessing of the rearward side of the dirt collection regions.

It will be appreciated that some of the dirt collection regions may be forward and/or rearward of the air treatment member however this amount is preferably minimized. For example, at least 60%, 70%, 80%, 90% or more of the dirt collection regions is laterally spaced from the air treatment member. It will also be appreciated that the shapes of the dirt collection regions may be varied but still provide one or more recesses for receiving components of the surface cleaning apparatus.

In the illustrated embodiments (see FIGS. 1-25, 26-29, 42-48, 49-52 and 53-57, the upright section 102 includes a cleaning unit 130 and a push handle 124. The cleaning unit 130 includes the air treatment member assembly 110, which is exemplified as a cyclone bin assembly. It will be appreciated that any other air treatment member know in the surface cleaning arts may be used. Referring to FIGS. 7, 8, 22, 30, 34, 35-41, 45, 52 and 77-85 examples of cyclone bin assemblies wherein the air treatment member 114 is in the form of one of more cyclonic cleaning stages. Each cyclonic cleaning stage may comprise one or more cyclones in parallel. As exemplified, each cyclonic cleaning stage may comprise a single cyclone. Accordingly, there may be a single cyclonic cleaning stage comprising a single cyclone chamber 188, or two cyclonic cleaning stages, with the first stage comprising a single cyclone chamber 188 and the second cyclonic cleaning stage comprising second cyclone chamber 188*a*. Each cyclonic cleaning stage may comprise an external dirt collection chamber. As exemplified, the first cyclonic cleaning stage comprises a dirt collection region 116 in the form of a dirt collection chamber 190 that is external to and in communication with the cyclone chamber 188, and the second cyclonic cleaning stage comprises a second dirt collection chamber 190*a* that is external to and in communication with the second cyclone chamber 188*a*, and is optionally be isolated from the dirt collection chamber 190.

The cleaning unit 130 may also include one or more of a lower housing 192 that houses the pre-motor filter 120 in a pre-motor filter chamber 194, the suction motor 112 in a motor housing portion and an optional post-motor filter 122 in a post-motor filter chamber 196. The cleaning unit 130 may also include the clean air outlet(s) 108.

In these embodiments, the lower housing 192 is vertically aligned with the air treatment member and is exemplified as being positioned beneath the air treatment member assembly 110, and underlies the air treatment member assembly 110. It will be appreciated that in alternate embodiments, housing 192 may be positioned above and overlying the cleaning unit 130.

As exemplified, the suction motor 112 is positioned below the air treatment member assembly 110. It will be appreciated that the suction motor 112 may be positioned below and underlie some or all of the cyclone chamber 188, the dirt collection chamber 190 or some or all of both the cyclone chamber 188 and the dirt collection chamber 190.

As exemplified in FIGS. 2E, 4, 11 and 20, the cleaning unit 130 has a low-profile, slab-like configuration. In this embodiment, the cleaning unit 130 has a generally flat front face that defines a front plane 198 (FIG. 5), and a rear face that is bounded by rear plane 200. In the illustrated example, the rear plane 200 is generally parallel to and offset from the front plane 198. The planes 198 and 200 are spaced apart from each other in the forward/rearward direction by a cleaning unit depth 201, which in the illustrated embodiments is the maximum depth of the cleaning unit 130, and the maximum depth of the portions of the upright section 102 that are likely to be moved beneath furniture or other obstacles. In addition to the front and rear faces, the cleaning unit has opposing side faces 203 that are, in the illustrated embodiment, generally planar and lie in planes 202 (FIG. 3) that are generally parallel to each other and orthogonal to the front and rear planes 198, 200.

Figure 22:
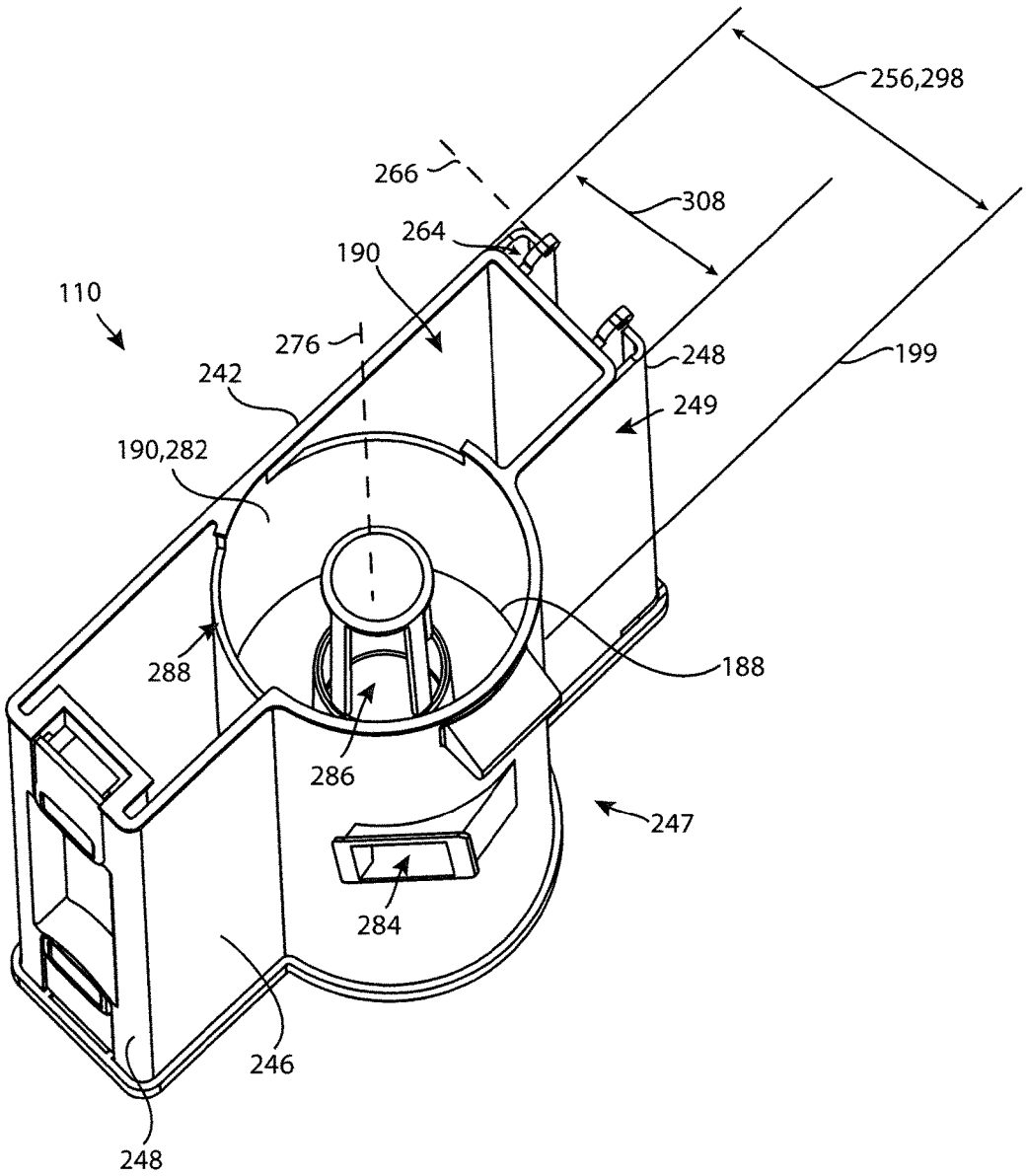
FIG. 22 is a top perspective view of a portion of the air treatment member assembly with the lid removed.

Optionally, the air treatment member assembly 110 may also be configured to have a low-profile, slab like configuration. Referring to FIGS. 11 and 22, in this embodiment, air treatment member assembly 110 has a generally flat front face 242 (see also FIGS. 9-11 and 22) which lies in the front plane 198 when the air treatment member assembly 110 is mounted on the cleaning unit 130. The air treatment member assembly 110 also has a rear face 246 that is formed by a centrally positioned cyclone chamber 188 and a dirt collection region 116 on each lateral side thereof. In this embodiment, a rear plane 199 (FIGS. 18 and 22) is located forward of the rearward extent of the cleaning unit 130 but may alternately be located at or essentially at plane 200. In this case rear plane 199 is at the rearward extent of the cyclone chamber 188, and is generally parallel to and offset from the front face 242 and front plane 198. The front face 242 and rear plane 199 are spaced apart from each other in the forward/rearward direction by an air treatment member assembly depth 256, which in the illustrated embodiments is the maximum depth of the cyclone chamber 188. In addition to the front 242 and rear faces 246, the cleaning unit has opposing side faces 248 (FIG. 22) that are, in the illustrated embodiment, generally planar and lie in planes 202 when the air treatment member assembly 110 is mounted to the cleaning unit. The side faces 248 are illustrated as being generally orthogonal to the front face 242, but may have other configurations.

As exemplified in FIGS. 11 and 22, the cyclone chamber 188 may extend rearwardly of dirt collection regions 116, so as to define a generally rounded protrusion 247 extending in the direction of cleaning unit axis 204, which may also define an air treatment member assembly axis. Accordingly, the first and second laterally opposed sides 248 and the front side 242 of the air treatment member assembly 110 are generally rectangular in top plan view when the upright section is in the upright position. Alternately, or in addition, the protrusion 247 may be on the front side and/or the front and rear sides of the cyclone assembly. The protrusion 247 may extend the entire length/height of the air treatment member assembly 110 in the axial direction, or may only extend along a portion of the length of the air treatment member assembly 110. Accordingly, other than the optional protrusion, the air treatment member assembly 110 has a generally rectangular perimeter and/or cross-sectional shape, taken in a plane that is orthogonal to a cleaning unit axis 204 (i.e. in a top plan view). This configuration may be selected to be complimentary with the shape of the cleaning unit 130, so that when the air treatment member assembly 110 is mounted to the cleaning unit 130 the planes 198, 200 and 202 define or essentially define the limits of the cleaning unit 130 and provide a generally rectangular perimeter and/or cross-sectional shape taken in the plane that is orthogonal to the cleaning unit axis 204.

The cleaning unit 130 also has an upper end 206 and an opposed lower end 208. The upper and lower ends 206 and 208 may have any suitable configuration. As exemplified, the lower end 208 may have a generally flat lower face 210 that is orthogonal to the front and rear planes 198, 200 so as to seat on the lower housing 192 and provide a seal.

Optionally, the air treatment member assembly 110 may be part of the structural connection of push handle 124 to the surface cleaning head. Accordingly, the air treatment member assembly 110 may provide substantially the entire upper end 206 of the cleaning unit 130. For example, the push handle 124 may be mounted to the air treatment member assembly 110 and the cleaning unit 130 may be moveably mounted to the surface cleaning head (e.g., it may be mounted to a pivotally mounted up flow duct. In such a case, the dirt collection region(s) may be removable from the cleaning unit 130 for emptying.

Alternately, the air treatment member assembly 110 may be supported by components of the cleaning unit 130 and/or upright section 102 (e.g. lower housing 192 and support structure 212) so as to be removable from the upright section to enable the dirt collection regions to be emptied. As exemplified, the upright section comprises an upwardly extending support structure 212 (FIGS. 2, 2B-2E, 10, 11, 42, 50) that provides a structural connection between the lower housing 192 and the handle 124. Optionally, support structure 212 may support or assist in supporting the air treatment member assembly 110 and the air treatment member assembly 110 may be releasably securable thereto.

The support structure 212 may be of any configuration and may comprise one or more vertically extending members (e.g., struts 214), which may be connected to each other by a connecting web 215 and may provide rigidity such that push handle 124 may be used to drive the surface cleaning head 104. For example, the support structure may be moveably mounted to the surface cleaning head 104 and provide a structural support for lower housing 192 and air treatment member assembly 110. An upper portion of the support structure 212 may be connected to the handle 124. It will be appreciated that if air treatment member assembly 110 is support by support structure 212, that handle 124 may be mounted to the air treatment member assembly 110. In such a case, the dirt collection region(s) may be removably mounted to the air treatment member assembly 110 for emptying. Alternately, lower portion 192 may itself be mounted to the surface cleaning head 104 and support structure 212 may extend along the length of the cleaning unit. In such a case, the upper portion of the support structure 212 may be connected to the handle 124 or the push handle 124 may be mounted to the air treatment member assembly 110.

In any such embodiment, the vertically extending members may extend generally upwardly along one of the front and rear side, preferably the rear side 246, of the air treatment member assembly 110. As exemplified, struts 214 may be provided at least partially recessed within the recesses 249 (FIGS. 2E, 18, 22 and 23) created by recessing the dirt collection regions 116 forward of the rearward extent of the cyclone chamber 188 and plane 199. It will be appreciated that the struts 214 may be fully recessed such that they do not extend rearward of plane 199. By recessing a portion of the struts 214, the overall depth of the portion of the upright section 102 that extends along the air treatment member assembly 110 may be reduced.

In the illustrated embodiment, the struts 214 are configured as generally flat, plates that have a width 251 (FIG. 2C) in the lateral direction that is much greater than their depth (i.e. wall thickness 253) in the forward/rearward direction (which in this embodiment is the thickness of the plate forming the strut 214). Alternatively, the struts 214 may have other configurations.

Optionally, while the struts 214 are nested with the air treatment member assembly 110, a portion of support structure 212, such as the connecting web 215 may extend rearwardly of plane 199. The connecting web 215 may be configured to have a relatively thin depth in the forward/rearward direction, to help reduce the overall thickness of the cleaning unit 130, and in the illustrated example has the same wall thickness 253 as the struts 214. Optionally, the connecting web 215 may extend along the rear side of the protrusion 247 and may be positioned between the cyclone chamber 188 and the rear plane 200. Preferably, the connecting web 215 is located immediately at rear plane 199.

By connecting push handle 124 to an upper end of support structure 212, the air treatment member assembly 110 may be removeable from the cleaning unit 130 (FIGS. 10 and 11) without requiring removal of the handle 124, support structure 212, lower housing 192 or other portions of the cleaning unit 130. This may also eliminate the need for the air treatment member assembly 110 to be a load bearing member, which may help simplify its construction and may allow for a lighter weight construction. For example, as exemplified in FIGS. 4, 10 and 11, the support structure 212 includes the laterally spaced apart struts 214, and a cross-member 216 that extends laterally between the upper ends of the struts 214 to support the handle 124. Optionally, as shown in the illustrated embodiments, the cross-member 216 may also include one or more functional components of the apparatus 100, such as a power button 219 (FIG. 4) for controlling the suction motor 112. Alternatively, the power button 219 may be located at another location, including on the handle 124, possibly on the hand grip 136, on the surface cleaning head 104, other portions of the cleaning unit 130 and the like.

Optionally, the region between the struts 214 may be open, i.e. substantially free of connecting walls or structures, such that the rear sides of the air treatment member assembly 110 is exposed when seated on the cleaning unit 130. This may help reduce the weight of the cleaning unit 130. Alternatively, as illustrated in the embodiment of FIGS. 2B-E and 18, the support structure 212 may include the connecting web 215 that spans between the struts 214. The connecting web 215 may help provide structural strength, and may provide a location to anchor the downstream end of the hose 113, and may support the transition member 344, further described herein, that provides air flow communication between the hose 113 and the air treatment member assembly 110. Alternatively, if the region between the struts 214 is open, the transition member 344 may be cantilevered from one of the struts 214 to be positioned adjacent the air treatment member assembly 110 inlet 284.

Figure 2A:
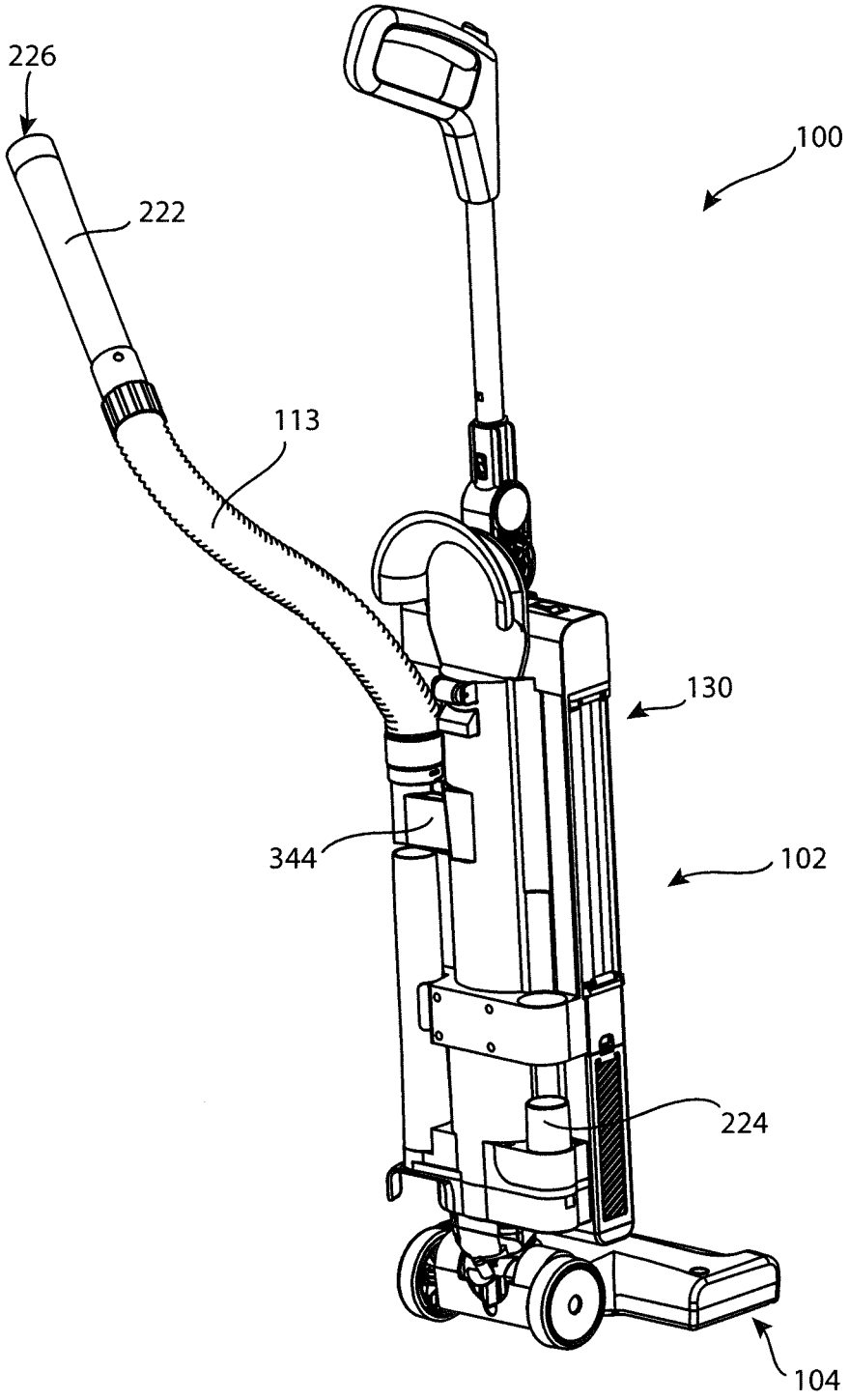
FIG. 2A is a rear perspective view of the surface cleaning apparatus of FIG. 1, in an above floor cleaning mode.
Figure 2B:
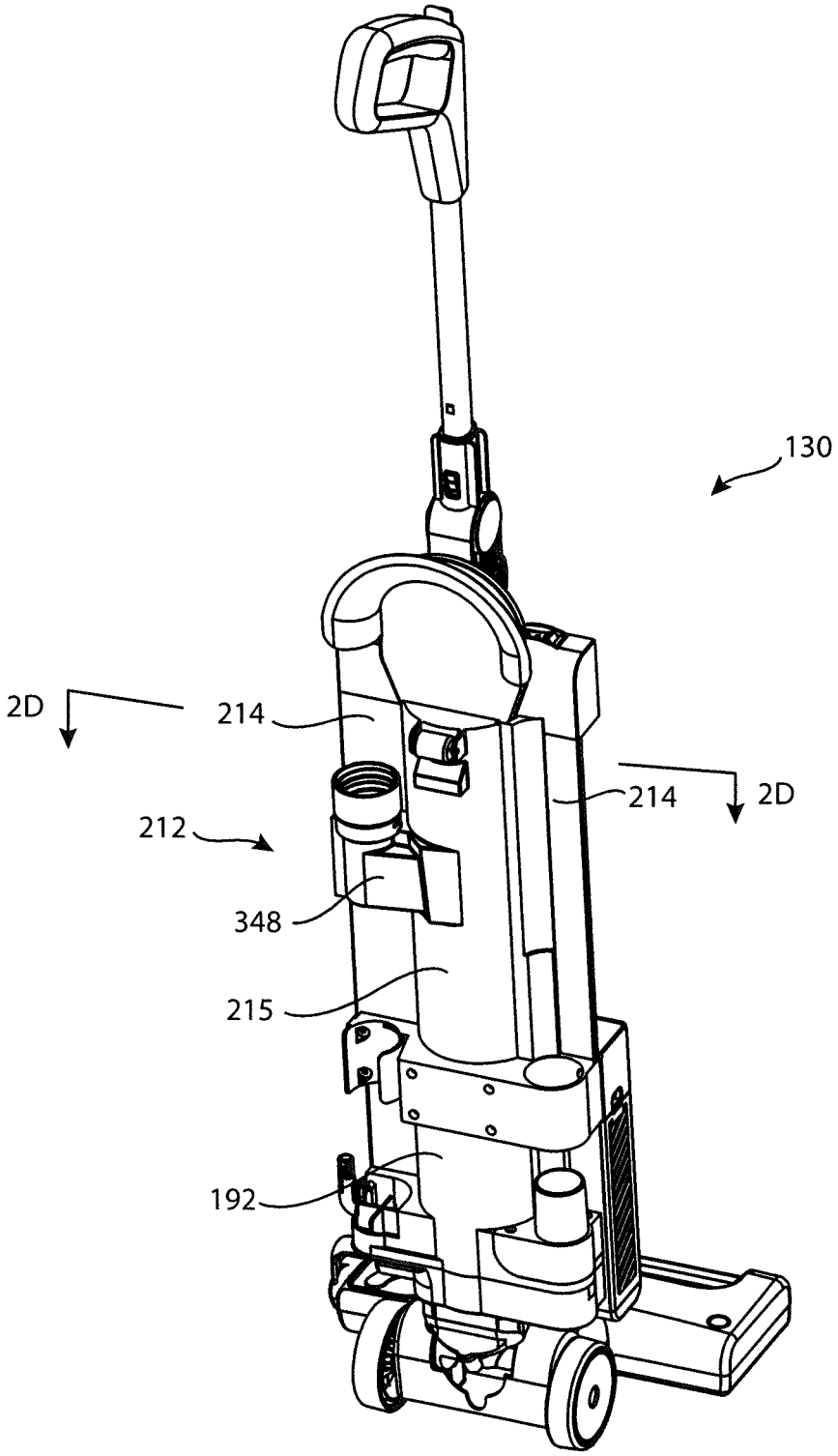
FIG. 2B is a rear perspective view of the surface cleaning apparatus of FIG. 1, with the air treatment member assembly, hose and wand removed.
Figure 2C:
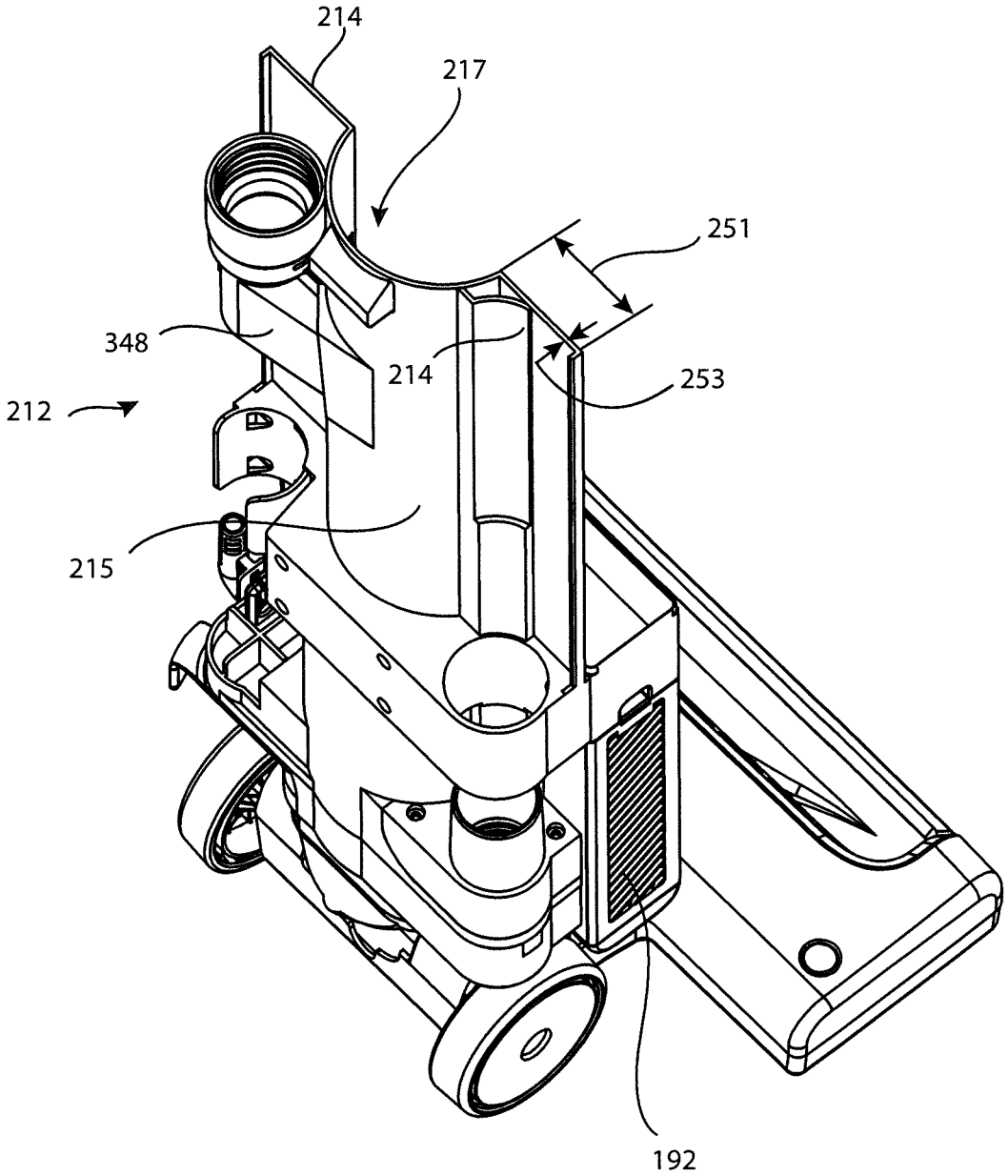
FIG. 2C is a perspective view from the rear and above of a cross-sectional of the surface cleaning apparatus of FIG. 2B, taken along line 2D-2D.
Figure 2D:
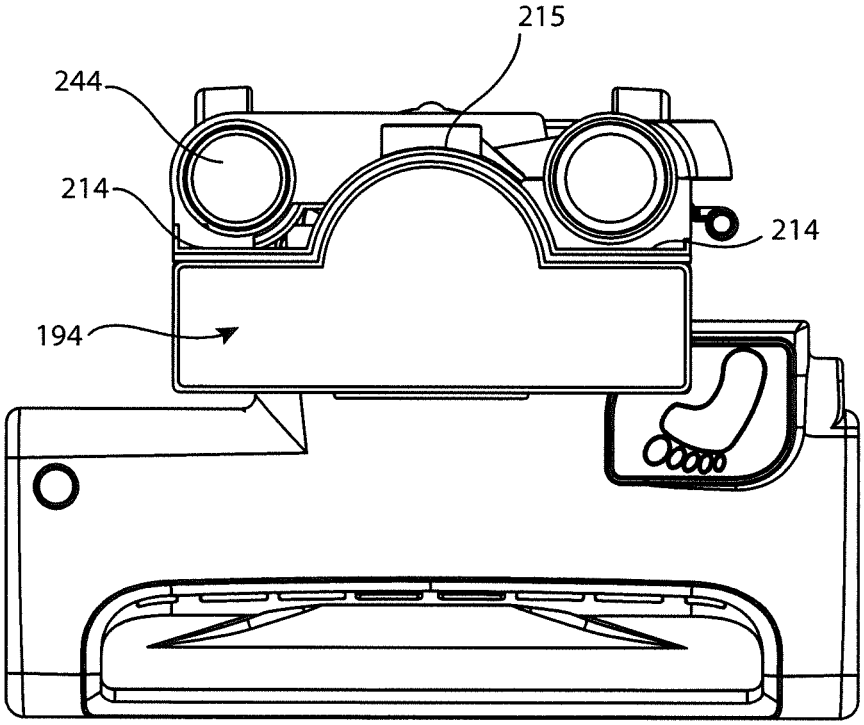
FIG. 2D is a top plan cross-sectional view of a portion of the surface cleaning apparatus of FIG. 2B, taken along line 2D-2D.
Figure 2E:
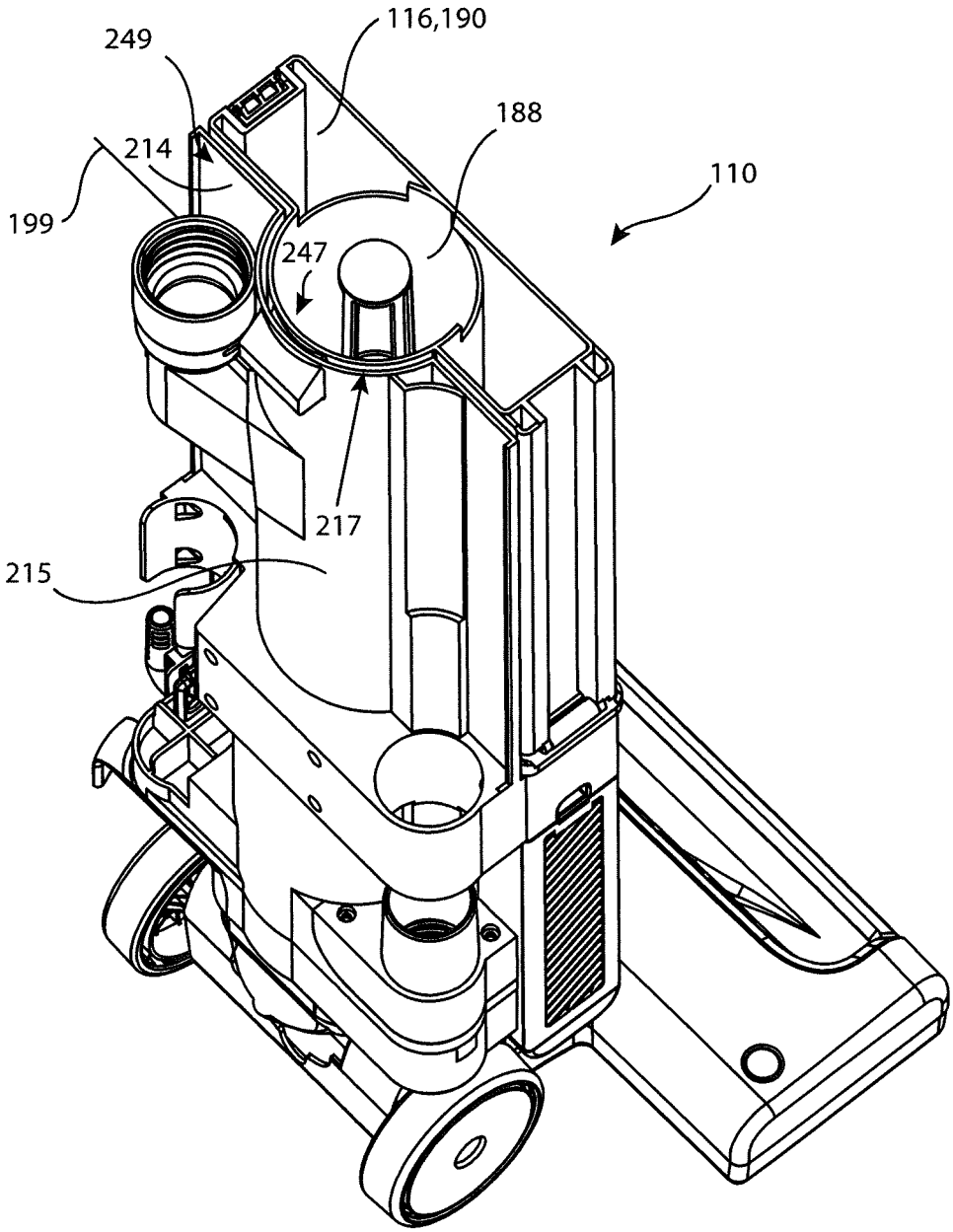
FIG. 2E is a perspective view from the rear and above of the cross-sectional view of FIG. 2D, with the air treatment member assembly attached.
Figure 3:
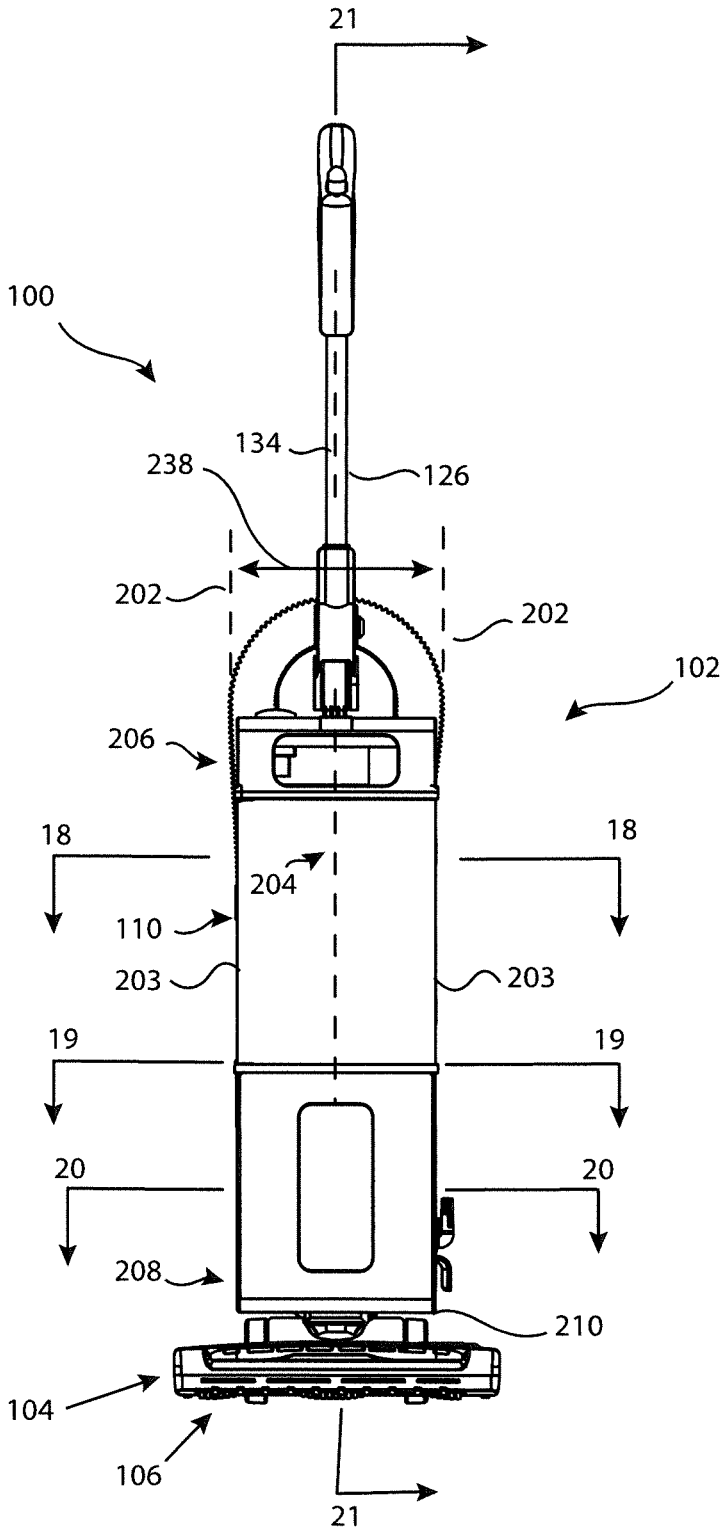
FIG. 3 is a front elevation view of the surface cleaning apparatus of FIG. 1.
Figure 18:
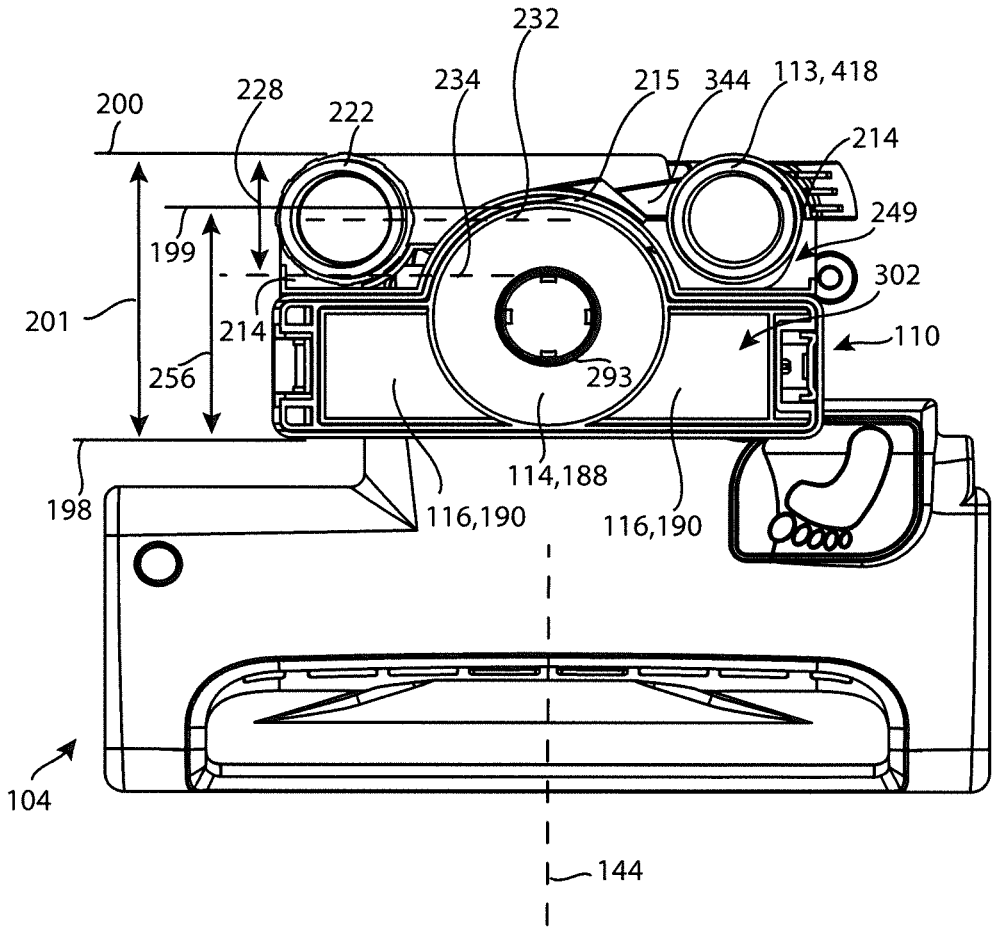
FIG. 18 is a cross-sectional view of a portion of the surface cleaning apparatus of FIG. 1, taken along line 18-18 in FIG. 3.

Preferably, the hose 113 and a transition member 344 are laterally offset from the cyclone chamber 188, and may be at least partially nested within the recess 249 on the back of the air treatment member assembly 110, which may help reduce the overall depth 201 of the cleaning unit. As illustrated in FIGS. 18 and 2E, in the present embodiment portions of the hose 113 and transition member 344 are positioned forward of the plane 199 that defines the rearmost extent of the air treatment member assembly 110. In this arrangement, a portion of the strut 214 is positioned between the dirt collection region 116 and the connector member transition member and hose 113.

Figure 40:
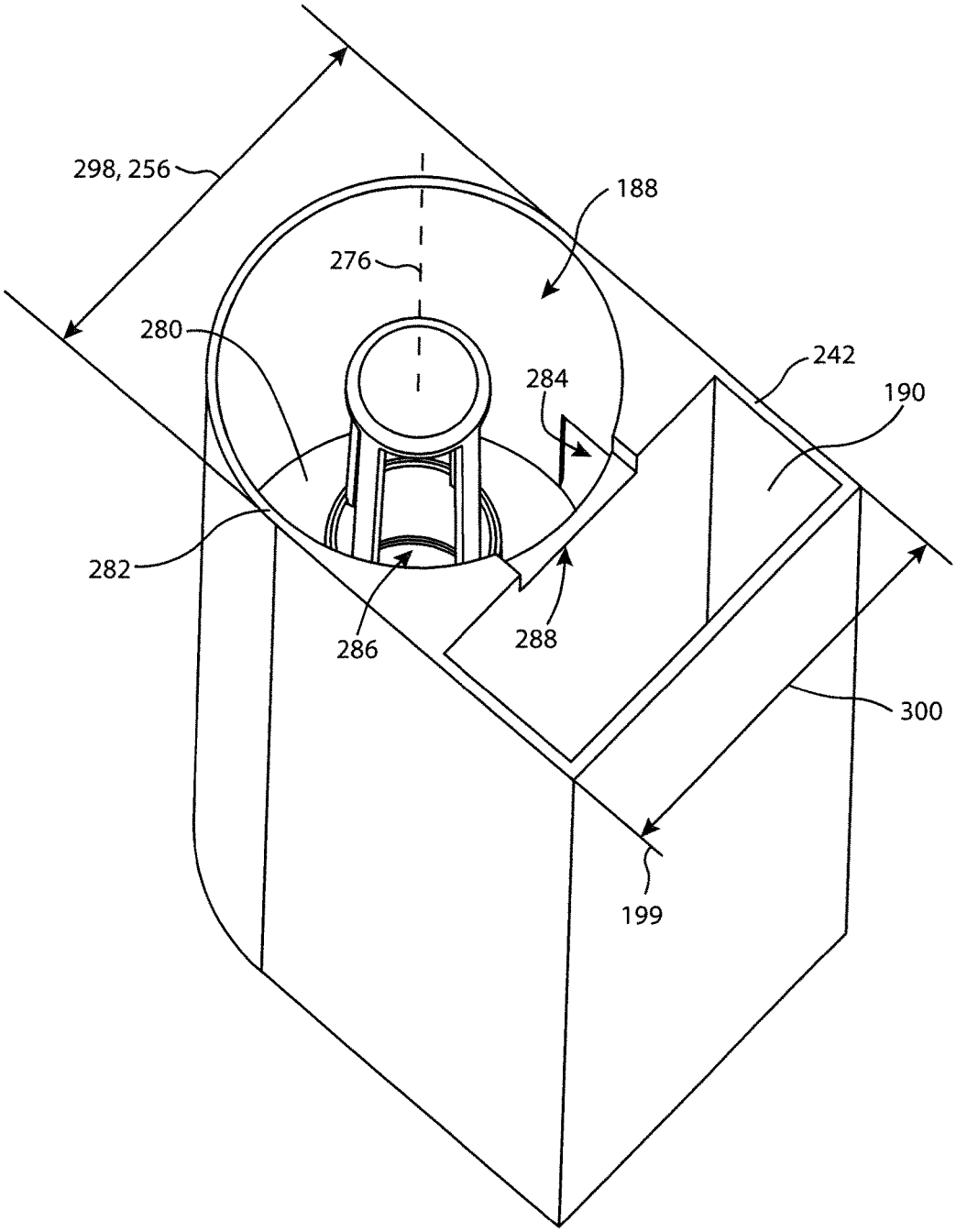

Together, the struts 214 and connecting web 215 may be configured to define a cavity 217 (FIGS. 2C and 2E) that has a complimentary shape to the rear side of the air treatment member assembly, and in the illustrated example is configured to receive the protrusion 247 on the rear side of the air treatment member assembly. Alternatively, the struts 214 and connecting web 215 may be generally flush with each other. For example, if the air treatment member assembly 110 of FIG. 40 is used a cavity 217 may not be needed because the rear face of the air treatment member assembly 110 is flat and lies in the plane 199.

The embodiments of FIGS. 42-52 may have an analogous configuration.

In addition to supporting the handle 124, the support structure 212 may also be configured to include one or more air flow ducts (e.g., an up flow duct to the air treatment member assembly) at least a portion of a locking mechanism or the like for securing the air treatment member assembly 110 to the cleaning unit 130 if the air treatment member is separately removable, at least a portion of a locking mechanism or the like for securing the cleaning unit 130 to the support structure if the cleaning unit 130 is removably mounted to the support structure, a brush control actuator, storage locations for auxiliary cleaning tools and the like.

In the illustrated embodiments, the air treatment member assembly 110 is removably mounted to the cleaning unit 130 and the locking mechanism for securing the air treatment member assembly 110 includes a latch provided on the air treatment member assembly, and a complimentary catch portion on the cleaning unit. Referring, for example, to FIGS. 1 and 10, the latch 218, which includes an integrated actuator button portion, is provided on the air treatment member assembly and can engage a corresponding catch portion 220 on the cross-member 216 of the cleaning unit 130. When a user presses on the exposed button portion, the latch 218 can be disengaged from the catch portion 220, thereby allowing the air treatment member assembly to be removed. Any locking mechanism known in the mechanical arts may be used.

The support structure 212 may also include one or more air flow ducts that form part of the air flow path between the dirty air inlet(s) 106 and the air treatment member assembly 110. Such ducts may be integrally formed and/or internal of the support structure 212, or may be external conduits connected to the support structure (such as wands, pipes and hoses).

Figure 19:
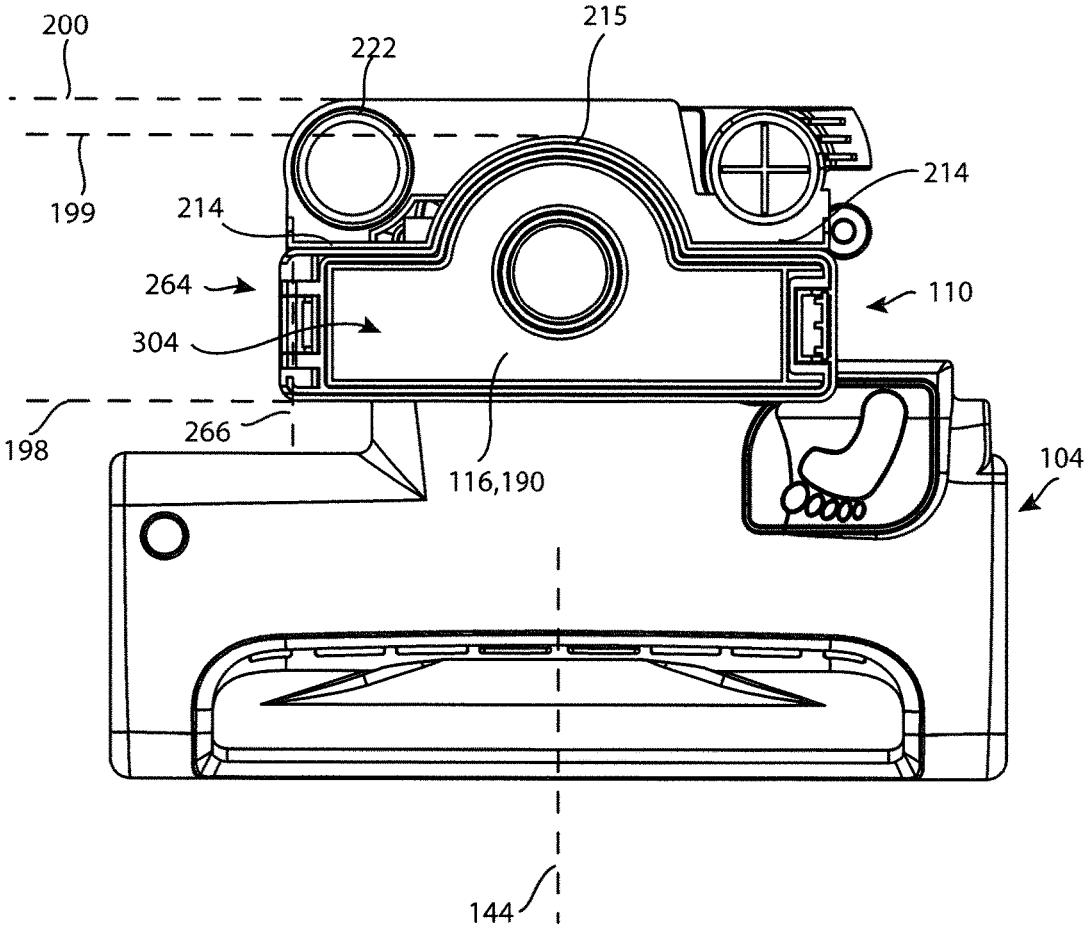
FIG. 19 is a cross-sectional view of a portion of the surface cleaning apparatus of FIG. 1, taken along line 19-19 in FIG. 3.
Figure 20:
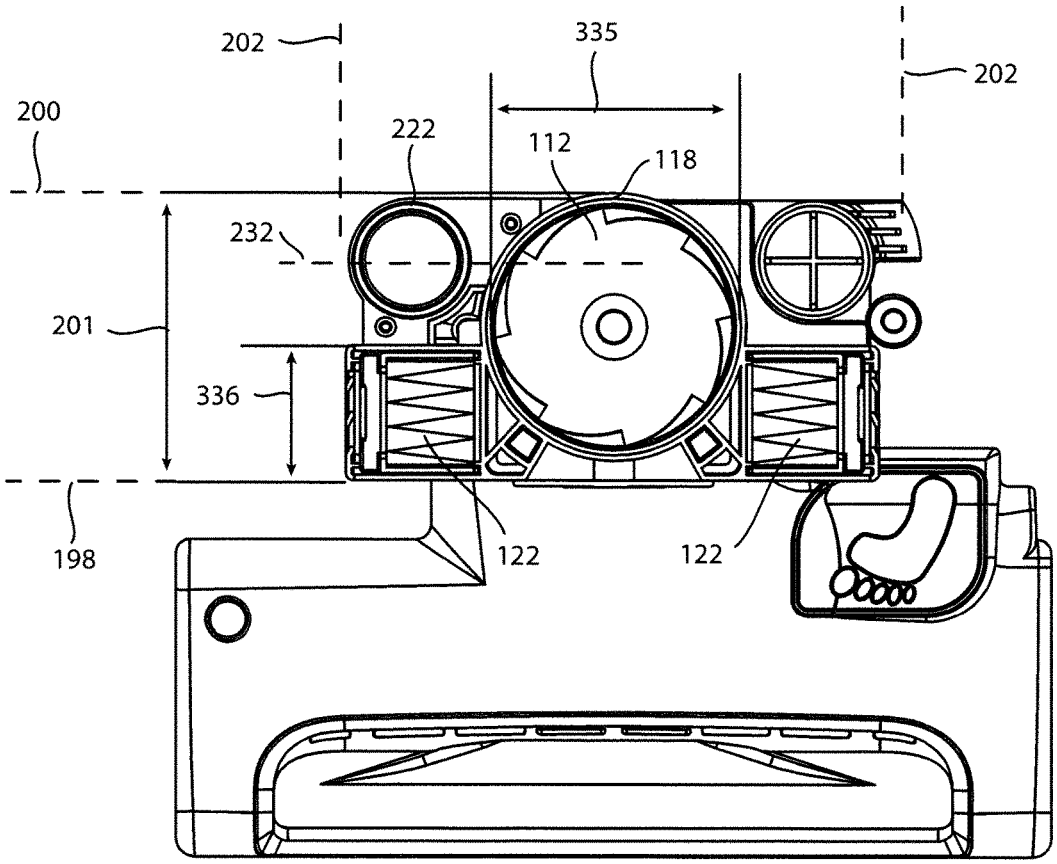
FIG. 20 is a cross-sectional view of a portion of the surface cleaning apparatus of FIG. 1, taken along line 20-20 in FIG. 3.

It will be appreciated that, in some embodiments, the airflow conduit from the surface cleaning head 104 to the air treatment member assembly 110 may include a rigid cleaning wand 222 and/or a flexible hose 113 (see e.g., FIGS. 18-20). The upright section may also include an up flow conduit, in the form of an up flow duct 224 provided on the cleaning unit 130 (FIG. 8), which fluidly connects an air exit of the surface cleaning head 104 to the cleaning wand 222. The inlet end 226 of the wand 222 may be detachably inserted into or otherwise connected in air flow communication to the up flow duct 224 (or vice versa) to complete the air flow path (FIG. 2A). Detachably connecting the wand to the air flow path enables the apparatus to be reconfigured for above floor cleaning. As exemplified, air travelling through the air flow path travels generally upwardly though up flow duct 224, into the cleaning wand 222, follows the curvature of the hose and then heads generally downwardly toward the air inlet of the air treatment member assembly. The embodiment of FIGS. 49-52 has an analogous configuration with the cleaning wand 222 in an alternative configuration, and the embodiment of FIGS. 42-48 illustrates an example of a cleaning unit 130 that has an internal up flow duct 224, without a rigid wand forming part of the illustrated air flow path.

It will be appreciated that the portion of the air flow path that is coextensive with the cleaning unit may be part of the cleaning unit, the support structure, separate components or a combination of two or more of these options. In any such case, this portion of the air flow conduit may be positioned to help reduce the overall size of the cleaning unit 130, and preferably to help reduce the maximum depth 201 of the cleaning unit 130. For example, the air flow conduits, such as ducts 224, wands 222 and hoses 113, may be nested in recesses provided recessing portions of the front and/or rear sides of the cleaning unit or on the lateral sides of the cleaning unit.

Referring to FIG. 18, in this embodiment when the cleaning wand 222 is mounted in a floor cleaning position, it is positioned behind a portion of the air treatment member assembly 110 (a lateral side portion of the dirt collection chamber as described herein), and also partially overlaps a portion of the air treatment member (e.g., the cyclone chamber 188) in the forward/rearward direction (e.g., it is positioned laterally outwardly of the air treatment member). Specifically, in this embodiment, both a central laterally extending plane 232 and a forward most laterally extending plane 234 of the wand 222 intersect a portion of the air treatment member, as well as the connecting web 215, but are spaced rearwardly from the struts 214 and dirt collection chamber 190. In this configuration, the depth 201 of the cleaning unit 130 is less than the sum of the diameter 228 of the cleaning wand and the maximum depth 230 of the air treatment member assembly 110. By reducing the depth of the dirt collection region 116, the wand may be positioned forward of the position shown in FIG. 18, in which case, the maximum depth of this portion of the upright section may be further reduced. The volume of the dirt collection region 116 may be increased by increasing the lateral length of the dirt collection region. The embodiments of FIGS. 42-48 and 49-52 have analogous configurations, in which portions of the upflow ducts 224 are nested behind portions of the air treatment member assemblies 110.

Accordingly, it will be appreciated that the cleaning unit 130 and the upright section 102 may be configured to have a relatively small depth 201 in the forward/backward direction. Configuring the upright section 102 to have a small depth may help facilitate positioning the cleaning unit 130 in relatively narrow spaces, such as beneath a couch, bed frame, coffee table and the like. Reducing the size of the cleaning unit 130 and/or upright section 102 may also help reduce the amount of space required to store the apparatus 100 when not in use.

Figure 4:
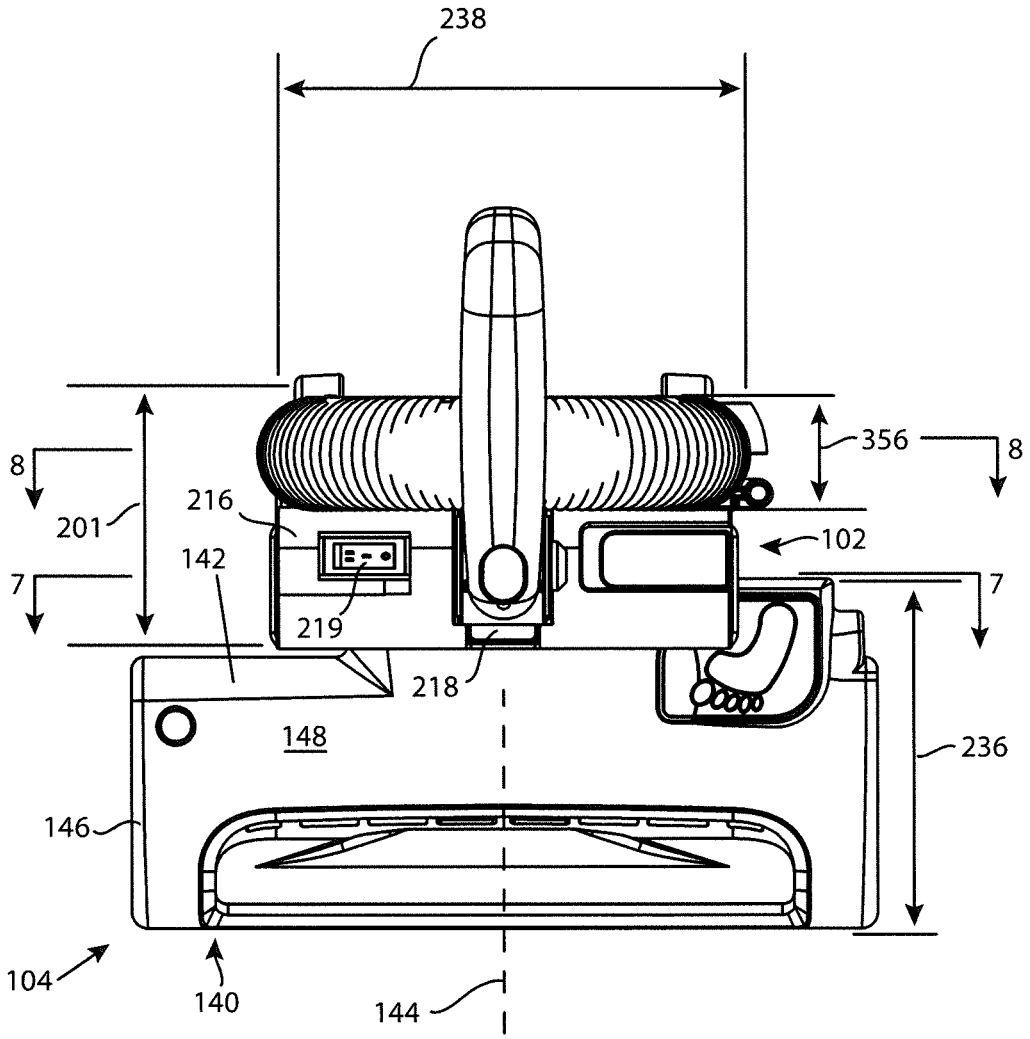
FIG. 4 is a top plan view of the surface cleaning apparatus of FIG. 1.

Referring to FIG. 4, in the illustrated embodiment the cleaning unit 130 is the largest portion of the upright section, and has a depth 201 in the forward/backward direction that is relatively narrow, and is less than the depth 236 of the surface cleaning head 104 taken in the same direction (exclusive of the wheels 158). The depth 201 can be any suitable distance, and may be less than about 8 inches, less than about 6 inches or less than about 4 inches. For example, the depth 201 may be sized to be essentially the same as or less than the height of surface cleaning head 104. In such a case, the extent to which apparatus 100 may extend under furniture is not limited by the depth of the cleaning unit.

It will be appreciated that the cleaning unit 130 may be configured so that it is wider than it is deep, such that the width 238 of the cleaning unit 130 in the lateral direction (see also FIG. 3) is greater than the depth 201 of the cleaning unit 130. Optionally, the lateral width 238 may be more than 125%, more than 150%, more than about 175%, more than about 200%, more than about 250% and/or more than about 300% of the of the depth 201 in the forward/rearward direction. Preferably, the width 238 is at least about two times as large as the depth 201. This may help reduce the depth of the cleaning unit 130, while still allowing sufficient volume within the cleaning unit 130 to contain the air treatment member assembly 110 and suction motor 112.

It will be appreciated that the air treatment member assembly 110 may have a width 252 in a lateral direction (FIG. 25) that is, in the embodiment illustrated, generally equal to the overall width 238 of the upright section 102 in the lateral direction. The air treatment member assembly 110 also has a maximum depth 256 (FIG. 22) that is measured between the forward most and rearward most portions of the air treatment member assembly 110 in the forward/rearward direction. The maximum depth 256 may be about the same depth as the cleaning unit if the rear side of the dirt collections regions is recessed sufficiently to receive, e.g., struts 214, the rigid wand and the hose. Alternately, if these components extend rearwardly of the rear face of the dirt collection regions, then the maximum depth 256 of the air treatment member assembly may be less than the depth 201 of the cleaning unit 130, and optionally may be at least 50%, at least about 60%, at least about 70%, at least about 80%, at least about 90% and/or at least about 95% of the depth 201.

Accordingly, when operated in the low profile floor cleaning mode (FIG. 12), with the upright section 102 pivoted so that the front plane 198 of the cleaning unit 130 is substantially horizontal (i.e. substantially parallel to the floor), the height 240 from the floor to the front plane 198 may be between about 100% and about 130% of the cleaning unit depth 201, and may be between about 105% and 120% of the depth 201. In some embodiments, the height 240 may be less than 5 inches. Preferably, the height 240 can be less than about 4.5 inches, less than about 4 inches, less than about 3.5 inches or less than about 3 inches.

Air Treatment Member Assembly

The following is a description of air treatment member assemblies that may be used by themselves in any surface cleaning apparatus or in any combination or sub-combination with any other feature or features described herein. For example, the air treatment member assemblies described herein may be used with any one or more of the surface cleaning head, moveable wheels, upright section, carry handles, cyclone configurations, dirt collection chambers, pre-motor filters, suction motors, post-motor filters, cleaning unit air flow ducts, above floor cleaning assemblies, low profile floor cleaning mode, bendable handle, adjustable handles, hose wraps and other features described herein.

In accordance with this aspect, the air treatment member assembly may be removable from the cleaning unit for emptying. The air treatment member assembly includes an air treatment member and one or more dirt collection regions. The air treatment member assembly may be removable as a sealed unit other than air inlet and outlet ports. Upper and/or lower ends of the air treatment member assembly may be openable to empty the air treatment member and the dirt collection region(s).

Referring to FIGS. 5, 13, 22-24, 32, 38-41, 49, 53, and 77-85 in the illustrated embodiments the air treatment member assembly 110 has a front face 242 that is generally flat and forms a portion of the front of the cleaning unit 130. The air treatment member assembly 110 also has an upper end 244 (FIGS. 10, 83) that is proximate the upper end 132 of the cleaning unit 130 or may be the upper end of the cleaning unit, a rear side 246 (FIGS. 22-24), opposed lateral sides 248 and a lower end 250 (see also FIGS. 11 and 83) that seats on the lower housing 192.

In the embodiments illustrated herein, the cleaning unit 130 air treatment member assembly is removably mounted to an upper end of the suction motor housing portion 118 of the cleaning unit 130. In this embodiment, the upper end of the suction motor housing 118 may bound part or all of the axially extending walls of the pre-motor filter chamber 194, and the pre-motor filter chamber 194 may have a generally open upper face. When the air treatment member assembly 110 is seated on the upper end of the motor housing 118, the air treatment member assembly 110 may seal the open, upper face of the pre-motor filter chamber 194. In this arrangement, the lower end 250 of the air treatment member assembly 110 may form the upper wall of the pre-motor filter chamber 194. When the air treatment member assembly 110 is removed (FIG. 25), the upper end of the pre-motor filter chamber 194 is opened and the pre-motor filter 120 is visible and may be removed through the open upper end for cleaning. When configured as illustrated, removing the air treatment member assembly 110 reveals the upstream/dirty side of the pre-motor filter 120. Positioning the pre-motor filter 120 in this manner may lead users to visually inspect the pre-motor filter 120 each time the air treatment member assembly 110 is removed and/or replaced on the cleaning unit 130. Alternatively, instead of using the air treatment member assembly 110 to seal the pre-motor filter chamber 194 or other portions of the motor housing 118, the cleaning unit 130 may include a separate cover or seal plate to enclose the motor housing and/or pre-motor filter chamber.

Figure 78:
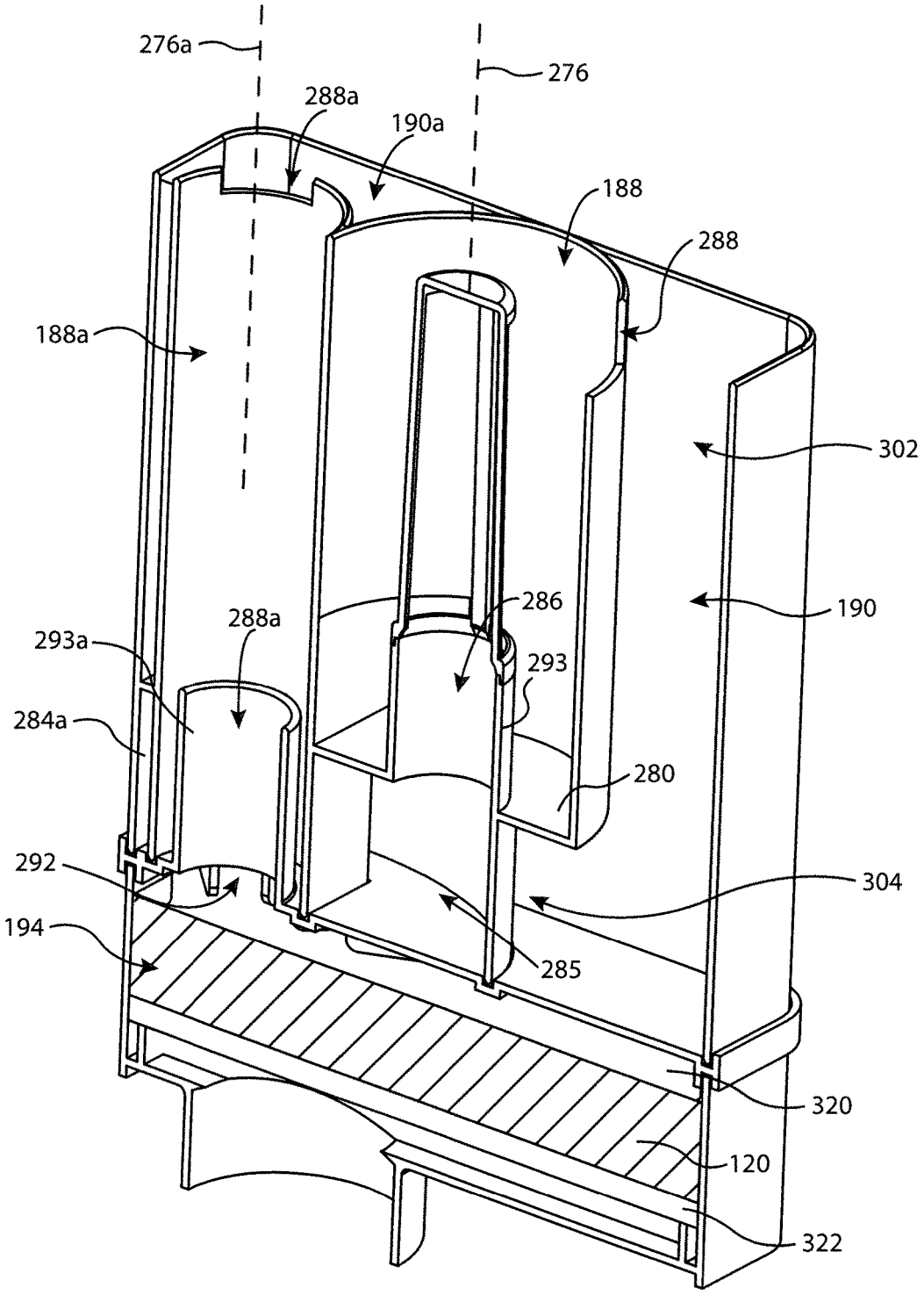
FIG. 78 is a perspective view of a cross-section of the air treatment member assembly of FIG. 77, taken along line 78-78.
Figure 79:
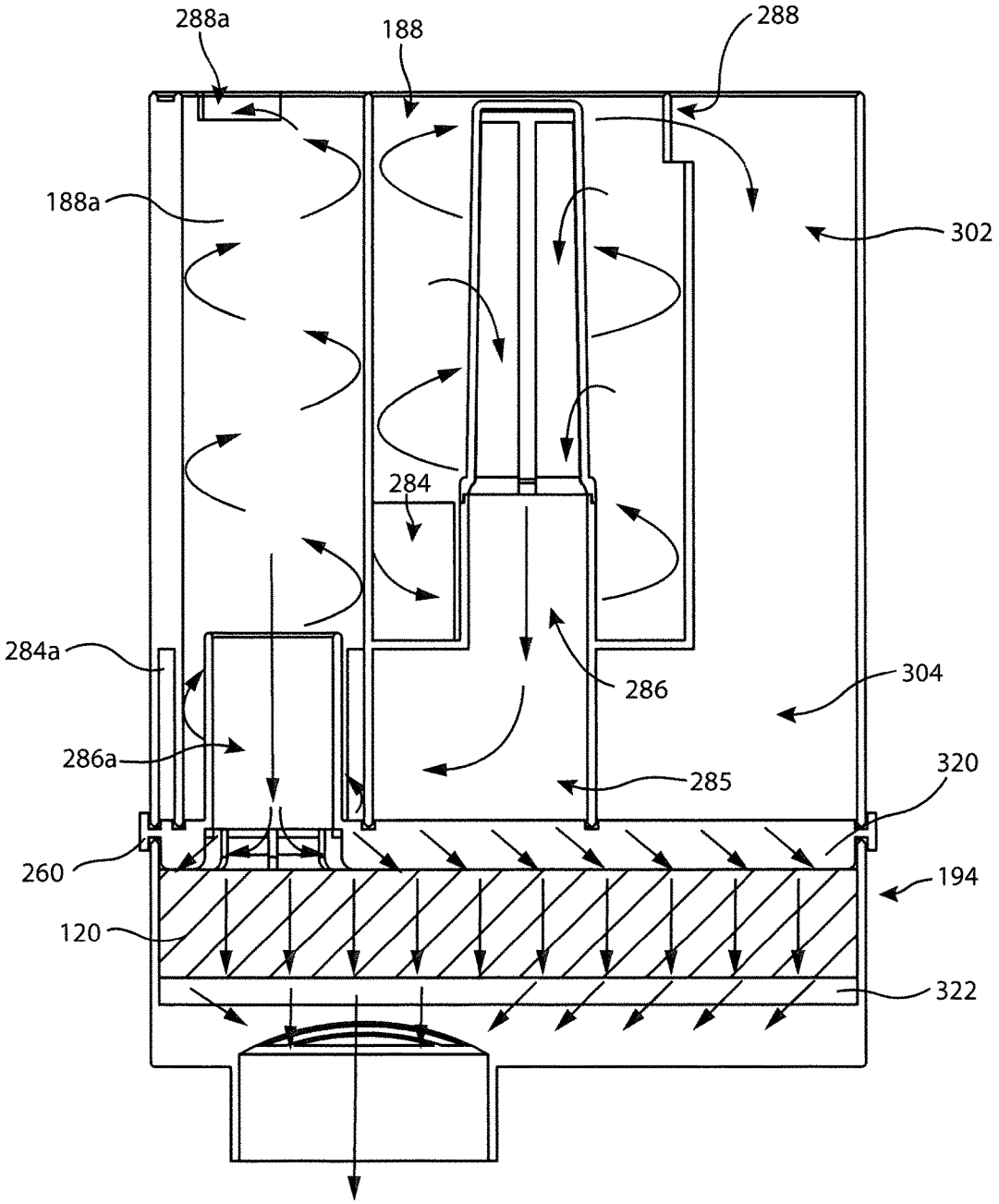
FIG. 79 is a side elevation view of the cross-section of the air treatment member assembly of FIG. 78.
Figure 80:
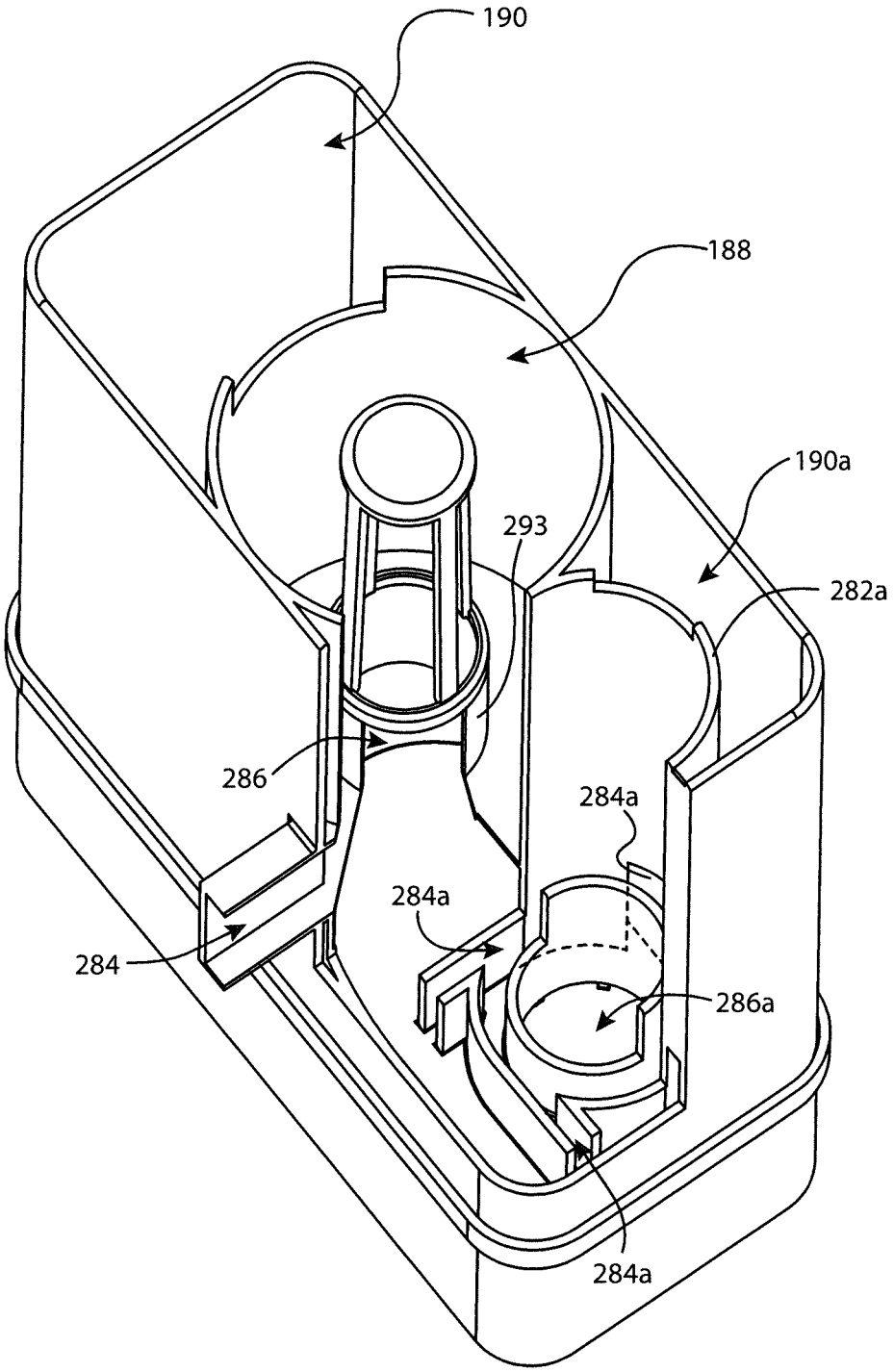
FIG. 80 is a partial-cut away of the perspective view of the air treatment member assembly of FIG. 77.
Figure 81:
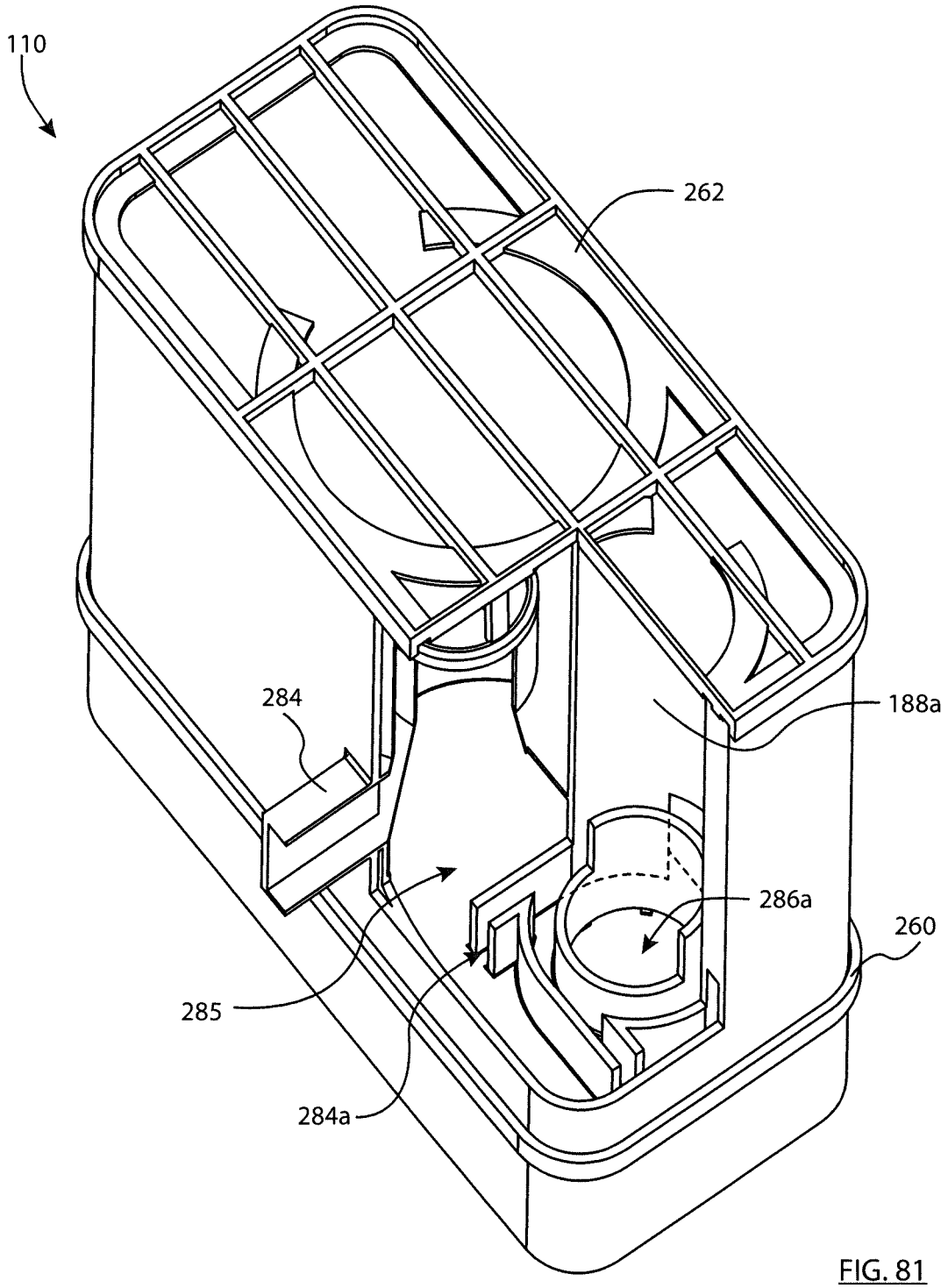
FIG. 81 is the partial cut-away view of FIG. 80, with an upper door in place.

Optionally, the pre-motor filter chamber 194, and pre-motor filter 120 therein, may be removable from the cleaning unit 130 with the air treatment member assembly 110 (as shown in FIGS. 78-80). This may allow a user to simultaneously carry all of the soiled portions of the surface cleaning apparatus 100 to the garbage can or other location for emptying/cleaning. In this configuration, the air treatment member assembly 110 and the pre-motor filter chamber 194 may be removably seated on the upper end of the motor housing 118. A removable pre-motor filter chamber 194 of this nature may be used in combination with any of the air treatment member assemblies 110 described herein, and similarly the air treatment member assembly of FIGS. 77-85 may be useable with a non-removable pre-motor filter chamber 194.

Optionally, the upper end 244 and/or the lower end 250 of the air treatment member assembly 110 may be openable to provide access to the interior of the air treatment member assembly 110. Referring to FIG. 10, in the illustrated embodiment the lower end 250 of the air treatment member assembly 110 includes an openable lower door 260, and referring to FIG. 11, the upper end 244 of the air treatment member assembly 110 includes an openable upper door 262. As illustrated, the upper and lower doors 260, 262 may be openable independently of each other. This may allow a user to open one end of the air treatment member assembly 110 without having to open the other. For example, a user may open the upper door 262 to inspect the interior of the air treatment member assembly 110, while keeping the lower door 260 closed to prevent spilling of the dirt and debris collected therein.

Optionally, the upper and lower doors 260, 262 may be opened by detaching the doors 260, 262 from the rest of the air treatment member assembly (as shown in the embodiment of FIGS. 77-85), or alternatively, as illustrated in FIGS. 10 and 11, the doors 260, 262 may be moveably mounted (e.g., pivotally connected) to a sidewall of the air treatment member assembly 110.

If configured to pivot, the doors 260, 262 may be connected using any suitable rotatable connection, such as a pivot joint and/or hinge. Referring to FIGS. 10-11, 19, 22 and 23 for example, in the illustrated embodiments, both the upper door 262 and lower door 260 are pivotally connected to the sidewall using hinges 264 that facilitate pivoting about respective pivot axes 266. In this embodiment, the hinges 264 are provided on one of the lateral sides of the air treatment member assembly 110, and oriented so that the pivot axes 266 are generally parallel to the longitudinal axis 144 (i.e. extend in the forward/rearward direction). The opposing sides of the upper and lower doors 260, 262 are secured in the closed position using respective latches 268. Like the hinges 264, the latches 268 in the illustrated embodiments are located on the opposing lateral side of the air treatment member assembly 110, rather than on the front 242 or rear sides 246. Positioning the hinges 264 and/or latches 268 on the lateral sides of the air treatment member assembly 110 may help reduce the depth 256 of the air treatment member assembly 110 in the forward/rearward direction. This may help reduce the overall depth 201 of the cleaning unit 130 and/or the upper section 102. This arrangement may also leave the hinges 264 and latches 268 visible and/or accessible when the air treatment member assembly 110 is mounted to the rest of the cleaning unit 130.

The air treatment member assembly 110 may be formed from any suitable material, including plastic and composite materials. Preferably, at least a portion of the air treatment member assembly is formed from transparent materials so that a user can view the interior of the air treatment member assembly without having to open the upper or lower doors 260, 262.

Carry Handle

The following is a description of carry handles that may be used by themselves in any surface cleaning apparatus or in any combination or sub-combination with any other feature or features described herein. For example, the carry handles described herein may be used with any one or more of the surface cleaning head, moveable wheels, upright section, air treatment member assemblies, cyclone configurations, dirt collection chambers, pre-motor filters, suction motors, post-motor filters, cleaning unit air flow ducts, above floor cleaning assemblies, low profile floor cleaning mode, bendable handle, adjustable handles, hose wraps and other features described herein.

In accordance with this aspect, the carry handle 258 is oriented so as to provide a grip area having sufficient length to enable a user to carry the air treatment member assembly 110, the cleaning unit 130 or the entire apparatus 100 while not increasing the depth of the air treatment member assembly 110 or the cleaning unit 130. For example, the cleaning unit may have a maximum depth of, e.g., less than 5 inches and possibly 4 inches or less. The carry handle may have a length of 5-8 inches, 5-7 inches or 5-6 inches so as to provide a grip length of, e.g., 4-5 inches. Accordingly, by orienting the carry handle to extend laterally (transverse to the central axis of the surface cleaning head), the user may comfortably carry the air treatment member assembly 110 without the need to increase the maximum depth of the air treatment member assembly.

Figure 25:
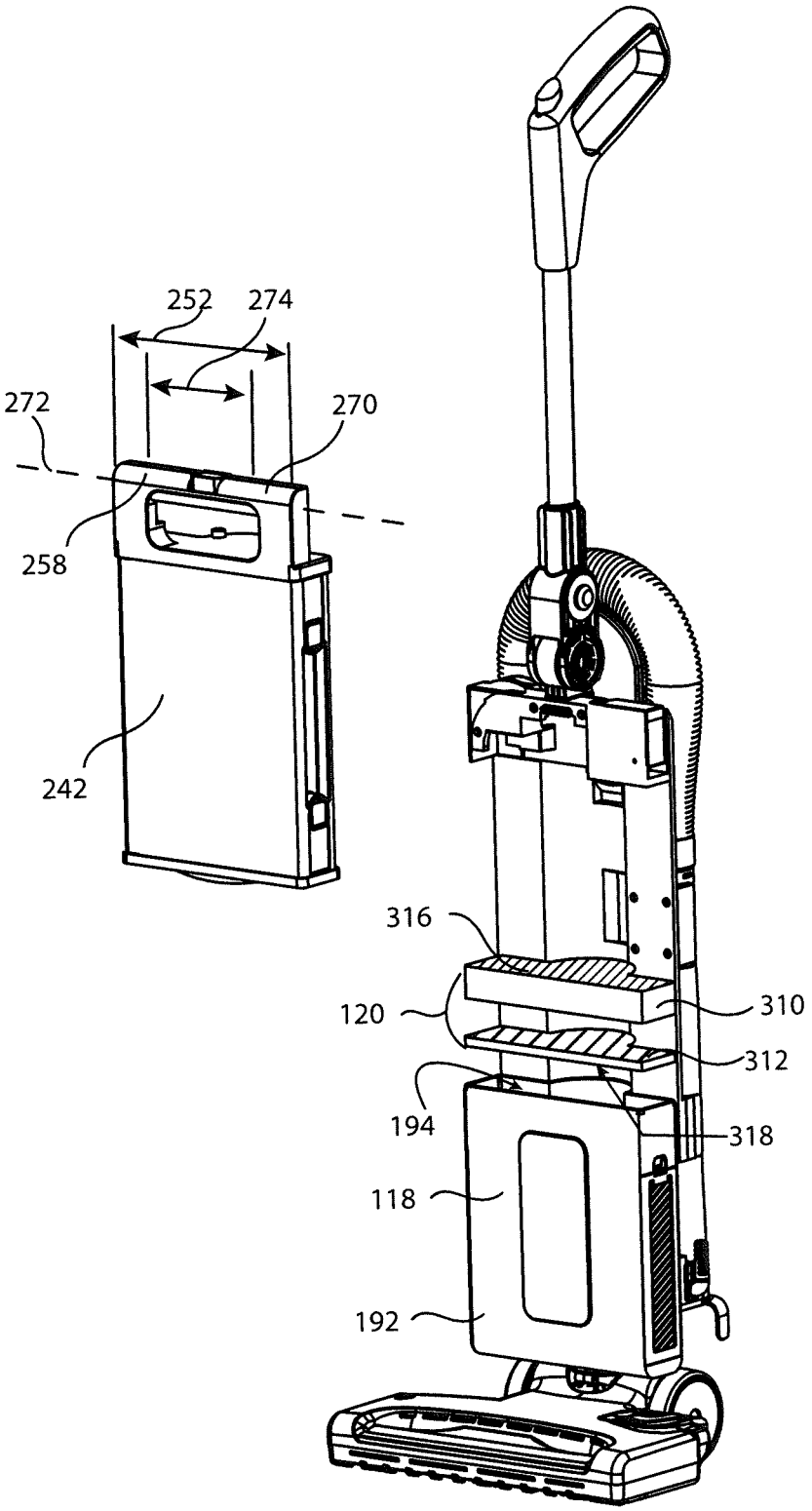
FIG. 25 is a partially exploded front perspective view of the surface cleaning apparatus of FIG. 1, with the air treatment member assembly and pre-motor filters removed.
Figure 26:
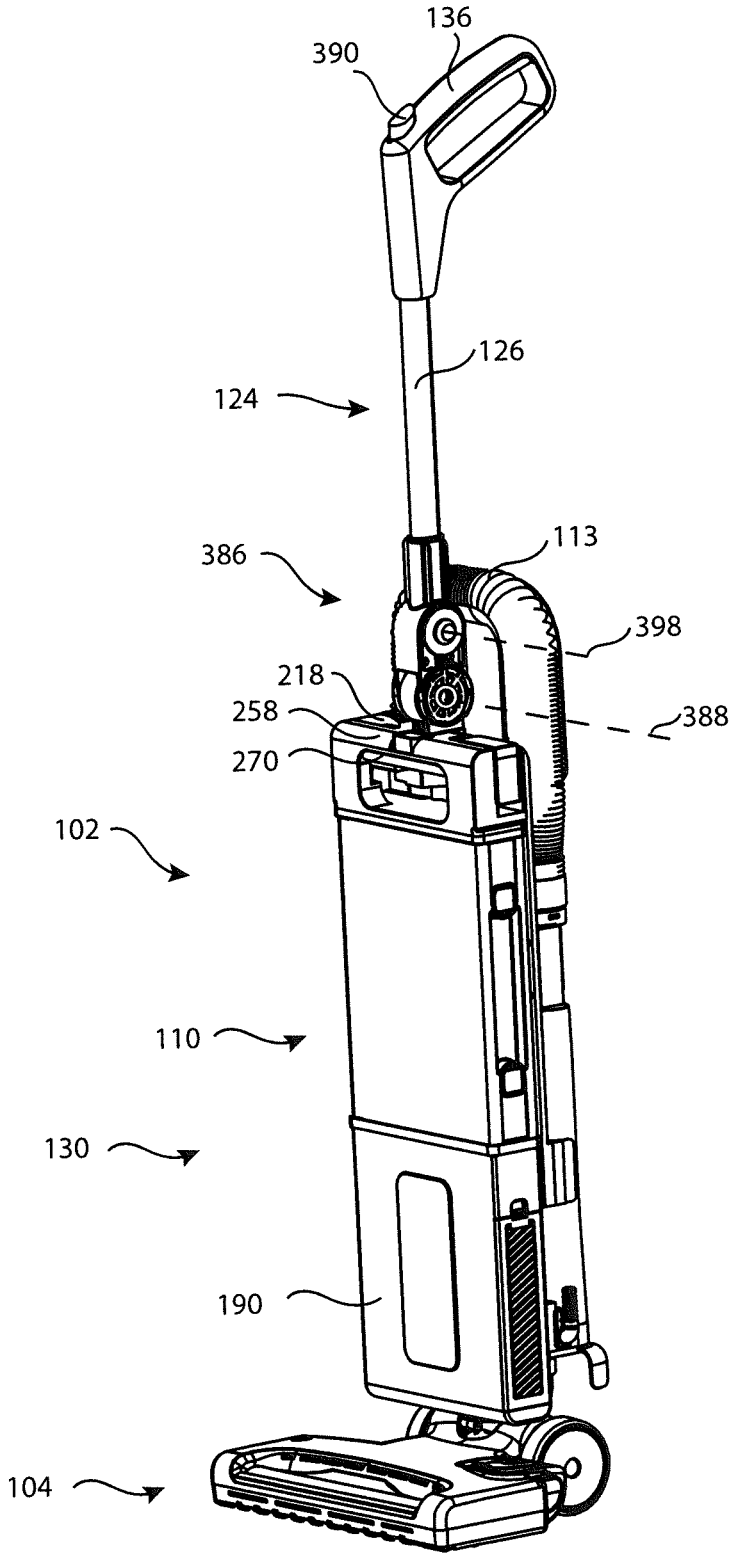
FIGS. 26 and 27 are front and rear perspective views of another embodiment of a surface cleaning apparatus.
Figure 27:
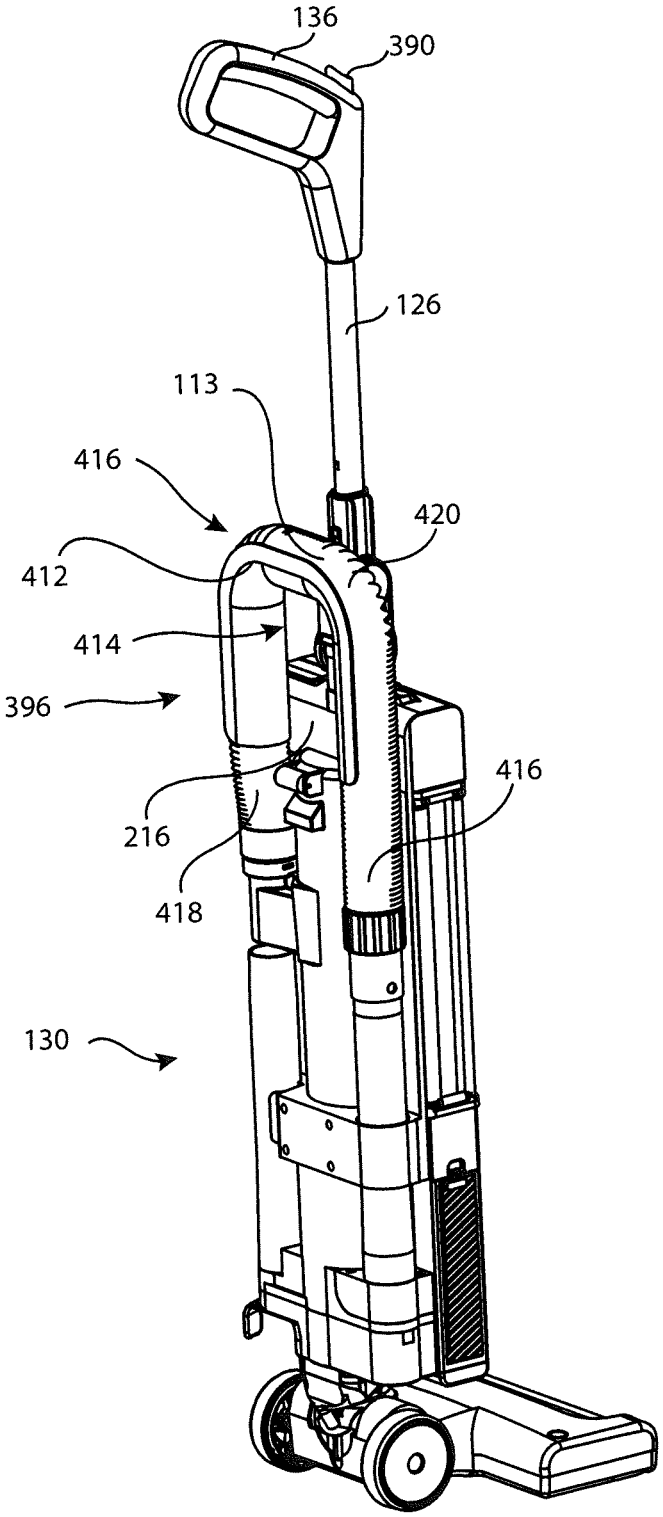

As discussed previously, preferably, the air treatment member assembly 110 is removable from the upright section 102 for emptying (as exemplified in FIGS. 10, 11 and 25). Accordingly, the air treatment member assembly 110 may include one or more carry handles 258 to help facilitate carrying the air treatment member assembly 110 to a garbage can or the like.

The carry handle 258 may have any suitable configuration, and in the illustrated embodiments includes a grip portion 270 that extends along a grip axis 272 and has a grip length 274 (FIGS. 10, 11 and 25). In the illustrated embodiments, the grip axis 272 extends in the lateral direction, and is orthogonal to the longitudinal axis 144. It will be appreciated that the grip axis 272 may extend generally in the lateral direction.

Optionally, the grip length 274 can be selected so that it is equal to or greater than the depth 201 of the cleaning unit 130, and optionally may be greater than twice the depth 201 in the direction of the central longitudinal axis 144 of the air treatment member assembly 110 or of the cleaning unit 130 or of the portion of the upright section on which the cleaning unit is provided. In this arrangement, the grip portion 270 may be sized to be comfortable for the user, without being limited by the depth 201 of the cleaning unit 130, or the depth 256 of the air treatment member assembly 110, as may be the circumstance if the grip axis 272 extended in the forward/rearward direction.

For example, the grip length 274 may be selected to be between about 3 inches and about 10 inches, or more, without changing the depth 201 of the cleaning unit 130 or depth 256 of the air treatment member assembly 110. Optionally, the grip length 274 can be selected so that it is between about 60% and about 150% of the depth 201 of the cleaning unit 130. For example, for a cleaning unit 130 having a depth 201 of about 6 inches, the grip length 274 may be about 4 inches (about 60%), or about 6 inches (about 100% of the depth), e.g., in the range of 4-5 inches. If the cleaning unit depth 201 is about 4 inches, the a grip length 274 of 4 inches would be about 100% of the depth, and a grip length 274 of 6 inches would be about 150% of the depth. Providing a grip 270 with a grip length 274 that is equal to or greater than the depth 201 of the cleaning unit 130 may help provide a relatively large, comfortable grip portion 270 on a relatively thin upright section 102.

In the embodiments, the carry handle 258 is positioned close to the front side of the air treatment member assembly 110 and is proximate the front face 242 of the air treatment member assembly 110 and the front plane 198 of the cleaning unit 130, i.e. the grip axis 272 is closer to the front plane 198 than the rear plane 200. In this position, the carry handle, and the grip portion, are positioned above and overlie the upper end 244 of the air treatment member assembly 110, and in particular overlie portions of the cyclone chamber 188 and the dirt collection chamber 190. While illustrated as being at the upper end 244 of the air treatment member assembly 110, the carry handle 258 may be provided at other locations, such as along one of the lateral sides of the air treatment member assembly 110.

In the illustrated embodiments, the carry handle 258 is provided on the openable upper door 262, and moves with the upper door 262 when it is opened (FIG. 11). Alternatively, the carry handle 258 may be connected to a different part of the air treatment member assembly 110, and need not move with an openable door.

In a further alternate embodiment, the carry handle 258 may be placed on the support structure 212 (such as cross-member 216) provided that the handle 124 and its connection to the cleaning unit 130 and/or the support structure 212 (e.g., pivot joint 386) does not interfere with placing carry handle at that location.

Cyclone (Air Treatment Member) Configuration

The following is a description of cyclone configurations that may be used by themselves in any surface cleaning apparatus or in any combination or sub-combination with any other feature or features described herein. For example, the cyclone configurations described herein may be used with any one or more of the surface cleaning head, moveable wheels, upright section, air treatment member assemblies, carry handles, dirt collection chambers, pre-motor filters, suction motors, post-motor filters, cleaning unit air flow ducts, above floor cleaning assemblies, low profile floor cleaning mode, bendable handle, adjustable handles, hose wraps and other features described herein.

In accordance with this aspect, the air treatment member is configured to reduce the overall depth of the air treatment member assembly. Accordingly, the dirt collection region or regions are positioned external to the air treatment member. By positioning the dirt collection region or regions external to the air treatment member, a portion of a dirt collection region need not be positioned in front or behind the air treatment member (see for example FIG. 22), thereby reducing the depth of the air treatment member assembly. Accordingly, the maximum depth of the air treatment member assembly 110 may be the depth of the air treatment member. Further, the shape of the dirt collection region or regions may be varied so as to fit within a desired footprint of the cleaning unit.

It will be appreciated that the air treatment member may be provided in the form of any suitable cyclone(s), swirl chamber or the like which are known in the surface cleaning art. In the illustrated embodiments (see FIGS. 7, 22-24, 31-41, 52 and 77-85), the air treatment member is provided in the form that includes at least one cyclone chamber 188 that extends along a cyclone axis 276, which may also define a cyclone bin assembly axis. The cyclone chamber may be of any design known in the art. Optionally, the air treatment member assembly 110 may include more than one air treatment member. For example, the air treatment member assembly 110 may include two or more cyclonic cleaning stages (each containing one or more cyclone chambers), arranged in parallel or in series with each other. One example of such an air treatment member assembly 110 is illustrated in FIGS. 77-85, and includes a first cyclone chamber 188, and a second cyclone chamber 188*a* that is positioned downstream from the cyclone chamber 188 and functions as a secondary cyclonic cleaning stage. Alternatively, the cyclones 188 and 188*a* may be connected in parallel with each other. The second cyclone chamber 188*a* and second dirt collection chamber 190*a* may include analogous features to the cyclone chambers 188 and dirt collection chambers 190 described herein, and like features are indicated using like reference numerals with an "a" suffix.

A variety of air treatment member assemblies are described herein, having different arrangements and configurations of the cyclone chambers and dirt collection chambers. Any of these air treatment member configurations may be used in combination with any of the other, compatible features described herein.

As exemplified, the cyclone chamber 188 includes a first end wall 278, a second end wall 280 axially spaced apart from the first end wall and a generally cylindrical sidewall 282 extending between the first and second end walls 278, 280. Optionally, some or all of the cyclone walls may coincide with portions of the dirt collection chamber walls, and/or may form portions of the outer surface of the cleaning unit 130 and upright section 102. Alternatively, in some examples some or all of the cyclone walls can be distinct from other portions of the cleaning unit 130, and may not overlap or be co-incident with other walls in the air treatment member assembly 110. Referring to the embodiment of FIGS. 77 and 82, the sidewall 282 of the first cyclone chamber 188 is coincident with portions of the dirt collection chamber sidewalls (at the front and rear sides of the air treatment member assembly 110), whereas, as exemplified, the diameter of second cyclone chamber 188*a* may be slightly smaller, and may be positioned such that the sidewall 282*a* is distinct from the dirt collection chamber sidewalls. In this example, there is an optional overlap between the cyclone chamber sidewalls, such that a portion of sidewall 282 is coincident with a portion of sidewall 282*a*. This may help reduce the combined lateral width of the cyclones 188 and 188*a*, and in some instances may help provide structural support/strength for the sidewalls 282 and 282*a*.

Referring to FIG. 22 as an example, in these embodiments the cyclone chamber 188 has a cyclone air inlet 284, through which dirty air can enter the cyclone chamber 188, and a cyclone air outlet 286, through which treated air can exit the cyclone chamber 188. While some dirt may settle/collect on the interior surface of the second end wall 280, the cyclone chamber 188 may also include at least one dirt outlet 288 through which dirt and debris can exit the cyclone chamber 188, and preferably collect in an external dirt collection chamber 190. If a second cyclone chamber 188*a* is included (FIGS. 77-85) it may include an analogous air inlet 184*a*, and optionally, may include two or more air inlets 184*a*. As exemplified in FIG. 83, in this embodiment the second cyclone 188*a* includes four air inlets 284*a*, and other embodiments may have different numbers of air inlets. In this embodiment, all four air inlets 184*a* are in air flow communication with a common air plenum 285 (FIGS. 78, 83 and 84) that is downstream from the air outlet 286 of the first cyclone chamber 188. That is, air exiting the first cyclone 188, via the air outlet 286, flows into the air plenum 285 and is then distributed amongst the four air inlets 184*a*. After flowing in via the inlets 184*a*, the air circulates within the second cyclone chamber 188*a* and exits via the air outlet 286*a* and travels into the pre-motor filter chamber 194. In this arrangement, the air plenum 285 extends beneath at least a portion of the second dirt chamber 190*a*, and laterally surrounds a lower end of the cyclone chamber 188*a*. The second cyclone chamber 188*a* includes dirt outlets 288*a* (two in the illustrated example) which are in communication with a corresponding second dirt collection chamber 190*a*. In the illustrated example, the second dirt chamber 190*a* is fluidly isolated from the dirt chamber 190, which may help maintain a desired air flow path through the air treatment member assembly 110.

The dirt outlet 288 (or 288*a*) may have any suitable configuration and be provided at any location in the cyclone chamber 188 (or 188*a*). For example, if a dirt collection region is provided below or above a cyclone chamber that has a longitudinal axis that extends vertically when the upright section is in the upright storage position of FIG. 1, then the overall height of the cleaning unit may be too large. Accordingly, if the cyclone chamber has a longitudinal axis that extends vertically when the upright section is in the upright storage position, it is preferred to position the dirt collection region or regions exterior to the cyclone chamber 188 and to extend in the same direction as the cyclone chamber 188. Accordingly, the dirt outlet or outlets 288 may be configured so that dirt travelling through the dirt outlet 288 travels in a generally lateral/radial outward direction and then falls downwardly into the dirt collection chamber 190.

Figure 23:
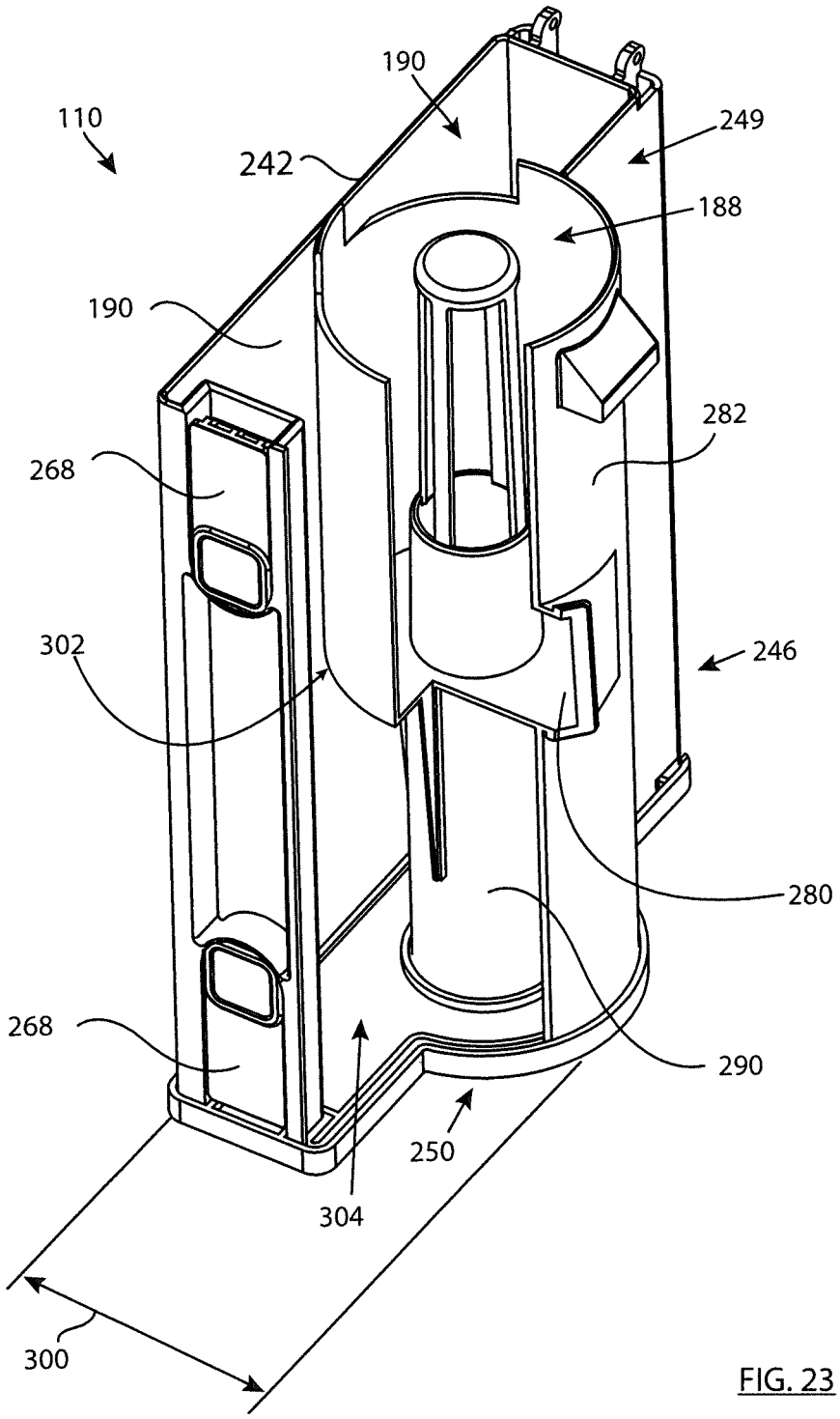
FIG. 23 is a partially cut-away perspective view of the portion of the air treatment member assembly of FIG. 22.
Figure 24:
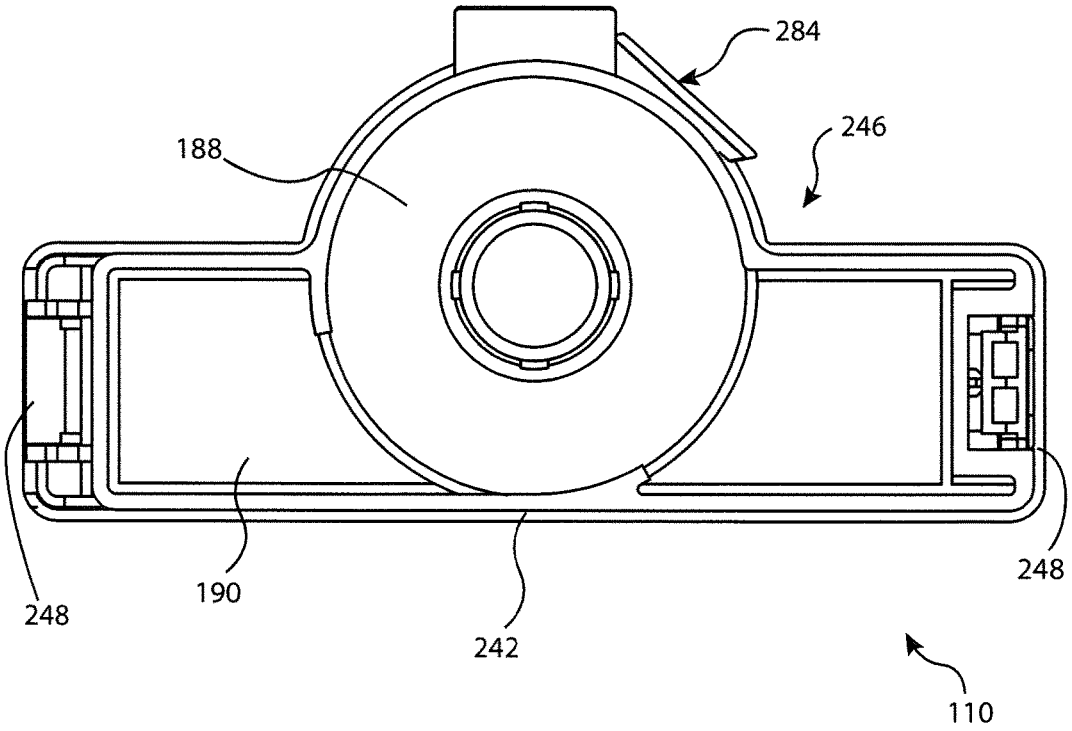
FIG. 24 is a top view of the portion of the air treatment member assembly of FIG. 22.

Optionally each cyclone chamber may be configured to include one dirt outlet, or more than one dirt outlet. For example, a dirt outlet 288 may be provided for each dirt collection chamber 190. Referring to FIGS. 22 and 23, in the illustrated embodiment, the cyclone assembly includes two dirt collection chambers 190, each of which is spaced laterally from the cyclone chamber. Accordingly, the cyclone chamber 188 includes two, spaced apart dirt outlets 288 that are provided on opposing lateral sides of the cyclone chamber 188. Each dirt outlet 288 may be configured as a slot that extends around a portion of the cyclone chamber sidewall 282, and may be partially bounded by the first end wall 278 of the cyclone chamber 188.

As exemplified, the dirt outlets 288 may be provided toward the upper end of the cyclone chamber 188, and at the upper end 244 of the air treatment member assembly 110 itself. In contrast, both the air inlet 284 and air outlet 286 may be provided toward the opposed, lower end 280 of the cyclone chamber 188, which corresponds to about the vertical mid-point of the air treatment member assembly 110. A cyclone with this orientation may be referred to as an inverted cyclone.

In this embodiment, and in the embodiments of FIGS. 31-33 and 38-40, air exiting the cyclone chamber 188 travels downwardly, and, as exemplified, may travel through a portion of the dirt collection chamber 190 if a dirt collection region is positioned below the cyclone chamber 188, via an exit conduit 290 (FIG. 23), to an aperture 292 (FIGS. 7 and 10) provided in the lower door 260 of the air treatment member assembly 110. The exit conduit 290 in these embodiments is at least partially surrounded by the dirt collection chamber 190, and as illustrated is entirely laterally surrounded (whereas it is only partially surrounded in the embodiments of FIGS. 35 and 36). Positioning the exit conduit 290 at least partially within, and extending through, the dirt collection chamber 190 may help reduce the overall size of the air treatment member assembly 110 while increasing the volume for dirt collection, for example as compared to placing the exit conduit outside of the dirt collection chamber.

Figure 84:
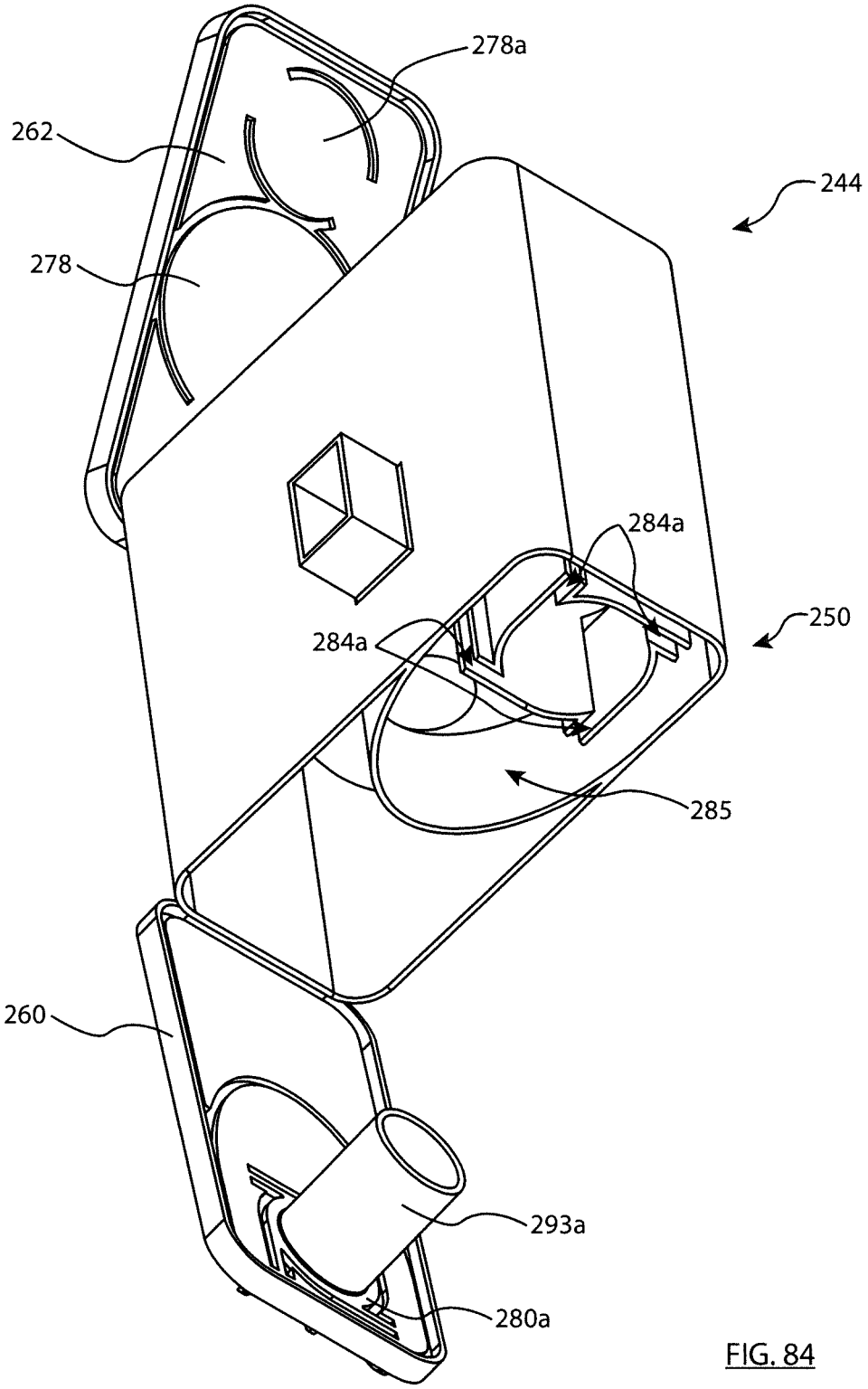
FIG. 84 is a rear perspective view of the air treatment member assembly of FIG. 77, with upper and lower doors open; and, FIG. 85 is a cross-sectional view of the air treatment member assembly of FIG. 77, with upper and lower doors open.
Figure 85:
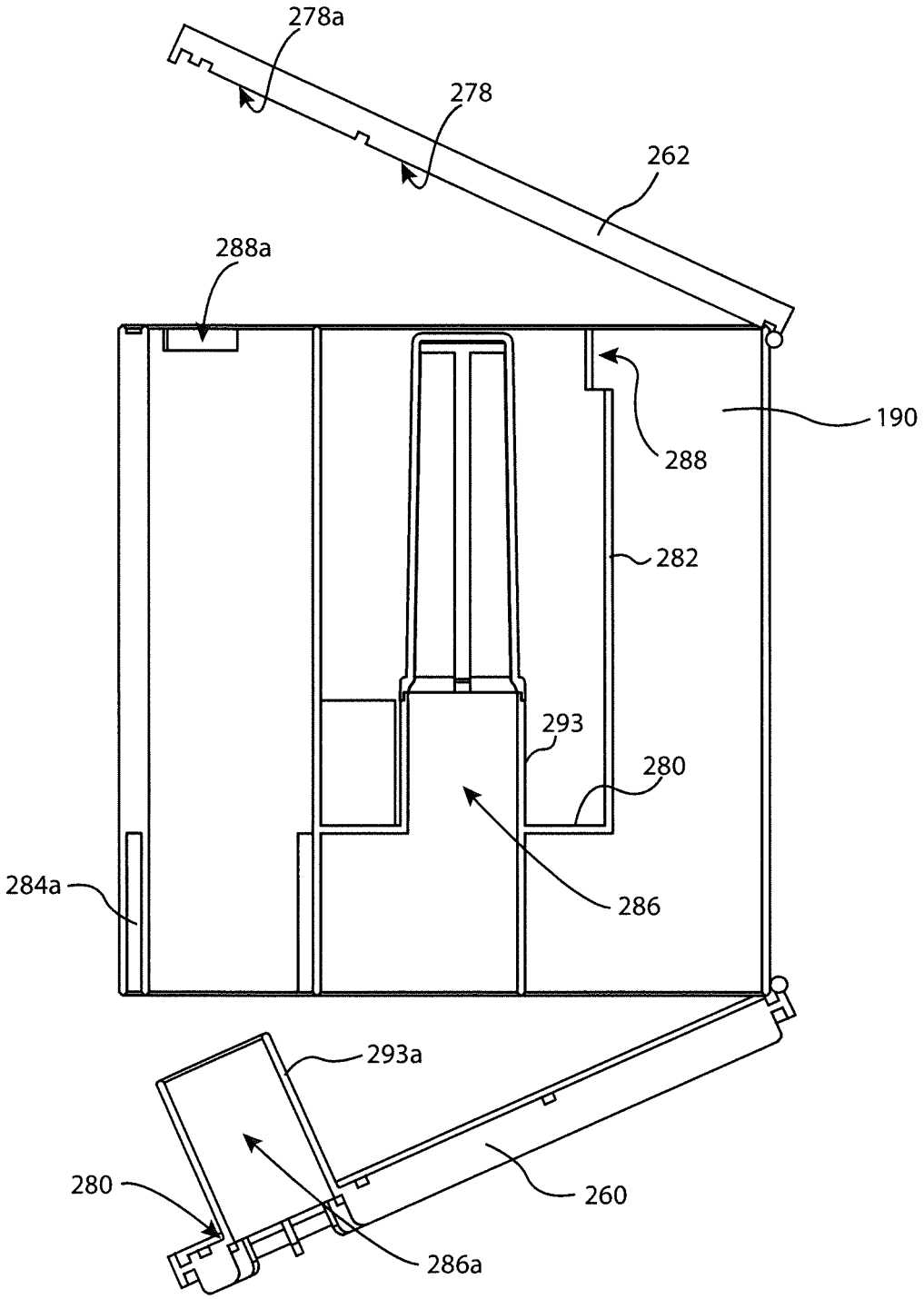

In other embodiments, such as shown in FIGS. 78 and 84, the lower end of the cyclone chamber 188*a* is positioned adjacent the openable bottom door 260, such that the dirt collection chambers 190 and 190*a* do not extend beneath the cyclone chamber 188*a*. In this arrangement, instead of using a separate exit conduit, the air outlet 286*a* of the cyclone chamber 188*a* includes the aperture 292 in the door 260. In addition to the aperture 292 being movable with the lower door 260, in this example an upwardly extending conduit 293*a* that forms part of the air outlet 286*a* is also movable with the door 260 (see FIG. 84). In this embodiment, opening the lower door 260 provides access to the interior of the cyclone chamber 188*a* and removes the conduit 293*a* from within the cyclone chamber 188*a*. The cyclone chamber 188 includes a similar conduit 293 (also referred to as a vortex finder—and similar conduits are included in the other embodiments described herein), but the conduit 293 is not moveable when the door 260 is opened. In the illustrated embodiment, opening the door 260 also opens the lower sides of each of the air inlets 284*a* (see also FIG. 83), which may be useful for cleaning or inspection of the air inlet s 284*a*.

When the air treatment member assembly 110 is mounted to the upright section, the aperture 292 is in fluid communication with the pre-motor filter chamber 194. This arrangement can also help simplify the air flow path, as the air exiting the cyclone chamber 188 may travel linearly along the direction of the cyclone axis 276 directly into the pre-motor filter chamber 194 and, in the illustrated embodiments, to the suction motor 112 that is positioned beneath the air treatment member assembly 110. Reducing the number of turns/corners along this portion of the air flow path may help reduce the back pressure in the air flow path. It will be appreciated that, in some embodiments, the suction motor inlet need not be aligned with, or extend in the same direction as, the cyclone chamber air outlet.

Figure 36:
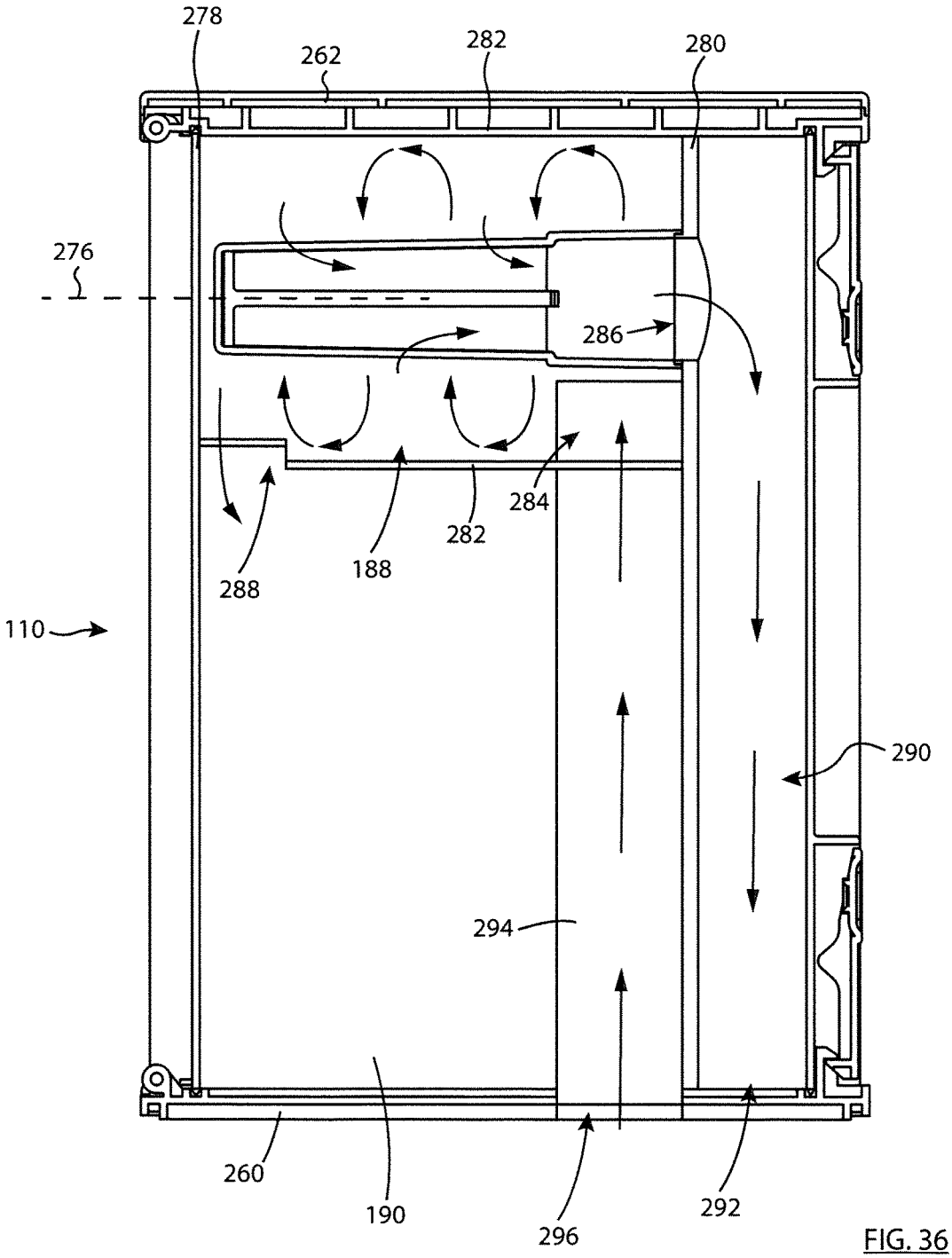
Figure 37:
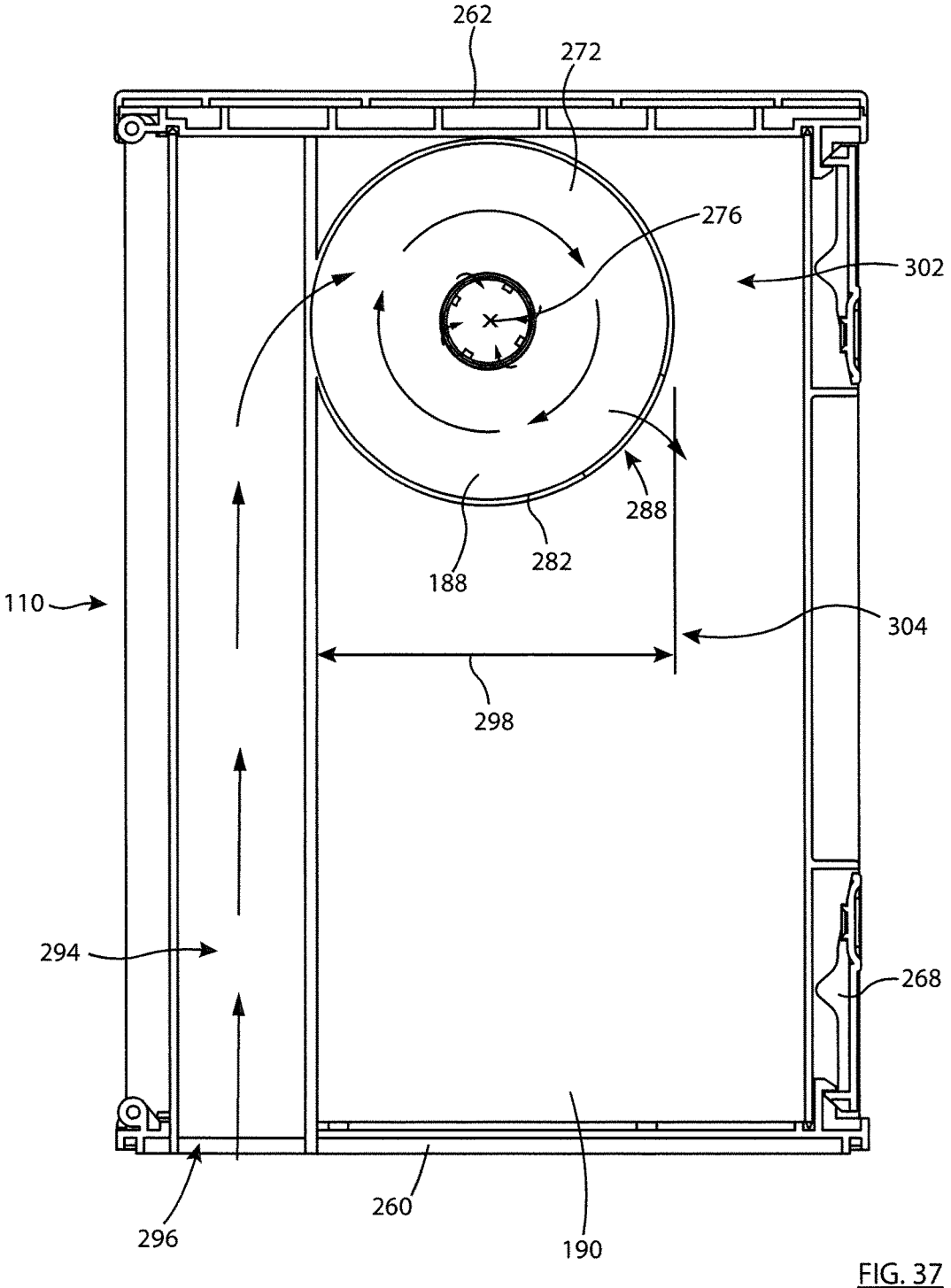
Figure 38:
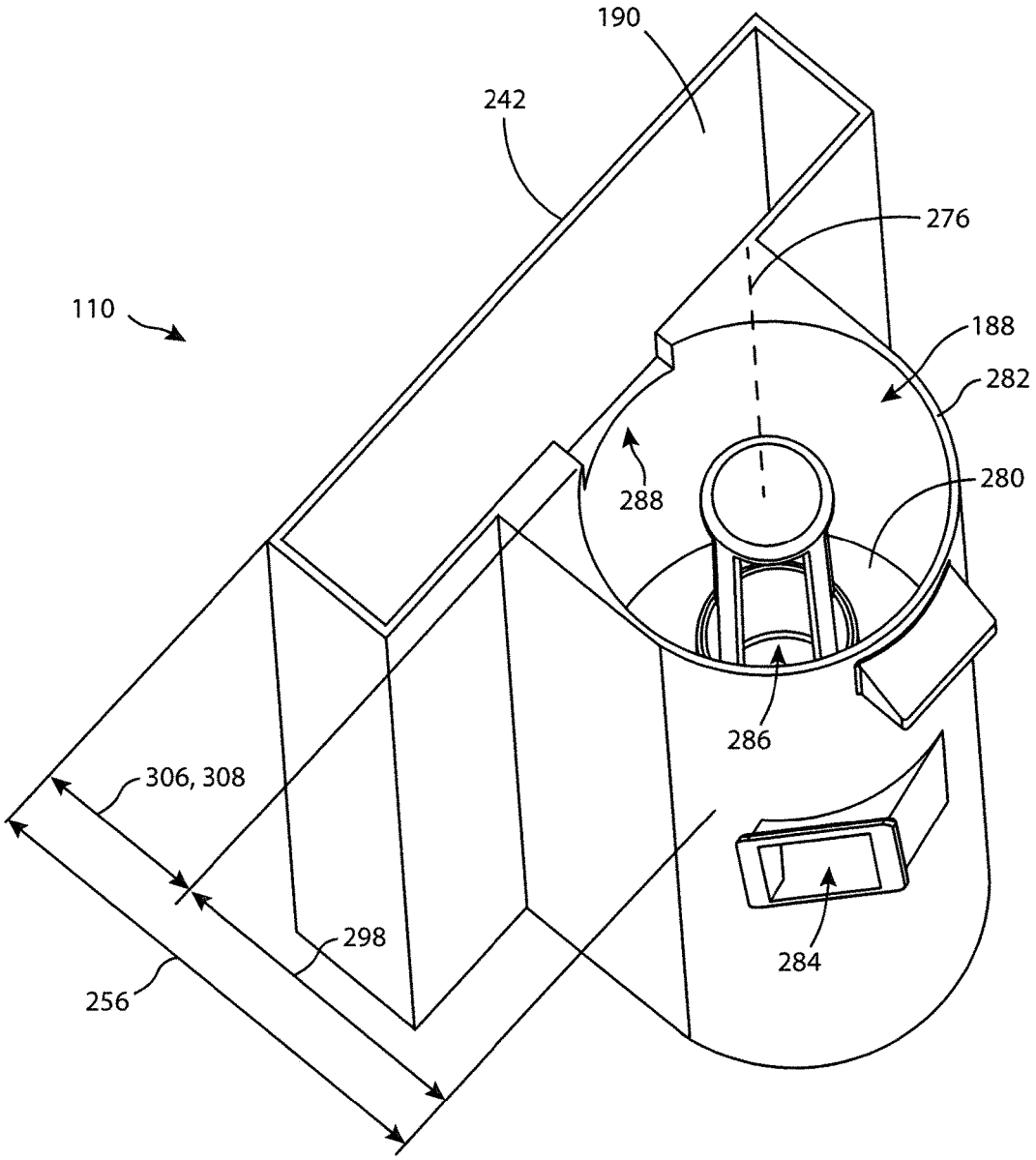
FIGS. 38-41 are top perspective views of different embodiments of an air treatment member assembly for use with a surface cleaning apparatus.
Figure 39:
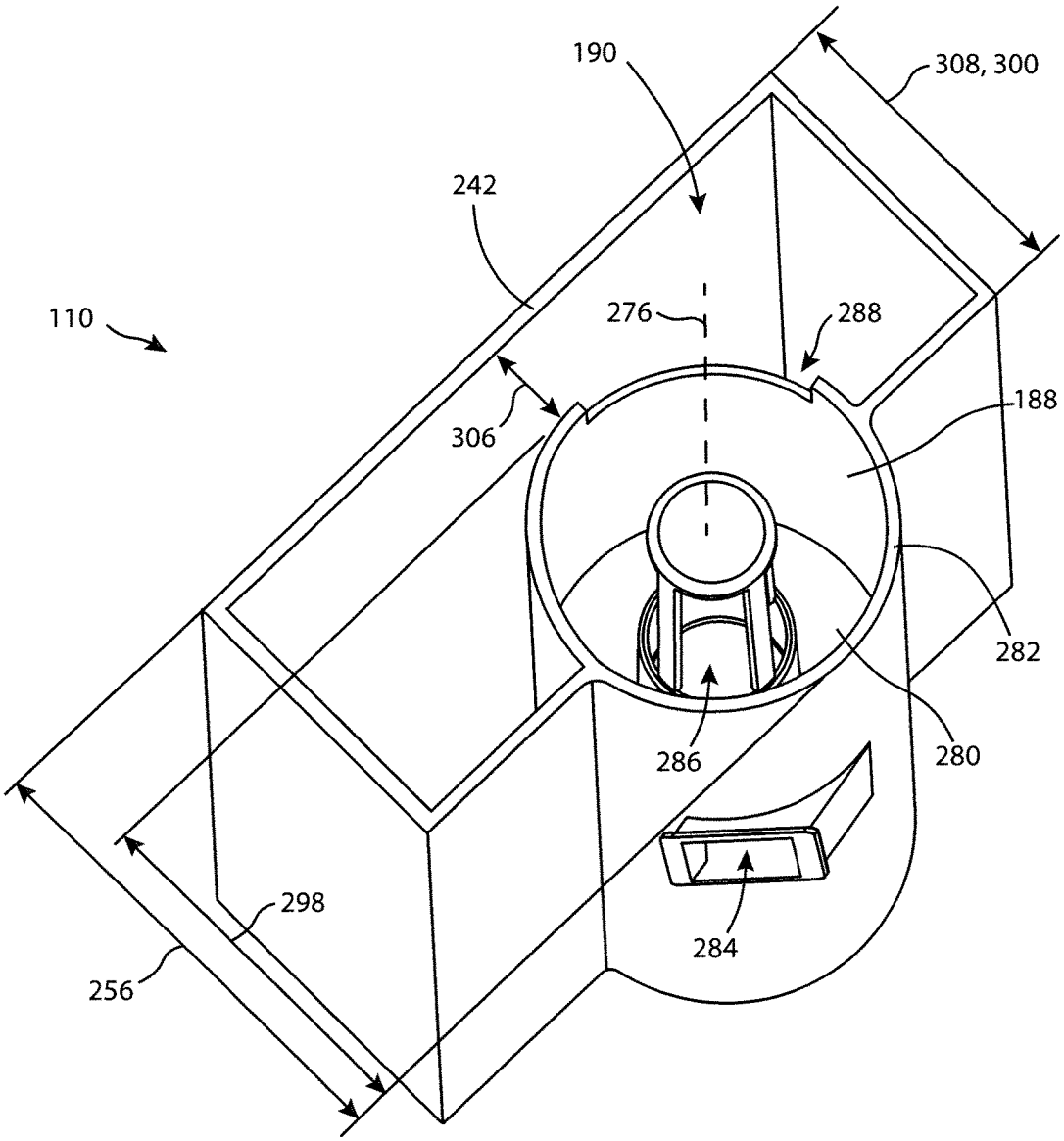

Alternatively, the cyclone chamber 188 may be configured as an inverted cyclone but may only include a single dirt outlet 288, which in the embodiment of FIG. 38 is provided at the front of the cyclone chamber 188. It will be appreciated that the overall depth 256 of the cyclone assembly is reduced in this embodiment since the dirt collection chamber 190 is not positioned rearward of the rearward extent of the cyclone chamber 188 and is configured to have a lateral length that is greater than its depth. It will also be appreciated that a single dirt outlet 288 need not be positioned directly at the front of the cyclone chamber, but instead may be offset toward one lateral side of the cyclone chamber, such as shown in the embodiments of FIGS. 31-33, 39, 40 and 77, or toward the bottom of the cyclone, such as shown in the embodiments of FIGS. 35-37.

Optionally, the cyclone chamber 188 may oriented in a generally upright configuration (i.e. the cyclone axis 276 (or axis 276*a*) is generally parallel to the handle axis 134 when the apparatus is in the upright position), but may alternatively be arranged so that the air outlet 286 is provided toward the top of the cyclone chamber 188, instead of the bottom. For example, in the embodiment of FIG. 41, the cyclone chamber 188 is arranged so that the air inlet 284 and the air outlet 286 are at the top of the air treatment member assembly 110, and the dirt outlet 288 is at the bottom. To connect this air treatment member assembly 110 to the air flow path, and aperture 292 may be provided in the upper door 262 of the air treatment member assembly 110 (not shown in this figure) and may be connected to suitable air flow conduits that may be external the dirt collection chamber 190 (for example conduits provided on or in the cleaning unit 130) to direct the air exiting the cyclone chamber 188 to suction motor 112. Configuring the air treatment member assembly 110 in this manner may, in some embodiments, increase the complexity of the air flow path between the cyclone chamber 188 and the suction motor 112 (for example as compared to the embodiment of FIGS. 22 and 23), but may help increase the capacity of the dirt collection chamber 190 by removing the need for the internal exit conduit 290. This may also help simplify the construction and/or operation of the lower door 260 of the air treatment member assembly 110, as it need not include an air exit aperture 292 and the associated gaskets and/or seals.

Alternatively, instead of arranging the cyclone chamber 188 in a generally upright configuration (in which the cyclone axis 276 is substantially parallel to the handle axis 134 in the upright position), the cyclone chamber 188 may be oriented in a lateral/sideways configuration in which the cyclone axis 276 is generally horizontal when the apparatus 100 is in the storage position, and optionally the cyclone axis 276 may be substantially orthogonal to the handle axis 137 when in the upright position. In the horizontal orientation, the cyclone chamber 188 may be oriented so that the cyclone axis 276 extends substantially laterally, i.e. substantially orthogonal to the longitudinal axis 144 (FIGS. 35 and 36), substantially longitudinally, i.e. substantially parallel to the longitudinal axis 144 (FIG. 37), or at any non-zero angle therebetween.

Figure 35:
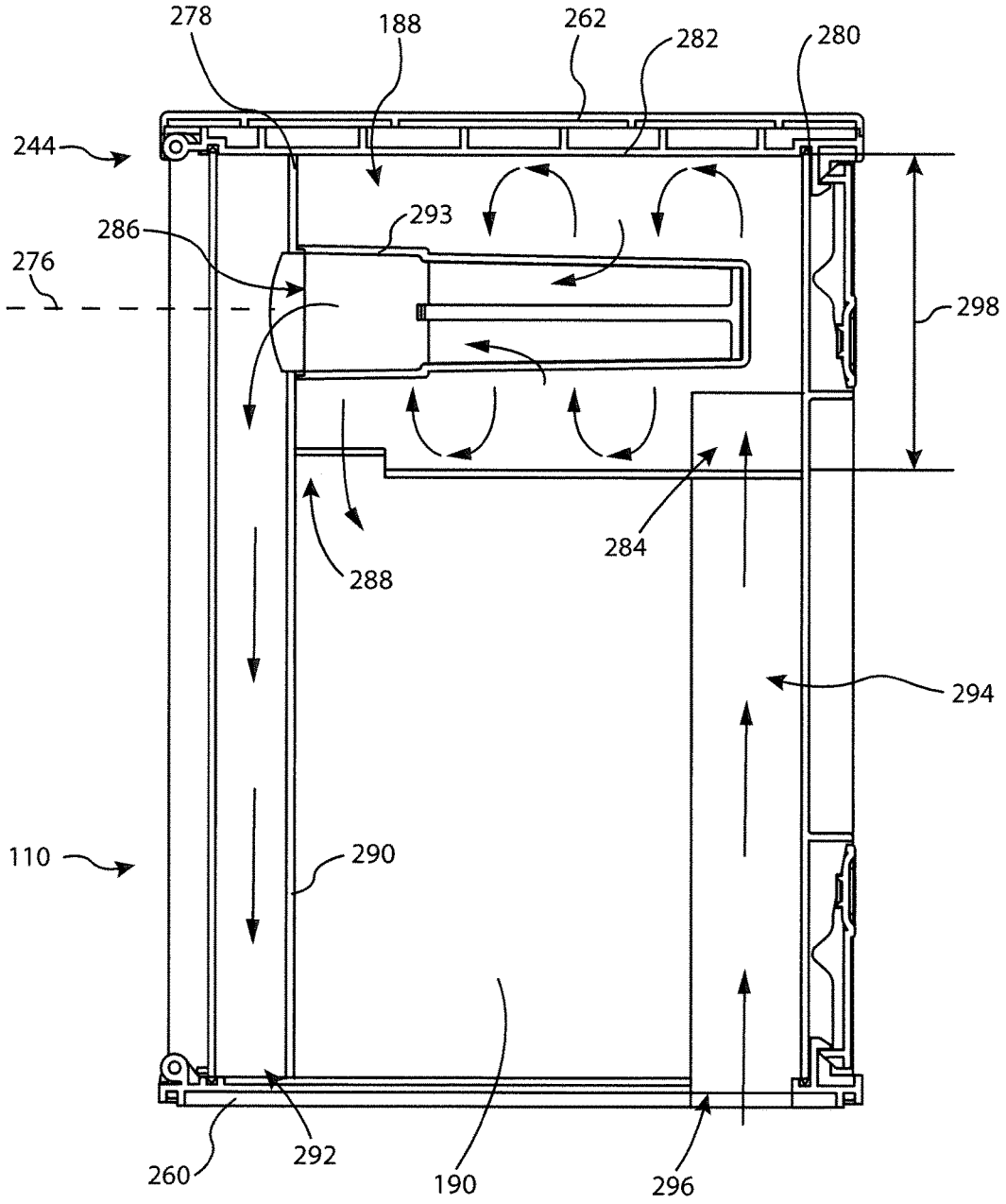
FIGS. 35 to 37 are cross-sectional views of different embodiments of an air treatment member assembly for use with a surface cleaning apparatus.

In the embodiment of FIG. 35, the cyclone chamber 188 is configured as a uniflow cyclone, where the cyclone air inlet 284 is at one end of the cyclone chamber 188 (toward the right as illustrated) and the air outlet 286 is at the opposed end of the cyclone chamber 188 (toward the left as illustrated), along with the dirt outlet 288. In this configuration, the air exit conduit 290 may extend generally vertically along one side of the air treatment member assembly 110, to an exit aperture 292 in the lower door 260. The air exit conduit 290 in this embodiment is only partially surrounded by the dirt collection chamber 190, and a portion of the exit conduit 290 forms part of the outer surface of the air treatment member assembly 110.

To supply air to the cyclone chamber 188, this embodiment includes an air inlet conduit 294 which, in the example illustrated is analogous to the air exit conduit 290 and, may extend from an inlet aperture 296 in the lower door 260 to the air inlet 284 in the cyclone chamber 188. In this arrangement, air travels generally upwardly into the cyclone chamber 188, rotates within the chamber, and travels downwardly from the cyclone chamber 188 to the rest of the air flow path. In the illustrated embodiment, much (and optionally all) of the dirt collection chamber 190 is located laterally between the air inlet 294 and exit conduits 290, and below the cyclone chamber 188.

Alternatively, instead of having a uniflow configuration, a laterally oriented cyclone may be configured with the air inlet and air outlet located toward the same end of the cyclone chamber. To provide air flow connections, the air treatment member assembly includes air inlet conduit 294 and air exit conduit 290 that may extend generally parallel to each other and may be located on toward the same side of the air treatment member assembly 110. As exemplified in FIG. 36, in this embodiment the dirt outlet 288 may be provided at the opposite end of the cyclone chamber 188 (to the left as illustrated). In these embodiments, the air inlet 294 and exit conduits 290 may be circular ducts, or may have any other suitable cross-sectional shape, including generally in the shape of a parallelogram (e.g., square or rectangular) and the like. Optionally, the inlet and exit conduits 294, 290 may have substantially the same cross-sectional flow area, so that the flow area at the cyclone air inlet 284 is generally equal to the flow area at the outlet 286 (this may be the case in any air treatment member assembly described herein). This may help reduce back pressure.

In the embodiment of FIG. 37, the cyclone chamber 188 is oriented so that the cyclone axis 276 is horizontal and is substantially parallel to the central longitudinal axis 144 of the apparatus 100, such that the cyclone axis 276 extends in the forward/rearward direction. In this arrangement, air is supplied to the cyclone chamber 188 via the inlet conduit 294, and removed via an outlet conduit that extends to the rear side of the air treatment member assembly (not shown in this figure). In this arrangement, changing the axial length of the cyclone chamber 188 can impact the overall depth 256 of the air treatment member assembly 110, whereas in the embodiments of FIGS. 35 and 36 the cyclone length is less relevant to the air treatment member assembly depth 256 than the cyclone diameter.

In the illustrated embodiments, the cyclone chambers 188 are generally cylindrical, and have a cyclone diameter 298 (FIG. 22). The cyclone diameter may be any suitable size, and may be, for example, between about 1 inch and about 6 inches or more, and preferably may be between about 2 inches and about 4 inches. The second cyclone chamber 188*a* has a diameter 298*a* (FIG. 82) which may be any suitable size, and in the illustrated example is less than the diameter 298.

Figure 41:
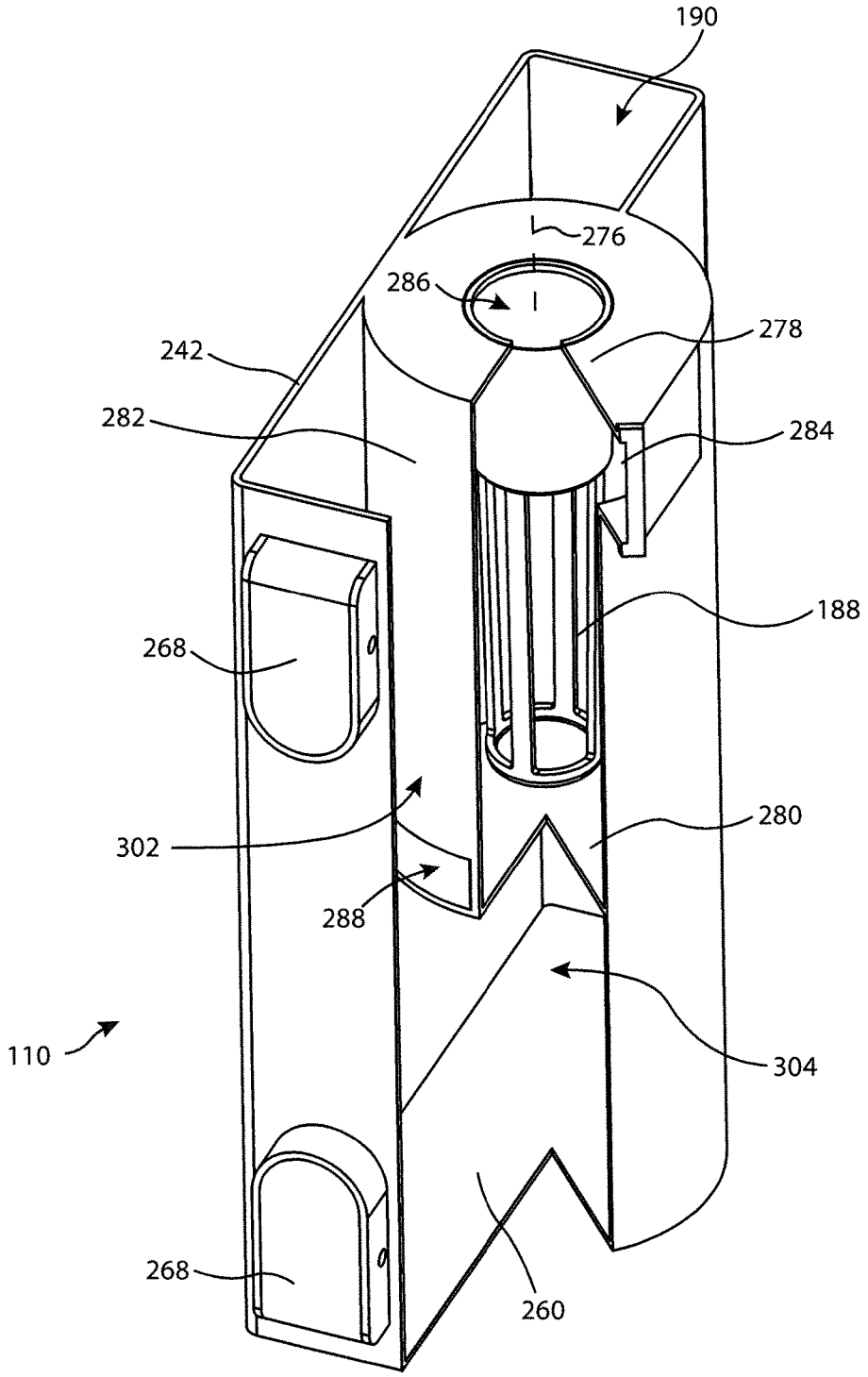

In some configurations, such as shown in FIGS. 22, 40 and 41, the cyclone diameter 298 may constitute a majority of the depth 256 of the air treatment member assembly 110 in the forward/rearward direction. For example, in the embodiments of FIGS. 22, 40, 45 and 82 the cyclone diameter 298 is equal to the maximum depth 256 of the air treatment member assembly 110. In this arrangement, sidewall 282 forms portions of the front and rear sides of the air treatment member assembly 110 (while the sidewall 282*a* does not in the illustrated example). Alternatively, the cyclone chamber 188 may be sized and/or positioned such that the cyclone diameter 298 is less than the air treatment member assembly depth 256, such as shown, for example, in the embodiments of FIGS. 38 and 39, and as shown for the second cyclone chamber 188*a* in FIG. 82.

Preferably, at least one portion of each cyclone chamber is openable. For example, a least a portion of the cyclone chambers 188 and 188*a* may be openable. This may help facilitate access to the cyclone chamber 188 or 188*a* for emptying, inspection, maintenance and the like. Optionally, one or both of the end walls 278, 280 of the cyclone chamber 188 may be openable. Referring to FIGS. 7, 8, 22-23, in this embodiment the upper end wall 278 of the cyclone chamber 188 is part of the openable upper door 262 of the air treatment member assembly 110, and is opened when the door 262 is opened. In these embodiments, neither the sidewall 282 nor the lower end wall 280 of the cyclone chamber 188 are openable. A similar arrangement is used in the embodiments of FIGS. 38-40. In the embodiment of FIGS. 77-85, the upper end walls 278 and 278*a* of the cyclone chambers 188 and 188*a* are both part of the openable upper door 262, such that opening the door 262 simultaneously opens both cyclone chambers 188 and 188*a*. In this embodiment the lower end wall 280 of cyclone chamber 188 is not openable, whereas the lower end wall 280*a* of cyclone chamber 188*a* is openable with lower door 260. Opening the door 262 also simultaneously opens dirt collection chambers 190 and 190*a*, whereas opening the lower door 260 opens dirt collection chamber 190 but does not open the lower end of dirt collection chamber 190*a*.

Alternatively, the end walls 278, 280 of the cyclone chamber 188 may be fixed, and a portion of the sidewall 282 may be openable. Examples of this configuration are shown in FIGS. 35 and 36, in which the openable upper door 262 of the air treatment member assembly 110 includes part of the sidewall 282 of the cyclone chamber 188. In this configuration, opening the upper door 262 can open the cyclone chamber 188, and neither the air inlet 284 or air outlet 286 are provided in a moving, openable portion of the air treatment member assembly 110.

In some embodiments, the cyclone chamber 188 need not be openable, as is shown in the embodiment of FIG. 41 where both the upper and lower end walls 278, 280 are fixed. However, this configuration may be modified to be openable, for example by making the upper end wall 278 openable.

It will be appreciated that, in some embodiments, the air treatment member may comprise two or more cyclone or other air treatment members in parallel with each other, rather than in series as illustrated with cyclone chambers 188 and 188*a*. Each cyclone chamber may include any suitable number of air inlets, air outlets and dirt outlets. For example, a cyclone may include four air inlets, one air outlet and two dirt outlets, or one air inlet, one air outlet and two dirt outlets, and the like.

Dirt Collection Chamber

The following is a description of dirt collection chambers that may be used by themselves in any surface cleaning apparatus or in any combination or sub-combination with any other feature or features described herein. For example, the dirt collection chambers described herein may be used with any one or more of the surface cleaning head, moveable wheels, upright section, air treatment member assemblies, carry handles, cyclone configurations, pre-motor filters, suction motors, post-motor filters, cleaning unit air flow ducts, above floor cleaning assemblies, low profile floor cleaning mode, bendable handle, adjustable handles, hose wraps and other features described herein.

In accordance with this aspect, some and preferably all of the dirt collection chamber or chambers are positioned external to the cyclone chamber. By positioning the dirt collection chamber or chambers exterior to the air treatment member, the dirt collection chamber or chambers may be positioned in a portion of the footprint of the cleaning unit 130 in which the air treatment member is not located. In this way, the dirt collection region or regions may be located and sized so as to not increase the depth of the cleaning unit, or to limit the extent to which the depth of the cleaning unit is increased. Accordingly, if the air treatment member has a longitudinal axis that extends vertically when the upright section is in the storage position, then the dirt collection region or regions may be laterally spaced from the air treatment member and if the air treatment member has a longitudinal axis that extends horizontally when the upright section is in the storage position, then the dirt collection region or regions may be spaced above or below the air treatment member.

The air treatment member assemblies 110 used in combination with the apparatuses 100 described herein can include any suitable type and/or configuration of dirt collection chamber 190 and/or dirt collection chamber 190*a* to receive and retain dirt and debris separated from the dirty air flowing through the air treatment member, for example the cyclone chambers 188/188*a*. Optionally, the dirt collection chambers 190/190*a* can at least partially, laterally surround the cyclone chambers 188/188*a*. For example portions of the dirt collection chamber 190 can be positioned forward of the cyclone chamber 188, rearward of the cyclone chamber 188, to the left or right sides of the cyclone chamber 188, or any suitable combination thereof. Dirt chamber 190*a* and cyclone chamber 188*a* may have an analogous configuration. In addition, portions of the dirt collection chambers 190/190*a* can extend below and beneath the cyclone chamber (or optionally above and overlie), such that the cyclone chamber 188/188*a* overlies (or underlies) some or all of the dirt collection chamber 190/190*a*. Configuring the cyclone chamber 188 and the dirt collection chamber 190 in this manner, at least partially, may help reduce the overall size of the air treatment member assembly 110.

Optionally, the dirt collection chamber 190 may be configured so that the dirt collection chamber 190 is only positioned laterally beside the cyclone chamber 188, and that the dirt collection chamber 190 does not extend completely in front of or behind the cyclone chamber 188. Optionally, the dirt collection chamber 190 may be configured so that the maximum depth 300 (FIGS. 21 and 23) of the dirt collection chamber 190 is equal to or less than the maximum depth of the cyclone chamber 188 (e.g. its diameter 298 as shown in FIG. 22, or its axial length as shown in FIG. 37). In some configurations, the dirt collection chamber 190 may not have a uniform depth, and some portions of the dirt collection chamber 190 may be relatively shallower than others in the forward/rearward direction. In accordance with such embodiments some or all of the portions of the support structure 212 (e.g., struts 214) may be positioned at these shallower locations so as to be recessed inwardly from the outer lateral extent of the cyclone chamber (see e.g., FIGS. 18 and 19).

Figure 52:
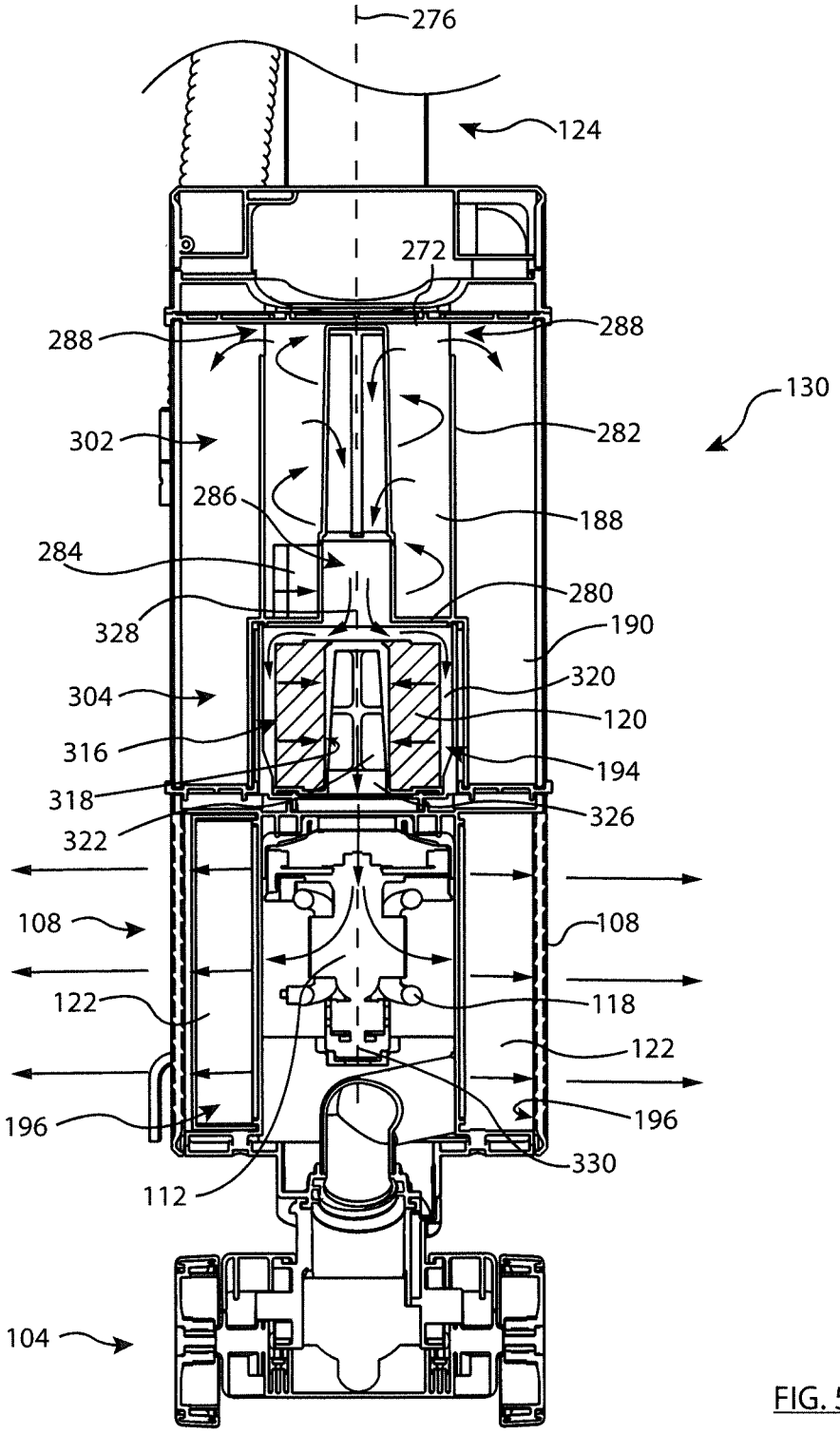
FIG. 52 is a cross-sectional view of the surface cleaning apparatus of FIG. 49, taken along line 52-52 in FIG. 50.

Referring to FIGS. 7, 8, and 22-24, in one embodiment the dirt collection chambers 190 have an upper region 302 that is provided adjacent each lateral side of the cyclone chamber 188, and a lower region 304 that is below the lower end wall 280 of the cyclone chamber 188, so as to underlie the cyclone chamber 188 in this embodiment. In this example, the cyclone chamber sidewall 282 contacts the front wall of the air treatment member assembly 110, and subdivides the upper region 302 into left and right portions, that are laterally separated by the cyclone chamber 188. Each of the left and right portions is in communication with a respective one of the dirt outlets 288 of the cyclone chamber 188. Optionally, the left and right portions could be sealed such that they function as separate first and second dirt collection chambers 190, each on different lateral sides of the cyclone chamber 188. Alternatively, as shown in this embodiment, both the left and right portions can be in communication with the lower region 304, such that dirt exiting via either dirt outlet 288 can eventually be collected in the common lower region 304 (at least until the dirt level reaches the lower end 280 of the cyclone chamber 188, at which point the left and right portions may be temporarily isolated from each other). In this embodiment, the strut portions 214 of the support structure 212 of the cleaning unit 130 are positioned behind a respective dirt collection chamber 190. Optionally, the lower region 304 may also be configured to laterally surround another portion of the apparatus 100, such as the pre-motor filter 120 as shown in the embodiment of FIG. 52.

Figure 82:
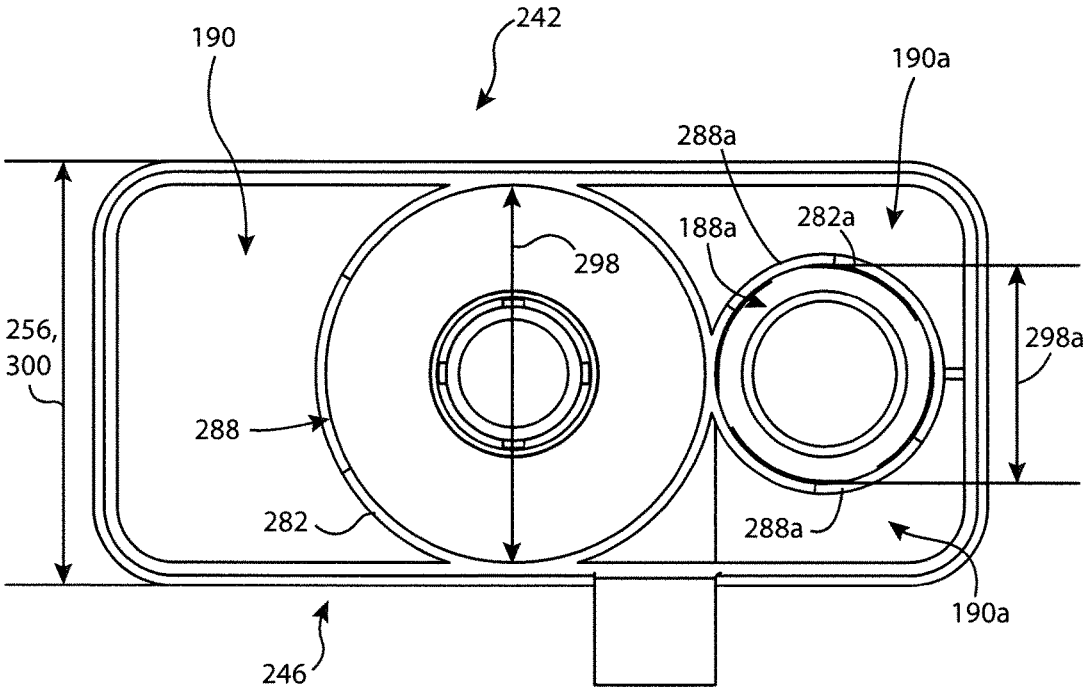
FIG. 82 is a top plan view of the air treatment member assembly of FIG. 77.
Figure 83:
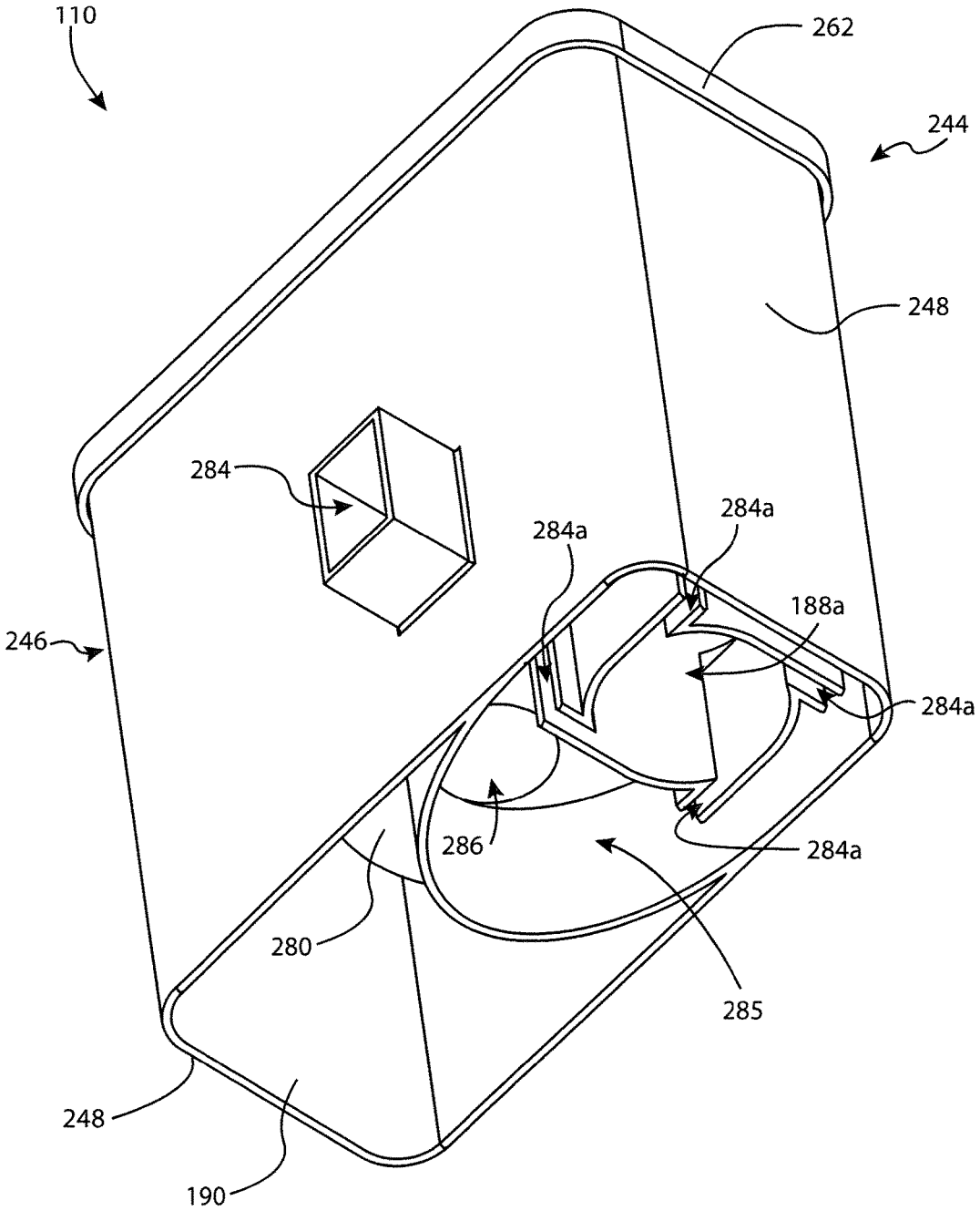
FIG. 83 is a bottom perspective view of the air treatment member assembly of FIG. 77, with the lower door removed.

Optionally, instead of extending between the front and rear walls of the air treatment member assembly 110, the cyclone chamber 188 may be sized and/or positioned so that the dirt collection chamber 190 is at least partially in front or behind the cyclone chamber 188. Accordingly, the cyclone chamber will not extend all the way to the front or rear wall of the air treatment member assembly 110. This may help reduce the overall size of the air treatment member assembly 110, while providing a dirt collection chamber 190 with a desired internal volume. For example, in the embodiment of FIG. 39, the cyclone chamber 188 is partially nested within the dirt collection chamber 190, and the dirt collection chamber 190 partially laterally surrounds the cyclone chamber 188, but the front of the cyclone chamber 188 is offset from the front wall of the dirt collection chamber by an offset distance 306. In this embodiment, the total depth 256 of the air treatment member assembly 110 is greater than the cyclone diameter 298, and may be about equal to the sum of the cyclone diameter 298 and the offset distance 306. Optionally, in this embodiment the dirt collection chamber 190 may extend beneath the lower end of the cyclone chamber 188. In the embodiment of FIG. 82, the dirt collection chamber 190*a* is positioned both in front of and behind the cyclone chamber 188*a*. In this arrangement, the overall depth of the cyclone chamber 188*a* and the dirt chambers 190*a* is equal to the diameter 298 of the cyclone chamber 188, and therefore this arrangement does not require that the depth 256 of the air treatment member assembly 110 be larger than the diameter 298. Portions of the dirt collection chamber 190*a* are located on one side of the cyclone chamber 188 (to the right as illustrated in FIG. 82), while the dirt collection chamber 190 is positioned on the opposite side (the left as illustrated) of cyclone chamber 188. In this arrangement, the cyclone chamber 188 separates the dirt collection chambers 190*a* and 190 from each other.

Optionally, instead of providing dirt collection chambers 190, or portions thereof, on both lateral sides of the cyclone chamber 188, the dirt collection chamber 190 may be provided on only one lateral side of the cyclone chamber 188 and optionally may extend beneath the cyclone chamber 188. For example, in the embodiment of FIGS. 31-33, the cyclone chamber 188 is laterally offset toward one side of the air treatment member assembly 110, and the upper region 302 of the dirt collection chamber 190 is located only on one side of the cyclone chamber 188. The lower region 304 of the dirt collection chamber may extend across the width of the air treatment member assembly 110, including a region beneath and underlying the cyclone chamber 188. Arranging the air treatment member assembly 110 in this manner may allow for a variety of different cyclone chamber placements, which may provide flexibility in the air flow path configuration. For example, if the suction motor 112 is located toward one lateral edge of the cleaning unit 130, positioning the cyclone chamber 188 toward the same lateral side of the cleaning unit 130 may align the air flow path components.

In the embodiment of FIG. 40, the cyclone chamber 188 is positioned on one lateral side of the air treatment member assembly 110, while the dirt collection chamber is primarily located on the other lateral side, and a lower region 304 of the dirt collection chamber 190 may optionally underlie at least a portion of the cyclone chamber 188. The embodiment of FIGS. 42-48 has an analogous configuration of the air treatment member assembly 110, and is arranged so that the suction motor 112 is also offset toward the same side as the cyclone chamber 188. In the embodiment of FIG. 79, the dirt collection chamber 190 is located on one lateral side of the cyclone chamber 188, and a lower portion 304 underlies a portion of the cyclone chamber 188.

Optionally, the cyclone chamber 188 need not be nested within the dirt collection chamber in the forward/rearward direction at all, and in some embodiments may be located substantially and/or entirely forward or rearward of the dirt collection chamber 190. Such configurations may allow the interior of dirt collection chamber 190 to be generally free from obstruction by the cyclone chamber 188. This may also allow the cyclone chamber 188 to be nested within the support structure 212, while the dirt collection chamber 190 remains located toward the front or rear of the cleaning unit 130. This configuration may allow different air flow path configurations, as neither the inlet nor the exit conduits 294, 290 need to pass through the interior of the dirt collection chamber 190. In the embodiment of FIG. 38, the cyclone chamber 188 is not nested within the dirt collection chamber 190, and instead is offset behind the dirt collection chamber 190. In this example, a single dirt outlet 288 is provided at the front of the cyclone chamber 188, through which debris can travel laterally forwardly into the dirt collection chamber 190. In this embodiment the overall depth 256 of the air treatment member assembly 110 is greater than the cyclone diameter 298, and is generally equal to the sum of the cyclone diameter 298 and offset distance 306.

Optionally, the dirt collection chamber 190 may be configured so that it does not extend underlie or extend below the bottom of the cyclone chamber 188. Portions of the dirt collection chamber 190 may be positioned laterally beside the cyclone chamber 188, and portions of the dirt collection chamber 190 may extend below the bottom end of the cyclone chamber 188 without extending beneath the cyclone chamber 188. For example, FIG. 52 illustrates one embodiment wherein the dirt collection chamber 190 extends laterally beside the cyclone chamber 188, and lateral portions of the dirt collection chamber 190 extend downwardly below the bottom end wall 280 of the cyclone chamber 188, but do not underlie the cyclone chamber 188. This may allow the space beneath the cyclone chamber 188 to be used to accommodate other components of the surface cleaning apparatus including, for example, the pre-motor filter 120 and pre-motor filter chamber 194 as illustrated in this embodiment. Nesting other portions of the surface cleaning apparatus 100 with the air treatment member assembly 110 may help reduce the overall size of the cleaning unit 130 and/or the surface cleaning apparatus 100.

The dirt collection chamber 190 or **190*a* may be sized to have any suitable internal volume for holding dirt. For example, the volume of the dirt collection chamber 190 may be between about 0.5 to about 2.5 liters, from about 1 to about 2 liters, or more in some applications, and may be between about 0.5 gallon and about 1 gallon. Optionally, the dirt collection chamber 190 can be configured so that at least a portion of the volume is provided laterally around the cyclone chamber 188 (such as the left and right portions in the upper region 302 of FIG. 23). The portion of the volume that is laterally adjacent the cyclone chamber 188, as opposed to being below or beneath the cyclone chamber 188 (such as the lower region 304 in FIG. 23) may be between about 0% and about 100% of the total volume of the dirt collection chamber 190**, and optionally may be between about 25% and about 90%, between about 40% and about 80%, between about 50% and about 70% of the volume, and optionally may be at least 60% of the volume and/or at least 80% of the total dirt collection chamber volume in some embodiments.

In some embodiments, the dirt collection chamber 190 may have different depths at different locations within the dirt collection chamber. Referring to FIGS. 21 and 23, in this example the upper region 302 (FIG. 23) of the dirt collection chamber 190 has a depth 308 (FIG. 22) that is less than the cyclone diameter 298 (which also corresponds to the cyclone chamber depth in this configuration), while portions of the lower region 304 of the dirt collection chamber have a depth 300 that is greater than the depth 308 of the upper region 302, and may be about equal to the cyclone diameter 298. Optionally, the depth 308 can be less than the diameter 162 of the wheels 158. This may help reduce the overall size of the air treatment member assembly 110. The embodiments of FIGS. 38 and 39 may have similar configurations, where the cyclone diameter 298 is greater than the depth 308 of at least the upper region 302 of the dirt collection chamber 190. Alternatively, the air treatment member assembly 110 may be configured such that the minimum depth of the dirt collection chamber 190 is generally equal to or greater than the depth/diameter 298 of the cyclone chamber 188. In the embodiment shown in FIG. 40, the depth 300 of the dirt collection chamber 190 is substantially the same as the cyclone diameter 298, and the overall depth 256 of the air treatment member assembly 110. Similarly, the embodiments of FIGS. 35-37 may also be configured such that the depth of the dirt collection chamber is at least equal to the depth of the cyclone chamber.

Optionally, one or both ends of the dirt collection chambers **190/190*a* may be openable for emptying. In the embodiment of FIGS. 10 and 11, both ends of the dirt collection chamber 190 are openable, the upper end being opened when the upper door 262 is opened, and the lower end being opened when lower door 260 is opened. In the embodiment of FIG. 84, the upper and lower ends of the dirt collection chamber 190 are opened by opening doors 262 and 260 respectively, while only the upper end of the dirt collection chamber 190*a*** is openable.

Pre-Motor Filter

The following is a description of pre-motor filters that may be used by themselves in any surface cleaning apparatus or in any combination or sub-combination with any other feature or features described herein. For example, the pre-motor filters described herein may be used with any one or more of the surface cleaning head, moveable wheels, upright section, air treatment member assemblies, carry handles, cyclone configurations, dirt collection chambers, suction motors, post-motor filters, cleaning unit air flow ducts, above floor cleaning assemblies, low profile floor cleaning mode, bendable handle, adjustable handles, hose wraps and other features described herein.

In accordance with this aspect, the pre-motor filter may be positioned so as to be visible or accessible when the air treatment member assembly is removed. Alternately or in addition, the pre-motor filter assembly may be positioned in a linear air flow path extending from the air treatment member air outlet to the suction motor air inlet.

Optionally, a pre-motor filter may be provided in the air flow path between the air treatment member assembly and the suction motor. The pre-motor filter may be housed in a pre-motor filter housing that may, optionally, be provided in the cleaning unit 130. The pre-motor filter may be any suitable filter, including a physical, porous media filter (e.g., foam, felt), electrostatic filter, HEPA filter and the like. The pre-motor filter may have any suitable physical configuration and may be positioned in any suitable location that is consistent with the cleaning unit and/or air treatment member in a given embodiment of the apparatus 100.

In the illustrated embodiments (see for example FIGS. 7, 25, 30, 31, 34 and 52) the lower housing 192 of the cleaning unit 130 includes the pre-motor filter chamber 194, which is positioned below and underlies at least a portion of the air treatment member assembly 110. Optionally, the pre-motor filter chamber 194 may also be located above and overlies the suction motor 112 and motor housing 118. Optionally, as shown in the embodiment of FIGS. 77-85, the pre-motor filter chamber 194 may be removable from the motor housing 118.

In the embodiments of FIGS. 7, 25, 30, 31 and 34, the pre-motor filter 120 is a generally flat, planar type filter that includes a foam layer 310 and a felt layer 312 (FIG. 25). The pre-motor filter 120 extends in a generally lateral filter plane 314 (which is horizontal as illustrated in FIG. 7). The pre-motor filter 120 includes an upstream side 316 (FIG. 25) through which air can enter the pre-motor filter, and that has an upstream flow area (i.e. the cross-sectional area of the pre-motor filter taken in a plane orthogonal to the direction of air flow through the pre-motor filter). The pre-motor also has an opposing downstream side 318 (FIG. 25) through which air can exit the pre-motor filter 120, and that has a downstream flow area. Optionally, the upstream and downstream flow areas may be substantially equal.

In these embodiments, the upstream side 318 may be in communication with an upstream header area 320 (FIG. 31), defined between the upstream side 318 of the pre-motor filter 120 and the bottom of the air treatment member assembly 110, and a downstream header area 322, defined between the downstream side 318 and the underlying portions of the cleaning unit 130, which include the motor housing 118 and the post-motor filter chamber 196 in this embodiment. In this embodiment, the pre-motor filter chamber 194 and the pre-motor filter 120 overlie at least a portion of the suction motor 112 and at least a portion of the post-motor filter 122 and its respective post-motor filter chamber 196. Stacking the components in this manner may help reduce the overall size of the cleaning unit 130.

The pre-motor filter 120 may be removed from the pre-motor filter chamber 194 when the air treatment member assembly is removed (FIG. 25).

Figure 30:
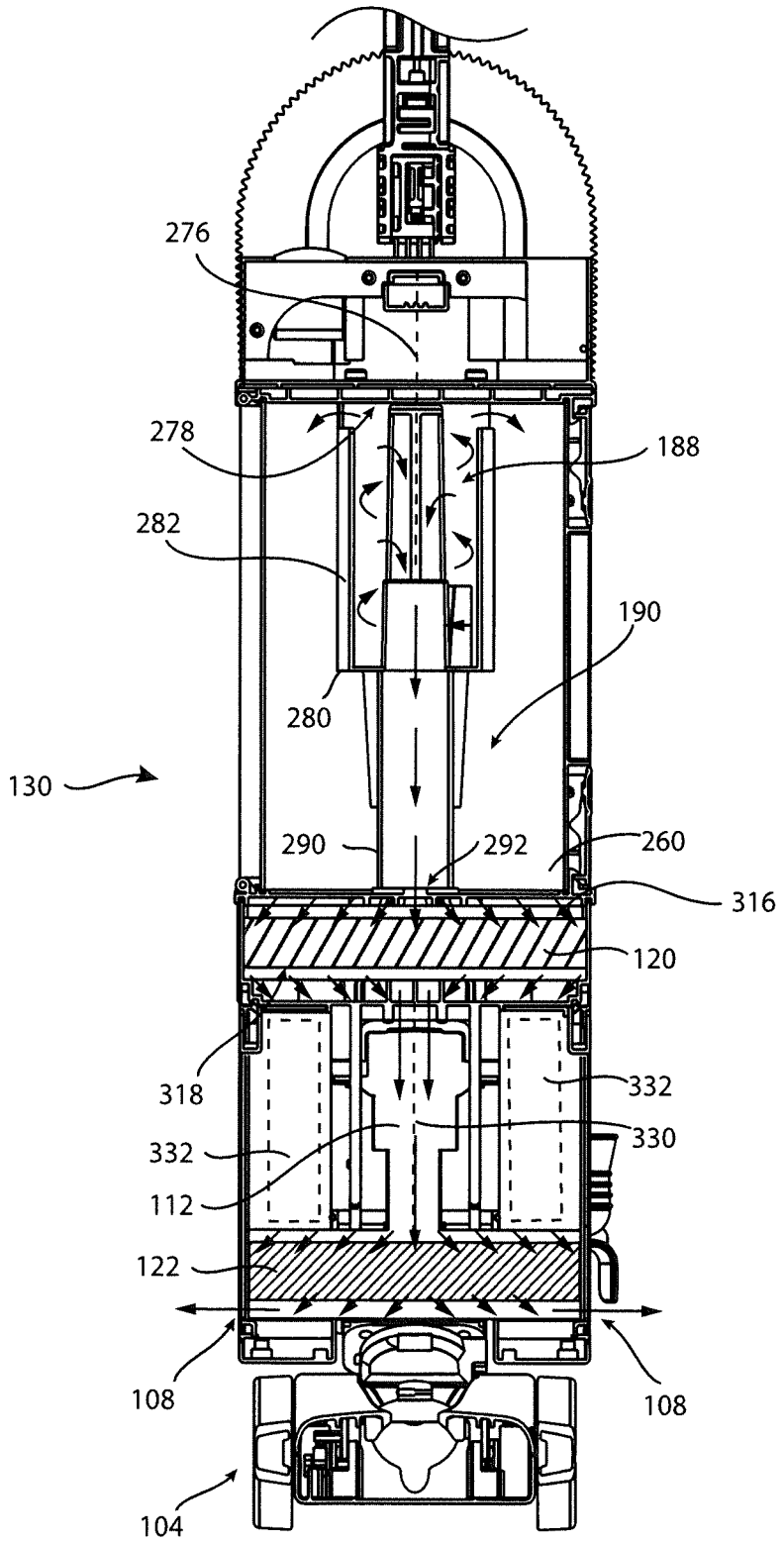
FIG. 30 is a cross-sectional view of a cleaning unit of another embodiment of a surface cleaning apparatus.
Figure 31:
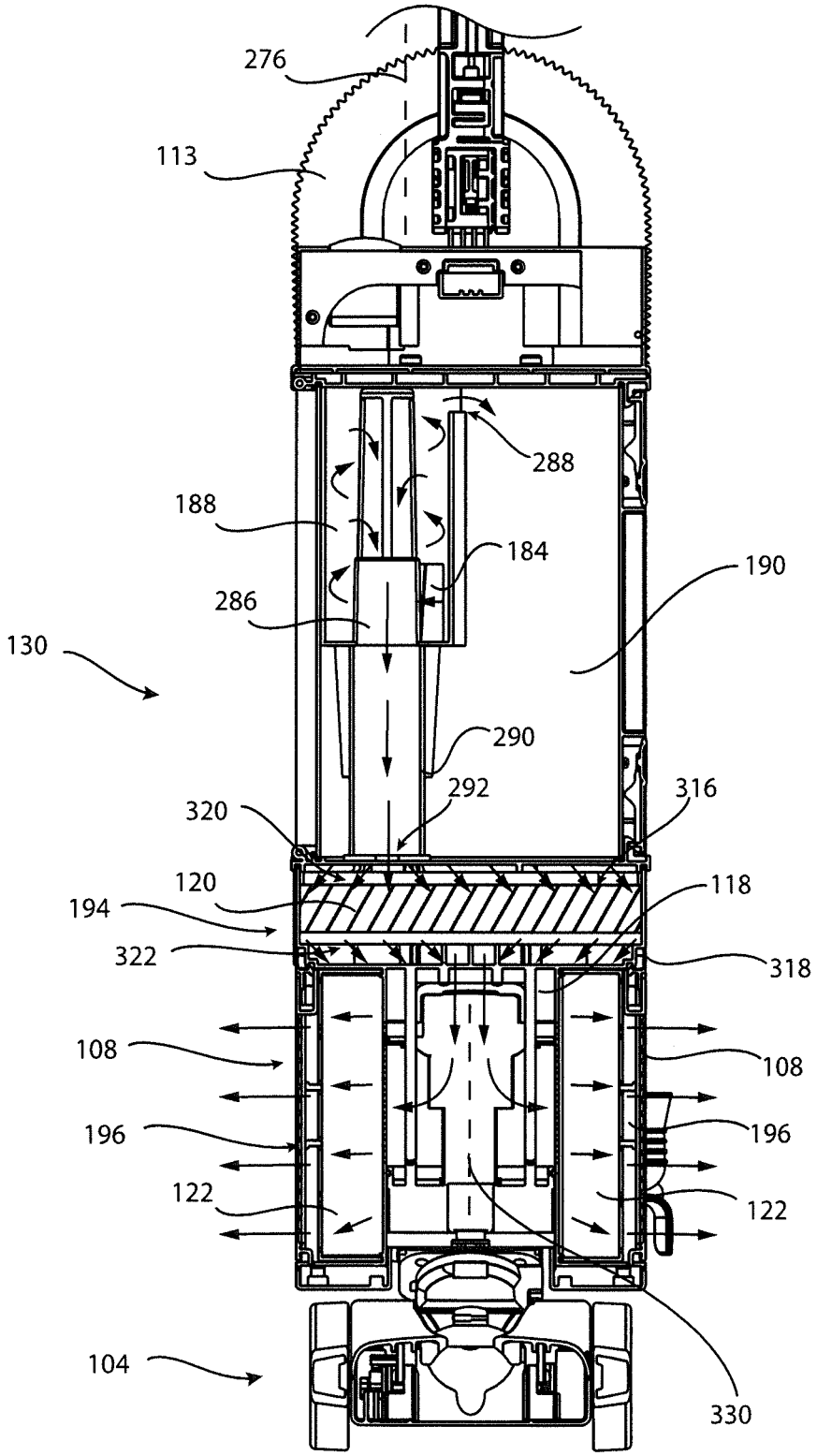
FIG. 31 is a cross-sectional view of a cleaning unit of another embodiment of a surface cleaning apparatus.
Figure 32:
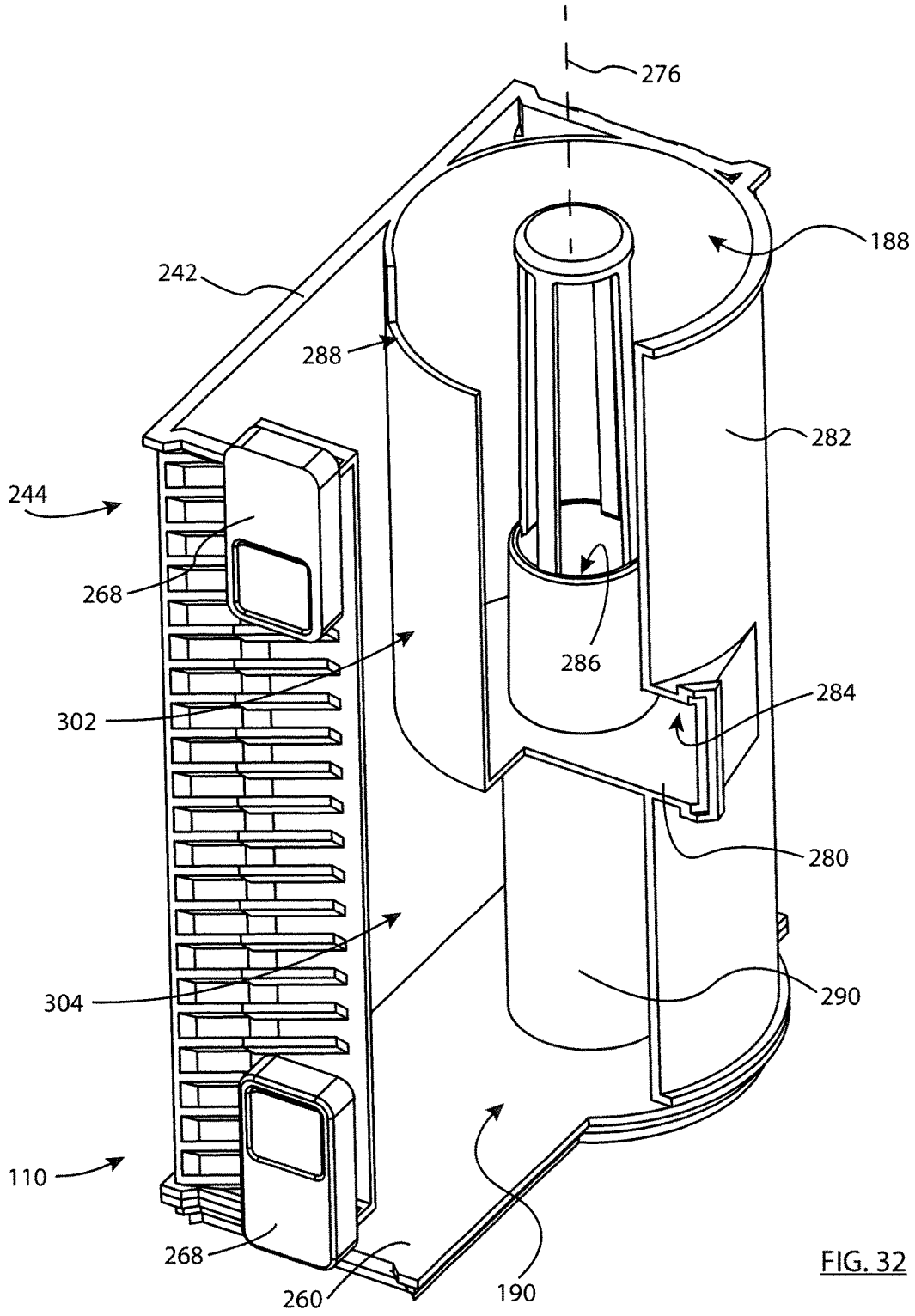
FIG. 32 is a partially cut-away perspective view of a portion of the surface cleaning apparatus of FIG. 31.
Figure 33:
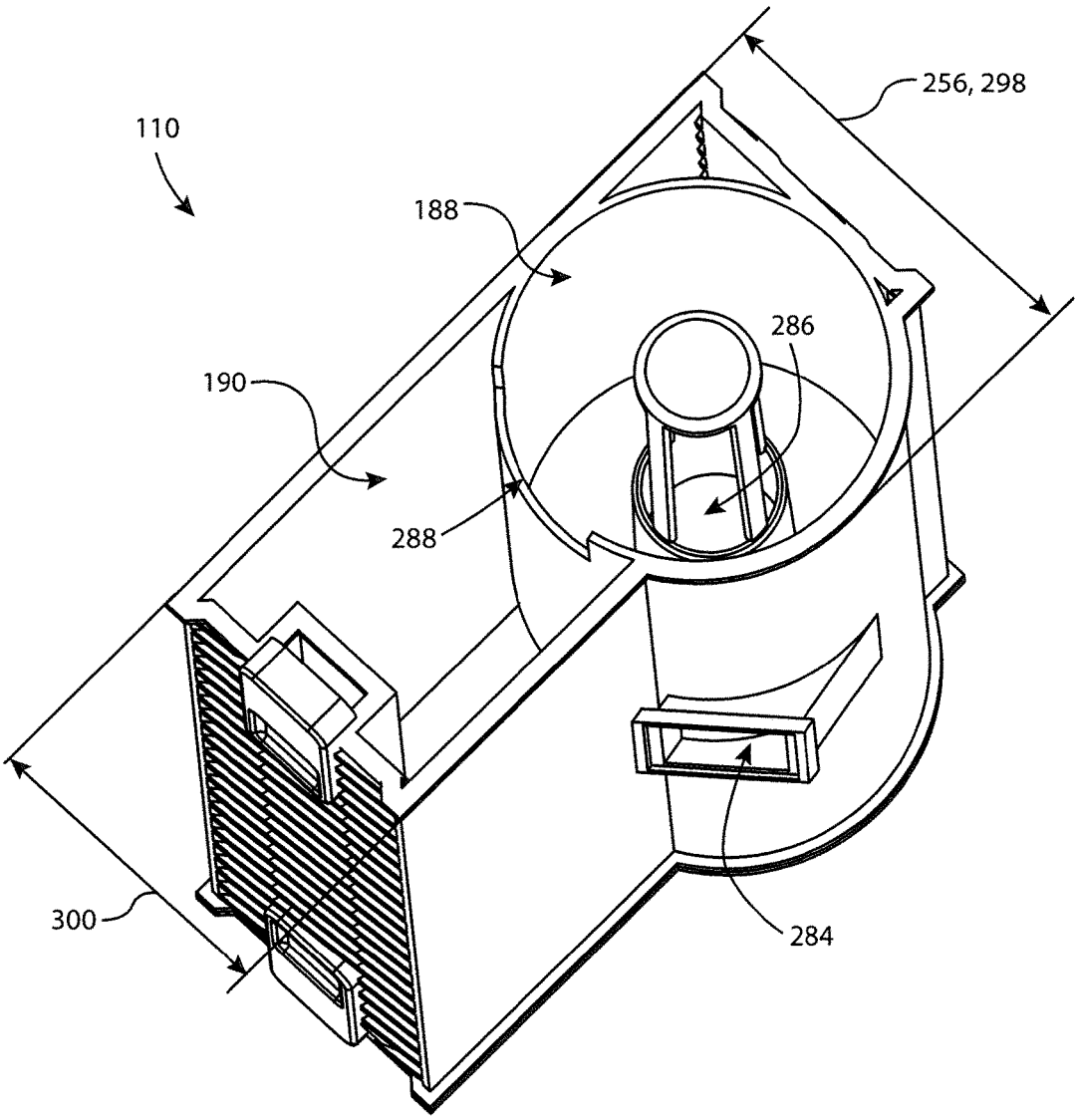
FIG. 33 is a top perspective view of the portion of the cleaning unit of FIG. 31.

As exemplified in FIGS. 7, 30- and 34, the air exit aperture 292 in the bottom end of the air treatment member assembly 110 maybe generally centered in the left/right direction, and air therefore enters the upstream header at about the centerline of cleaning unit 130. Alternatively, as shown in FIG. 31, the air exit aperture 292 (along with the cyclone chamber 188 and exit conduit 290) may be offset to one side of the cleaning unit 130, such that air enters the upstream header 320 toward one side of the header. In either embodiment, the header 320 is configured to allow air to travel laterally across the upstream surface 316 of the pre-motor filter 120, before being drawn through the pre-motor filter 120.

In these embodiments, the pre-motor filter chamber 194, and pre-motor filter 120, may extend the entire lateral width 238 of the cleaning unit 130. This may help increase the upstream and downstream flow areas. Alternatively, the pre-motor filter chamber 194 and pre-motor filter 120 may extend across only a portion of the width 238 of the cleaning unit 130. Optionally, the pre-motor filter chamber 194, and pre-motor filter 120, may be configured to extend over at least 40%, and optionally at least 50%, at least 60%, at least 70%, at least 75%, at least 80% or more of the overall depth 201 of the cleaning unit 130. Increasing the depth of the pre-motor filter 120 may help increase its upstream flow area and reduce the frequency of cleaning or replacing the pre-motor filter. Referring to FIG. 21, in this embodiment, the pre-motor filter chamber, and pre-motor filter, has a depth 324 that is over about 75% of the maximum cleaning unit depth 201.

Alternatively, instead of being configured as a generally planar filter, the pre-motor filter 120 may be configured as a generally cylindrical filter. In the embodiment illustrated in FIGS. 49-52, the pre-motor filter 120 is itself configured as a generally cylindrical foam filter with a hollow, open interior that may be sized to fit around an optional outlet conduit 326. The foam filter extends longitudinally between upper and lower ends along a filter axis 328, which is generally vertical in the illustrated embodiment. In this example, the pre-motor filter 120 and outlet conduit 326 are concentrically positioned, and both extend along the filter axis 328. In this embodiment, the filter axis 328 is co-axial with the cyclone axis 276, but alternatively the pre-motor filter 120 may be laterally offset from the cyclone chamber 188, such that the axes 328 and 276 are not co-axial, but optionally may still be substantially parallel to each other. The filter axis 328 is also parallel to the suction motor axis 330 in this embodiment, but need not be in other embodiments.

As exemplified in FIGS. 49-52, the pre-motor filter 120 is sized so that its diameter is less than the diameter of the pre-motor filter housing side wall. In this arrangement, a generally annular flow region is defined between the side wall and the outer wall of the filter which functions as the upstream surface 316. This annular flow region functions as the upstream header 320. An opposed inner wall of the filter surrounds and faces the outlet conduit 326 and functions as the downstream surface 318. In this embodiment, the interior of the conduit 326 can function as the downstream header 322. In this embodiment, the pre-motor filter 120 has a generally annular transverse cross-sectional area, taken in a plane that is orthogonal to the filter axis 328.

Referring to FIG. 52, in the illustrated example, the projection of the suction motor axis 330 extends through the pre-motor filter chamber 194 and through the interior of the conduit, but does not actually intersect the foam filter itself. In this configuration the air exiting the pre-motor filter 120 may be traveling in the same direction as air entering the suction motor 112, which could help reduce back pressure.

In this embodiment, the pre-motor filter chamber 194 and pre-motor filter 120 underlie the cyclone chamber 188 and overlie at least a portion of the suction motor 112, but does not extend beneath the dirt collection chamber 190 or above the post-motor filter chamber 196.

Positioning of the Suction Motor

The following is a description of suction motors that may be used by themselves in any surface cleaning apparatus or in any combination or sub-combination with any other feature or features described herein. For example, the suction motors described herein may be used with any one or more of the surface cleaning head, moveable wheels, upright section, air treatment member assemblies, carry handles, cyclone configurations, dirt collection chambers, pre-motor filters, post-motor filters, cleaning unit air flow ducts, above floor cleaning assemblies, low profile floor cleaning mode, bendable handle, adjustable handles, hose wraps and other features described herein.

In accordance with this aspect, the suction motor housing 118, and the suction motor positioned therein, may be sized so as not to increase the depth of the cleaning unit 130 or the upright section at the location of the cleaning unit 130. Accordingly, the diameter 335 of the suction motor housing 118 may be equal to or less than depth 201 and may be equal to or less than depth 230. Optionally, the suction motor may be sized so that the depth 230 of the air treatment member assembly 110 is the same as the diameter of the suction motor ±2 inches or ±1 inches. Optionally, as shown in FIG. 20, the diameter of the suction motor may be the depth of the cleaning unit from front plane 198 to rear plane 200.

The suction motor 112 used in combination with the embodiments described herein may be any suitable type of suction motor, and may include a motor portion and a fan/impeller portion for moving the air. For example, the suction motor 112 may be an AC motor or a DC motor, or both. The suction motor 112 may be powered by plugging the apparatus 100 into a wall outlet (typically AC power), by using an on board power source 332 (schematically illustrated in FIG. 30) such as batteries and/or capacitors—typically DC) or both. The suction motor 112 may be of any suitable power, and may be at least 300 W, 400 W, at least 500 W, at least 600 W, at least 700 W, at least 800 W, at least 900 W and at least 1000 W or more. The lower power ranges, e.g., 300 W—500 W are particularly suitable for a hand held or battery powered construction as disclosed herein. The suction motor may be positioned at any suitable location within the surface cleaning apparatus 100, and in any suitable orientation. For example, the suction motor 112 may be positioned above the air treatment member assembly 110, or alternatively, as illustrated, may be positioned generally below the air treatment member assembly 110, and optionally may underlie at least a portion of the air treatment member assembly 110.

In the embodiment of FIG. 7, the suction motor 112 is positioned below the air treatment member assembly 110, in the motor housing portion 118 of the lower housing 192 of the cleaning unit 130. In this example, the suction motor 112 underlies the cyclone chamber 188 and the air exit conduit 290 (see also FIG. 21), and is positioned such that the axis of rotation 330 of the suction motor 112 is generally parallel to, but offset rearwardly from the cyclone axis 276 (FIG. 21). In this configuration, air travels generally downwardly through the air exit conduit 290 and into the suction motor housing 118.

In this embodiment, the suction motor 112 is generally centered between the lateral sides of the cleaning unit 130 in the lateral direction (FIG. 7), and is offset slightly toward the rear side of the cleaning unit 130 in the forward/rearward direction (FIGS. 20 and 21). In this arrangement, the motor axis 330 is parallel to and offset rearwardly from the handle axis 134 (when the handle is in the upright position).

The suction motor 112 and the suction motor housing 118 may have any suitable size and shape, and in the embodiment of FIG. 20, has a motor diameter 335 (taken at its widest location) that is only slightly less than the depth 230 (FIG. 18) of the air treatment member assembly 110 and/or of the overall depth 201 of the cleaning unit 130.

In the embodiment of FIG. 20, the motor diameter 335 is about 90% of the overall depth 201, and the motor housing 118 extends the entire distance from the rear plane 200 to the front plane 198. In this arrangement, none of the other operating components of the surface cleaning apparatus (such as the pre-motor filter, air conduits, post-motor filter and the like) is position forward or rearward of the suction motor 112. This may help reduce the overall depth of the cleaning unit 130. In this configuration, portions of the post-motor filter 122 are laterally beside the suction motor 112 (such that plane 232 intersects the suction motor 112), along with portions of the air flow path (i.e. portions of the wand 222 in this embodiment). Positioning the components laterally with respect to each other may help reduce the overall depth of the cleaning unit 130.

The embodiments of FIGS. 30, 31 and 52 also have the suction motor 112 in the lateral centre of the cleaning unit 130, and oriented so that the motor axis 330 is generally upright/vertical when the upright section is in the storage position and parallel to the cyclone axis 276.

Alternatively, instead of positioning the suction motor 112 in the lateral middle of the cleaning unit 130, it may be offset toward one of the sides of the cleaning unit 130. This may help align the suction motor 112 with other operating components (such as if the cyclone chamber 188 is offset toward one side of the air treatment member assembly 110), and/or may allow for different configurations of the air flow path, and in particular the location and configuration of the post-motor filter as described herein.

Figure 34:
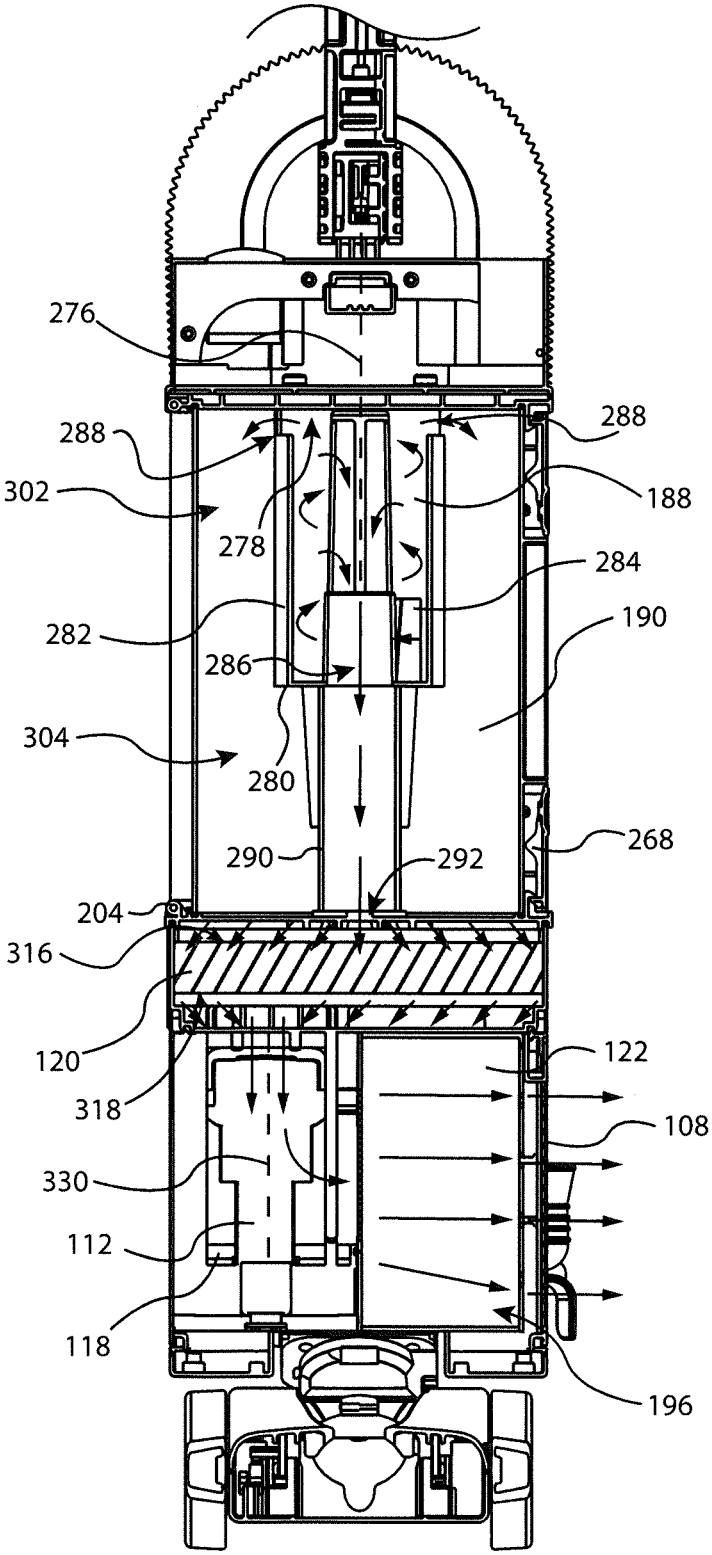
FIG. 34 is a cross-sectional view of a cleaning unit of another embodiment of a surface cleaning apparatus.

FIG. 34 illustrates one embodiment where the suction motor 112 is laterally offset toward one side of the cleaning unit 130 (to the left as illustrated). In this embodiment, the cyclone chamber 188 is not offset, and remains in the lateral centre of the air treatment member assembly 110, such that the motor axis 330 is parallel to the cyclone axis 276, but is both laterally and forward/rearwardly offset from the cyclone axis 276. In this configuration, a projection of the motor axis 330 does not intersect the cyclone chamber 188 (although it does pass through the pre-motor filter chamber 194, post-motor filter chamber 196 and dirt collection chamber 190), and a projection of the cyclone axis 276 does not intersect the suction motor 112.

In contrast, FIG. 31 illustrates an alternative embodiment in which the suction motor 112 is laterally centered, while the cyclone chamber 188 is laterally offset.

Positioning the suction motor 112 toward the lower end of the cleaning unit 130 may help lower the position of the centre of gravity of the cleaning unit 130, which may help facilitate steering and maneuvering of the surface cleaning apparatus 100.

While illustrated with the motor axis 330 in the generally upright direction, the suction motor 112 may also be positioned so that the motor axis 330 is generally horizontal, in orientations analogous to the cyclone chamber configurations described herein. Orienting the suction motor 112 laterally may help reduce the overall height of the cleaning unit 130.

Post-Motor Filter

The following is a description of post-motor filters that may be used by themselves in any surface cleaning apparatus or in any combination or sub-combination with any other feature or features described herein. For example, the post-motor filters described herein may be used with any one or more of the surface cleaning head, moveable wheels, upright section, air treatment member assemblies, carry handles, cyclone configurations, dirt collection chambers, pre-motor filters, suction motors, cleaning unit air flow ducts, above floor cleaning assemblies, low profile floor cleaning mode, bendable handle, adjustable handles, hose wraps and other features described herein.

In accordance with this aspect, the post-motor filter, if provided, is positioned so not increase the depth of the cleaning unit 130. Accordingly, the post-motor filter may be positioned so as not to be forward and/or rearward of the suction motor. For example, one or more post-motor filters may be positioned laterally from the suction motor and/or below the suction motor. Accordingly, a post-motor filter may be positioned on each lateral side of the suction motor. In such an embodiment, a clean air outlet may be provided on each lateral side of the cleaning unit.

The post-motor filter may be housed in a post-motor filter chamber positioned in the air flow path downstream from the suction motor. The post-motor filter may be housed in a suitable post-motor filter housing that can, optionally, be provided on the cleaning unit. The post-motor filter may be any suitable filter, including a physical, porous media filter (foam, felt), filter bag, electrostatic filter, HEPA filter and the like. The post-motor filter may have any suitable physical configuration and may be positioned in any suitable location that is consistent with the cleaning unit and/or air treatment member in a given embodiment of the apparatus 100.

In the embodiment of FIGS. 7, 20, 31 and 52, air is exhausted through a clean air outlet 108 provided on each lateral side of the suction motor 112, and the lower end of the cleaning unit 130 includes two post-motor filter chambers 196—one positioned on each lateral side of the suction motor housing 118 and suction motor 112 upstream from the respective clean air outlet. A post-motor filter 122, provided, e.g., in the form of a porous filter media, is positioned in each post-motor filter chamber 196. Respective clean air outlets 108 are provided on each lateral side of the cleaning unit 130, each in air flow communication with one of the post-motor filter chambers 196. The post-motor filters 122 in this embodiment have a depth 336 (FIG. 20) that is less than the depth 201 of the cleaning unit 130, and less than the diameter 335 of the suction motor 112.

Alternatively, instead of providing post-motor filters 122 on both lateral sides of the suction motor 112, the apparatus 100 may be configured so that a post-motor filter chamber 196, and the post-motor filter 122 provided therein, are only provided adjacent one lateral side of the suction motor 112. For example, in the embodiments of FIGS. 34 and 46 the suction motor 112 is offset toward one side of the cleaning unit 130, while the post-motor filter chamber 196, post-motor filter 122 and a single clean air outlet 108 are positioned toward the other lateral side. In these embodiments, the post-motor filter 122 at least partially overlaps the suction motor 112 in the forward/rearward direction.

Figure 46:
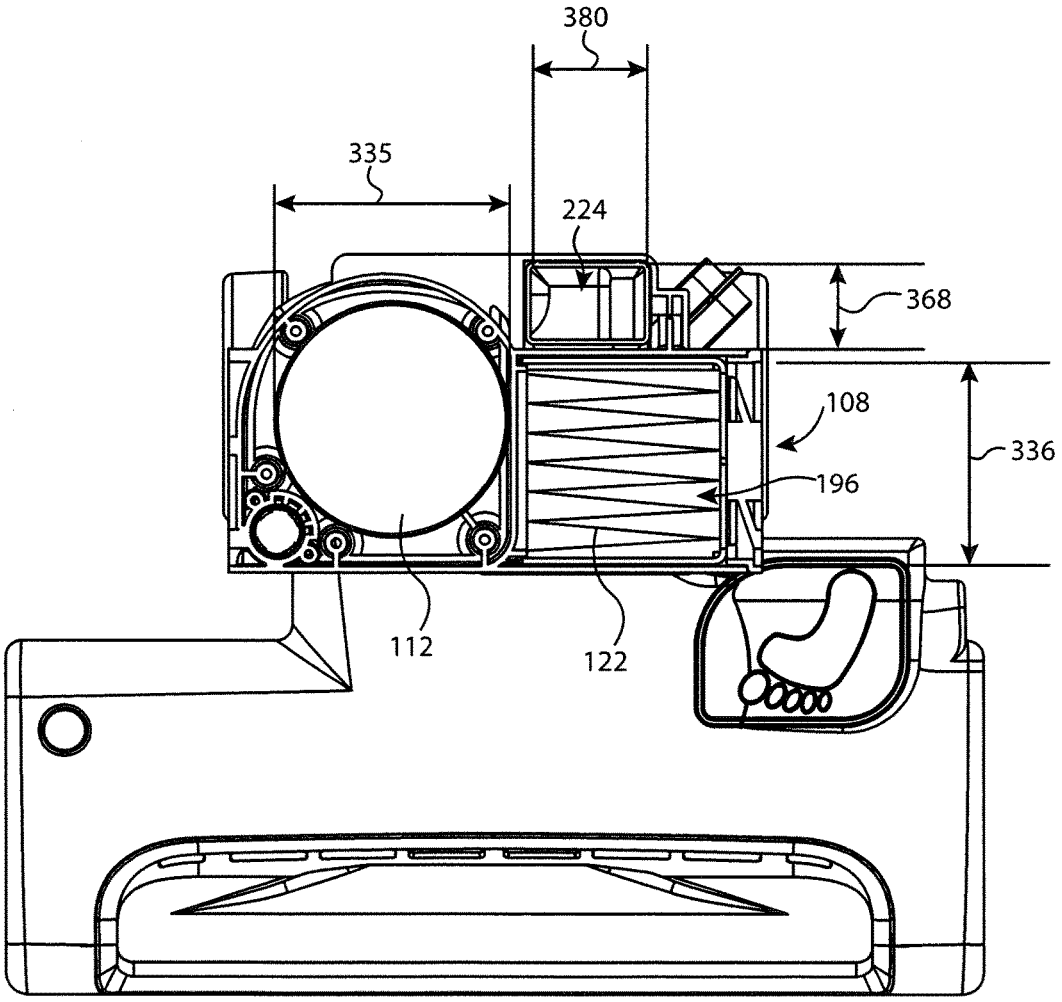
FIG. 46 is a cross-sectional view of the surface cleaning apparatus of FIG. 42, taken along line 46-46 in FIG. 44.

Optionally, the post-motor filter chamber 196, and post-motor filter 122, may be positioned to overlap other components in the forward/rearward direction. Referring to FIGS. 20 and 46, in these examples, the post-motor filters 122 are positioned so that portions of the air flow conduits (wand 222 and upflow duct 224) are located behind the post-motor filters 122 (i.e. rearward of the post-motor filters in the forward/rearward direction). The depth of the filters in the direction of axis 144 may be reduced (e.g., the may have about the same depth as the portion of the dirt collection regions that they underlie. This may help reduce the overall depth of the cleaning unit 130.

In other embodiments, such as shown in FIG. 30, the post-motor filter chamber 196 and post-motor filter 122 are located entirely below the suction motor 112, such that the post-motor filter 122 does not overlap the suction motor 112 in the vertical/upright direction. In this embodiment, the suction motor 112 overlies at least a portion of the post-motor filter 122. This may allow other components to be positioned laterally beside the suction motor 112, such as on board batteries 332, etc., while still providing a post-motor filter 122 of acceptable size and configuration. Optionally, the post-motor filter 122 may be configured to have the same size and shape as the pre-motor filter 120. In this embodiment, clean air outlets 108 may be provided on one side of the cleaning unit 130, both sides of the cleaning unit 130, the front of the cleaning unit 130 and/or the rear of the cleaning unit 130, or any combination thereof.

Like the pre-motor filters, each post-motor filter 122 has an upstream side, through which air enters the post-motor filter, and an opposing downstream side, through which air exits the post-motor filter.

Cleaning Unit Airflow Ducts

The following is a description of cleaning unit air flow ducts that may be used by themselves in any surface cleaning apparatus or in any combination or sub-combination with any other feature or features described herein. For example, the cleaning unit air flow ducts described herein may be used with any one or more of the surface cleaning head, moveable wheels, upright section, air treatment member assemblies, carry handles, cyclone configurations, dirt collection chambers, pre-motor filters, suction motors, post-motor filters, above floor cleaning assemblies, low profile floor cleaning mode, bendable handle, adjustable handles, hose wraps and other features described herein.

In accordance with this aspect some or all of the air flow conduit of the upright section may be configured to have an aspect ratio that reduces the overall depth of the upright section that houses the cleaning unit. For example, some or all of the portions of the air flow conduit that are co-extensive with the cleaning unit 130 may be non-circular (e.g., elliptical or a parallelogram (e.g., rectangular) so that their lateral extent is greater than their depth in the direction of axis 144. Accordingly, the volume of the air flow conduits need not be reduced by changing them from circular in cross section, but may be increased by increasing the length of the conduits in a direction transverse to axis 144.

Alternately, or in addition, some or all of the portions of the air flow conduit that are co-extensive with the cleaning unit 130 may be positioned at locations of the cleaning unit that are located inwardly of the outer lateral extent of the cyclone chamber 188. In this way, the depth of the upright section that houses the cleaning unit need not be increased by the air flow passages that are co-extensive with the cleaning unit or the extent to which they increase the depth may be reduced.

It will be appreciated that, when the apparatus 100 is operated in a floor cleaning mode, the air flow conduits that are co-extensive with the cleaning unit may form part of the cleaning unit itself (see the embodiments of FIGS. 42-48 and FIGS. 49-52) or may be separate removable components (such as a wand—as in the embodiment of FIGS. 1).

Figure 8:
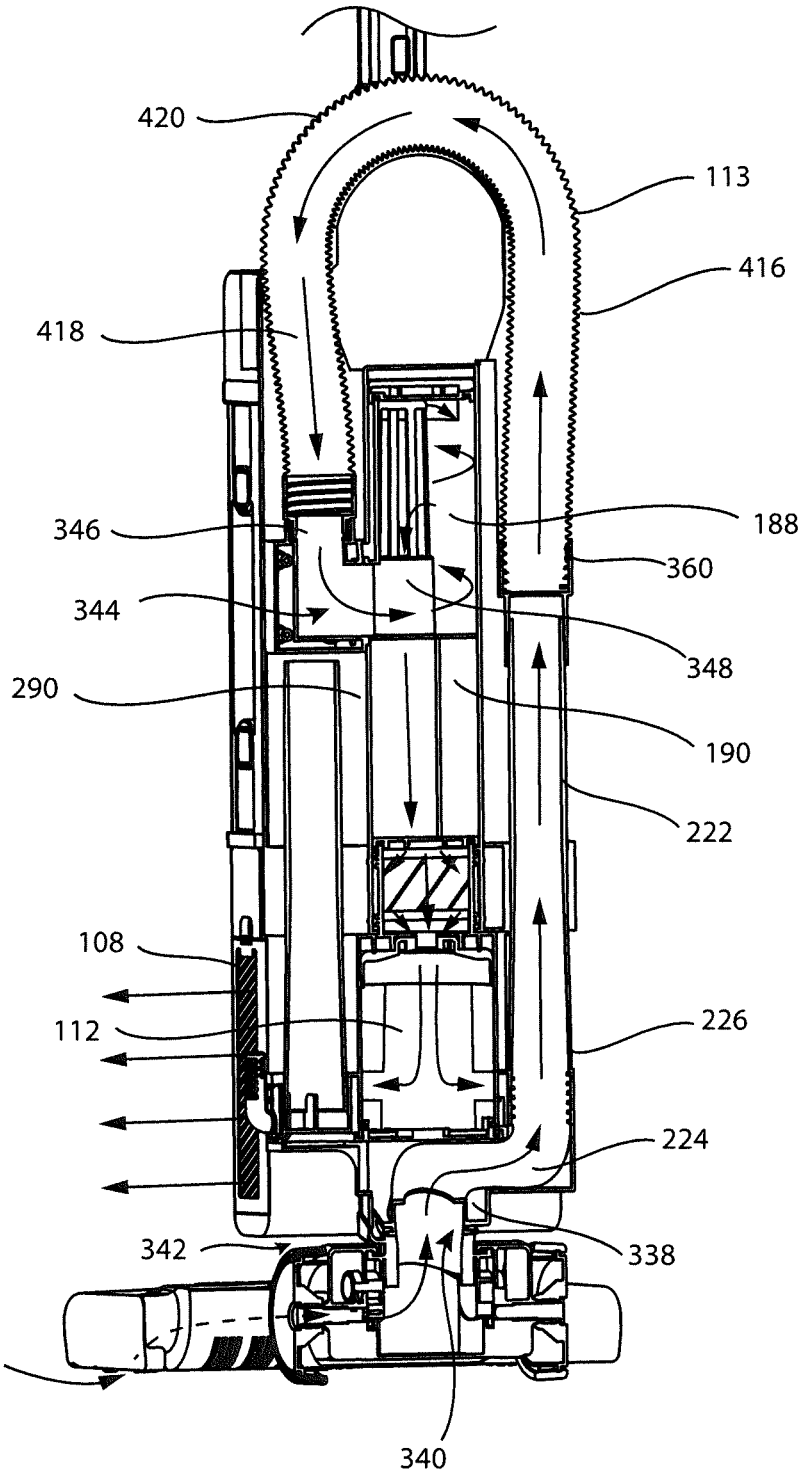
FIG. 8 is a cross-sectional view of a portion of the surface cleaning apparatus of FIG. 1, taken along line 8-8 in FIG. 4.
Figure 9:
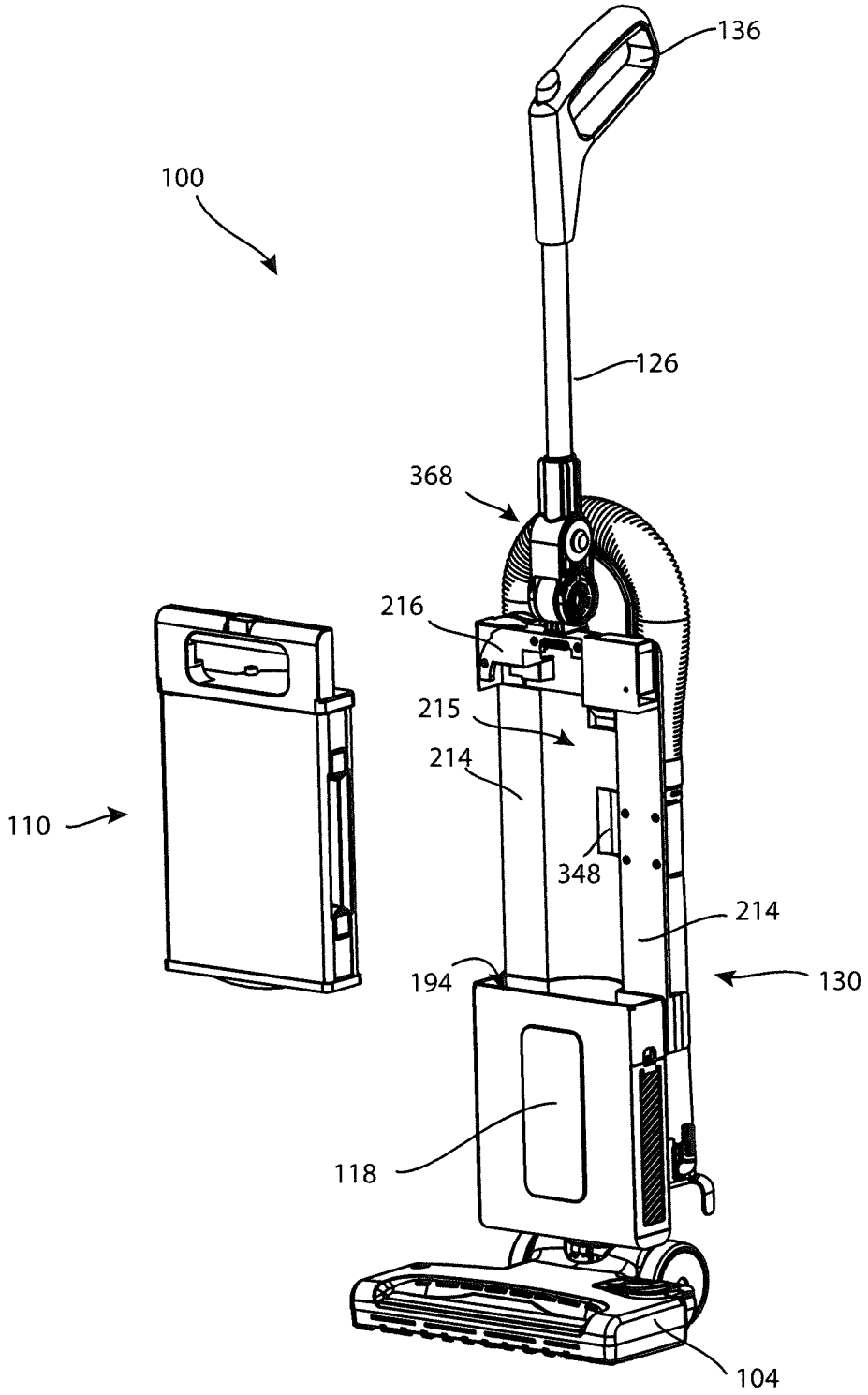
FIG. 9 is a front perspective view of the surface cleaning apparatus of FIG. 1 with the air treatment member assembly removed.

Referring to FIG. 8 as an example, in the illustrated embodiments the cleaning unit includes an air inlet 338 at its lower end that is in air flow communication with the surface cleaning head air outlet 340. In this embodiment, the air flow path extends through the pivoting/swivel joint 342 (see also FIG. 2) that structurally connects the cleaning unit 130 to the surface cleaning head 104. This may reduce the need to provide separate structural and air flow connections.

Air then travels upwardly though a the cleaning unit upflow duct 224 which may extend directly to the air treatment member assembly (FIG. 48) or may be indirectly connected to the air treatment member assembly via the wand 222, the hose 113 and a transition member 344 that has an inlet 346 connected to the hose 113 on one side, and outlet 348 that is connectable to the air inlet of the air treatment member assembly 110 (see also FIG. 10). In this example, the wand 222 has a generally circular cross-sectional shape, but could have a different configuration in other examples.

Optionally, the transition member 344 may be configured so that its inlet 346 has a different cross-sectional shape than its outlet 348 (taken in a direction orthogonal to the direction of air travel). For example, in this embodiment the inlet 346 is generally circular to match the transverse cross section of the hose 113, while the outlet 348 is generally rectangular in cross-sectional shape, with a width 350 and a length 352 (FIG. 10). Using a rectangular shape may help provide a desirable flow area (i.e. the cross-sectional area at the outlet) while having a depth in the forward/rearward direction that is less than the hose diameter 356 (FIG. 4). This may help reduce the overall depth 201 of the cleaning unit 130.

Similarly, some or all of the conduits that are co-extensive with cleaning unit (e.g., up flow duct 224 as exemplified in FIG. 46 and wand 222) may be non-circular as discussed. This embodiment is particularly useful if the up-flow duct 224 extends to the air treatment member inlet.

Above Floor Cleaning Assembly

The following is a description of above floor cleaning assemblies that may be used by themselves in any surface cleaning apparatus or in any combination or sub-combination with any other feature or features described herein. For example, the above floor cleaning assemblies described herein may be used with any one or more of the surface cleaning head, moveable wheels, upright section, air treatment member assemblies, carry handles, cyclone configurations, dirt collection chambers, pre-motor filters, suction motors, post-motor filters, cleaning unit air flow ducts, low profile floor cleaning mode, bendable handle, adjustable handles, hose wraps and other features described herein.

Optionally, an above floor cleaning assembly may be provided to allow the apparatus 100 to be used in an above floor cleaning mode. The above floor cleaning assembly may include any suitable apparatus, including a rigid or flexible wand 222, a flexible air flow conduit such as a hose 113, auxiliary cleaning tools and the like. Optionally, referring to the embodiments shown in FIGS. 2, 2A and 49 for example, the cleaning wand 222, hose 113 or a combination thereof may be detachable from the cleaning unit 130 and used in an above floor cleaning mode. In such a configuration, the air flow connection between the dirty air inlet 106 in the surface cleaning head 104 and the air treatment member assembly 110 would be interrupted and the upstream end 226 of the wand 222 or hose 113 (or auxiliary tool connected thereto) may serve as an auxiliary dirty air inlet for the apparatus 100.

It will be appreciated that the wand and/or hose may or may not form part of the air flow path in the floor cleaning mode. In the embodiment of FIGS. 2-8, the wand 222 may be disconnected, such that the upstream end 226 of the wand 222 (the lower end when mounted to the upright section and the upright section is in the stored position) forms an auxiliary dirty air inlet for use in the above floor cleaning mode. Optionally, the upstream end 360 of the hose 113 may be detachable from the downstream end of the wand 222, such that the upstream end 360 of the hose may alternately form an auxiliary dirty air inlet in another above floor cleaning mode (without the need to detach or use the wand), or alternatively the upstream end 360 of the hose 113 may be connected to a different, auxiliary cleaning tool. In this embodiment, the apparatus 100 may be changed from a floor cleaning mode to an above floor cleaning mode without having to adjust the connection between the hose 113 and the cleaning unit 130 (i.e. at the downstream end of the hose 113), and at least the hose 113, and optionally the wand 222, may form part of the air flow path in both modes.

Figure 51:
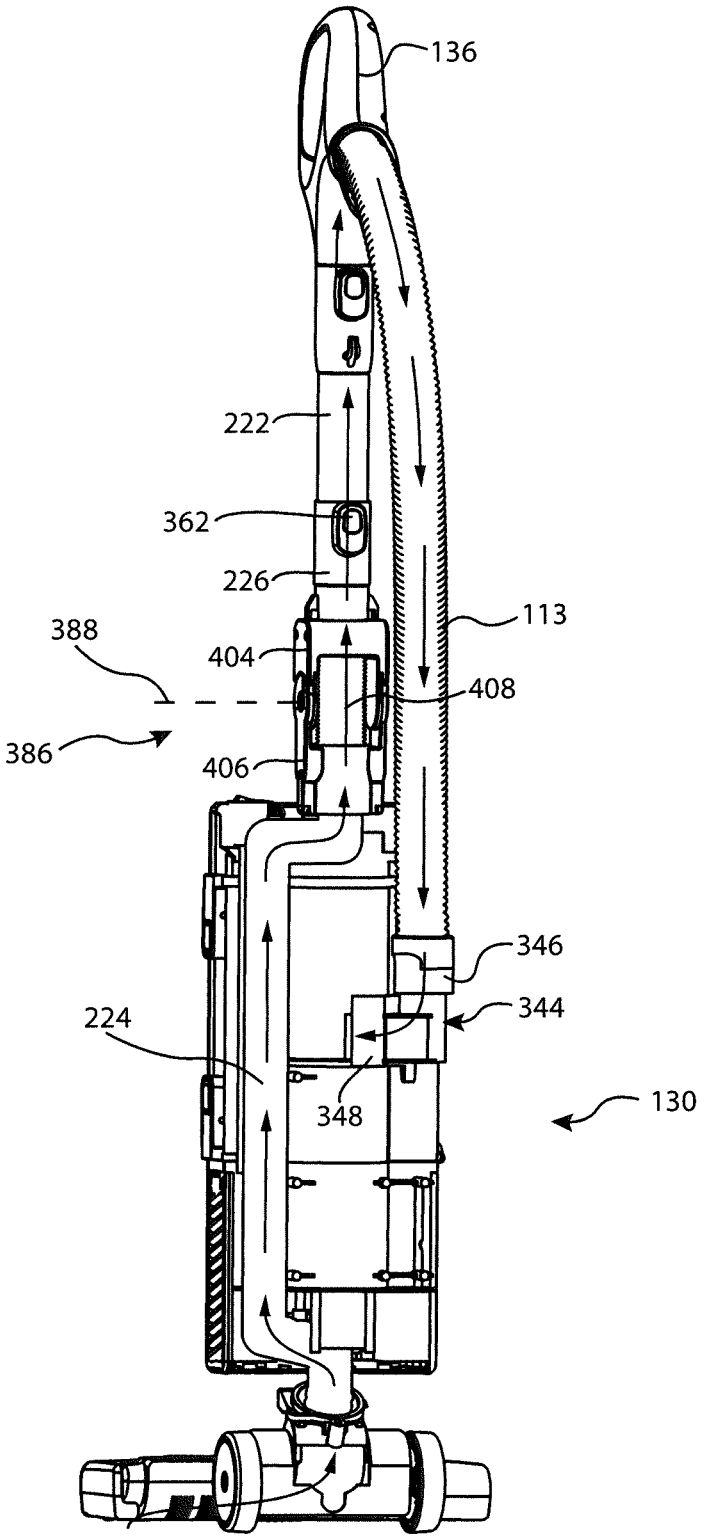
FIG. 51 is a rear perspective view of the surface cleaning apparatus of FIG. 49, with portions of the upright section removed.

In the embodiment shown in FIGS. 49-52, the apparatus 100 includes a detachable cleaning wand 222 that forms part of the air flow path, but the cleaning wand forms part of the drive handle 124 (i.e. is positioned between the hand grip 136 and acting as the extension member 126), rather than forming part of the cleaning unit 130. To provide air flow communication in a floor cleaning mode, the cleaning unit 130 includes a longer up flow duct 224 than in the embodiment of FIG. 8, which may be provided towards the rear side of the cleaning unit 130. The cleaning wand 222 is positioned to in air flow communication with the outlet end of the upflow duct 224, and may be secured, e.g., by using a releasable latch 362 (FIG. 51).

When the wand 222 is secured, air can travel upwardly through the wand 222 and into the attached hose 113, which has a downstream end that is connected to the cleaning unit 130, via a suitable transition member 344. To transition to an above floor cleaning mode, the upstream end 226 of the wand 222 may be detached, such that both the wand 222 and hose 113 form an above floor cleaning assembly that is part of the air flow path in the above floor cleaning mode. Alternatively, the hand grip portion 136 may be detached from the upper end of the wand 222, while remaining attached to the hose 113, or the upstream end 360 of the hose 113 may be detached from the hand grip portion 136, to provide alternative above floor cleaning configurations, in which only the hose 113 remains part of the air flow path.

Alternatively, the apparatus may include an above floor cleaning assembly, optionally including a wand 222 and flexible hose 113, which do not form part of the air flow path when the apparatus 100 is in the floor cleaning mode. In such embodiments, portions of the air flow path may be reconfigured, and the hose 113 and wand 222 may be connected and/or disconnected to the cleaning unit 130 (or other suitable portion, such as the surface cleaning head 104) when changing operating mode. Optionally, one or more valves may be provided in the air flow path to help reconfigure the air flow path as needed. The valves may be manually actuable, or may be automatically actuated by changing the configuration of the apparatus.

Figure 42:
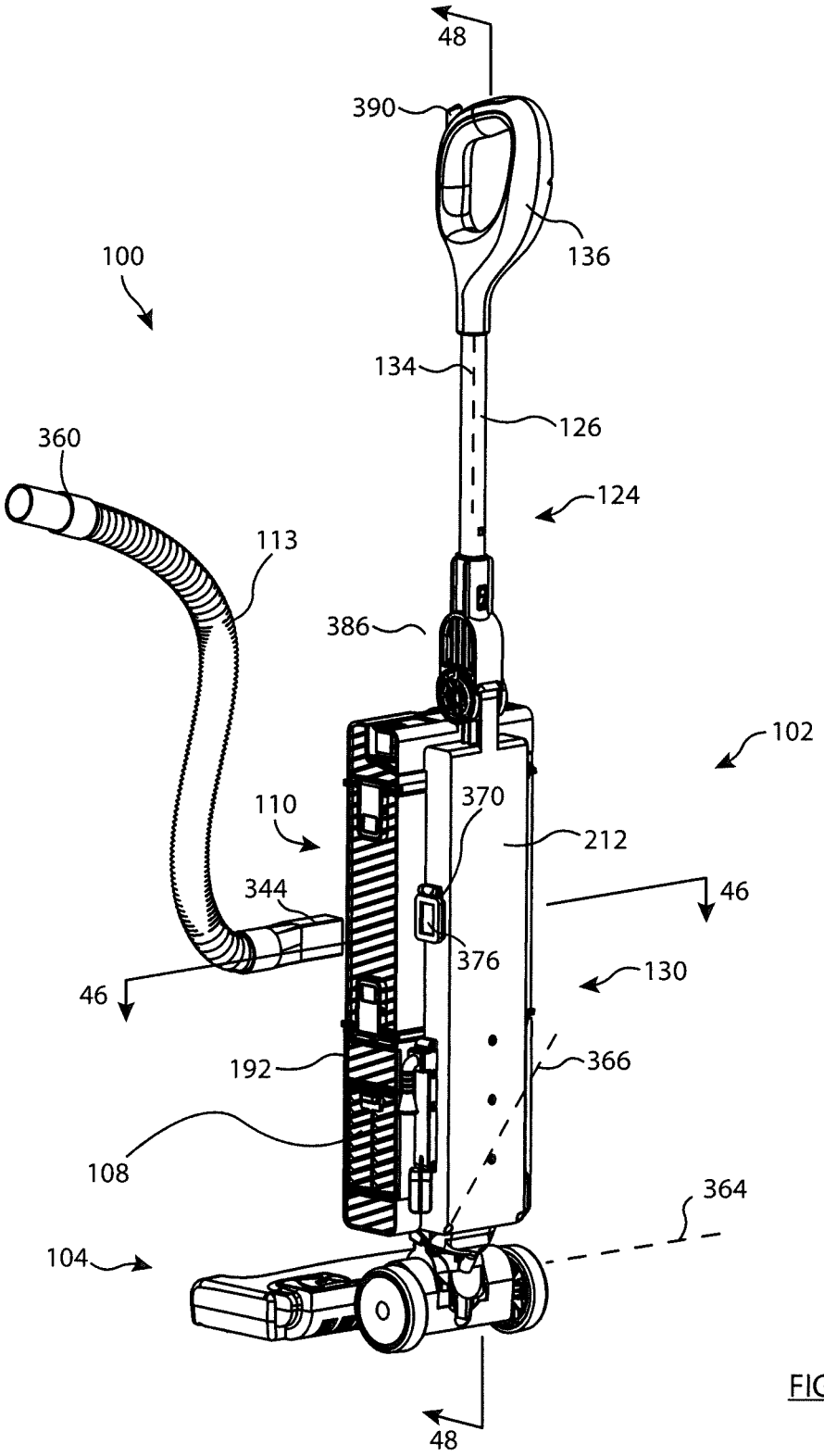
FIG. 42 is rear perspective view of another embodiment of a surface cleaning apparatus with an above floor cleaning hose being installed.
Figure 47:
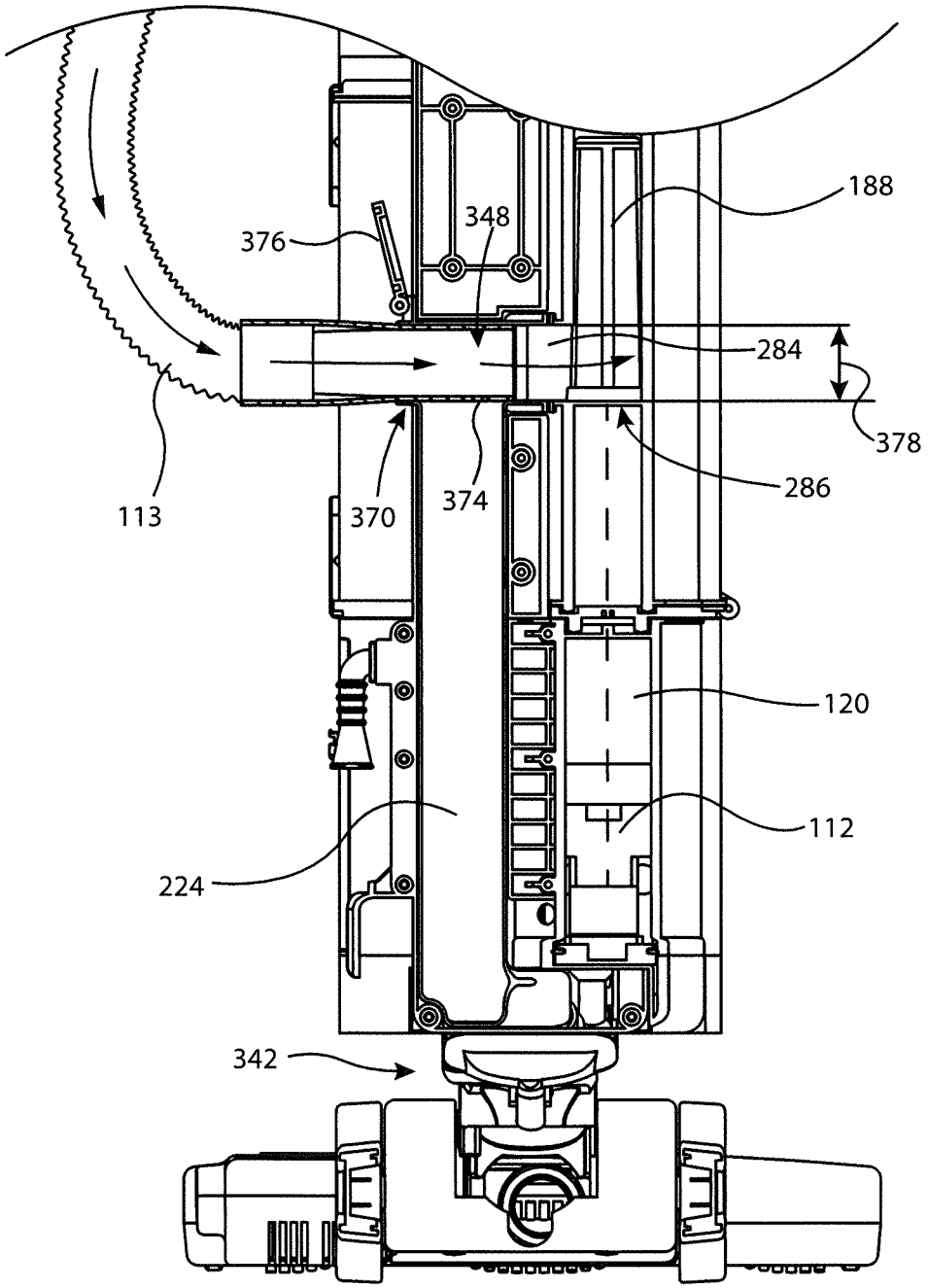
FIG. 47 is a cross-sectional view of the surface cleaning apparatus of FIG. 42, taken along line 47-47 in FIG. 43.
Figure 48:
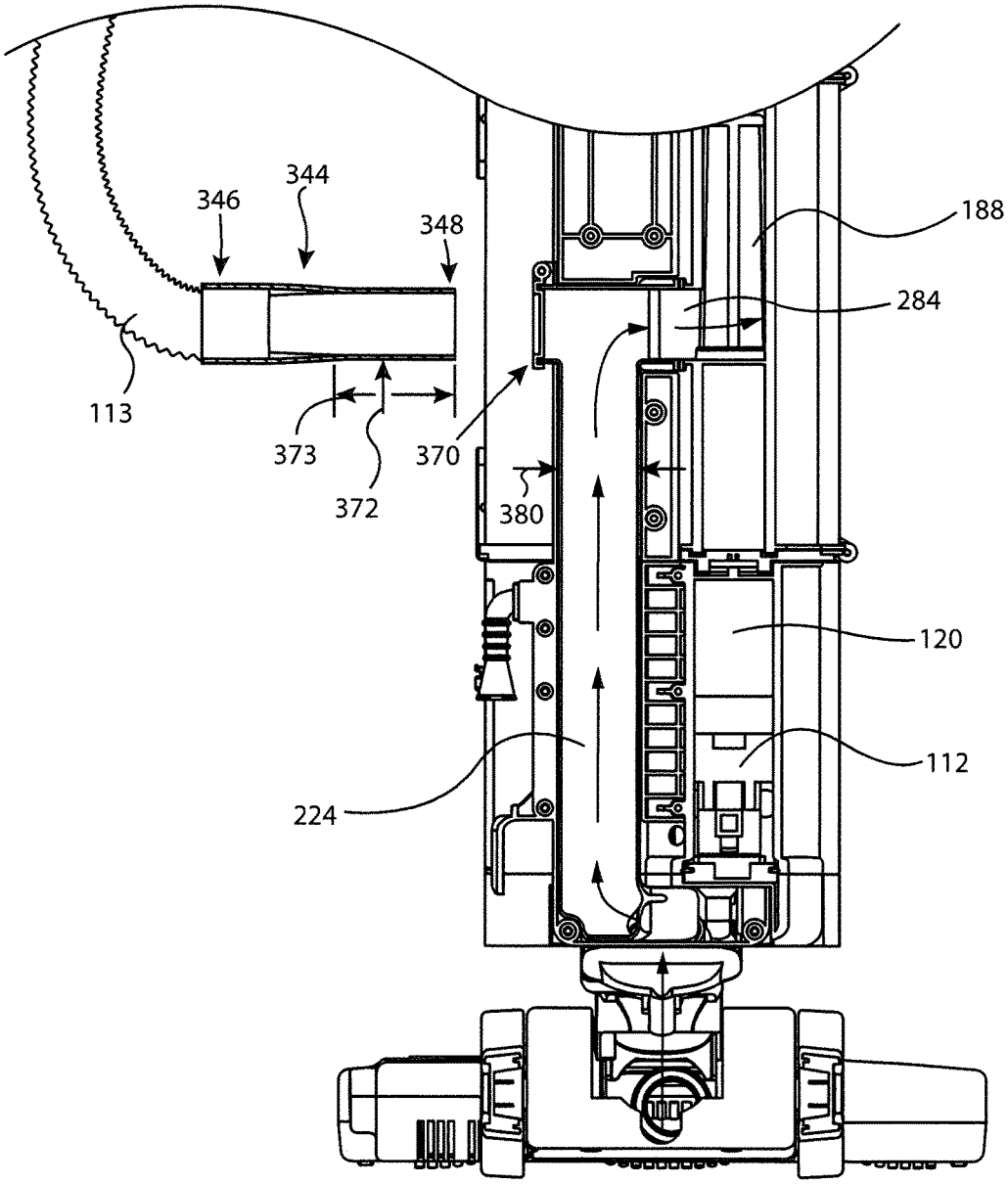
FIG. 48 is a cross-sectional view of the surface cleaning apparatus of FIG. 42, taken along line 48-48 in FIG. 42.

The embodiment of FIGS. 42-48, illustrates one embodiment in which the hose 113 does not form part of the air flow path in the floor cleaning mode, but does form part of the air flow path in an above floor cleaning mode. As shown in FIGS. 42 and 48, when the apparatus 100 is in a floor cleaning mode, an air flow path is provided between the dirty air inlet 106 and the air treatment member assembly 110 and includes portions of the joint 342 connecting the cleaning unit 130 to the surface cleaning head 104, and air flow conduits 224 within the cleaning unit 130.

For example, in this embodiment (and in the other embodiments described herein) the joint 342 allows the cleaning unit 130 to pivot about pivot axis 364 (or otherwise rotate) relative surface cleaning head to an inclined, use position, and, optionally, may also function as a rotatable mount so that the upright section 102 may rotate clockwise or counter clockwise with respect to the surface cleaning head 104 about an upright section rotation axis 366 (FIG. 42) so as to be useable to permit handle 124 to be used to steer the cleaning head 104 left or right. In this embodiment, the rotation axis 366 is inclined relative to the cleaning unit axis 204 (and therefore inclined relative to the drive/handle axis 134), but alternatively the joint 342 may be configured so that the axes 366 and 204 are generally parallel to each other, and may be co-axial. The joint 342 may have an internal upflow duct with a generally circular cross-sectional area.

As exemplified in this embodiment, the up flow duct 224 may have a generally rectangular perimeter shape and cross-sectional area, and has a vertically extending portion that is laterally offset from the suction motor 112 and its housing 118 and nested behind the post-motor filter 122 (FIGS. 46 and 47). In this configuration, the diameter 335 of the suction motor 112 is greater than the depth 368 of the air flow conduit in the forward/rearward direction of both the vertically extending (FIG. 46) and laterally extending (FIG. 45) portions of the air flow conduit. In this embodiment, the air outlet 286 of the air treatment member assembly 110 is substantially aligned with the air inlet of the suction motor 112 (see also FIGS. 45 and 46).

To operate in an above floor cleaning mode, a port 370 on the side of the cleaning unit 130 is opened to provide access to the air flow path. The hose 113 may then be connected to the air flow path. Optionally, a transition member may be provided to connect the generally round outlet end of the hose to the generally rectangular air flow conduit in the cleaning unit. Optionally, the transition member may be configured so that the flow area remains generally constant along the length of the transition member, even as the perimeter shape changes. The transition member may be provided with, and be removable with, the hose 113 as illustrated, or alternatively may be formed as part of the cleaning unit 130 or provided as a separate piece.

Preferably, the outlet end of the transition member may be configured to have a generally similar shape as the portion of the air flow path it is intended to be connected with, such as portions of the up flow duct and air flow conduits in the cleaning unit. This may help facilitate mechanical connection of the transition member to the air flow conduits, and may help reduce changes in the flow area along the length of the air flow path.

In the illustrated embodiment, the transition member is provided in the form of a transition member 344 that has an inlet end 346 that is generally round (i.e. the same shape as the outlet end of the hose 113) and an outlet end 348 that is rectangular (i.e. the same shape as the air flow conduit in the cleaning unit 130). In this configuration, the transition member 344 is sized so that at its outlet end 348 its height 372 (FIG. 48) in the upright direction and a length 373 in the lateral direction, each of which can be greater than its depth 368 in the forward/rearward direction (FIG. 45), and optionally can be at least about 1.2 times the depth 368, at least about 1.4 times the depth 368, at least 1.6 times the depth, at least 1.8 times the depth or more. This may help reduce the depth 201 of the cleaning unit 130, and may help provide a desired connection between the hose 113 and the air treatment member assembly 110.

Figure 43:
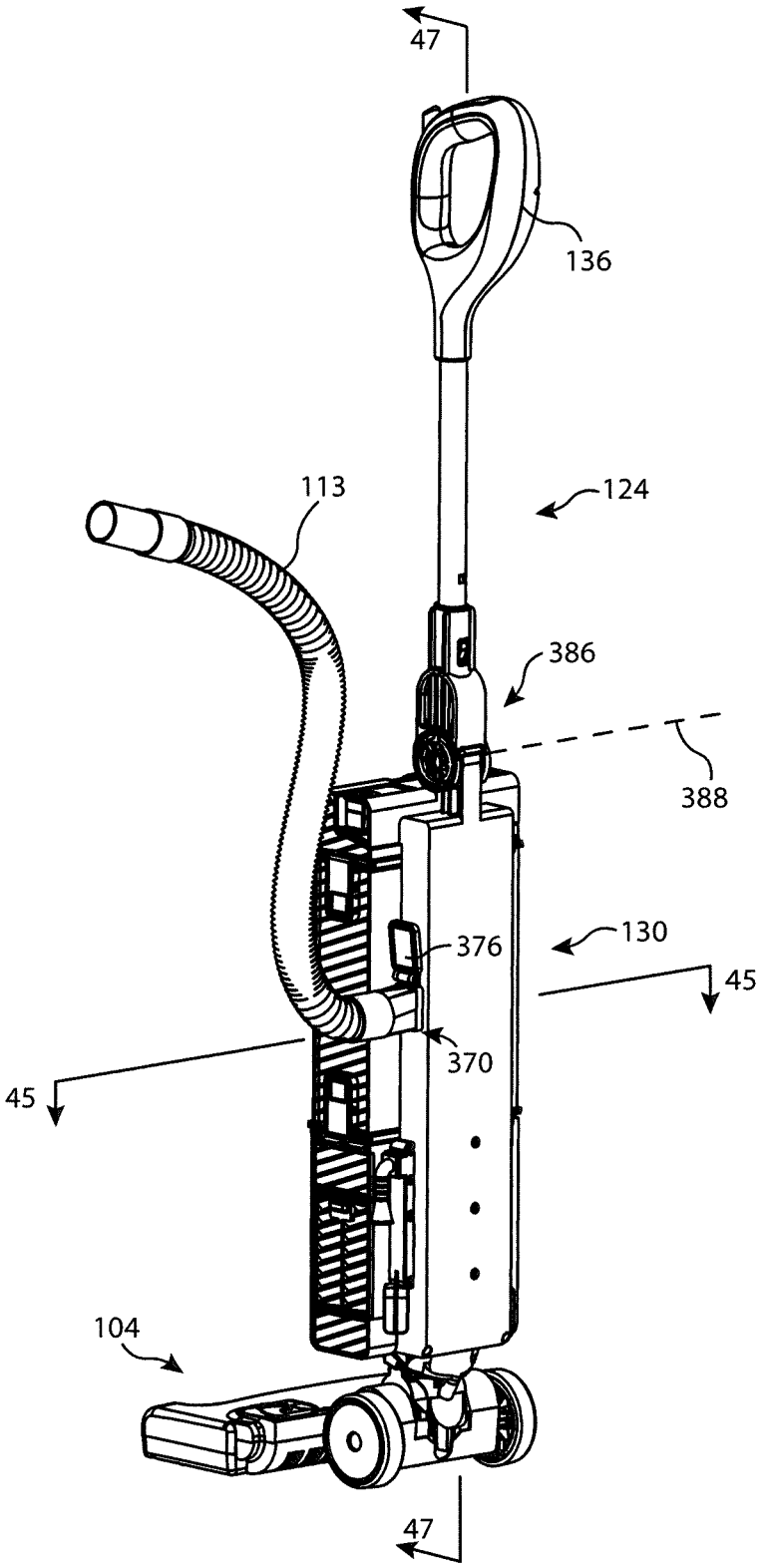
FIG. 43 is a rear perspective view of the surface cleaning apparatus of FIG. 42, in an above floor cleaning mode.
Figure 44:
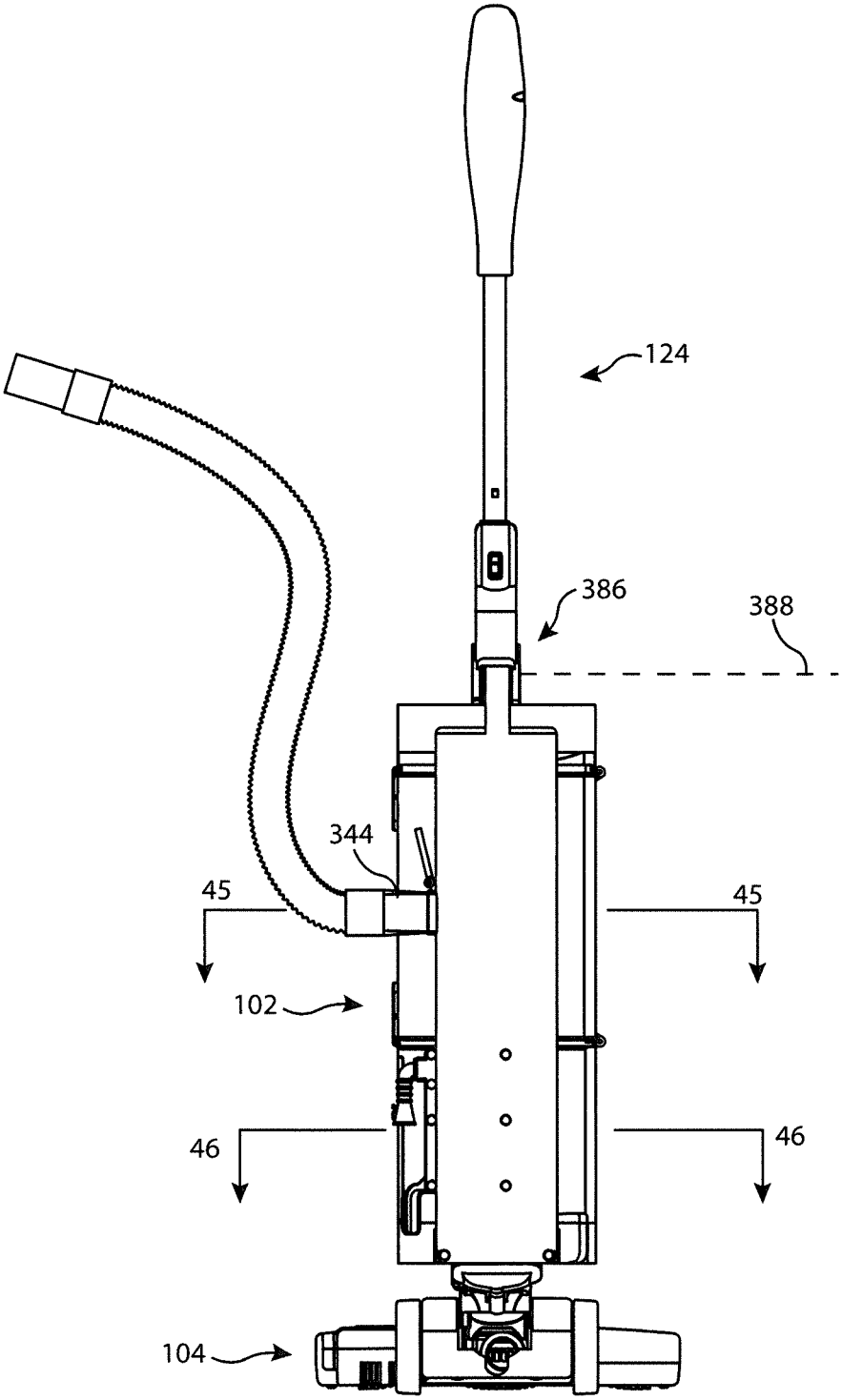
FIG. 44 is a rear elevation view of the surface cleaning apparatus of FIG. 42, in an above floor cleaning mode.
Figure 45:
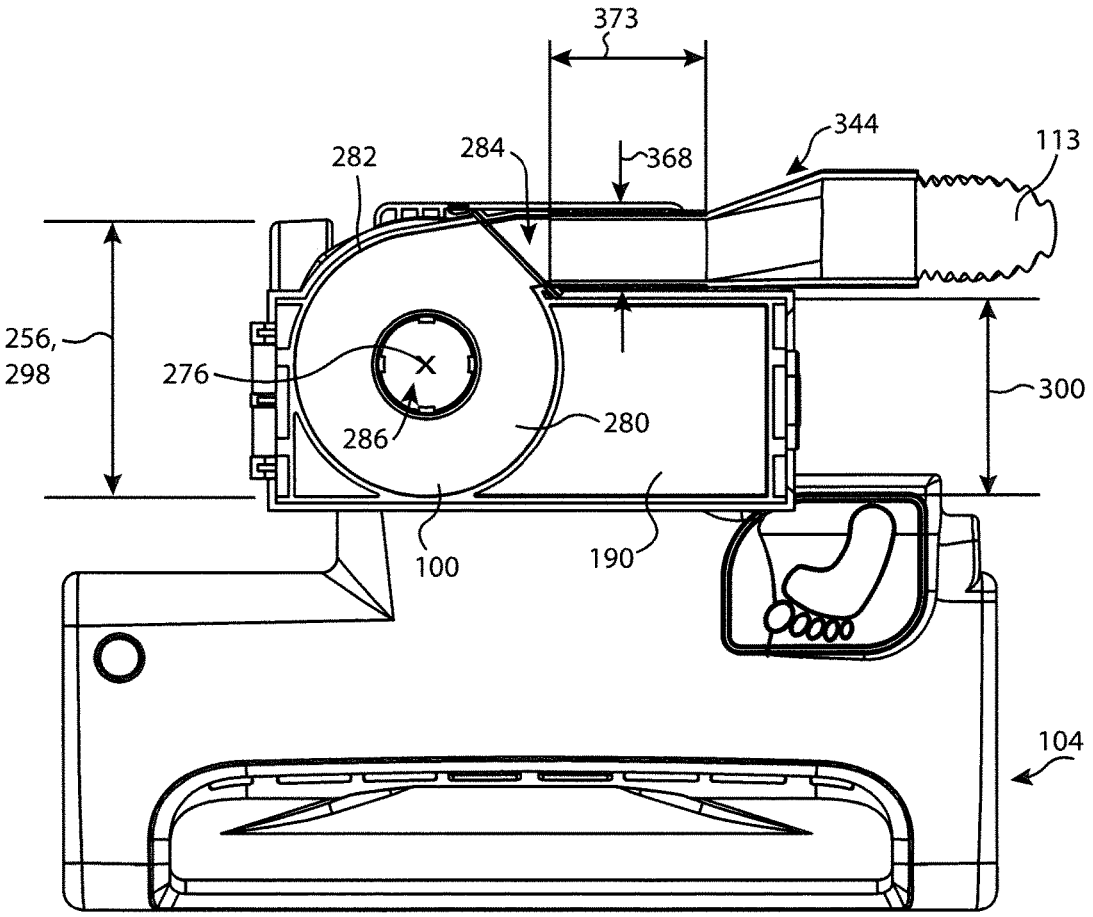
FIG. 45 is a cross-sectional view of the surface cleaning apparatus of FIG. 42, taken along line 45-45 in FIG. 44.

Referring to FIGS. 43-45 and 47, to attach the hose 113 to the cleaning unit 130, the outlet end 348 of the transition member 344 may be inserted into the port 370. In this position, the sidewall 374 of the transition member 344 blocks the up flow duct 224 in the cleaning unit 130 (interrupting air flow communication between the surface cleaning head 104 and the air treatment member assembly 110), and the outlet end 348 of the transition member 344 connects to the air inlet of the air treatment member assembly 110. To return to floor cleaning mode, the transition member 344 is extracted and the port 370 is closed, thereby re-establishing air flow communication between the air treatment member assembly 110 and the surface cleaning head 104. Preferably, the port is closed by a door 376 (FIGS. 42 and 43) that is biased to its closed, sealed position (FIG. 43). Alternatively, the door 376 need not be biased. It will be appreciated that, if the outlet of the connector extends to the entrance to a cyclonic air inlet for a cyclone chamber, the cross section of the outlet in the direction of flow is preferably proximate that or the same as that of the entrance to the cyclonic air inlet.

In this example, the air inlet of the air treatment member assembly 110, and the air inlet of the cyclone chamber 188 may each be configured to have a generally similar shape to the air flow conduit 224 and/or the outlet end 348 of the transition member. Accordingly, the air flow path through these conduits may have the same or generally the same cross-sectional area in the flow direction, thereby reducing the back pressure which could be caused by changing the cross sectional area in the flow direction.

As exemplified in FIGS. 46 and 47, the air inlet 284 of the cyclone chamber 188 may have a height 378 in a direction of a longitudinal axis of the upright section that is ±about 15% of a width 380 of the up flow duct 224 in a direction transverse to the central longitudinal axis 144 and the air inlet 284 of the air treatment member may have a depth in the direction of the longitudinal axis of the upright section that is ±about 15% of the depth of the up flow duct in the direction of the longitudinal axis of the upright section.

The air flow conduits 224 in the cleaning unit, and optionally the wand 222 and hose 113, may have any suitable shape, including rectangular, ovaloid, round and the like. Providing non-round conduits may help provide conduits that can be relatively narrow in the forward/rearward direction while still having a desired flow area. For example, the air flow duct 224 can have a length 380 (FIG. 46) in a lateral direction that is transverse to the central longitudinal axis 144 that is greater than the depth 368 of the air flow duct 224 in the forward/rearward direction (i.e. the direction of the central longitudinal axis 144). Optionally, the length 380 may be at least 1.5 times the depth 368, at least 2 times the depth 368, at least 2.5 times the depth 368 or more.

Low Profile Floor Cleaning Mode

The following is a description of a low profile floor cleaning mode that may be used by themselves in any surface cleaning apparatus or in any combination or sub-combination with any other feature or features described herein. For example, the low profile floor cleaning mode described herein may be used with vacuums having any of the surface cleaning head, moveable wheels, upright section, air treatment member assemblies, carry handles, cyclone configurations, dirt collection chambers, pre-motor filters, suction motors, post-motor filters, cleaning unit air flow ducts, above floor cleaning assemblies, bendable handle, adjustable handles, hose wraps and other features described herein.

In accordance with this aspect, in addition to be operable in a conventional, upright floor cleaning mode, the apparatus may also be operable in at least one additional floor cleaning mode, such as a low profile cleaning mode for cleaning under furniture and other obstacles. An advantage of this mode is that, using the slab like configuration provided herein, the surface cleaning head may extend further, and possibly, all the way under furniture having a low ground clearance.

Preferably, upright section may be reconfigurable to help configure the apparatus 100 in a low profile cleaning mode. For example, the handle 124 may be reconfigurable and/or may be movably connected to the cleaning unit 130 so that the orientation of part or all of the handle 124, and the hand grip portion 136, may be changed relative to the cleaning unit 130.

Figure 12:
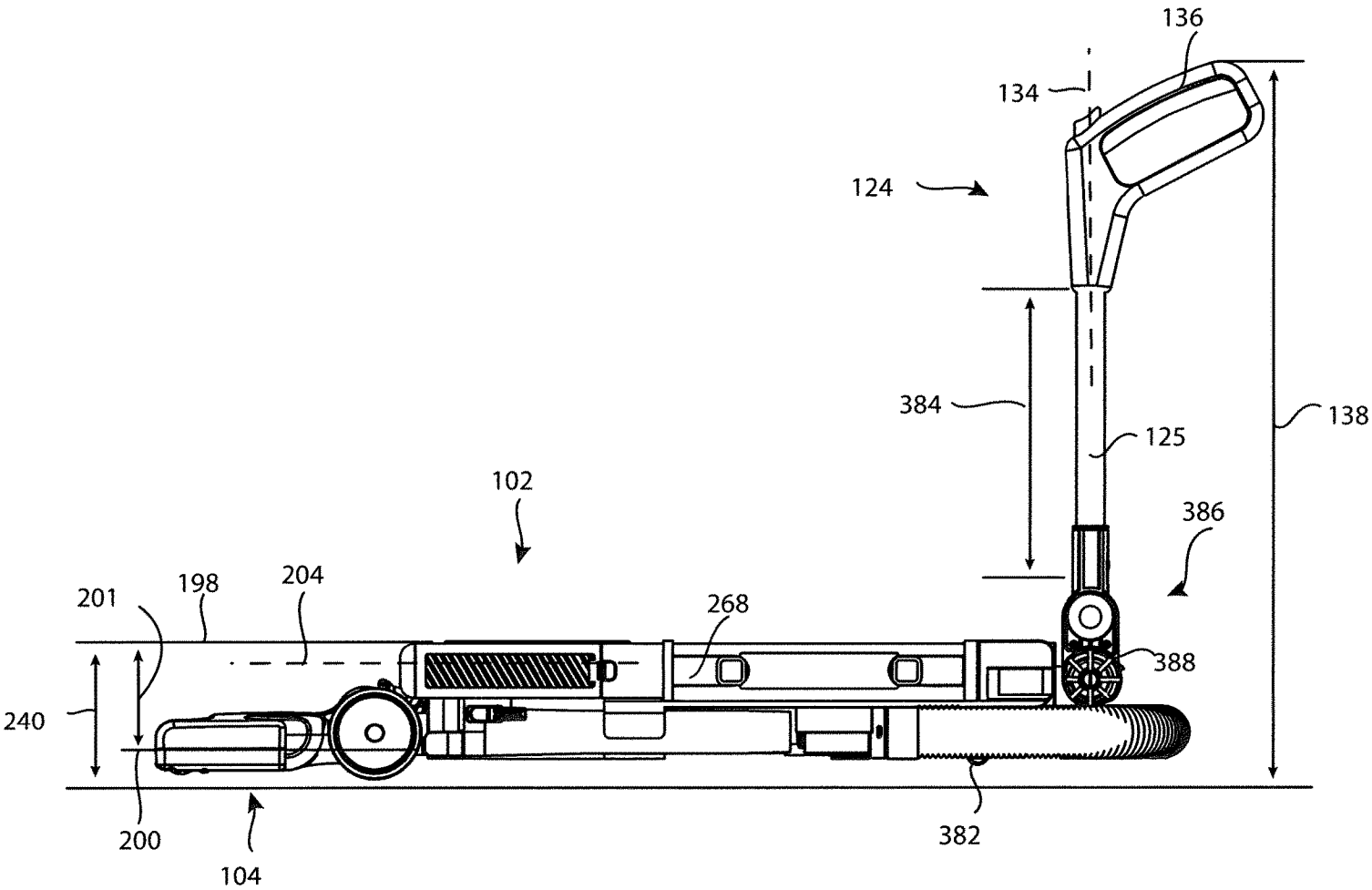
FIG. 12 is a side view of the surface cleaning apparatus of FIG. 1, in a low profile floor cleaning mode.
Figure 13:
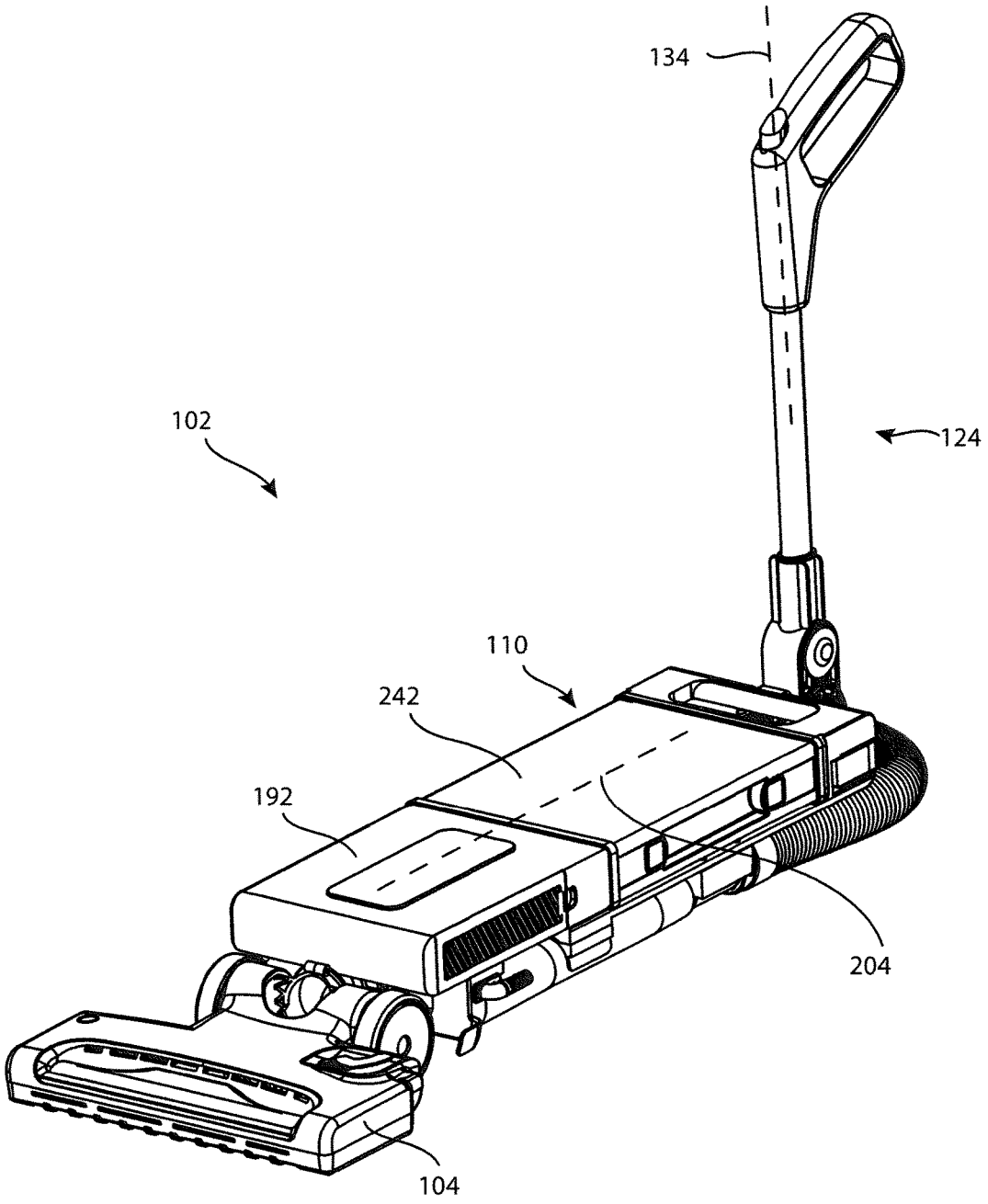
FIG. 13 is a perspective view of the surface cleaning apparatus of FIG. 1, in the low profile floor cleaning mode.

Referring to FIGS. 12 and 13 as an example of configurations that may be achieved using embodiments described herein (including in FIGS. 42-57), the cleaning unit 130 may be positioned in a low profile mode, in which the cleaning unit axis 204, and front and rear planes 198 and 200, are generally horizontal and parallel to the surface being cleaned (i.e. can be parallel and/or within about 15 degrees of parallel or less). In this mode, the overall height 240 of the cleaning unit 130 (i.e. the distance from the ground to the front plane 198) may be generally similar to the depth 201 of the cleaning unit 130, and may be less than about 6 inches and less than 4 inches in some examples.

Optionally, an additional low profile support wheel 382 may be provided on the rear face of the cleaning unit 130 (see also FIG. 2). This wheel 382 may be positioned so that it is spaced apart from the floor when the cleaning unit 130 is in an inclined floor cleaning mode, and v contact the floor when the cleaning unit 130 is in the low profile cleaning mode. Providing a support wheel 382 may help the cleaning unit 130 roll across the surface, and may help reduce the chances of the cleaning unit 130 scratching or otherwise damaging the floor. The support wheel 382 may carry at least some of the load of the cleaning unit 130, which may help reduce the amount of weight felt by a user when operating the apparatus 100 in this mode. Preferably, the support wheel 382 is provided toward the upper end of the cleaning unit 130, but alternatively may be provided in alternative locations on the cleaning unit 130. While a single, roller-like support wheel 382 is illustrated, more than one support wheel may be used. Optionally, the support may be any other type of wheel or glide, such as a swivel/castor type wheel that can swivel relative to the cleaning unit, as well as having a rotation axis. This may help the steerability of the apparatus 100 in the low profile cleaning mode.

Bendable Handle

The following is a description of bendable handles that may be used by themselves in any surface cleaning apparatus or in any combination or sub-combination with any other feature or features described herein. For example, the bendable handles described herein may be used with vacuums having any one or more of the surface cleaning head, moveable wheels, upright section, air treatment member assemblies, carry handles, cyclone configurations, dirt collection chambers, pre-motor filters, suction motors, post-motor filters, cleaning unit air flow ducts, above floor cleaning assemblies, low profile floor cleaning mode, adjustable handles, hose wraps and other features described herein.

In accordance with this aspect, the push handle 124 of a surface cleaning apparatus is reconfigurable into the low profile cleaning mode whereby the cleaning unit 130 may be position such that the longitudinal axis of the cleaning unit 130 may be oriented so as to extend generally horizontally (e.g., within 25°, 20°, 15°, 10°, 5° of horizontal) or may in fact extend horizontally without the user having to fully bend over.

The apparatus may be positionable in the low profile cleaning mode using any suitable mechanism. For example, the handle 124 may be bendable and/or movably connected to the cleaning unit 130, such that the orientation of the handle, and hand grip 136, relative to the cleaning unit 130 may be changed. This can allow a common handle 124 and/or hand grip 136 to be used in both the inclined floor cleaning mode and the low profile cleaning mode. Alternatively, a separate low profile handle apparatus may be provided, such that different handles and/or hand grips are used in the different cleaning modes.

Preferably, the length 384 (FIG. 12) of the elongate extension member 126 is selected so that when the apparatus is in the low profile cleaning mode the hand grip 136 is at a comfortable height 138 for a user to grasp. For example, the apparatus may be configured so that the height 138 from the floor to the hand grip 136 in the low profile cleaning mode (FIG. 12) may be between about 20 inches and about 40 inches, and preferably is between about 30 inches and about 40 inches. In addition, the apparatus 100 may also be configured so that when the handle 124 is not pivoted, the height 138 from the floor and the hand grip 136 (FIG. 5) is in a desired range, of between about 30 inches and about 48 inches. As discussed subsequently herein, the handle may be telescopically mounted.

As exemplified in FIGS. 1, 12, 13 and 21, the handle 124 may be moveably mounted to the support structure 212, preferably at or towards the upper end of the cleaning unit 130, by a rotational joint which may be in the form of a pivot joint 386. The pivot joint 386 includes at least a first pivot axis 388, about which the handle 124 may pivot. In this embodiment, the pivot axis 388 extends in the lateral (i.e., side-to-side) direction. In this embodiment, the handle 124 may pivot forwardly between a generally upright position (FIG. 1), in which the handle axis 134 is generally parallel to the cleaning unit axis 204, and a low profile position (FIG. 13), in which the handle axis 134 is generally orthogonal to the cleaning unit axis 204. In the exemplified embodiment, the pivot joint is provided overlying the cleaning unit. Accordingly, when in the upright position, the axis 134 may intersect one or more of the suction motor 112, the air treatment member assembly 110 (e.g., optionally both the cyclone chamber 188 and dirt collection chamber 190) and the pre-motor filter 120 (see also FIG. 21), as well as intersecting the pivot joint 386.

In this example, the support structure 212 may be configured such that it is located to partially or fully overlie the upper end of the cleaning unit 130 (e.g., cross-member 216). An advantage of this configuration is that the pivot joint need not be located rearward of the cleaning unit 130 and therefore need not increase the height of the front of the cleaning unit 130 from the floor when the apparatus 100 is in the low profile mode. The pivot joint 386 may be connected to such forwardly extending portion of the support structure 212 (cross-member 216), such that the pivot joint 386 may overlie a portion of the air treatment member assembly 110 when the apparatus 100 is in the storage position (FIG. 21). In this configuration, at least some portion of the air treatment member assembly 110 extends rearwardly of the longitudinally extending extension member 126 when the upright section 102 is in the generally upright position (FIG. 21).

Preferably, the pivot joint 386 may be locked with the extension member 126 in the upright configuration (FIGS. 1-5), and may be unlocked to allow the extension member 126 to pivot relative to the cleaning unit 130. Optionally, the pivot joint may be unlockable by applying rotational torque to the pivot joint 368 (e.g., the lock may comprise inter-engaging detents that may rotate by each other when sufficient rotational torque is applied). Optionally, an unlocking actuator may be provided to allow a user to unlock the pivot joint 386. In the embodiments, the unlocking actuator includes a button 390 that is adjacent the hand grip portion 136. The button 390 may be pressed by a user, which may urge a linkage rod 392 (FIG. 21) within the extension member 126 downwardly, thereby disengaging a latch 394 member and allowing the extension member 126 to pivot. Optionally, the linkage rod 392 and/or button 390 may be biased toward the locked positions. Other suitable pivoting mechanisms, locking mechanisms and actuators, as well as positioning of the actuator, may be used, including those described in U.S. patent application Ser. Nos. 13/781,470, and 12/720,570 which are incorporated herein by reference.

Optionally, the pivot joint 386 may be nested with other components on the cleaning unit 130, preferably in the forward/rearward direction, which may help reduce the overall depth 201 of the cleaning unit 130. In the embodiment shown in FIG. 21, the pivot joint 386 is located toward the front side of the cleaning unit 130, and is forward of the hose 113, and its hose support 396. In this arrangement, the pivot axis 388 is forward of the air flow path, forward of a central plane of the cleaning unit and overlies portions of the cyclone chamber 188 and dirt collection chamber 190. When reclined into the low profile cleaning mode, the pivot axis 388 is above and overlies the hose 113. Arranging the pivot joint 386 toward the front of the cleaning unit 130 may help facilitate placing the hose 113 and hose support 396 toward the rear side of the cleaning unit 130, while helping to reduce the overall depth 201.

In this embodiment, the pivot joint 386 may at least partially overlie the carry handle 258 on the air treatment member assembly 110 in the forward/rearward direction, when the apparatus is in the storage position (FIG. 1). Nesting the components in this manner may help reduce the overall depth 201 of the cleaning unit 130.

Optionally, as illustrated in the embodiment of FIGS. 49-52, the movable portion of the handle may include a portion of the air flow path.

Optionally, in addition to pivoting into a low profile use position, the handle 124 may be moveable into a storage position to help reduce the overall size of the apparatus 100 when it is not in use or during shipment.

Figure 14:
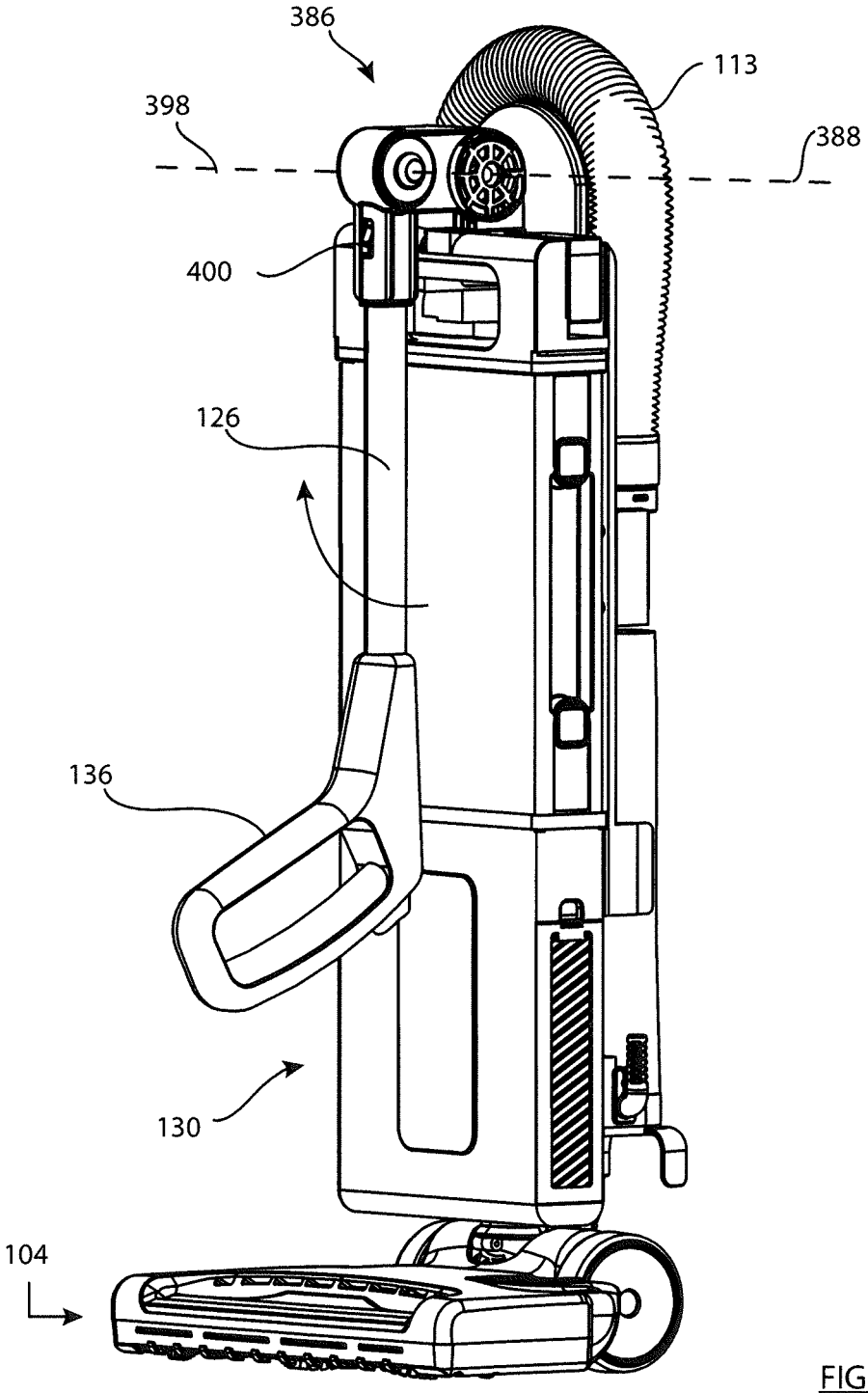
FIG. 14 is a front perspective view of the surface cleaning apparatus of FIG. 1, with the handle in a storage position.
Figure 15:
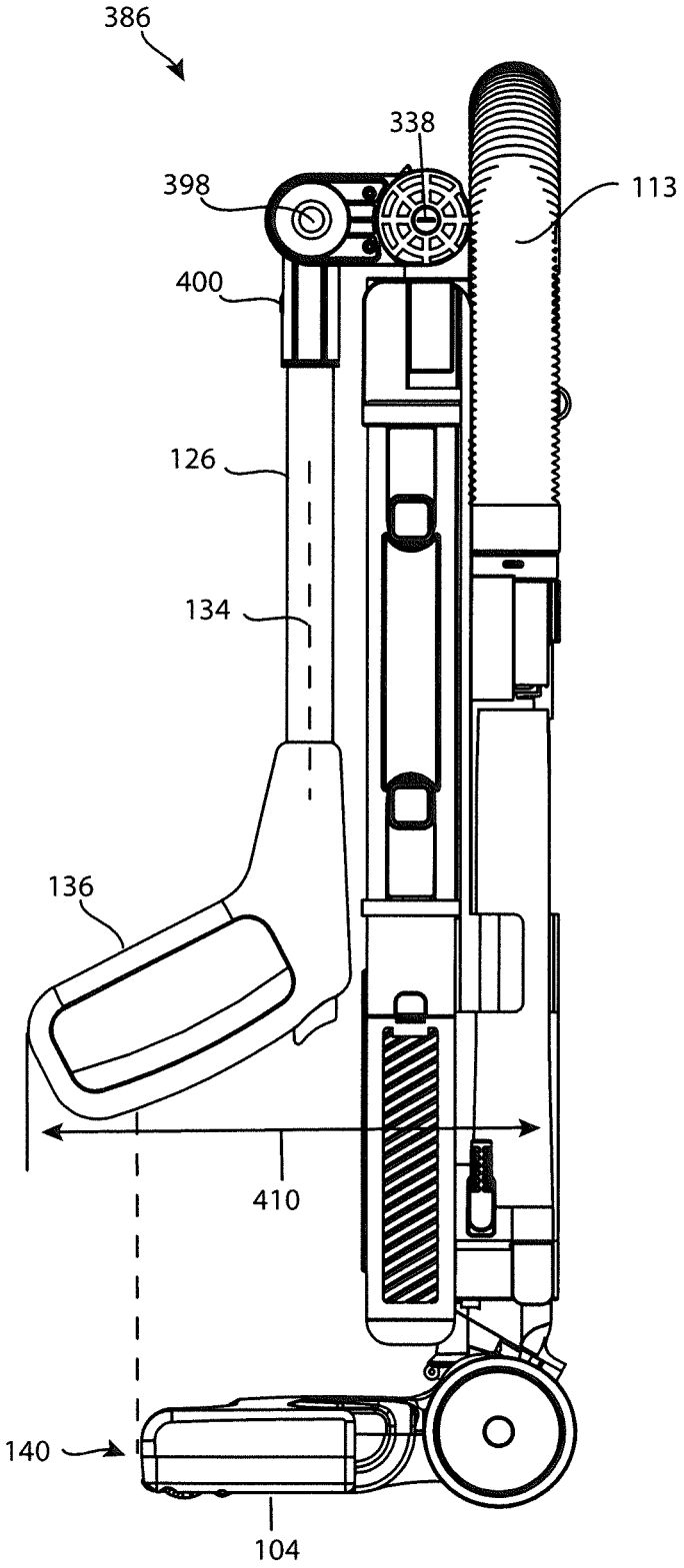
FIG. 15 is a side view of the surface cleaning apparatus of FIG. 14.
Figure 16:
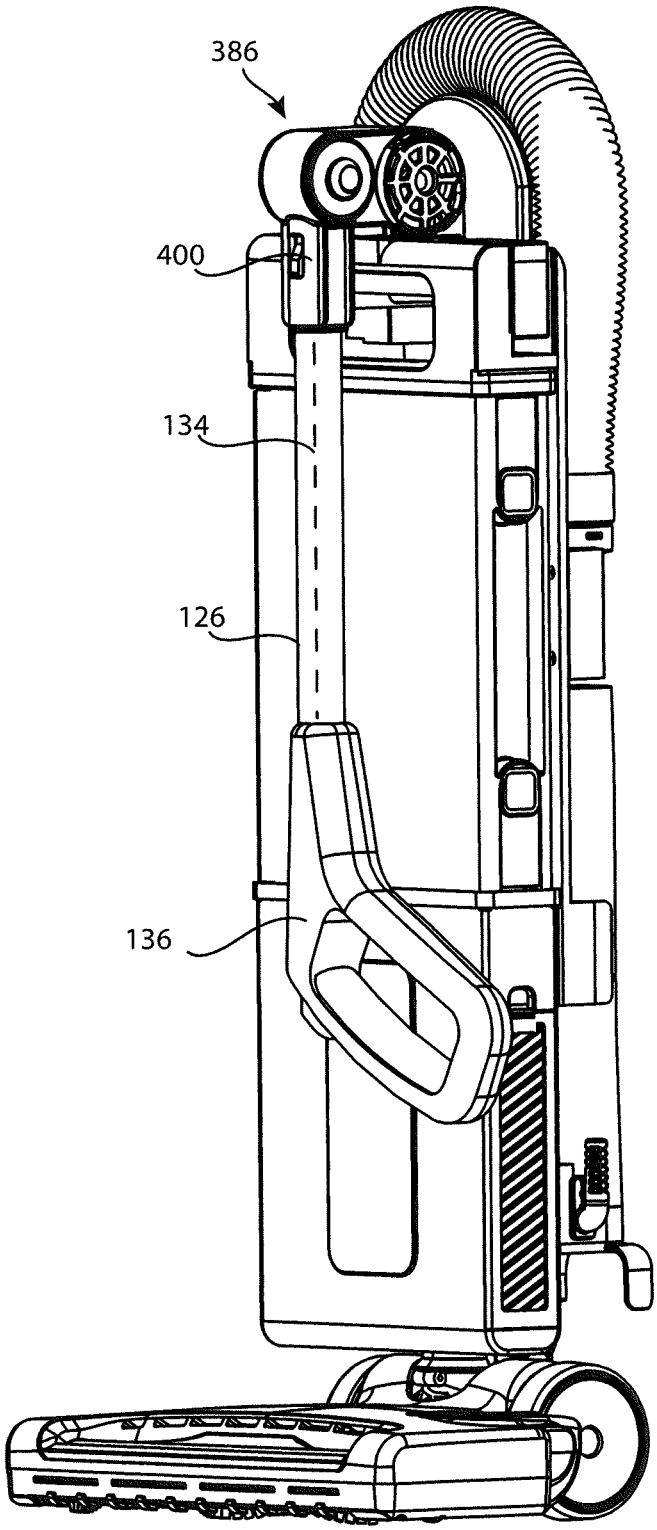
FIG. 16 is a front perspective view of the surface cleaning apparatus of FIG. 1, with the handle in another storage position.
Figure 17:
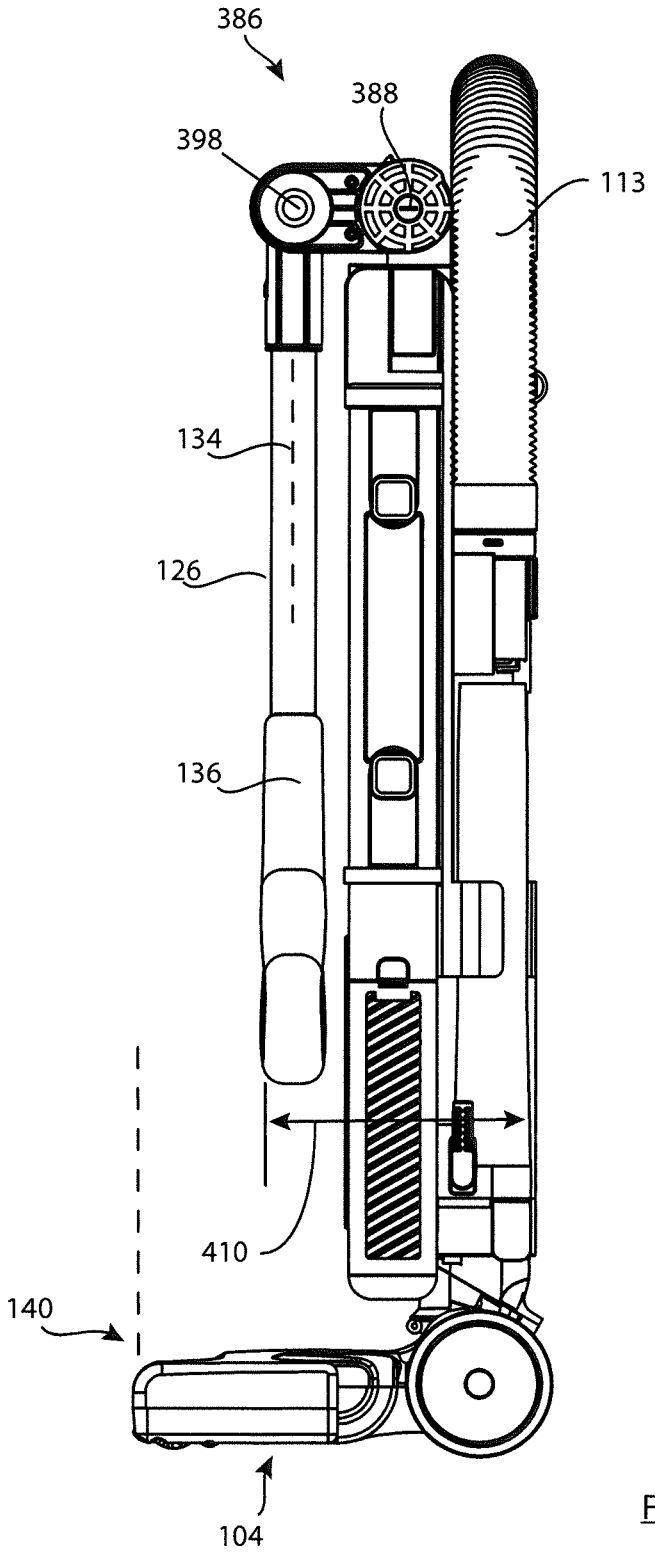
FIG. 17 is a side view of the surface cleaning apparatus of FIG. 16.

Referring to FIGS. 14-17, in one embodiment the handle 124 may be moveably connected to the cleaning unit 130 such that it may be move forwardly to the low profile cleaning position (FIGS. 12 and 13), and may then be moved further forwardly (rotated forwardly) into a storage position as exemplified in FIG. 14 or 16. In this embodiment, the pivot joint 386 includes a second pivot axis 398 that is generally parallel to the pivot axis 388, thus providing two pivot joints, pivot joint 422 having an axis 388 and pivot joint 424 having an axis 398. When in the storage configuration, the second pivot joint 424 may be positioned above, and may lie in the same plane as, pivot joint 422. In this position, the second axis 398 may also be forward of the hose 113 and hose support 396, and may overlie the cyclone chamber 188 and dirt collection chamber 190 (FIG. 1). Alternatively, the second pivot axis 398 may be offset forward or rearwardly form the pivot axis 388. Preferably, the rotation about the second pivot axis 398 may be restrained by a second lock. The lock may be any suitable mechanism, and may include a release actuator 400 that is provided at any location, e.g., adjacent or as part of pivot joint 424. In this embodiment, a user may manually release the second lock by releasing the actuator 400 (FIGS. 14 and 16). In this embodiment, when the handle 124 is in the storage position, the handle axis 134 intersects both the first and second pivot joints 386A and 386B. That is, the pivot joints 422 and 424 are positioned generally beneath the extension member 126, along the drive axis of the apparatus 100.

Figure 76:
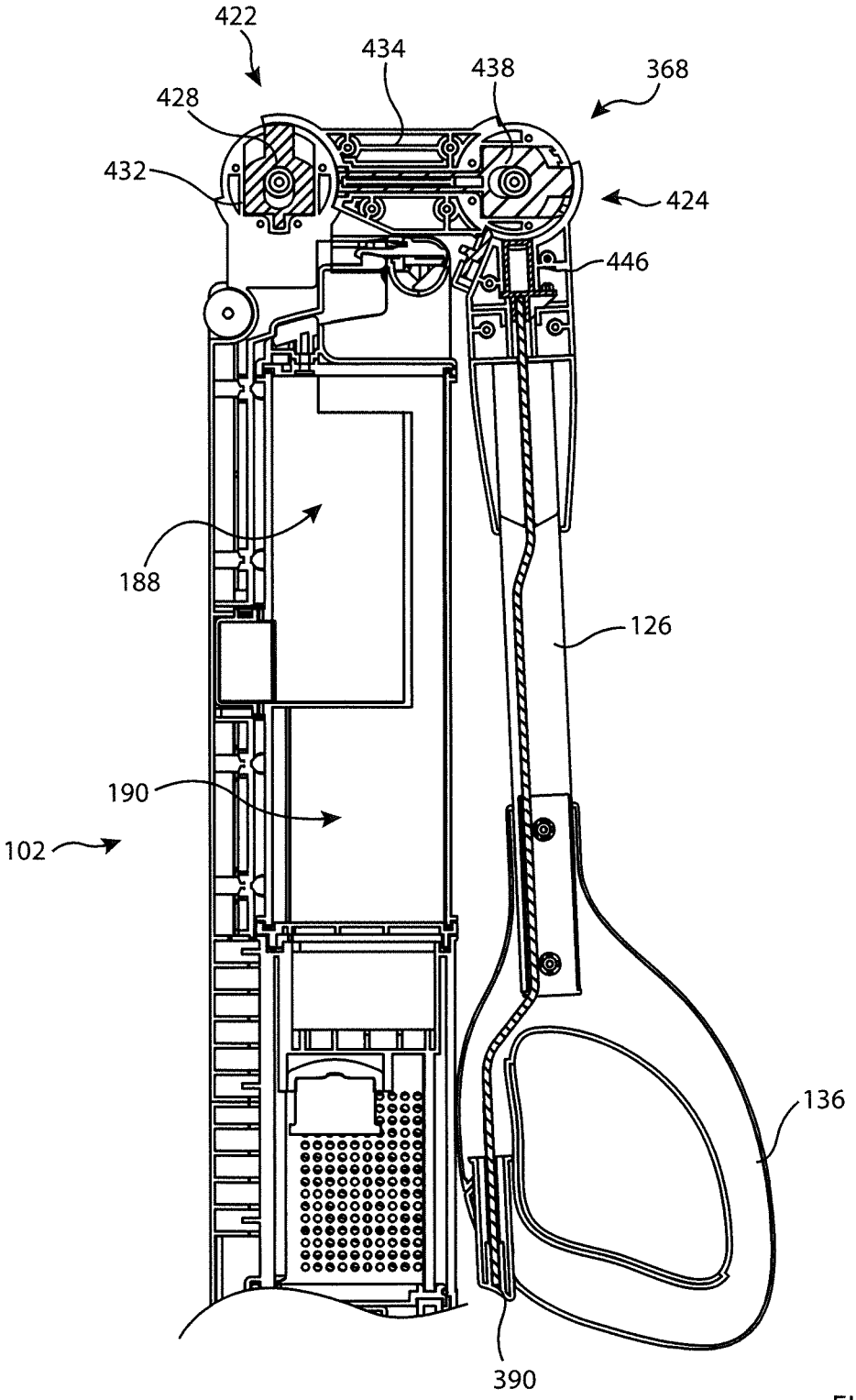
FIG. 76 is the cross-sectional view of FIG. 73, with the handle in a fourth position.
Figure 77:
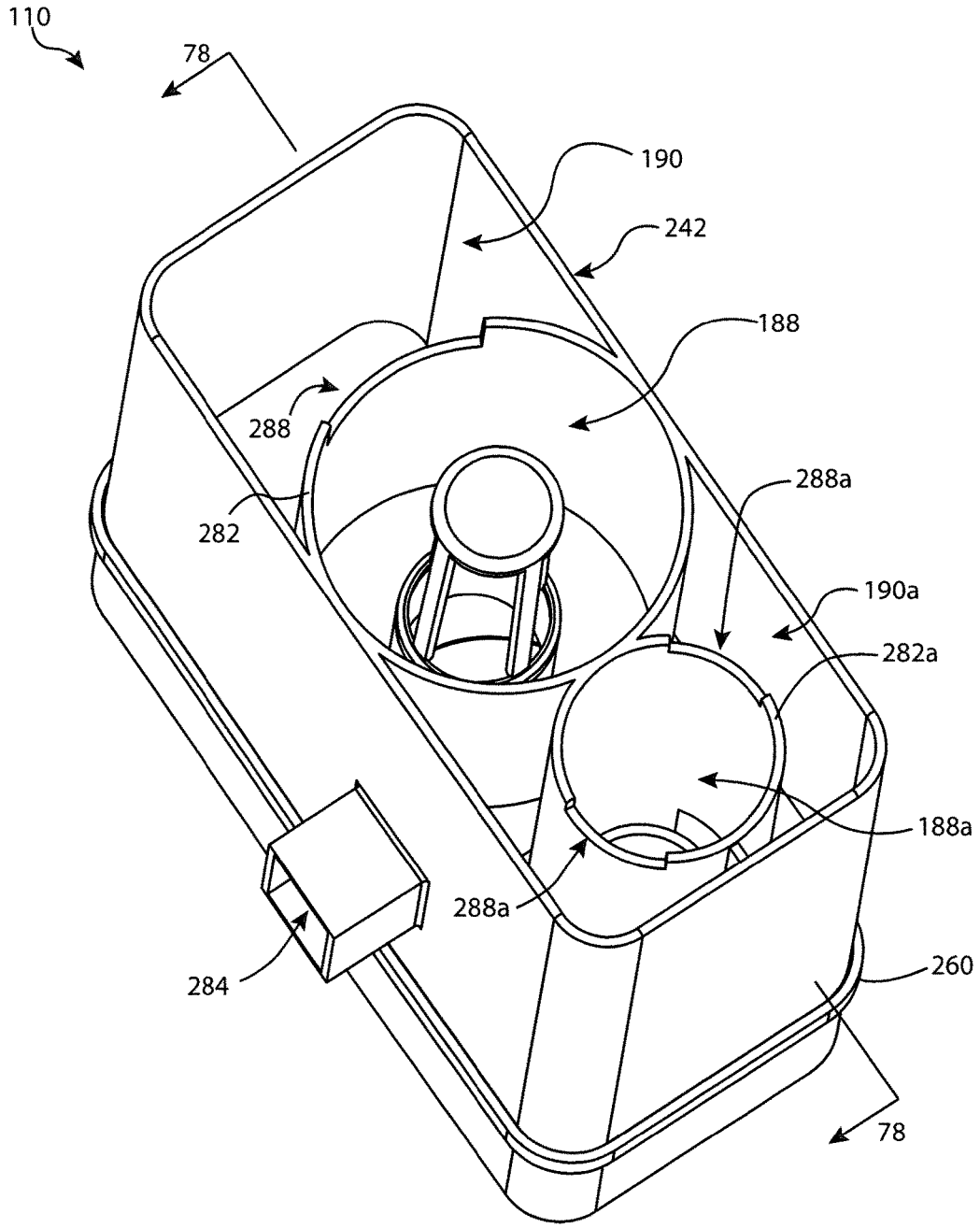
FIG. 77 is perspective view from above of another embodiment of an air treatment member assembly for use with a surface cleaning apparatus, with an upper door removed.

FIGS. 72-76 exemplify another embodiment that comprises two separate pivot joints 422 and 424. Rotating the elongate member 126 about one of the pivot axes 388 and 398 moves the handle 124 into the low profile cleaning position, and then rotating about the other of the axes 388 and 398 further moves (rotates) the handle 124 into the storage position (FIG. 76). In this embodiment, the handle 124 rotates about the first axis 388 to move into the low profile cleaning position, and about the second axis 398 to move into the storage position.

Figure 72:
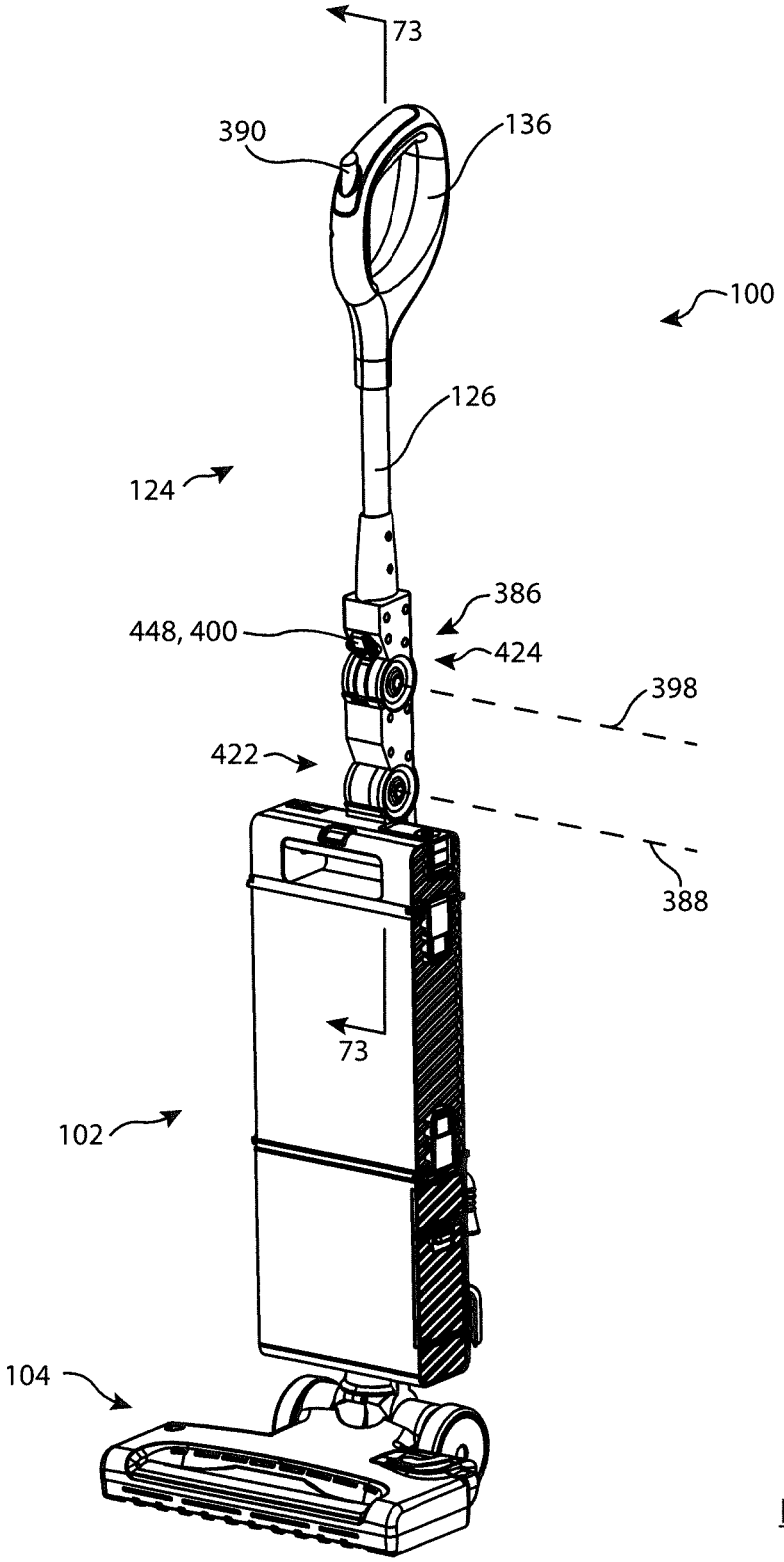
FIG. 72 is a front perspective view of another embodiment of a surface cleaning apparatus.
Figure 73:
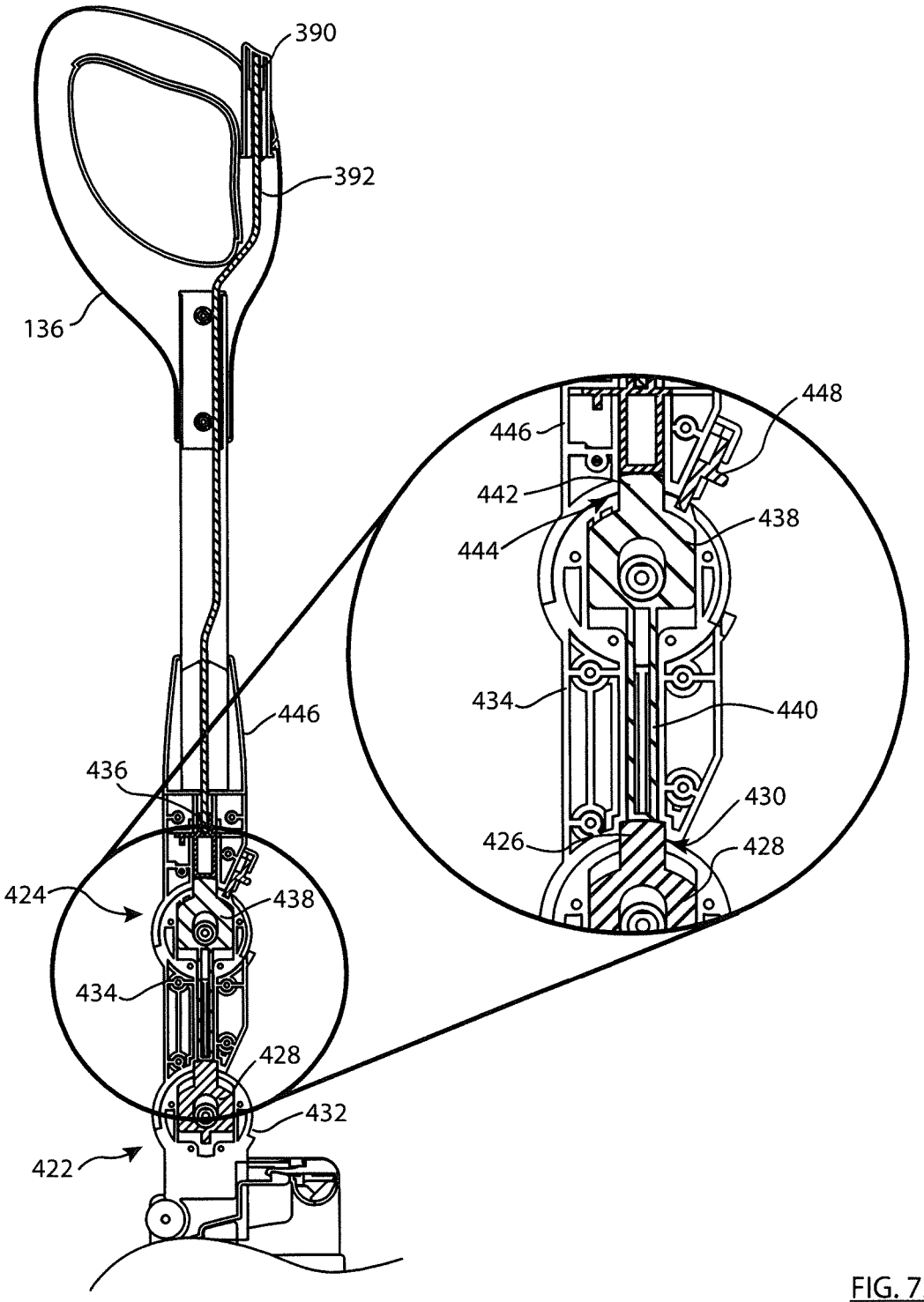
FIG. 73 is a cross-sectional view of a portion of the surface cleaning apparatus of FIG. 72, taken along line 73-73.

As exemplified in FIG. 73, rotation about both axes 388 and 398 may be prevented by locking pivot joint 424 (as shown in FIGS. 72 and 73), and rotation about each axis 388 and 398 may be selectively, and independently, enabled by unlocking pivot joints 422 and 424.

When the lower pivot joint 422 is locked, as illustrated in FIG. 73, a tab portion 426 of a lower slider 428 protrudes through a gap 430 in a lower housing 432 and engages an intermediary housing 434. In this configuration, interference between the tab 426 and the walls of the gap 430 and intermediary housing 434 prevent rotation of the intermediary housing 434 relative to the lower housing 432, about the first axis 388. The upper pivot joint 424 may have a generally analogous configuration, in which the upper pivot joint 424 is locked when a tab portion 442 on an upper slider 438 projects through a gap 444 in the intermediary housing 434 and engages an upper housing 446.

Figure 74:
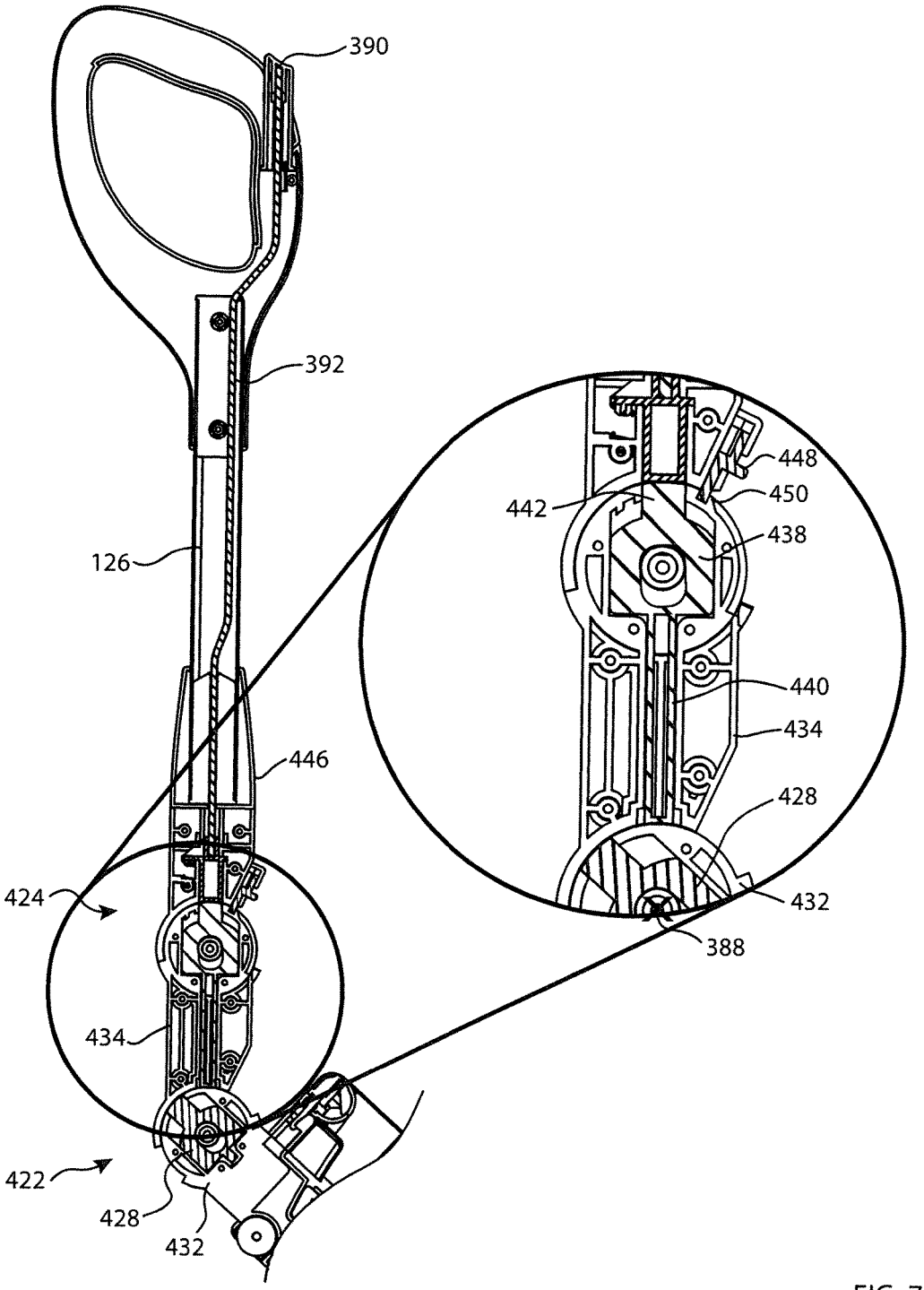
FIG. 74 is the cross-sectional view of FIG. 73, with the handle in a second position.
Figure 75:
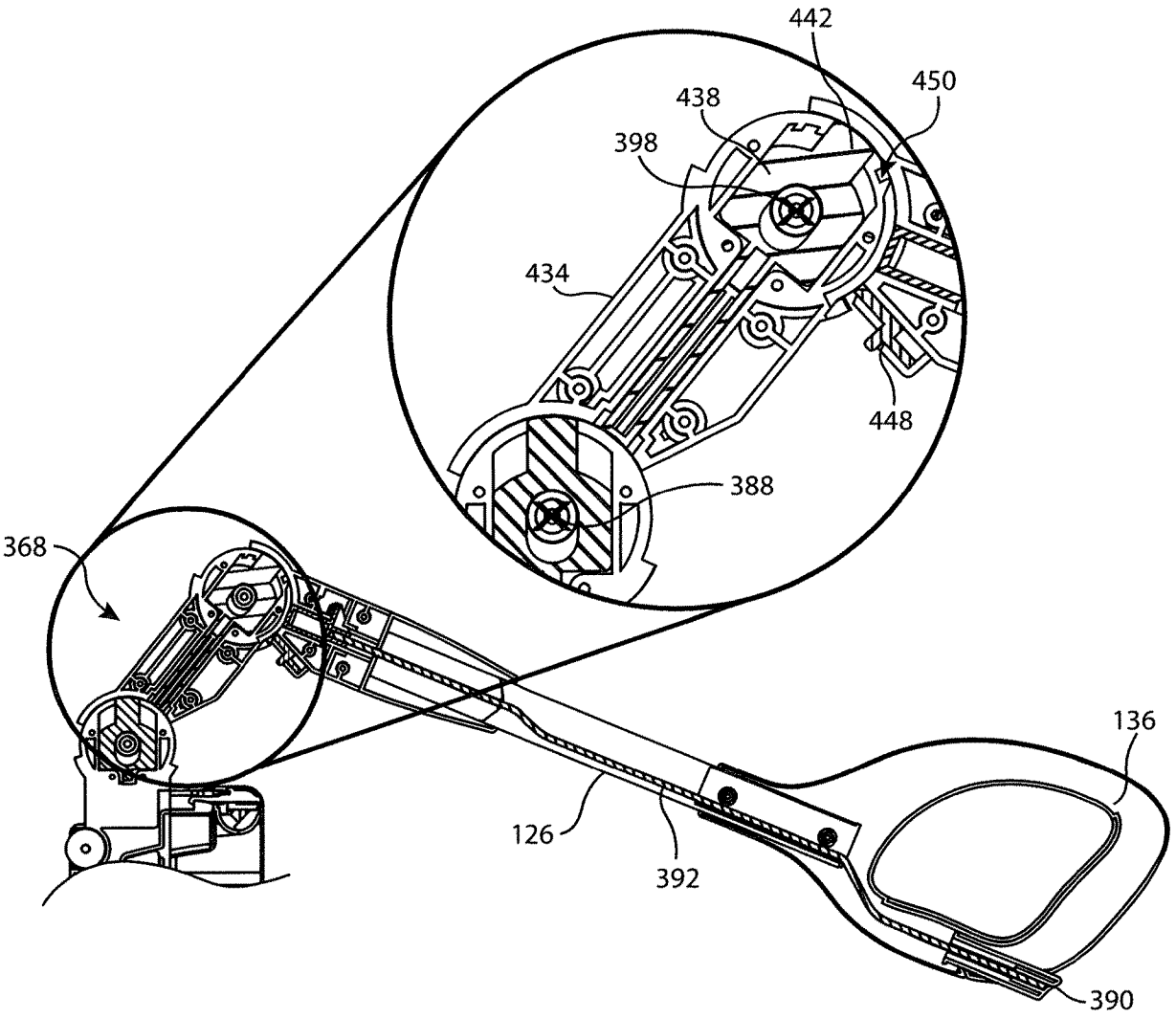
FIG. 75 is the cross-sectional view of FIG. 73, with the handle in a third position.

To unlock the lower pivot joint 422, a user may push the button 390 which may be, e.g., on the hand grip 136. Depressing the button 390 causes the linkage rod 392 to translate along the length of the elongate member 126. A lower end 436 of the rod 392 pushes on the upper slider 438, pushing it downwardly (as illustrated). An elongate portion 440 of the upper slider 438 bears against the tab 426, and downward translation of the upper slider 438 thereby leads to a corresponding downward translation of the lower slider 428. When the lower slider 428 has been moved sufficiently downwardly, the tab 426 is removed from the gap 430 and disengages the intermediary housing 434, as shown in FIG. 74. In this configuration, the intermediary housing 434 (and everything mounted thereto) can pivot about the first axis 388.

To unlock the upper pivot joint 424, a user may push the button 390 so that the tab portion 442 is driven out of the gap 444 and disengages the upper housing 446. In some embodiments, this may be sufficient to allow rotation about the second axis 398. Alternatively, as illustrated a second release actuator 400 may need to be released to allow rotation about the axis 398. In this embodiment, when the release actuator 400 remains engaged it is sufficient to inhibit rotation about the axis 398, even when button 390 is pressed. This may help provide independent control over the unlocking of the upper and lower pivot joint 422 and 424.

In the illustrated embodiment, the release actuator 400 includes a latch member 448 that is mounted to the upper housing 446 and that extends into a corresponding slot 450 in the intermediary housing 424. When the latch 448 is engaged with the slot 450 (FIGS. 73 and 74) rotation about axis 398 is inhibited. When the latch 448 is withdrawn from the slot 450 (FIG. 75), the upper housing 446 can pivot about the axis 398 relative to the intermediary housing 434. This can allow the handle to be moved into the storage position (FIG. 76). A similar pivot joint configuration may be used in combination with any one or more of the other embodiments described herein.

It will be appreciated that other locking mechanisms known in the handle art may be used.

Adjustable Handle Length

The following is a description of adjustable handle that may be used by themselves in any surface cleaning apparatus or in any combination or sub-combination with any other feature or features described herein. For example, the adjustable handle described herein may be used with vacuums having any one or more of the surface cleaning head, moveable wheels, upright section, air treatment member assemblies, carry handles, cyclone configurations, dirt collection chambers, pre-motor filters, suction motors, post-motor filters, cleaning unit air flow ducts, above floor cleaning assemblies, low profile floor cleaning mode, bendable handles, hose wraps and other features described herein.

In accordance with this aspect, instead of using a push button, linkage rod and sliders to unlock the pivot joint 386, the pivot joint 386 may be unlocked by reconfiguring and/or adjusting portions of the handle 124, cleaning unit 130 or other portion of the apparatus 100. For example, reconfiguring the push handle 124 may be used to selectively lock one or both pivot joints 422, 424. For example, if the push handle 124 telescopes, e.g., it may comprise a stationary handle member and a moveable telescoping handle member, then the moveable telescoping handle member may be engageable with one or both of the pivot joints 422, 424 to lock the pivot joint in position when the handle is telescoped inwardly. For example, as discussed herein, the moveable telescoping handle member may be slidably receivable in one or both of the pivot joints 422, 424 thereby locking the pivot joints 422, 424 in position.

As exemplified in FIGS. 64-71, axially telescoping the elongate extension member 126 (the moveable telescoping handle member) along the handle axis 134 may unlock one or both of the pivot joints 422, 424 to allow rotation about at least one of the axes 388 and 398. Optionally, the handle 124 may be configured such that telescoping the extension member 126 to a first position enables rotation about the first axis 388, and further telescoping the extension member 126 to a second position then enables rotation about the second axis 398.

Figure 64:
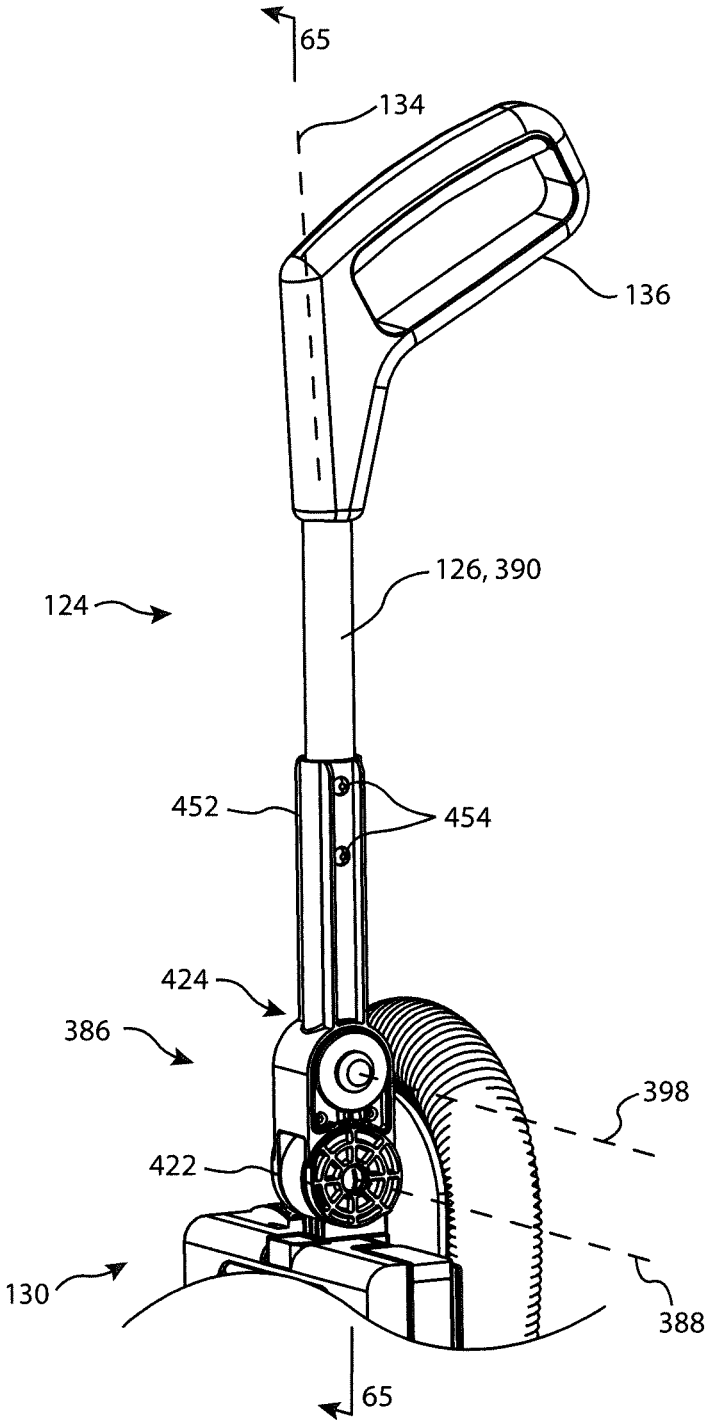
FIG. 64 is a perspective view of a portion of another embodiment of a surface cleaning apparatus.
Figure 65:
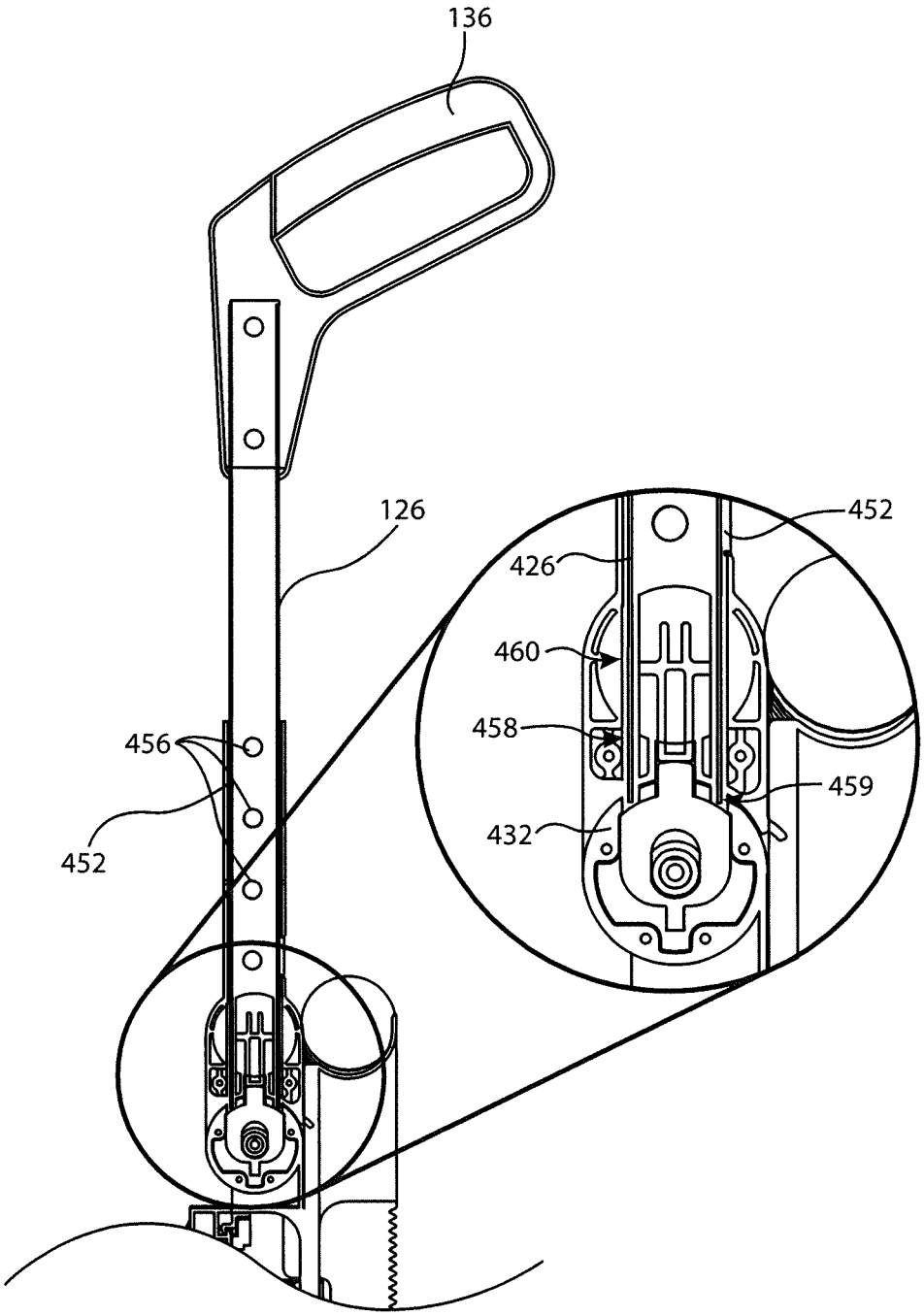
FIG. 65 is a cross-sectional view of the portion of the surface cleaning apparatus of FIG. 64, taken along line 65-65.

Referring to FIG. 64, in one embodiment the extension member 126 of the handle 124 may be an inner telescoping member that is slidably received in an outer telescoping member in the form of an outer sleeve portion 452 of the upper portion 424 of the pivot joint 386. Movement between the extension member 126 and the sleeve 452 may be inhibited using any suitable securing apparatus, including, for example, moveable detents 454 provided on the sleeve 452 that engage corresponding holes 456 on the extension member 126 (FIG. 65).

In this embodiment, when the extension member 126 is fully inserted within the sleeve 452 (FIG. 64-65) in a retracted position, an outer surface toward the lower end of the extension member 126 provides an abutment member 458 that extends through corresponding channels 460 within the pivot joint 386, such that interference between the abutment member 458 and a corresponding abutment member 459 (in the form of notches) on the lower housing 432 of the pivot joint 386 inhibits rotation about the first axis 388. In this position, the outer surface of the extension member 126 also functions as a second abutment member 458 that contacts a corresponding abutment member 462 in the intermediary housing 434 (FIGS. 69 and 71), thereby inhibiting rotation about the upper axis 398. In this configuration the pivot joint 386 is locked.

Figure 68:
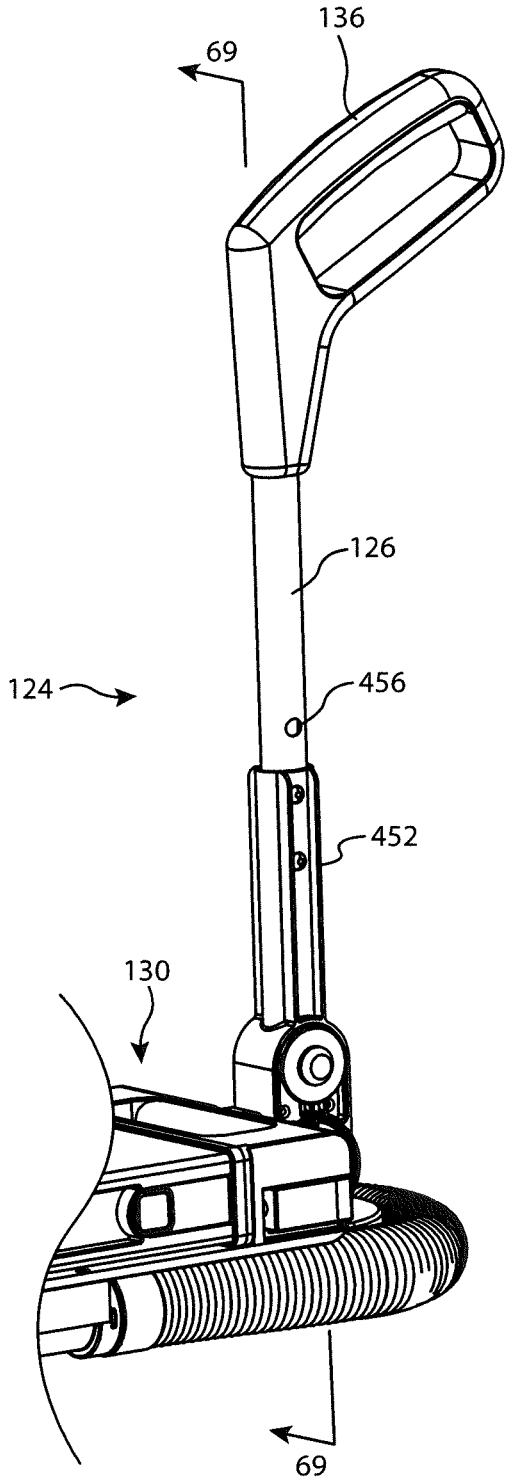
FIG. 68 is a perspective view of the portion of the surface cleaning apparatus of FIG. 64, with the handle in a third position.
Figure 69:
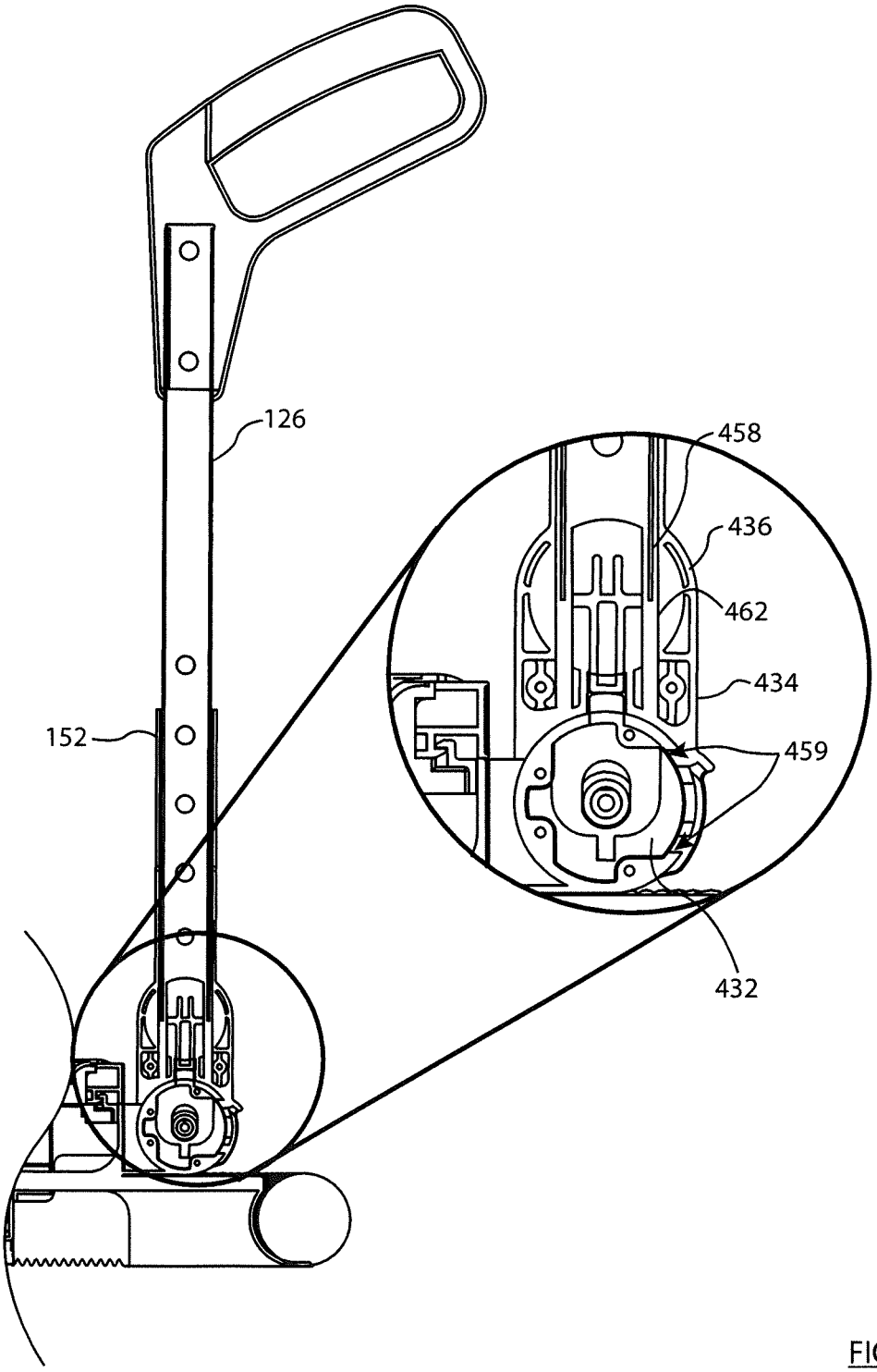
FIG. 69 is a cross-sectional view of the portion of the surface cleaning apparatus of FIG. 68, taken along line 69-69.

Referring also to FIGS. 66-69, telescoping the extension member 126 away from the lower housing 432 (upwardly as illustrated) to a first extended position may move the lower end of the extension member 126 so that the abutment member 458 does not contact/engage with the abutment member 459 in the lower housing 432. Disengaging the abutment members 458 and 459 may enable the handle 124 to pivot forwardly about the first axis 388, and for the handle to be reconfigured into a low profile cleaning position (FIG. 68). In this position, the lower pivot joint 422 is unlocked. When in this position, the abutment member 458 on the extension member 126 remains in contact with the complimentary abutment member 462 on the intermediary housing 434, thereby continuing to inhibit rotation about the upper axis 398.

Figure 66:
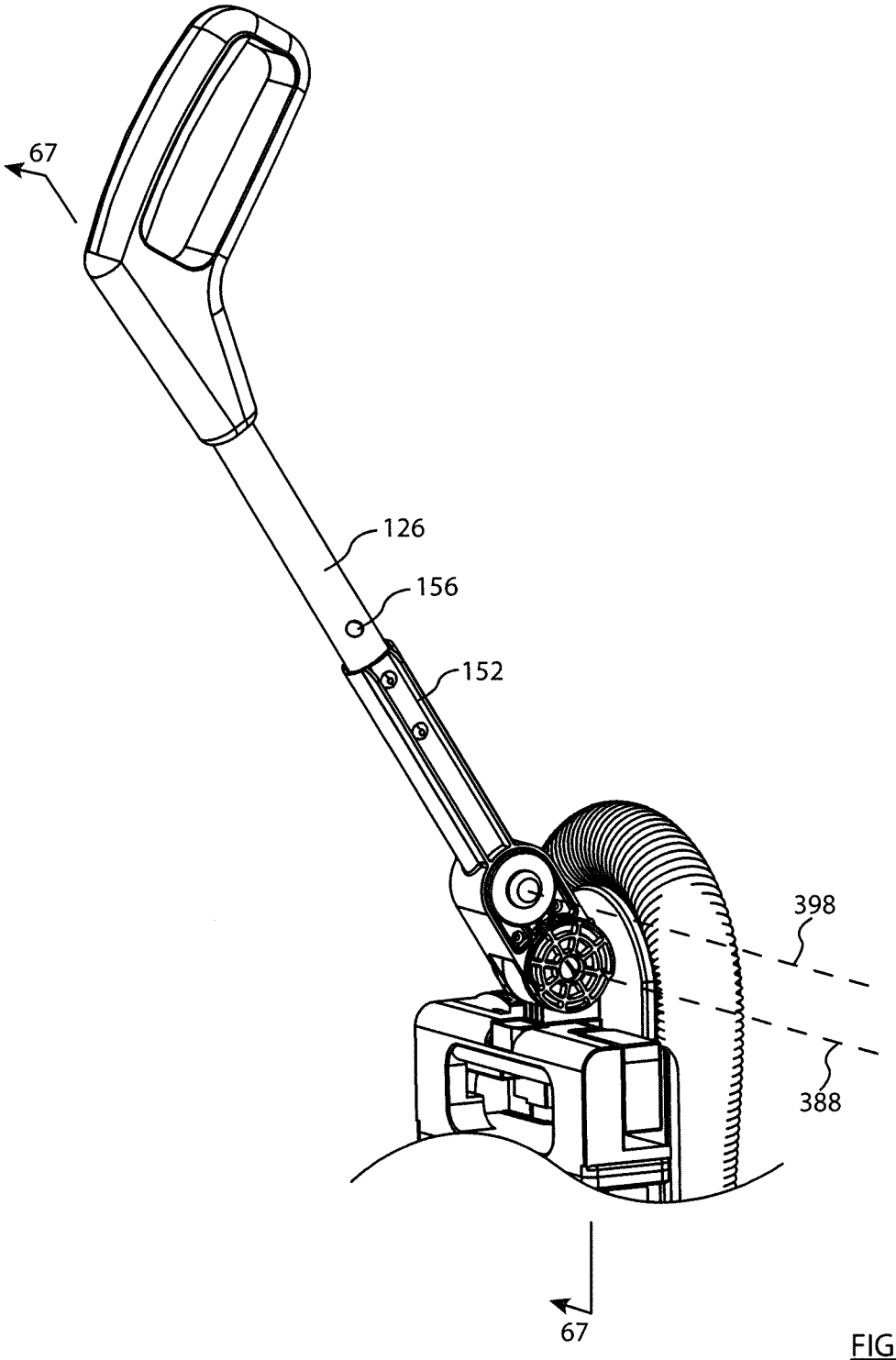
FIG. 66 is a perspective view of the portion of the surface cleaning apparatus of FIG. 64, with the handle in a second position.
Figure 67:
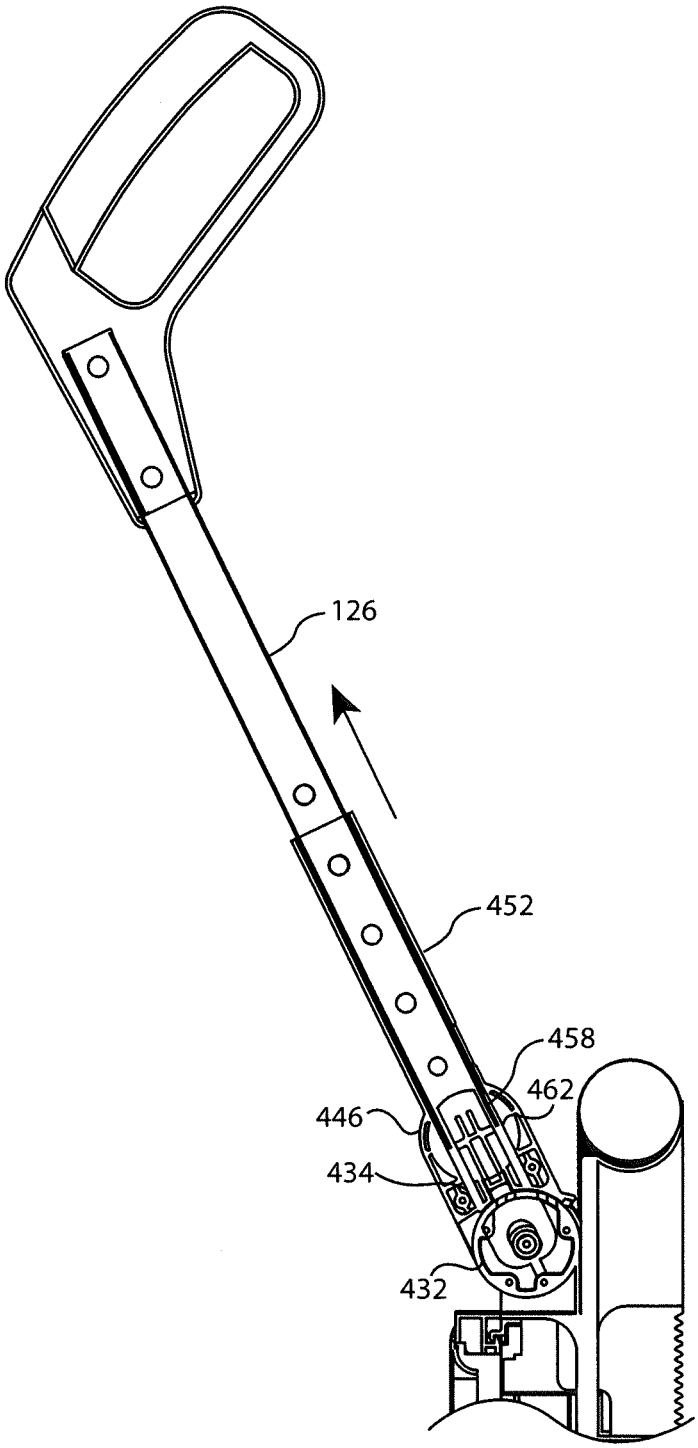
FIG. 67 is a cross-sectional view of the portion of the surface cleaning apparatus of FIG. 66, taken along line 67-67.

In some embodiments, the pivot joint 386 may only include a single pivot joint 386 as exemplified in FIG. 66. Alternatively, as illustrated, the pivot joint 386 may include lower and upper pivot joints 422, 424 and the handle 124 can be further pivoted into a storage position (for example as shown in FIG. 14). Optionally, the rotation about the second pivot axis 398 may be controlled via a separate secondary actuator, or alternatively may also be controlled by the positioning of the extension member 126.

Figure 70:
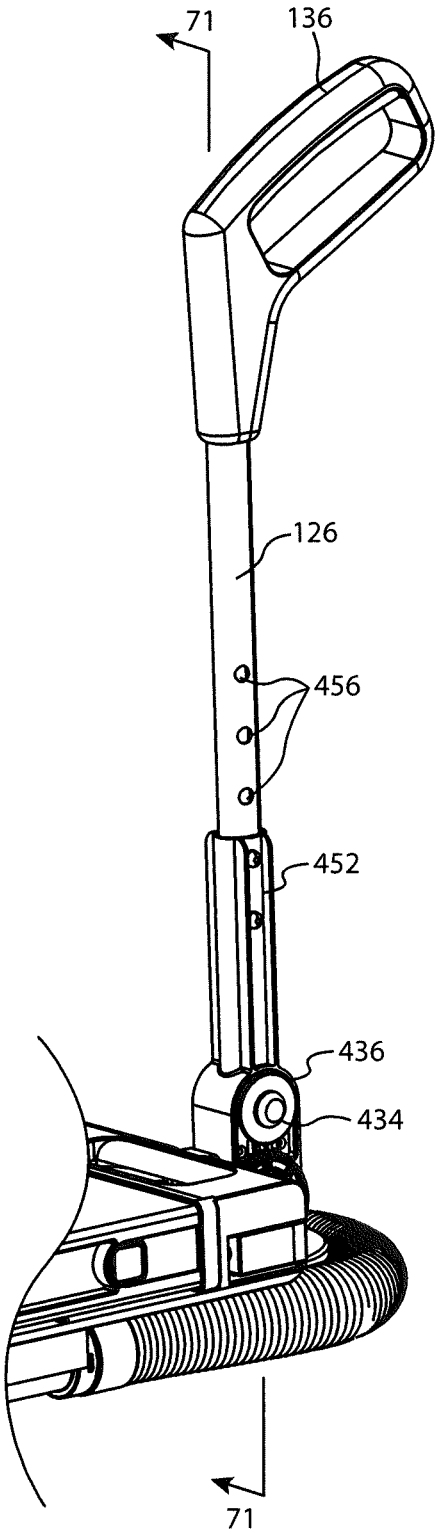
FIG. 70 is a perspective view of the portion of the surface cleaning apparatus of FIG. 64, with the handle in a fourth position.
Figure 71:
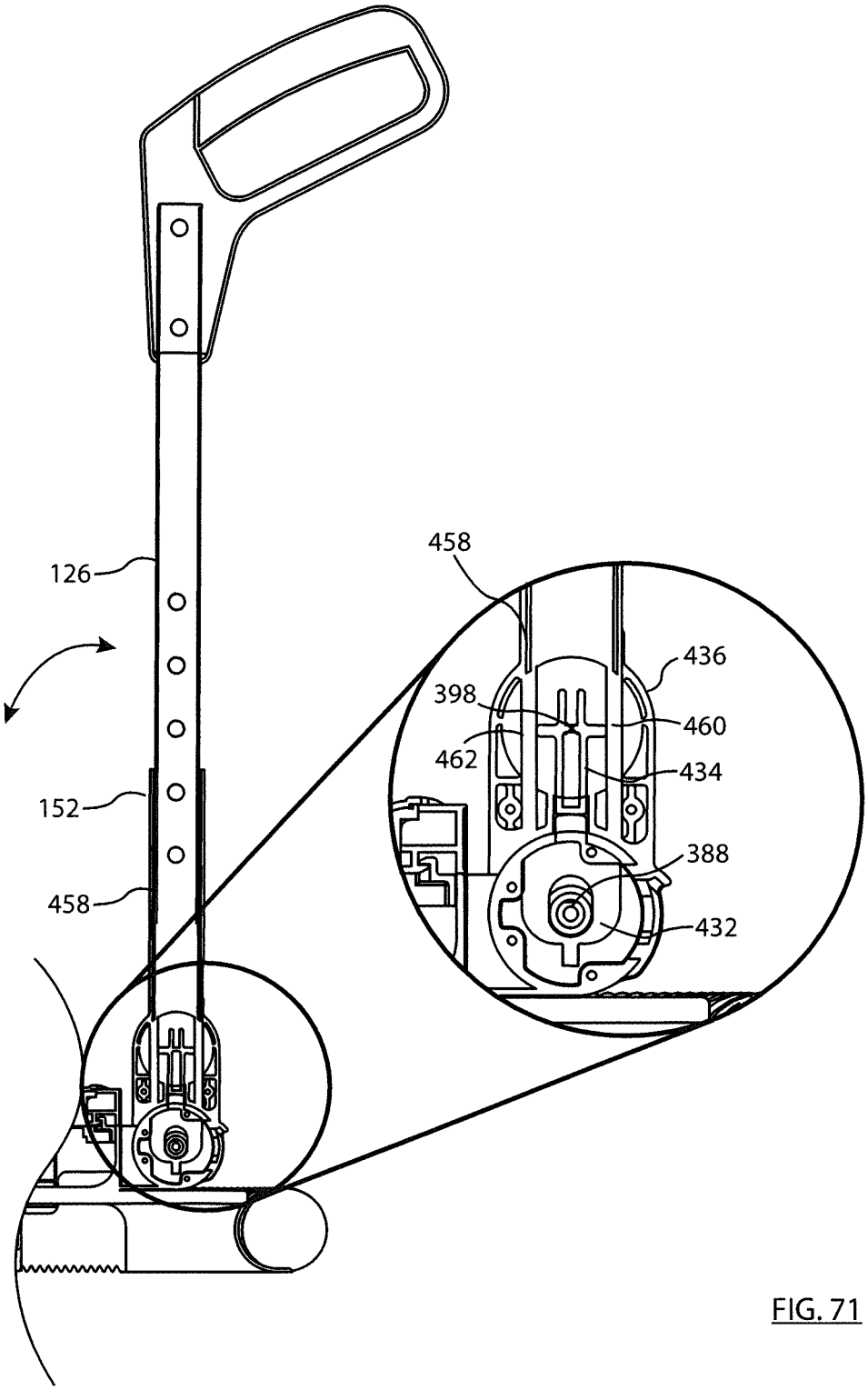
FIG. 71 is a cross-sectional view of the portion of the surface cleaning apparatus of FIG. 70, taken along line 71-71.

Referring to FIGS. 70 and 71, in the illustrated embodiment the extension member 126 may be further translated relative to the sleeve 452, to a second extended position. In this embodiment, when the extension member 126 is in the second extended position, the lower end is moved such that the abutment member 458 is removed from the channels 460 and is disengaged from the abutment members 462 in the intermediary housing 434 (FIG. 71). In this configuration, the upper housing 446, including the sleeve 452 and handle 124 mounted thereto, is free to pivot about the second axis 398.

Figure 53:
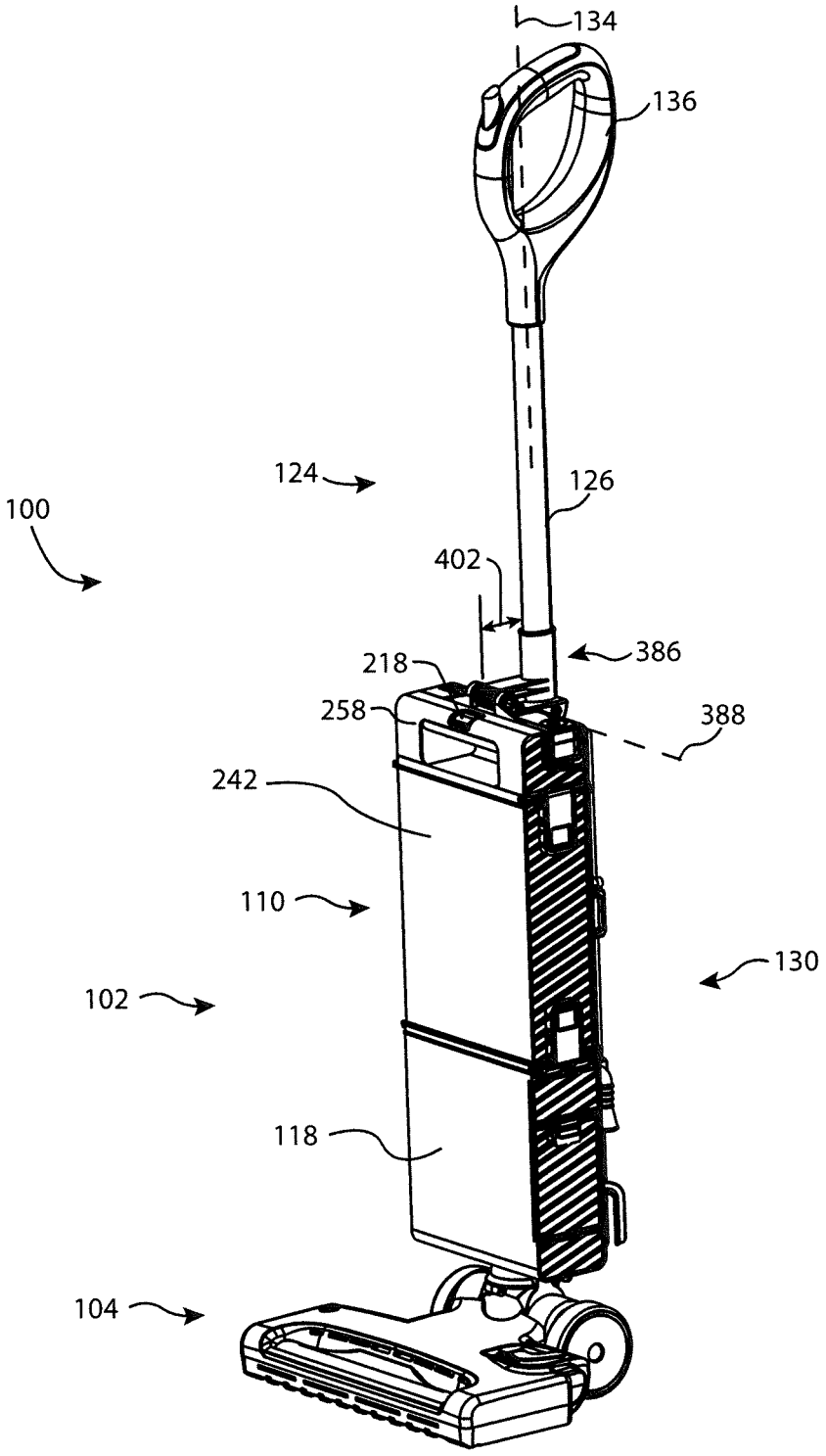
FIGS. 53 and 54 are front and rear perspective views of another embodiment of a surface cleaning apparatus.
Figure 54:
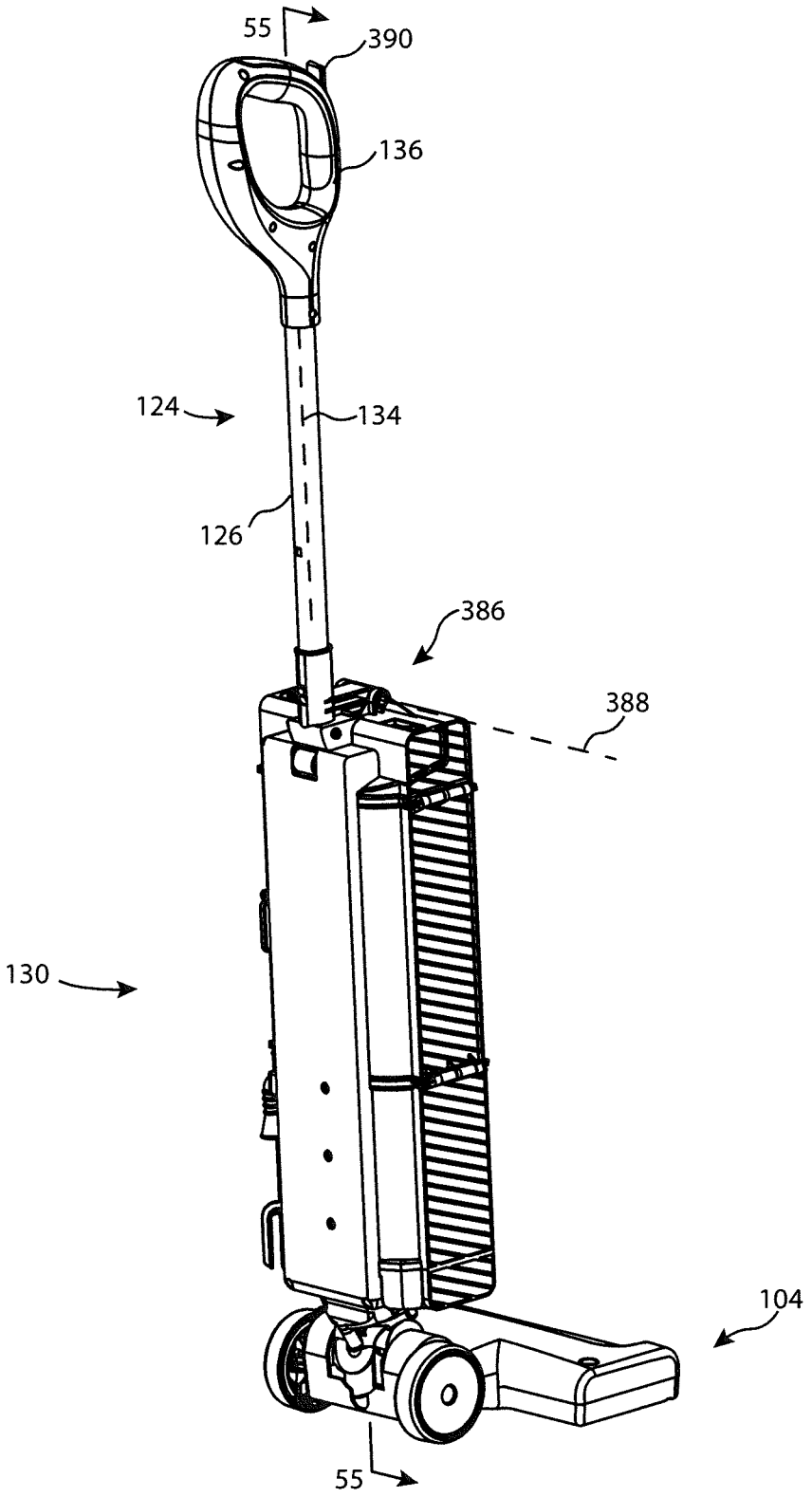
Figure 55:
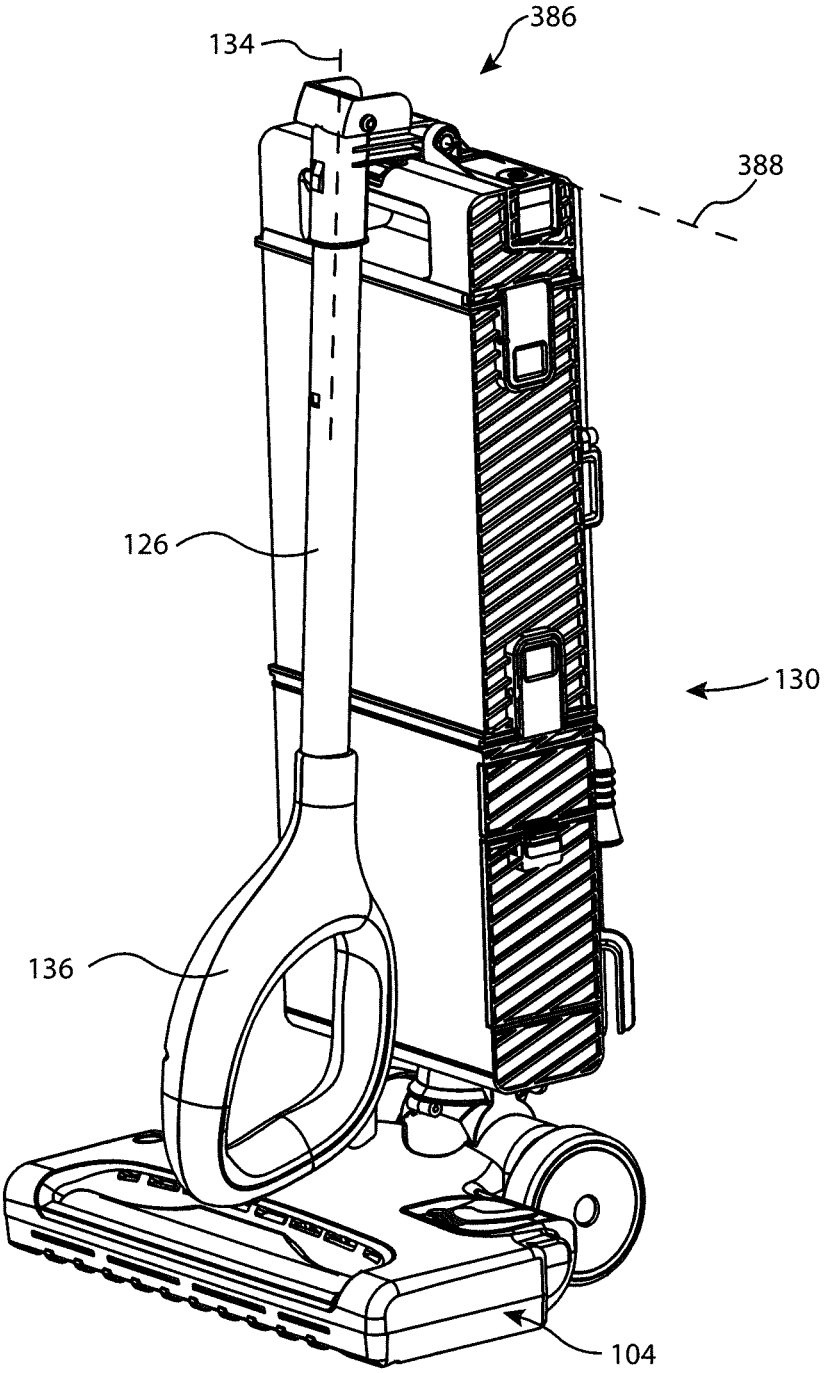
FIG. 55 is a front perspective view of the surface cleaning apparatus of FIG. 53, with a handle in a storage position.
Figure 56:
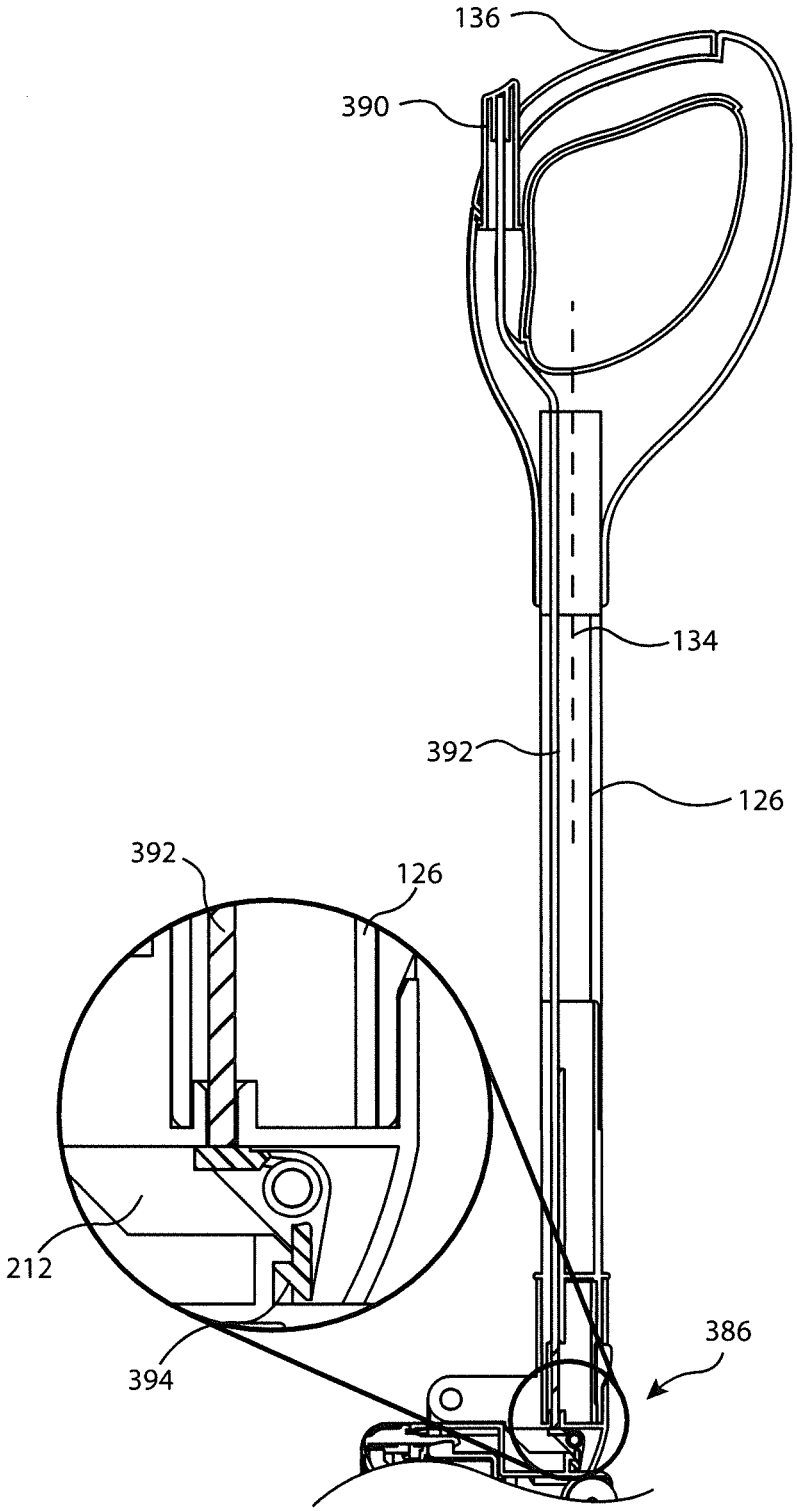
FIG. 56 is a cross-sectional view of a portion of the surface cleaning apparatus of FIG. 53, taken along line 55-55 in FIG. 54 with a latch in a first position.
Figure 57:
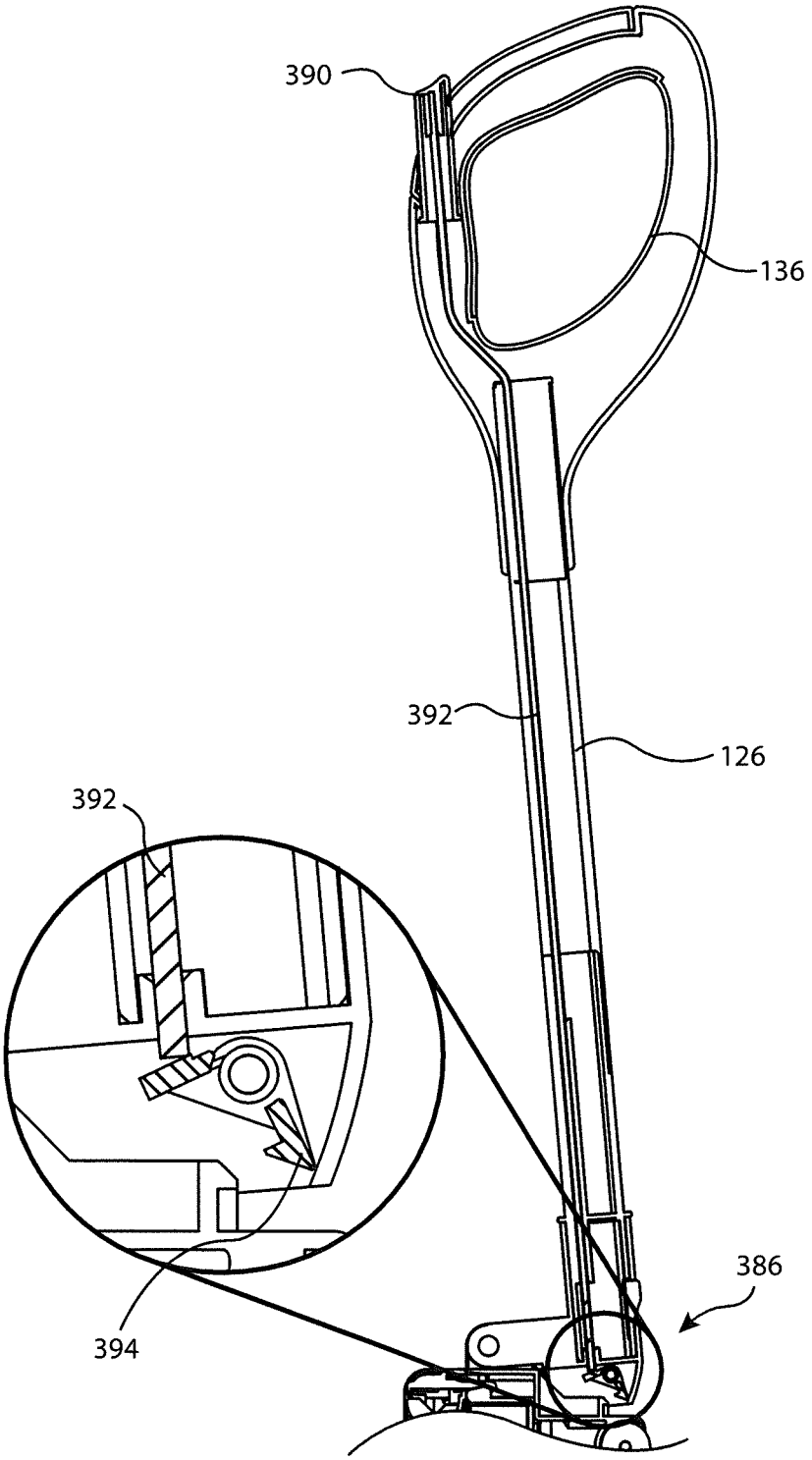
FIG. 57 is the cross-sectional view of FIG. 56, with the latch in a second position.

Alternatively, referring to FIGS. 53-57, the pivot joint 386 may include only a single pivot axis, while still permitting the handle to be moved into a low profile cleaning position and a storage position. For example, the pivot joint 386 may be configured as an offset pivot joint, in which the extension member 126 and handle axis 134 are offset rearwardly from the pivot axis 388 by a pivot offset distance 402 (FIG. 53). In this arrangement, the handle 124 may pivot about the pivot axis 388 to operate the apparatus 100 in the low profile floor cleaning mode, and may rotate further about the same pivot axis 388 to move the handle into its storage position (FIG. 55). This embodiment includes an unlocking actuator having, e.g., a button 390 and axially translating linkage rod 392 (FIGS. 54, 56 and 57) that is configured to release a latch member 394 that engages the upper end of the support structure 212 of the cleaning unit 130. In this embodiment, the handle 124 may be moved to the low profile cleaning position and a storage position by only rotating about one pivot axis 388. It will be appreciated at alternate actuation means may be used as is known in the art.

Optionally, the pivot joint 386 may form part of the air flow path, much like the joint between the cleaning unit 130 and the surface cleaning head 104 can include an internal air flow conduit. For example, in embodiment of FIGS. 49-52, the pivot joint 386 includes an upper yolk 404 member that is pivotally connected to a lower yolk member 406, such that the upper yolk 404 member may pivot about pivot axis 388. The yolk members 404 and 406 provide a structural, mechanical connection between the handle 124 and the cleaning unit 130.

Figure 49:
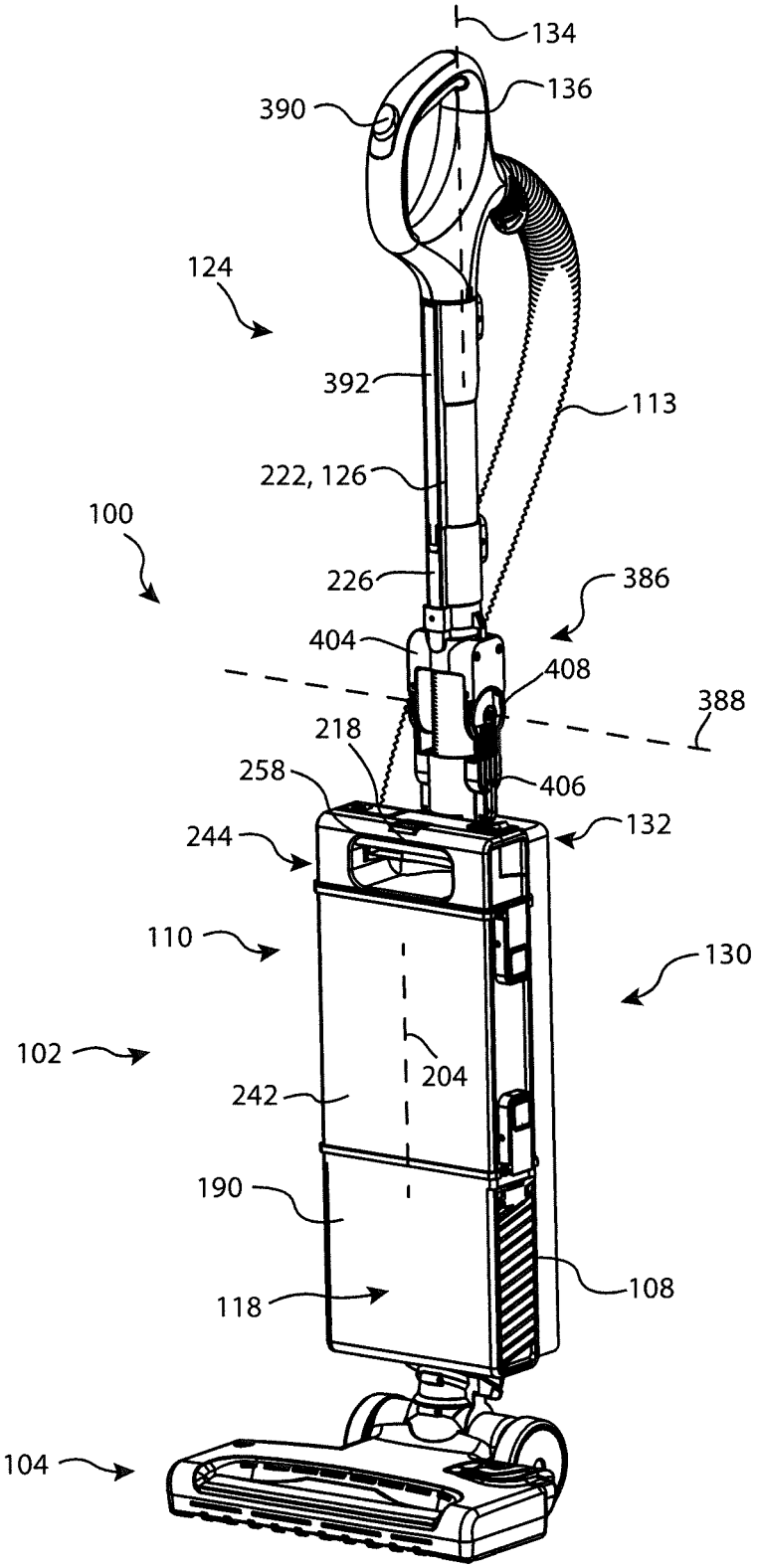
FIG. 49 is a front perspective view of another embodiment of a surface cleaning apparatus.
Figure 50:
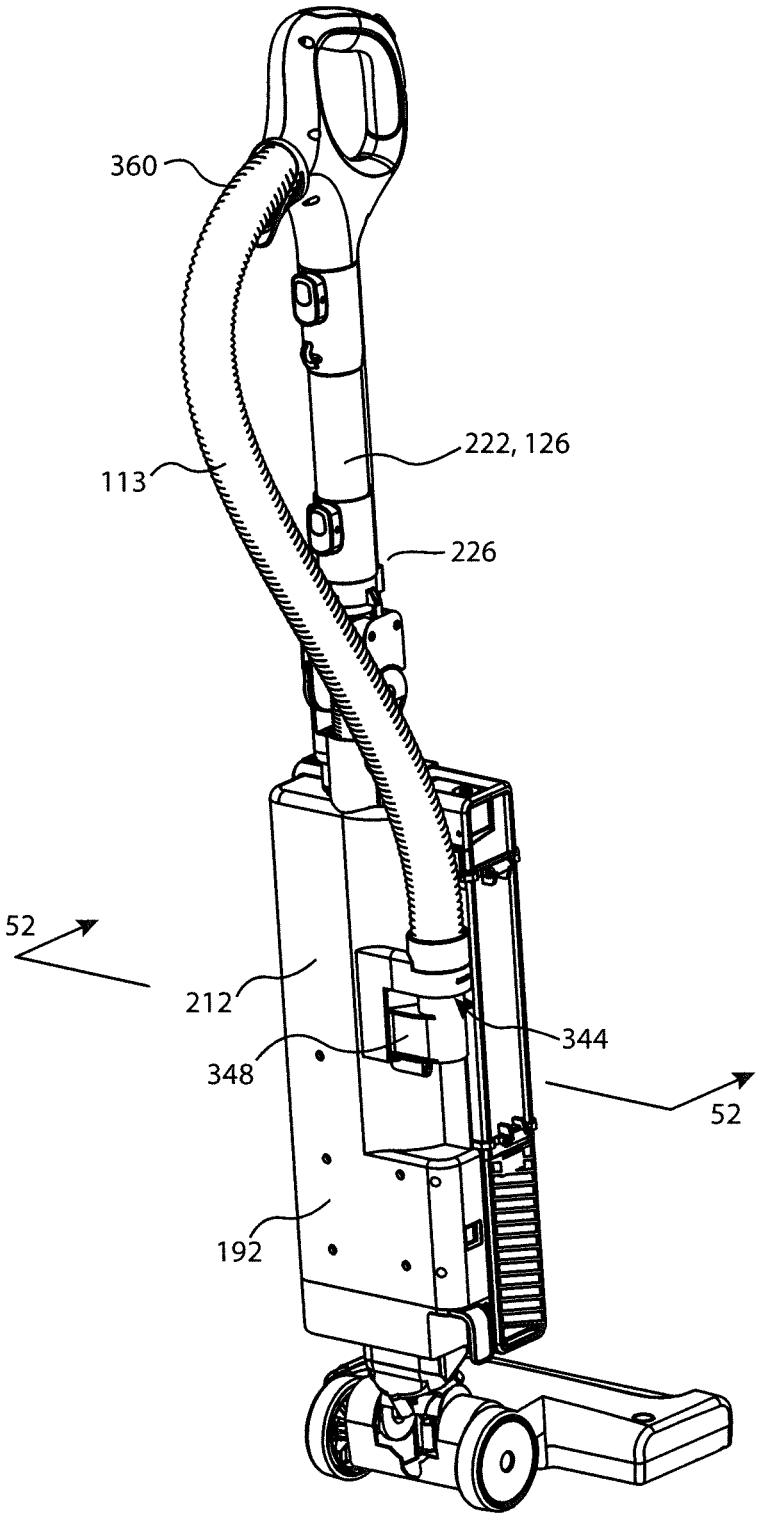
FIG. 50 is a rear perspective view of the surface cleaning apparatus of FIG. 49.

To provide air flow communication between the wand 222 and the cleaning unit 130, the pivot joint 386 may include an internal fluid passage. Referring to FIG. 49, in the illustrated example the pivot joint 386 includes an internal fluid passage in the form of a flexible hose 408 that is positioned within the yolk members 404, 406 and connects the cleaning unit 130 to the inlet end 226 of the wand 222. Optionally, the hose 113 may be extensible and/or elastic. Preferably, the hose 408 may be formed from the same material, and have generally the same properties as hose 113. Optionally, instead of being positioned within the yolk members 404, 406, the fluid passage member may be positioned outside the yolk members 404, 406. Alternately, as is known in the art, the pivot joint may be constructed to have an air flow passage therethrough and use rigid members that rotate relative to each other and uses rotating seals or the like such that a flexible hose is not required.

The pivot joint 386 may be unlocked using an unlocking actuator, which may use a button 390 connected to a linkage rod 392.

Optionally, in addition to moving relative to the cleaning unit 130, the handle may also be configured so that the extension member 126 and/or hand grip 136 can rotate about the handle axis 134. Referring to FIGS. 14-17, rotating the extension member 126 and/or hand grip 136 about the handle axis 134 may alter a storage depth 410 of the apparatus, from a relatively large storage depth 410 (FIG. 15), in which the hand grip 136 protrudes beyond the front end 140 of the surface cleaning head 104, to a smaller storage depth 410 (FIG. 17), in which no portion of the apparatus 100 may protrude forwardly beyond the front end 140 of the surface cleaning head 104.

Instead of rotating in this manner, the handle 124 may be moved into the storage position in any suitable way, including collapsing or otherwise modifying the shape of the hand grip portion 136, rotating the hand grip 136 relative the extension member 126, detaching the extension member 126 from the pivot joint 386 and stowing it in a suitable location, and the like.

Hose Wrap

The following is a description of hose wraps that may be used by themselves in any surface cleaning apparatus or in any combination or sub-combination with any other feature or features described herein. For example, the hose wraps described herein may be used with vacuums having any one or more of the surface cleaning head, moveable wheels, upright section, air treatment member assemblies, carry handles, cyclone configurations, dirt collection chambers, pre-motor filters, suction motors, post-motor filters, cleaning unit air flow ducts, above floor cleaning assemblies, low profile floor cleaning mode, bendable handles, adjustable handles and other features described herein.

In accordance with this aspect, hose is secured in position on the upright section, preferably surrounding the lateral sides of the cleaning unit 130, such that the hose does not increase the maximum depth of the portion of the upright section that supports the cleaning unit 130.

For example, if the air flow conduits on the upper section 102 include a flexible hose, the cleaning unit 130 may include a hose wrap portion to help support and store the flexible hose when the apparatus is being used in a floor cleaning mode. Optionally, the hose wrap may be provided toward the rear side of the cleaning unit 130, which may help align the hose 113 with the other air flow conduits in the cleaning unit 130 (such as ducts 224 and wand 222).

As exemplified in FIG. 2, the hose support 396, also referred to as a hose wrap, may be a curved support with a channel 412 that can receive a portion of the hose 113. The hose 113 is preferably resiliently extendable, and when seated in the channel 412, the hose's resiliency may help retain it in place. When a user detaches the wand 222, for above floor cleaning, the hose 113 may be lifted generally upwardly out of the channel.

Figure 28:
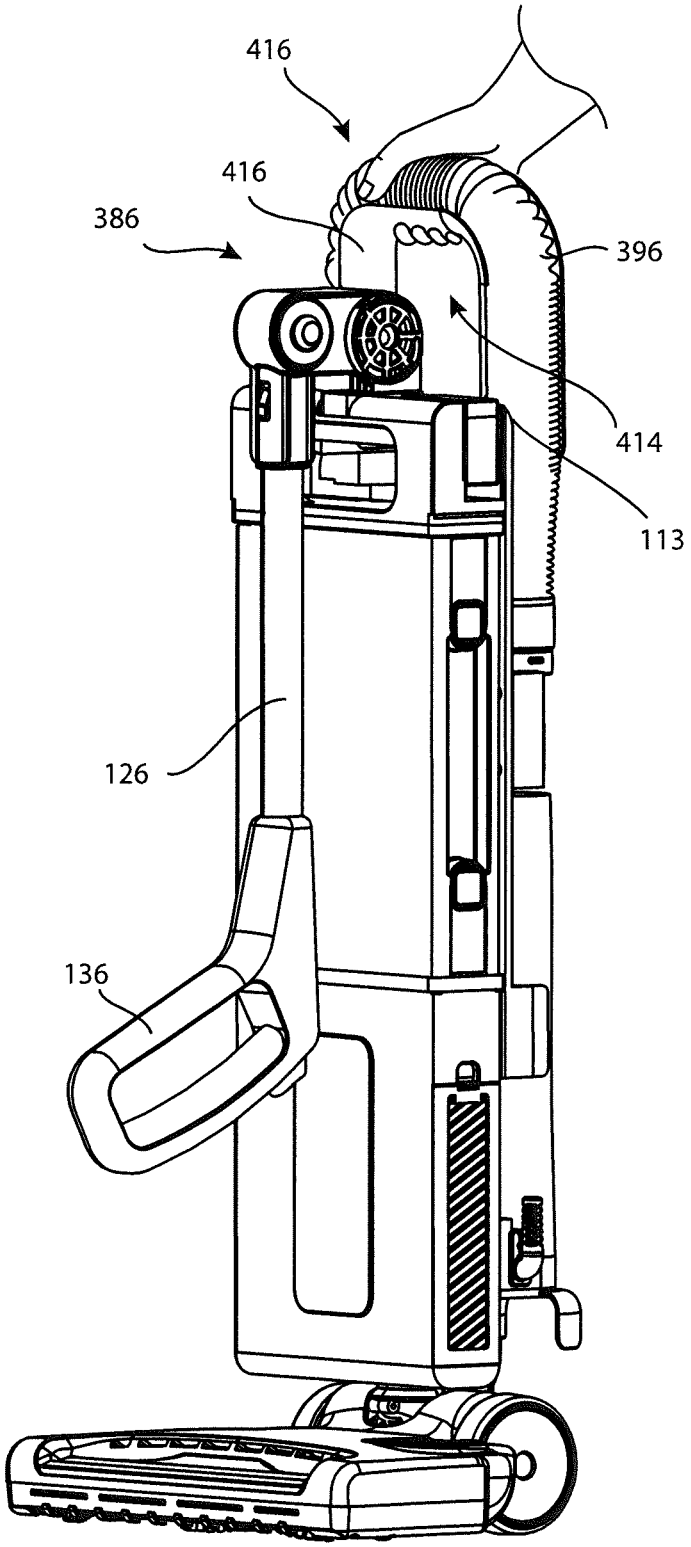
FIGS. 28 and 29 are front and rear perspective views of the surface cleaning apparatus of FIGS. 26 and 27, with a handle in a storage position.
Figure 29:
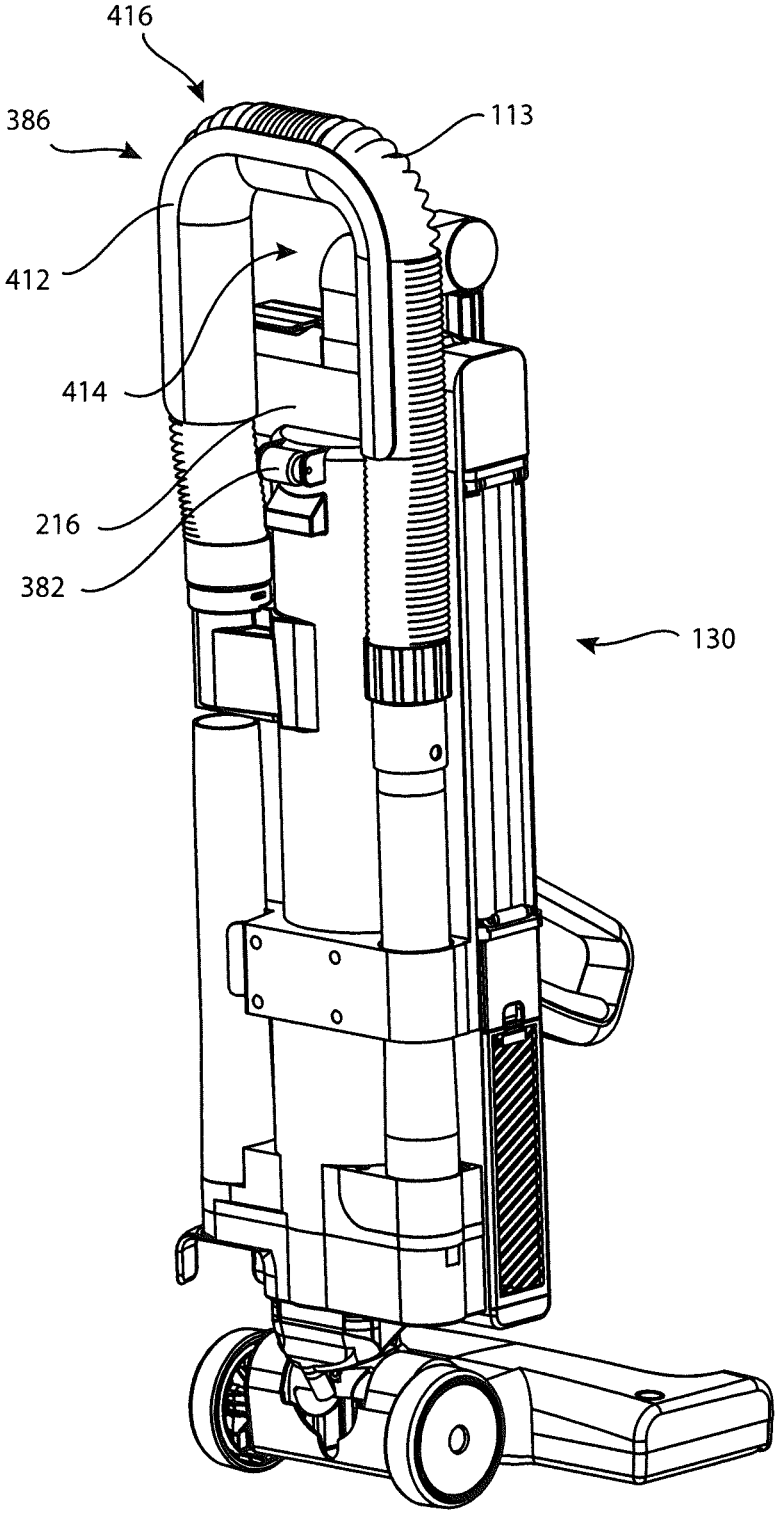

Optionally, the hose support 396 may surround an open region, and may also function as a carry handle 416 for lifting the cleaning unit. As exemplified in FIGS. 26-29, the curved support channel 412 may form part of the perimeter of a finger gap 414 region that may receive the hand/fingers of a user (FIG. 28). In this embodiment, the support channel 412 bounds part of the finger gap 414, and other portions of the cleaning unit support structure 212 (such as cross-member 216) bound the bottom portion of the finger gap 414. Providing a carry handle 416 of this nature may help a user grasp and carry the cleaning unit 130 while the apparatus 100 is in use, and may be helpful if the drive handle 124 has been moved into an optional storage position (as shown in FIGS. 28 and 29 and described herein). It will be appreciated that hose support 396 may be positioned a sufficient distance above support structure 212 and the pivot joint such that a user may easily grasp the hose support (e.g., channel 412) without contacting another part of the apparatus 100.

The support channel 412 may be configured so that it provides a sufficient grip area such that a user can pick-up the cleaning unit 130 without contacting the underside of the hose 113. This may help improve the stability of the carry handle 416, and may help reduce the chances that the hose 113 may be squeezed or crushed during the lifting process. To that end, the support channel 412 may be sized to receive at least 40% of the hose 113, and optionally may be sized to receive at least 50% or at least 60% of the hose 113, and preferably the hose 113 can be nested at least up to its midpoint within the support channel 412.

Optionally, the cleaning unit 130 may be configured so that the hose support 396, whether configured as a carry handle or not, is the upper most portion of the cleaning unit 130 or the support structure except for the handle 124. This may help position the hose support 396 at a convenient height for users to interact with the hose wrap 369, and the hose 113 thereon. This may also help increase the path length of the hose 113, from the upper end of the wand 222 to the air inlet of the air treatment member assembly 110. Increasing the path length in this manner may allow a longer hose 113 to be provided and stored on the cleaning unit 130, which may help improve the above floor cleaning range.

In embodiments having a hose support 396 (see for example FIGS. 8 and 27), when the apparatus 100 is used in the floor cleaning mode, a first vertical portion 416 of the hose 113 may convey air upwardly on one side of the cleaning unit 130 and a second vertical portion 418 of the hose 113 may convey air downwardly on the opposing side of the cleaning unit 130. In such embodiments, a transverse portion 420 of the hose 113 may extend between the first and second vertical portions 416, 418 (and may be generally curved) over the upper end of the cleaning unit 130. In this configuration, the transverse portion 420 of the hose 113 is positioned vertically above, and may be rearward or forward of the pivot axes 388 and 398. Also, in this embodiment the first vertical portion 416 of the hose, along with a portion of the wand 222, may be positioned behind the first dirt collection chamber 190 and the second vertical portion 418 of the hose 113 may be positioned behind the second dirt collection chamber 190 (see for example FIGS. 7 and 18). This can help reduce the overall depth 201 of the cleaning unit 130.

In this embodiment, the first and second vertical portions 416, 418 and the transverse portion 420 of the hose and the rigid extension wand 222 (i.e. the above floor cleaning assembly) may all lie in a common, central transverse plane 232, which in this embodiment may extend through one or both of the suction motor 112 and cyclone chamber 188 (see for example FIGS. 18 and 20) and may be disposed toward the rear side of the cleaning unit 130.

Similarly, in this embodiment, the transverse plane 234 that contains the forward most portions of the rigid wand 222 and hose 113 may be positioned forward of the rearmost portion of the air treatment member assembly 110, and a rearmost portion of the above floor clean assembly may lie in, or forward of, the rear plane 200 (bounding the rear side of the cleaning unit).

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An upright surface cleaning apparatus comprising:

a) a surface cleaning head having a front end, a rear end, a central longitudinal axis extending between the front and rear ends, first and second laterally opposed sides, a dirty air inlet and a surface cleaning head air outlet;

b) an upright section mounted to the surface cleaning head and moveable between a generally upright position and a rearwardly inclined in use position, the upright section comprising an air treatment member assembly and a suction motor; and, c) the air treatment member assembly having a longitudinally extending air treatment member assembly axis, first and second laterally opposed sides, a front side and a rear side, the air treatment member assembly comprising an air treatment member having an internal volume in which air is treated and a dirt collection region that is positioned laterally from the air treatment member, wherein the suction motor is positioned below at least one of the air treatment member and the dirt collection region, and wherein the first and second laterally opposed sides and one of the front side and the rear side of the air treatment member assembly is generally rectangular in top plan view when the upright section is in the upright position, and wherein the rear side of the air treatment member assembly has a portion that extends outwardly in a direction of the central longitudinal axis of the surface cleaning head when the upright section is oriented to extend generally upwardly from the surface cleaning head, the portion including at least part of the internal volume of the air treatment member.

2. The upright surface cleaning apparatus of claim 1 wherein the portion extends along a length of the air treatment member assembly in a direction of the longitudinally extending air treatment member assembly axis.

3. The upright surface cleaning apparatus of claim 1 wherein the suction motor underlies at least one of the air treatment member and the dirt collection region.

4. The upright surface cleaning apparatus of claim 1 wherein an inlet of the suction motor is aligned with an air outlet of the air treatment member.

5. The upright surface cleaning apparatus of claim 1 wherein the air treatment member has a dirt outlet provided on a lateral side of the air treatment member.

6. The upright surface cleaning apparatus of claim 1 wherein a depth of the air treatment member assembly in a direction of the central longitudinal axis is about equal to a diameter of the suction motor.

7. The upright surface cleaning apparatus of claim 6 wherein the depth of the air treatment member assembly is the same as the diameter of the suction motor ±2 inches.

8. The upright surface cleaning apparatus of claim 1 wherein a maximum depth of the upright section in a direction of the central longitudinal axis is 6 inches or less.

9. The upright surface cleaning apparatus of claim 8 wherein the maximum depth of the upright section is 4 inches or less.

10. The upright surface cleaning apparatus of claim 1 wherein a depth of the air treatment member in a direction of the central longitudinal axis is about equal to a diameter of the suction motor.

11. The upright surface cleaning apparatus of claim 10 wherein the depth of the air treatment member assembly is the same as the diameter of the suction motor ±2 inches.

12. The upright surface cleaning apparatus of claim 11 wherein a maximum depth of the upright section in a direction of the central longitudinal axis is 6 inches or less.

13. The upright surface cleaning apparatus of claim 11 wherein the maximum depth of the upright section is 4 inches or less.

14. An upright surface cleaning apparatus comprising:

a) a surface cleaning head having a front end, a rear end, a central longitudinal axis extending between the front and rear ends, first and second laterally opposed sides, a dirty air inlet, rear wheels, and a surface cleaning head air outlet;

b) an upright section mounted to the surface cleaning head and moveable between a generally upright position and a rearwardly inclined in use position, the upright section comprising a suction motor and an air treatment member comprising a dirt collection chamber; and, c) a diameter of the rear wheels is greater than a depth of a portion of the dirt collection chamber in a direction of the central longitudinal axis, wherein the suction motor is positioned below the air treatment member, and wherein the air treatment member comprises a cyclone bin assembly having a cyclone, a longitudinally extending cyclone bin assembly axis, first and second laterally opposed sides, a front side and a rear side, the dirt collection chamber is external to the cyclone, and the rear side of the cyclone bin assembly has a portion of the cyclone that extends outwardly in the direction of the central longitudinal axis of the surface cleaning head when the upright section is oriented to extend generally upwardly from the surface cleaning head, which portion also extends along a length of the cyclone bin assembly in a direction of the longitudinally extending cyclone bin assembly axis.

15. The upright surface cleaning apparatus of claim 14 wherein the portion is rounded in transverse section.

16. The upright surface cleaning apparatus of claim 14 wherein an inlet of the suction motor is aligned with an air outlet of the cyclone.

17. The upright surface cleaning apparatus of claim 14 wherein the cyclone has a laterally directed dirt outlet.

18. The upright surface cleaning apparatus of claim 17 wherein the maximum depth is 4 inches or less.

19. The upright surface cleaning apparatus of claim 14 wherein a diameter of the cyclone is about equal to a diameter of the suction motor.

20. The upright surface cleaning apparatus of claim 14 wherein a maximum depth of the upright section in a direction of the central longitudinal axis is 6 inches or less.

* * * * *